US010969122B2

(12) United States Patent
Kim et al.

(10) Patent No.: US 10,969,122 B2
(45) Date of Patent: Apr. 6, 2021

(54) AIR CONDITIONER

(71) Applicant: SAMSUNG ELECTRONICS CO., LTD., Suwon-si (KR)

(72) Inventors: Do Hoon Kim, Suwon-si (KR); Kyoung Rock Kim, Suwon-si (KR); Jong Youb Kim, Suwon-si (KR); Jung Ho Kim, Suwon-si (KR); Je Myung Moon, Hwaseong-si (KR); Jae Hyoung Sim, Suwon-si (KR); Joon Ho Yoon, Suwon-si (KR); Bu Youn Lee, Hwaseong-si (KR); Jung Dae Lee, Seongnam-si (KR); Bum Jang, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/770,388

(22) PCT Filed: Oct. 6, 2016

(86) PCT No.: PCT/KR2016/011199
§ 371 (c)(1),
(2) Date: Apr. 23, 2018

(87) PCT Pub. No.: WO2017/069437
PCT Pub. Date: Apr. 27, 2017

(65) Prior Publication Data

US 2018/0306452 A1 Oct. 25, 2018

(30) Foreign Application Priority Data

Oct. 23, 2015 (KR) ..... 10-2015-0148299
Nov. 25, 2015 (KR) ..... 10-2015-0165717
(Continued)

(51) Int. Cl.
*F24F 1/48* (2011.01)
*F24F 13/20* (2006.01)
(Continued)

(52) U.S. Cl.
CPC ..... *F24F 1/48* (2013.01); *F24F 1/0007* (2013.01); *F24F 1/0011* (2013.01);
(Continued)

(58) Field of Classification Search
CPC ..... F24F 1/48; F24F 1/0047; F24F 1/0007; F24F 1/0011; F24F 11/00; F24F 13/10; F24F 13/12; F24F 13/14; F24F 13/20
(Continued)

(56) References Cited

U.S. PATENT DOCUMENTS 3,653,589 A * 4/1972 McGrath ..... F24F 5/0003 236/49.3
2008/0302120 A1* 12/2008 Kang ..... F24F 1/0014 62/259.1
(Continued)

FOREIGN PATENT DOCUMENTS

CN 101118071 A 2/2008
CN 201433923 Y 3/2010
(Continued)

OTHER PUBLICATIONS

Office Action dated Jun. 27, 2019 in co-pending U.S. Appl. No. 16/386,973.
(Continued)

*Primary Examiner* — Steven B McAllister
*Assistant Examiner* — Allen R Schult
(74) *Attorney, Agent, or Firm* — Staas & Halsey LP

(57) ABSTRACT

Disclosed herein is an air conditioner. The air conditioner includes a housing having an inlet and an outlet, and having a first guide surface forming the outlet and a second guide
(Continued)

surface facing the first guide surface provided therein, a heat exchanger configured to heat-exchange air suctioned through the inlet, a blower fan configured to suction air from the inlet, heat-exchange the air by passing air through the heat exchanger, and discharge air toward the outlet, and an airflow control unit provided to be movable between a first position adjacent to one end portion of the outlet from which air is discharged and a second position spaced apart from the end portion of the outlet from which air is discharged, and protruding from the first guide surface or the second guide surface when the airflow control unit placed at the first position.

7 Claims, 108 Drawing Sheets

(30) Foreign Application Priority Data

| | | |
|---|---|---|
| Nov. 25, 2015 | (KR) | 10-2015-0165807 |
| Nov. 25, 2015 | (KR) | 10-2015-0165887 |
| Nov. 25, 2015 | (KR) | 10-2015-0165895 |
| Jan. 20, 2016 | (KR) | 10-2016-0007061 |
| May 4, 2016 | (KR) | 10-2016-0055164 |

(51) Int. Cl.

| | |
|---|---|
| ***F24F 13/14*** | (2006.01) |
| ***F24F 13/12*** | (2006.01) |
| ***F24F 1/0007*** | (2019.01) |
| ***F24F 1/0011*** | (2019.01) |
| ***F24F 13/10*** | (2006.01) |
| ***F24F 1/0047*** | (2019.01) |
| ***F24F 11/00*** | (2018.01) |

(52) U.S. Cl.
CPC ..... *F24F 1/0047* (2019.02); *F24F 13/10* (2013.01); *F24F 13/12* (2013.01); *F24F 13/14* (2013.01); *F24F 13/20* (2013.01); *F24F 11/00* (2013.01)

(58) Field of Classification Search
USPC ..... 454/27
See application file for complete search history.

(56) References Cited

U.S. PATENT DOCUMENTS

| | | | | |
|---|---|---|---|---|
| 2012/0055186 | A1 | 3/2012 | Jung et al. | |
| 2017/0276389 | A1* | 9/2017 | Yamamoto | B60H 1/34 |

FOREIGN PATENT DOCUMENTS

| | | | |
|---|---|---|---|
| CN | 104279734 | A | 1/2015 |
| DE | 10 2009 025 527 | A1 | 1/2011 |
| JP | 2000-9342 | | 1/2000 |
| JP | 2000-283544 | | 10/2000 |
| JP | 2001-201165 | | 7/2001 |
| JP | 2003-42528 | A | 2/2003 |
| JP | 2004-353910 | | 12/2004 |
| JP | 2005-257142 | A | 9/2005 |
| JP | 2007-218511 | | 8/2007 |
| JP | 2009-300044 | | 12/2009 |
| JP | 2010-43765 | A | 2/2010 |
| JP | 2011-99613 | | 5/2011 |
| JP | 2012-72954 | | 4/2012 |
| JP | 5108674 | B2 | 12/2012 |
| JP | 5113639 | | 1/2013 |
| JP | 2013-113541 | | 6/2013 |
| KR | 1998-019628 | | 6/1998 |
| KR | 10-1998-0087480 | | 12/1998 |
| KR | 10-2004-0106056 | | 12/2004 |
| KR | 10-2007-0019195 | | 2/2007 |
| KR | 10-2008-0067405 | | 7/2008 |
| KR | 10-2009-0042524 | | 4/2009 |
| KR | 10-0897425 | B1 | 5/2009 |
| KR | 20-2009-0007743 | | 7/2009 |
| KR | 10-2009-0122503 | | 12/2009 |
| KR | 10-1045550 | B1 | 7/2011 |
| KR | 10-2013-0049120 | A | 5/2013 |
| KR | 10-1577071 | B1 | 12/2015 |
| WO | WO 2013/065437 | A1 | 5/2013 |

OTHER PUBLICATIONS

International Search Report dated Jan. 12, 2017 in corresponding International Patent Application No. PCT/KR2016/011199.
Written Opinion of the International Searching Authority dated Jan. 12, 2017 in corresponding International Patent Application No. PCT/KR2016/011199.
European Search Report issued in European Patent Application No. 19169341.5 dated Jun. 13, 2019.
European Patent Office Action issued in European Patent Application No. 16857695.7 dated May 7, 2019.
Korean Patent Office Action issued in Korean Patent Application No. 10-2016-0055164 dated May 22, 2019.
European Office Action dated Sep. 19, 2018 in corresponding European Patent Application No. 16857695.7.
Final Office Action dated Jan. 3, 2020 in co-pending U.S. Appl. No. 16/386,973.
European Patent Office Action issued in European Patent Application No. 19 169 341.5 dated Dec. 3, 2019.
Korean Patent Office Action issued in Korean Patent Application No. 10-2016-0055164 dated Sep. 26, 2019.
Office Action dated Jun. 22, 2020 in U.S. Appl. No. 16/386,973.
Chinese Office Action dated Nov. 25, 2019 in corresponding Chinese Patent Application No. 201680015663.8.
European Office Action dated Dec. 3, 2019 in corresponding European Patent Application No. 16857695.7.
European Office Action dated Dec. 3, 2019 in corresponding European Patent Application No. 19169341.5.
Office Action dated Feb. 18, 2020 in Russian Patent Application No. 2018114685.
Search Report completed Feb. 17, 2020 in Russian Patent Application No. 2018114685.
Chinese Office Action dated Jul. 10, 2020 in corresponding Chinese Patent Application No. 201680015663.8.
Indian Office Action dated Aug. 27, 2020 in corresponding Indian Patent Application No. 201817019001.
Office Action dated Oct. 26, 2020, in U.S. Appl. No. 16/215,993.
Brazilian Office Action dated Jul. 2, 2020, in corresponding Brazilian Patent Application No. BR112018006863-2.
Office Action dated Nov. 13, 2020, in U.S. Appl. No. 16/386,973.

* cited by examiner

2005(2500)

6003

AIR CONDITIONER

CROSS-REFERENCE TO RELATED APPLICATIONS

This application is a National Phase Application under 35 U.S.C. § 371 of PCT International Patent Application No. PCT/KR2016/011199, filed on Oct. 6, 2016, which claims the foreign priority benefit under 35 U.S.C. § 119 to Korean Patent Application No. 10-2015-0148299, filed on Oct. 23, 2015, Korean Patent Application No. 10-2015-0165807, filed on Nov. 25, 2015, Korean Patent Application No. 10-2015-0165895, filed on Nov. 25, 2015, Korean Patent Application No. 10-2015-0165887, filed on Nov. 25, 2015, Korean Patent Application No. 10-2015-0165717, filed on Nov. 25, 2015, Korean Patent Application No. 10-2016-0007061, filed on Jan. 20, 2016, and Korean Patent Application No. 10-2016-0055164, filed on May 4, 2016, the contents of which are incorporated herein by reference.

TECHNICAL FIELD

The present disclosure relates to an air conditioner, and more particularly, to an air conditioner with an improved airflow control structure.

BACKGROUND ART

An air conditioner is an apparatus that includes a compressor, a condenser, an expansion valve, an evaporator, a blower fan, etc. and uses a refrigeration cycle to adjust a temperature, a humidity level, an airflow, etc. in an indoor space. Air conditioners may be classified into a separated type having an indoor unit arranged inside and an outdoor unit arranged outside and an integrated type having both an indoor unit and an outdoor unit arranged inside a single housing.

An air conditioner includes a heat exchanger configured to heat-exchange refrigerant with air, a blower fan configured to circulate air, and a motor configured to drive the blower fan, and cools or heats an indoor space.

An air conditioner sometimes includes a discharged airflow controller configured to discharge air that is cooled or heated by a heat exchanger in various directions. Generally, such a discharged airflow controller includes a vertical or horizontal blade provided at an outlet, and a driving device configured to rotate the vertical or horizontal blade. That is, the air conditioner adjusts an angle of rotation of the blade to control a direction of discharged airflow.

According to the discharged airflow control structure using the blade, an amount of discharged air may be decreased because airflow is interfered by the blade, flow noise may be increased due to turbulent flow that is generated around the blade, and the blade cannot be easily rotated when the air conditioner is a central-discharge type, thereby causing a problem.

Also, in a case of an air conditioner in which an outlet has a circular shape, there is a problem in that a conventional blade structure is difficult to be applied thereto. Consequently, a method for controlling discharged airflow of air being discharged through the outlet is required.

DISCLOSURE

Technical Problem

An aspect of the present disclosure is directed to providing an air conditioner having an improved discharged airflow control structure to control discharged airflow without a blade structure.

Another aspect of the present disclosure is directed to providing an air conditioner having an improved discharged airflow control structure to reduce loss of discharged air volume.

Still another aspect of the present disclosure is directed to providing an air conditioner having an improved discharged airflow control structure to reduce flow noise caused by turbulent flow that is generated around an outlet.

Yet another aspect of the present disclosure discloses an air conditioner capable of controlling discharged airflow of air being discharged from an outlet having a circular shape.

Yet another aspect of the present disclosure discloses an air conditioner capable of easily controlling discharged airflow by adjusting a direction of an outlet without adjusting an angle of rotation of a blade.

Yet another aspect of the present disclosure discloses an air conditioner capable of easily controlling discharged airflow in a central-discharge type ceiling-mounted air conditioner.

Technical Solution

In accordance with one aspect of the present disclosure, an air conditioner includes a housing having an inlet and an outlet, and having a first guide surface forming the outlet and a second guide surface facing the first guide surface provided therein, a heat exchanger configured to heat-exchange air suctioned through the inlet, a blower fan configured to suction air from the inlet, heat-exchange the air by passing air through the heat exchanger, and discharge air toward the outlet, and an airflow control unit provided to be movable between a first position adjacent to one end portion of the outlet from which air is discharged and a second position spaced apart from the end portion of the outlet from which air is discharged, and protruding from the first guide surface or the second guide surface when the airflow control unit placed at the first position.

Then the airflow control unit placed at the first position, the airflow control unit may guide air being discharged from the outlet toward the airflow control unit.

The airflow control unit may move on the first guide surface or the second guide surface.

The airflow control unit may be concealed in the first guide surface or the second guide surface at the second position.

The housing may include a cover member configured to partially open the first guide surface or the second guide surface to make the airflow control unit exposed when the airflow control unit is at the first position, and configured to cover the airflow control unit and form a portion of the first guide surface or the second guide surface when the airflow control unit is at the second position.

The airflow control unit may move in a direction perpendicular to the first guide surface or the second guide surface The airflow control unit may include a guide member protruding from the first guide surface or the second guide surface at the first position.

The airflow control unit may include an airflow control driving source configured to generate power for moving the guide member.

A portion of the guide member protruding from the first guide surface or the second guide surface may be curved.

At least one of the first guide surface and the second guide surface may include a Coanda curved portion provided at the end portion of the outlet from which air is discharged.

The airflow control unit may extend toward both sides along a width direction of the outlet from a central portion of the outlet.

The inlet and the outlet may be provided at a bottom surface of the housing, and the housing may be installed on a ceiling.

The housing may be installed on a wall.

In accordance with another aspect of the present disclosure, an air conditioner includes a housing having a portion thereof embedded in the ceiling and having an inlet and an outlet provided at an outer side of the inlet at a lower portion of the housing, a heat exchanger configured to heat-exchange air suctioned through the inlet, a blower fan configured to suction air from the inlet, heat-exchange the air by passing air through the heat exchanger, and discharge air toward the outlet, and an airflow control unit movably provided on a first guide surface of the housing forming the outlet or on a second guide surface facing the first guide surface, and protruding in a curved shape from the first guide surface or the second guide surface, wherein the airflow control unit moves adjacent to one end of the outlet where the air is discharged to guide the air discharged from the outlet toward the airflow control unit.

The airflow control unit may include a guide member

The airflow control unit may include a guide member protruding from the first guide surface or the second guide surface at the first position, an airflow control driving source configured to generate power for moving the guide member, and a power transmission member for transmitting the power generated by the airflow control driving source to the guide member.

The power transmission member may have a shape corresponding to the first guide surface of the second guide surface and may move along the first guide surface of the second guide surface.

In accordance with another aspect of the present disclosure, an air conditioner includes a housing having an inlet and an outlet, a heat exchanger configured to heat-exchange air suctioned through the inlet, a blower fan configured to suction air from the inlet and discharge the air toward the outlet, and an airflow control unit provided to move between a first position at which the airflow control unit is arranged on the outlet and a second position at which the airflow control unit is deviated from the outlet.

The airflow control unit may include a guide member protruding in a curved shape on the outlet at the first position and configured to guide air being discharged from the outlet toward the airflow control unit, and an airflow control driving source configured to generate power for moving the guide member between the first position and the second position.

The airflow control driving source may include a hydraulic cylinder.

The airflow control unit may further include a power transmission member for transmitting the power generated by the airflow control driving source to the guide member.

The housing may further include a cover member to cover a portion where the airflow control unit protrudes on the outlet when the airflow control unit is at the second position.

Advantageous Effects

According to an aspect of the present disclosure, an air conditioner can control discharged airflow without a blade.

According to an aspect of the present disclosure, because an air conditioner controls discharged airflow without a blade, a decrease of an amount of discharged air due to interference with the blade can be reduced.

According to an aspect of the present disclosure, flow noise can be reduced because an air conditioner controls discharged airflow without a blade.

According to an aspect of the present disclosure, an air conditioner can control discharged airflow of air being discharged from an outlet having a circular shape.

According to an aspect of the present disclosure, because a direction of an outlet can be changed by moving a discharge grille that includes the outlet, an air conditioner can easily control discharged airflow without adjusting an angle of rotation of a blade. In a case of a central-discharge type air conditioner, discharged airflow can be controlled by simply deforming a blade of a discharge grille.

MODES OF THE INVENTION

Figure 1:
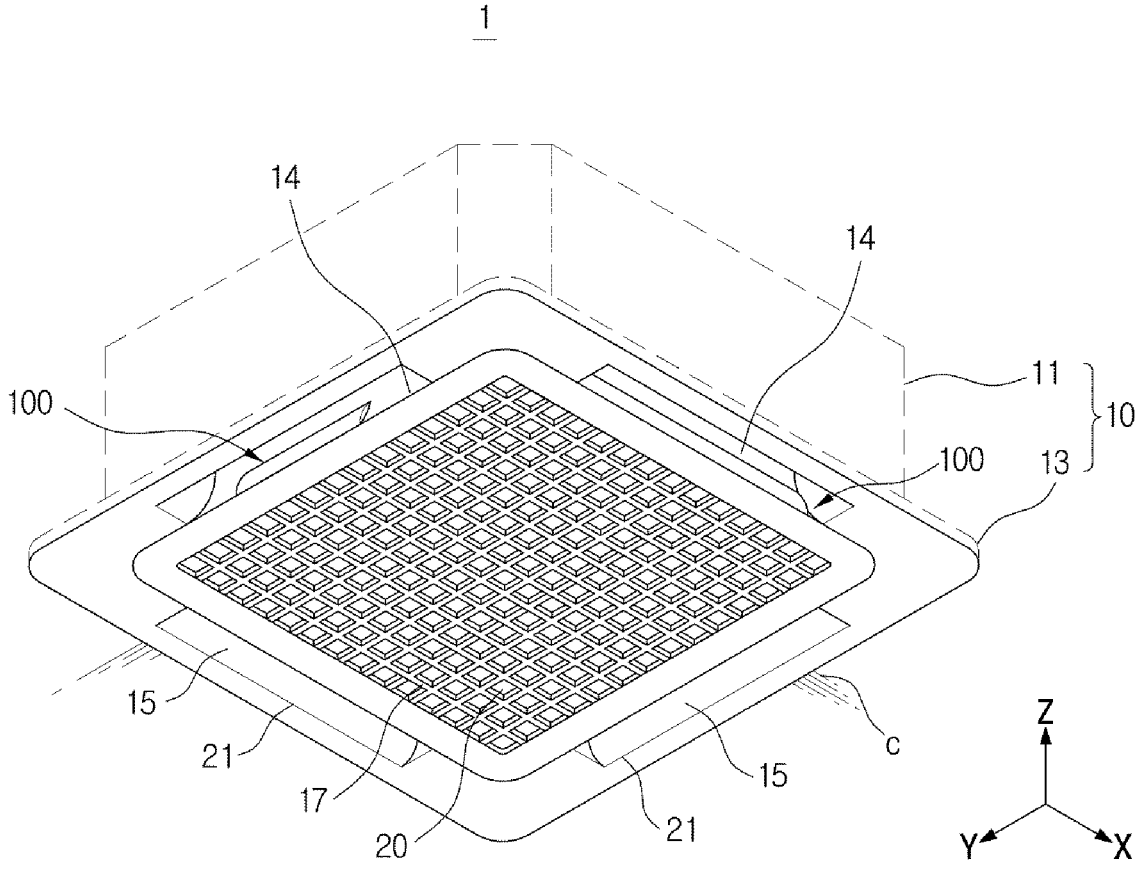
FIG. 1 is a perspective view illustrating an air conditioner according to an embodiment of the present disclosure.

Embodiments described herein and configurations illustrated in the drawings are merely preferred embodiments of the present disclosure, and various modified embodiments that are capable of substituting the embodiments and the drawings of the present specification may exist at the time of applying the present application.

Also, like reference numerals or symbols given in each drawing of the present specification represent parts or elements that perform substantially the same functions.

Also, the terms used herein are used to describe the embodiments and are not intended to restrict and/or limit the present disclosure. A singular expression includes a plural expression unless clearly defined otherwise in the context. The terms such as "include" or "have" used herein are to designate that a characteristic, a number, a step, an operation, an element, a part, or combinations thereof exist, and do not preclude in advance the existence of or the possibility of adding one or more other characteristics, numbers, steps, operations, elements, parts, or combinations thereof.

Also, the terms including ordinals such as "first," "second," and the like used herein may be used to describe various elements, but the elements are not limited by the terms, and the terms are used to only distinguish one element from another element. For example, a first element may be referred to as a second element while not departing from the scope of the present disclosure, and likewise, a second element may also be referred to as a first element. The term "and/or" includes a combination of a plurality of related described items or any one item among the plurality of related described items.

Meanwhile, the terms used in the description below such as "front end," "rear end," "upper portion," "lower portion," "upper end," and "lower end" are defined on the basis of the drawings, and a shape and a position of each element are not limited by the terms.

Also, hereinafter, a circular ceiling-mounted air conditioner that includes a ring-shaped inlet/outlet formed by a ring-shaped heat exchanger and arranged at an outside in a radial direction of the heat exchanger and a central circular outlet/inlet arranged at an inside in the radial direction of the heat exchanger will be described as an example. However, the present disclosure is not limited to the circular ceiling-mounted air conditioner and may also be applied to a conventional general ceiling-mounted air conditioner having a four-way outlet/inlet formed by a heat exchanger formed in a quadrilateral shape.

Hereinafter, embodiments of the present disclosure will be described in detail with reference to the accompanying drawings.

Figure 2:
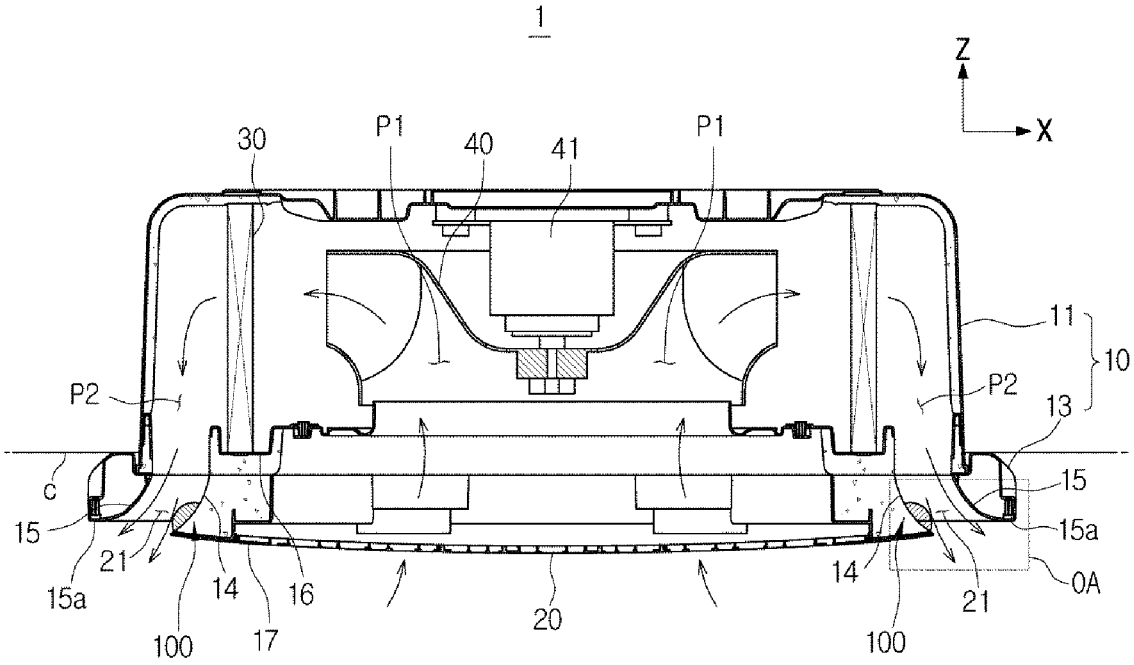
FIG. 2 is a lateral cross-sectional view of an indoor unit of the air conditioner illustrated in FIG. 1.
Figure 3:
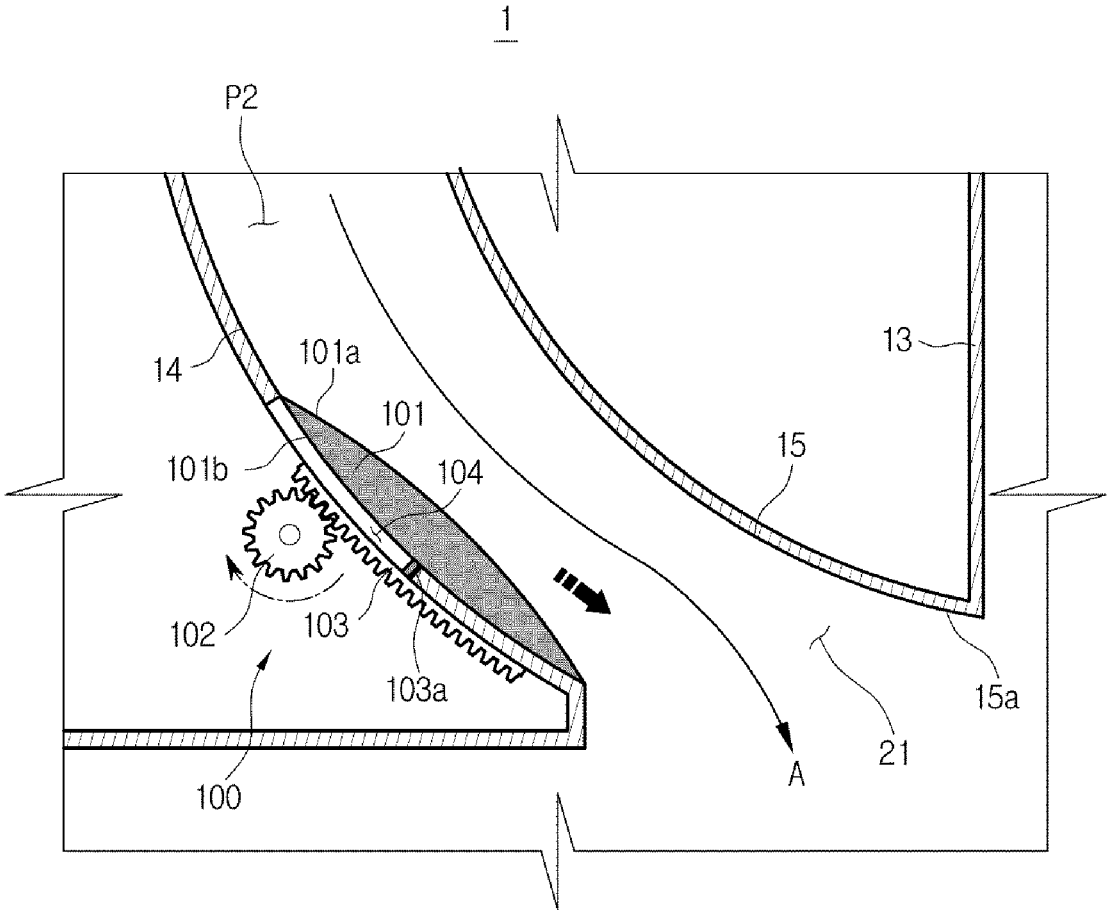
FIGS. 3 and 4 are views schematically illustrating an enlarged view of a portion OA marked in FIG. 2.
Figure 4:
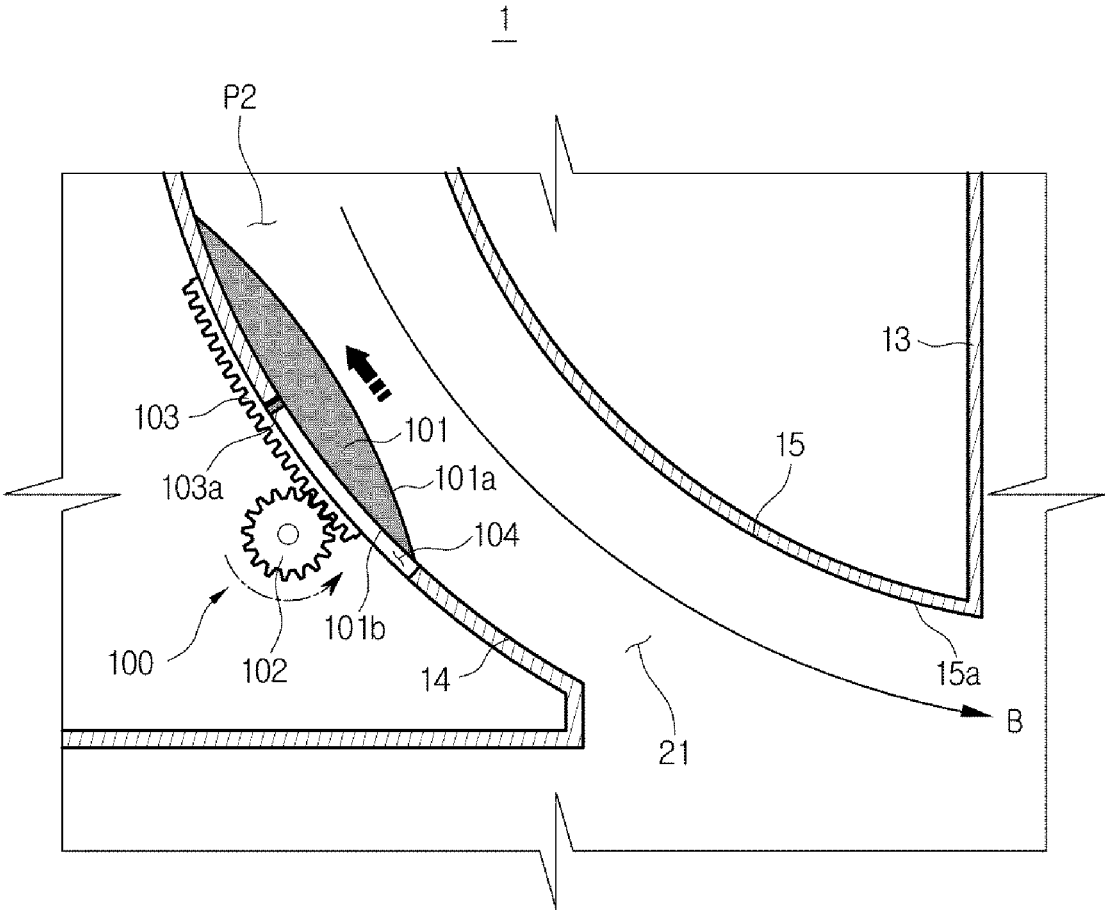
Figure 5:
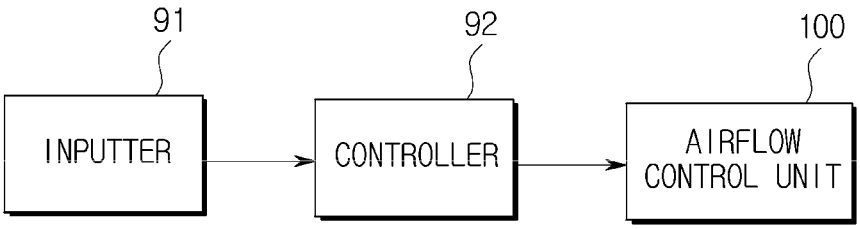
FIG. 5 is a block diagram illustrating a control system of the air conditioner according to an embodiment of the present disclosure.

FIG. 1 is a perspective view illustrating an air conditioner according to an embodiment of the present disclosure. FIG. 2 is a lateral cross-sectional view of an indoor unit of the air conditioner illustrated in FIG. 1. FIGS. 3 and 4 are views schematically illustrating an enlarged view of a portion OA marked in FIG. 2. FIG. 5 is a block diagram illustrating a control system of the air conditioner according to an embodiment of the present disclosure.

Referring to FIGS. 1 and 2, an air conditioner 1 according to an embodiment of the present disclosure may be installed on a ceiling C. At least a portion of the air conditioner 1 may be buried in the ceiling C.

The air conditioner 1 may include a housing 10 having an inlet 20 and an outlet 21, a heat exchanger 30 provided inside the housing 10, and a blower fan 40 configured to circulate air.

The housing 10 may have a quadrilateral container shape which is open downward to accommodate elements of the air conditioner 1 therein. The housing 10 may include an upper housing 11 arranged inside the ceiling C and a lower housing 13 coupled to a lower portion of the upper housing 11.

The inlet 20 configured to suction air may be formed at a central portion of the lower housing 13, and an outlet 21 configured to discharge air may be formed at an outer edge side of the inlet 20. A suction flow passage P1 having air suctioned through the inlet 20 flow therethrough may be provided between the inlet 20 and the blower fan 40, and a discharge flow passage P2 having air discharged by the blower fan 40 flow therethrough may be provided between the blower fan 40 and the outlet 21.

The outlet 21 may be formed to be adjacent to each edge of the lower housing 13 to correspond to an outer edge of the lower housing 13. Four outlets 21 may be formed. That is, two outlets 21 may be formed in each of the x-axis direction and the y-axis direction. The four outlets 21 are arranged to discharge air in four directions in an indoor space. By the above structure, the air conditioner 1 may suction air from a lower side, cool or heat the air, and then discharge the air back to the lower side.

The lower housing 13 may have a first guide surface 14 and a second guide surface 15 forming the outlets 21. The first guide surface 14 and the second guide surface 15 may be arranged to face each other.

The first guide surface 14 and/or the second guide surface 15 may selectively include Coanda curved portions 14*a* and 15*a*. The Coanda curved portions 14*a* (see FIGS. 3 and 4) and 15*a* (see FIGS. 6 and 7) may induce airflow being discharged through the outlets 21 to flow in close contact with the Coanda curved portion 15*a*.

A grille 17 may be coupled to a bottom surface of the lower housing 13 to filter dust from air being suctioned into the inlet 20.

The heat exchanger 30 may be formed in a rounded quadrilateral shape and arranged at an outer edge side of blower fan 40 inside the housing 10. The heat exchanger 30 is not limited to having a rounded quadrilateral shape, and may be formed in various shapes such as a circular shape, an elliptical shape, and a polygonal shape.

The heat exchanger 30 may be placed on a drain tray 16, and condensate generated in the heat exchanger 30 may be collected in the drain tray 16. The drain tray 16 may be formed in a shape corresponding to that of the heat exchanger 30. That is, when the heat exchanger 30 is formed in a rounded quadrilateral shape, the drain tray 16 may also have a rounded quadrilateral shape. Also, when the heat exchanger 30 is formed in a circular shape, the drain tray 16 may also have a circular shape.

The blower fan 40 may be arranged at a central side of the housing 10. That is, the blower fan 40 may be provided inside the heat exchanger 30. The blower fan 40 may be a centrifugal fan configured to suction air in an axial direction and discharge air in a radial direction. A blower motor 41 configured to drive the blower fan 40 may be provided in the air conditioner 1.

By the above configuration, the air conditioner 1 may suction air from an indoor space, cool the air, and then discharge the air back to the indoor space, or suction air from an indoor space, heat the air, and then discharge the air back to the indoor space.

Referring to FIGS. 3 and 4, the air conditioner 1 may further include an airflow control unit 100 configured to control discharged airflow that is discharged from the outlets 21.

The airflow control unit 100 may be provided at the first guide surface 14 and may extend from a central portion of the outlet 21 along a width direction of the outlet 21 (i.e., the x-axis and y-axis directions illustrated in FIG. 1). The airflow control unit 100 may extend a length that is almost similar to the width of the outlet 21 along the width direction of the outlet 21, or may extend a length that is about a half of the width of the outlet 21.

The airflow control unit 100 may guide air being discharged from the outlet 21 and control a direction of discharged airflow. Here, to control a direction of discharged airflow means to control an angle of discharged airflow.

The airflow control unit 100 may include a guide member 101 configured to guide air being discharged from the outlet 21, an airflow control driving source 102 configured to generate power for moving the guide member 101, and a power transmission member 103 configured to transmit power generated by the airflow control driving source 102 to the guide member 101.

The guide member 101 is provided to receive power from the airflow control driving source 102 and be movable between a first position illustrated in FIG. 3 and a second position illustrated in FIG. 4 along the first guide surface 14. The guide member 101 is provided to protrude a predetermined height from the first guide surface 14. The guide member 101 may guide discharged airflow toward the airflow control unit 100.

The guide member 101 may be formed in a curved shape having a predetermined curvature. When the guide member 101 is at the first position, one surface 101*a* thereof facing the outlet 21 may have a convex shape to guide air being discharged from the outlet 21 in a downward direction using the Coanda effect. The other surface 101*b*, which is at the opposite side of the surface 101*a* of the guide member 101, may have a shape corresponding to that of the first guide surface 14 to come into contact with the first guide surface 14.

The airflow control driving source 102 generates power to enable the guide member 101 to move between the first position illustrated in FIG. 3 and the second position illustrated in FIG. 4. The airflow control driving source 102 may be fixed to the lower housing 13. The airflow control driving source 102 may use a motor.

The power transmission member 103 connects the guide member 101 to the airflow control driving source 102 and transmits power generated by the airflow control driving source 102 to the guide member 101.

Specifically, the guide member 101 may move between the first position and the second position as a pinion gear provided at the airflow control driving source 102 and a rack gear provided at the power transmission member 103 move by being engaged with each other. That is, as illustrated in FIG. 3, the guide member 101 may move along the first guide surface 14 in the downward direction when the airflow control driving source 102 is rotated clockwise. On the other hand, as illustrated in FIG. 4, the guide member 101 may move along the first guide surface 14 in an upward direction when the airflow control driving source 102 is rotated counterclockwise.

The airflow control unit 100 may include a guide groove 104 configured to guide the power transmission member 103 and enable the guide member 101 to move between the first position and the second position along the first guide surface 14. Specifically, a portion 103*a* of the power transmission member 103 may be inserted into the guide groove 104 and move along the guide groove 104. The guide member 101 is arranged at the first position when the portion 103*a* of the power transmission member 103 is arranged at one end at a lower side of the guide groove 104, and the guide member 101 is arranged at the second position when the portion 103*a* of the power transmission member 103 is arranged at one end at an upper side of the guide groove 104.

Because the guide groove 104 is not exposed to the outlet 21 due to the guide member 101, the guide groove 104 does not affect flow of discharged air.

Hereinafter, action of the airflow control unit 100 will be described with reference to FIGS. 3 to 5.

When a user attempts to control airflow of air being discharged from the outlet 21 to be in a direction adjacent to the air conditioner 1, the user transmits a command to a controller 92 through an inputter 91, and the controller 92 moves the airflow control unit 100 to the first position illustrated in FIG. 3.

Specifically, the controller 92 rotates the airflow control driving source 102 clockwise, and rotation power of the airflow control driving source 102 is converted into power for curved movement by the power transmission member 103. The guide member 101 that has received the power moves along the first guide surface 14 in the downward direction so that one end of the guide member 101 abuts one end of the first guide surface 14 from which air is discharged. In this case, air passing through the outlet 21 through the discharge flow passage P2 is guided along the surface 101*a* of the guide member 101 in the downward direction by the Coanda effect and is discharged in a substantially vertical direction. That is, airflow in a direction A which is marked in FIG. 3 may be formed in the outlet 21.

On the other hand, when the user attempts to control airflow of air being discharged from the outlet 21 to spread far from the air conditioner 1, the user transmits a command to the controller 92 through the inputter 91, and the controller 92 moves the airflow control unit 100 to the second position illustrated in FIG. 4.

Specifically, the controller 92 rotates the airflow control driving source 102 counterclockwise, and the rotation power of the airflow control driving source 102 is converted into power for curved movement by the power transmission member 103. The guide member 101 that has received the power moves along the first guide surface 14 in the upward direction so that one end of the guide member 101 is spaced apart from the end of the first guide surface 14 from which air is discharged. That is, the guide member 101 moves toward the discharge flow passage P2. In this case, air passing through the outlet 21 through the discharge flow passage P2 passes through the guide member 101, is guided along the first guide surface 14, and is discharged from the outlet 21. That is, airflow in a direction B which is marked in FIG. 4 may be formed in the outlet 21.

Also, the airflow control unit 100 may be arranged between the first position illustrated in FIG. 3 and the second position illustrated in FIG. 4. In this case, because air being discharged through the outlet 21 is less affected by the Coanda effect compared to the case illustrated in FIG. 3, air may be discharged in a direction between the direction A which is marked in FIG. 3 and the direction B illustrated in FIG. 4.

By the above configuration, the air conditioner according to an embodiment of the present disclosure may control discharged airflow even without a blade structure, compared to a conventional structure in which a blade is provided in an outlet and discharged airflow is controlled by rotation of the blade. Accordingly, because there is no interference with a blade, an amount of discharged air may be increased, and flow noise may be reduced.

Figure 6:
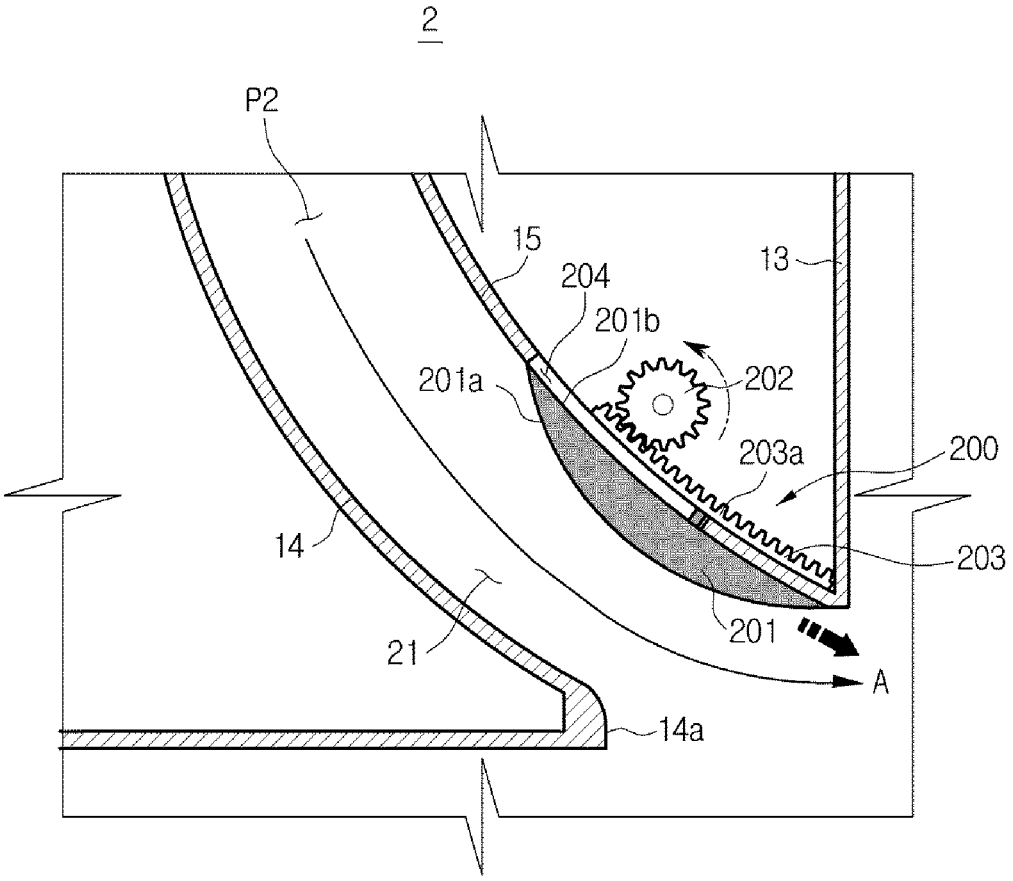
FIGS. 6 and 7 are views illustrating an airflow control unit of an air conditioner according to another embodiment of the present disclosure.
Figure 7:
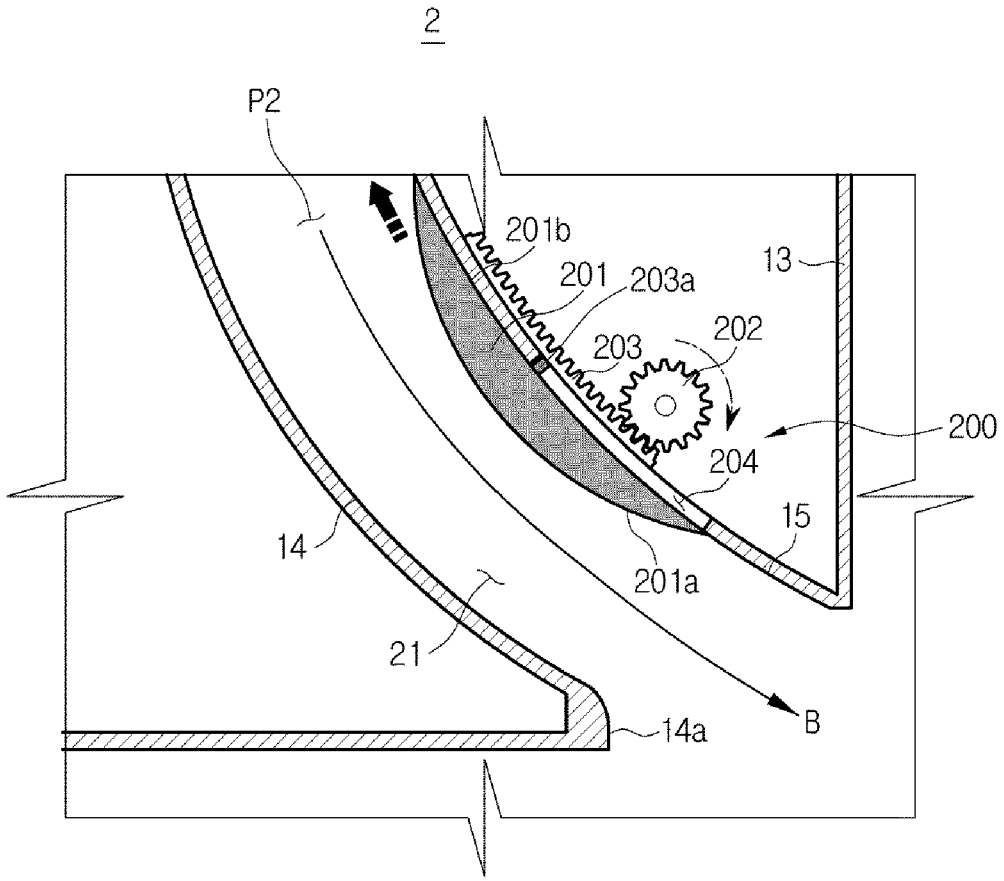

FIGS. 6 and 7 are views illustrating an airflow control unit 200 of an air conditioner 2 according to another embodiment of the present disclosure.

The air conditioner 2 according to another embodiment of the present disclosure will be described with reference to FIGS. 6 and 7. In describing the embodiment illustrated in FIGS. 6 and 7, like reference numerals may be assigned to elements which are the same as those illustrated in FIGS. 3 and 4, and description thereof may be omitted.

The airflow control unit 200 of the air conditioner 2 may be provided at the second guide surface 15 and guide air being discharged from the outlet 21 to spread even further from the air conditioner 2.

A guide member 201 of the airflow control unit 200 is provided to receive power from an airflow control driving source 202 and be movable between a first position illustrated in FIG. 6 and a second position illustrated in FIG. 7 along the second guide surface 15. The guide member 201 may have one surface 201*a* formed in a downwardly convex shape to protrude a predetermined height from the second guide surface 1S. The guide member 201 may be formed in a curved shape having a predetermined curvature.

On the other hand, the other surface 201*b* of the guide member 201 may have a shape corresponding to that of the second guide surface 15 to come into contact with the second guide surface 15.

A portion 203*a* of a power transmission member 203 is inserted into a guide groove 204 and connected to the guide member 201, and the guide member 201 is moved between the first position and the second position by power generated by the driving source 202.

According to the embodiment illustrated in FIGS. 6 and 7, when the guide member 201 is at the first position as illustrated in FIG. 6, air being discharged from the outlet 21 is guided in the upward direction by the guide member 201 and is discharged in a substantially horizontal direction. That is, airflow in a direction A which is marked in FIG. 6 may be formed in the outlet 21.

On the other hand, when the guide member 201 is at the second position as illustrated in FIG. 7, air being discharged from the outlet 21 passes through the guide member 201, is guided along the second guide surface 15, and is discharged from the outlet 21. That is, airflow in a direction B which is marked in FIG. 7 may be formed in the outlet 21.

Figure 8:
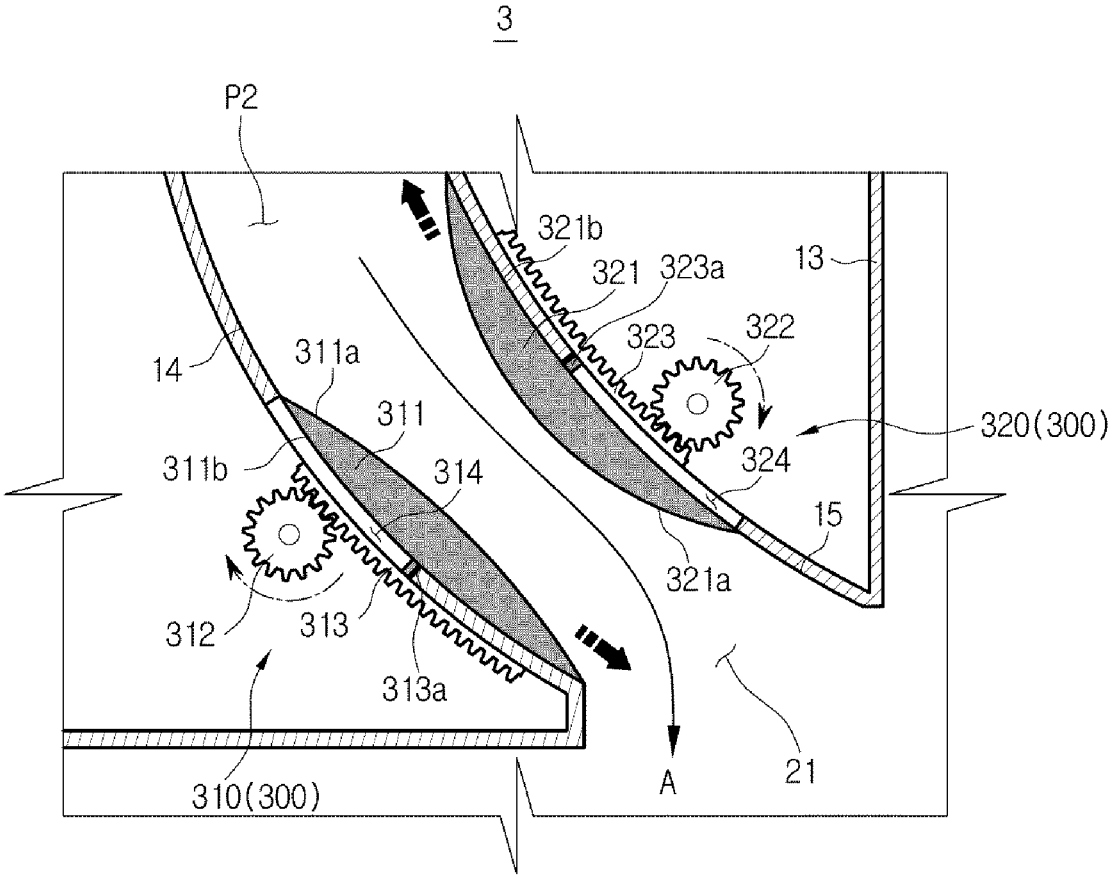
FIGS. 8 to 10 are views illustrating an airflow control unit of an air conditioner according to still another embodiment of the present disclosure.
Figure 9:
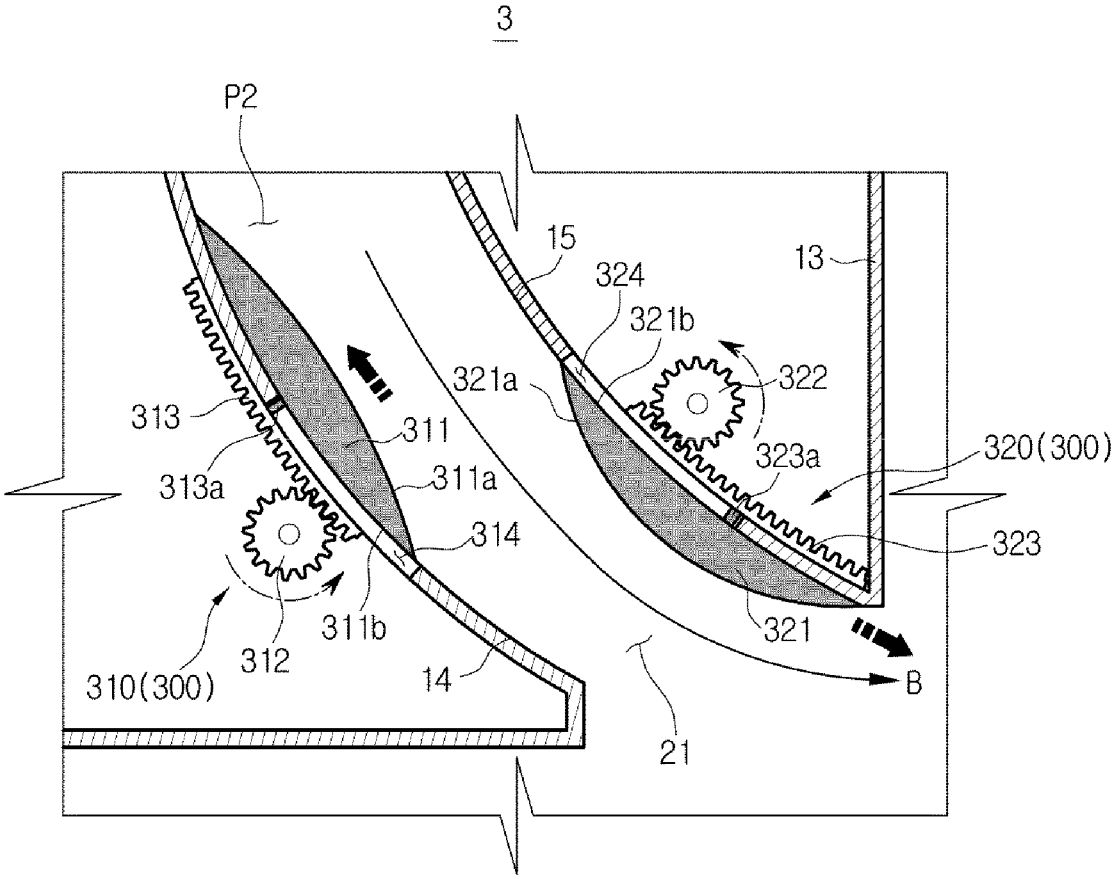
Figure 10:
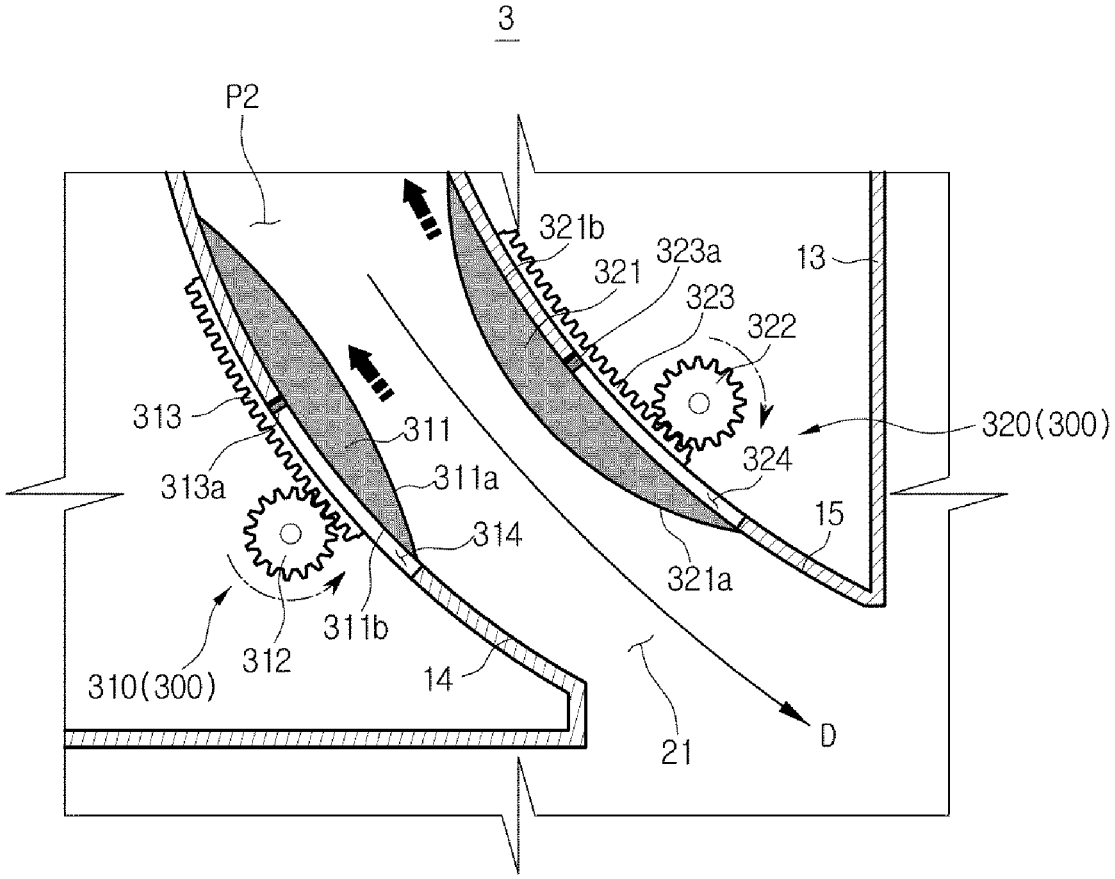

FIGS. 8 to 10 are views illustrating an airflow control unit 300 of an air conditioner according to still another embodiment of the present disclosure.

The air conditioner 3 according to still another embodiment of the present disclosure will be described with reference to FIGS. 8 to 10. In describing the embodiment illustrated in FIGS. 8 to 10, like reference numerals may be assigned to elements which are the same as those illustrated in FIGS. 3 and 4, and description thereof may be omitted.

The airflow control unit 300 of the air conditioner 3 may be provided at each of the first guide surface 14 and the second guide surface 15 and control airflow of air being discharged from the outlet 21.

The airflow control unit 300 may include a first airflow control unit 310 provided at the first guide surface 14 and a second airflow control unit 320 provided at the second guide surface 15. A first guide member 311 and a second guide member 321 may be formed in a curved shape having a predetermined curvature.

According to the embodiment illustrated in FIGS. 8 to 10, discharged airflow in a direction A which is marked in FIG. 8 may be formed when the first guide member 311 is arranged adjacent to one end portion of the outlet 21 from which air is discharged and the second guide member 321 is arranged to be spaced apart from one end portion of the outlet 21 from which air is discharged as illustrated in FIG. 8.

On the other hand, discharged airflow in a direction B which is marked in FIG. 9 may be formed when the first guide member 311 is arranged to be spaced apart from one end portion of the outlet 21 from which air is discharged and the second guide member 321 is arranged adjacent to one end portion of the outlet 21 from which air is discharged as illustrated in FIG. 9.

On the other hand, discharged airflow in a direction D marked in FIG. 10 may be formed when both the first guide member 311 and the second guide member 321 are arranged to be spaced apart from one end portion of the outlet 21 from which air is discharged as illustrated in FIG. 10.

Figure 11:
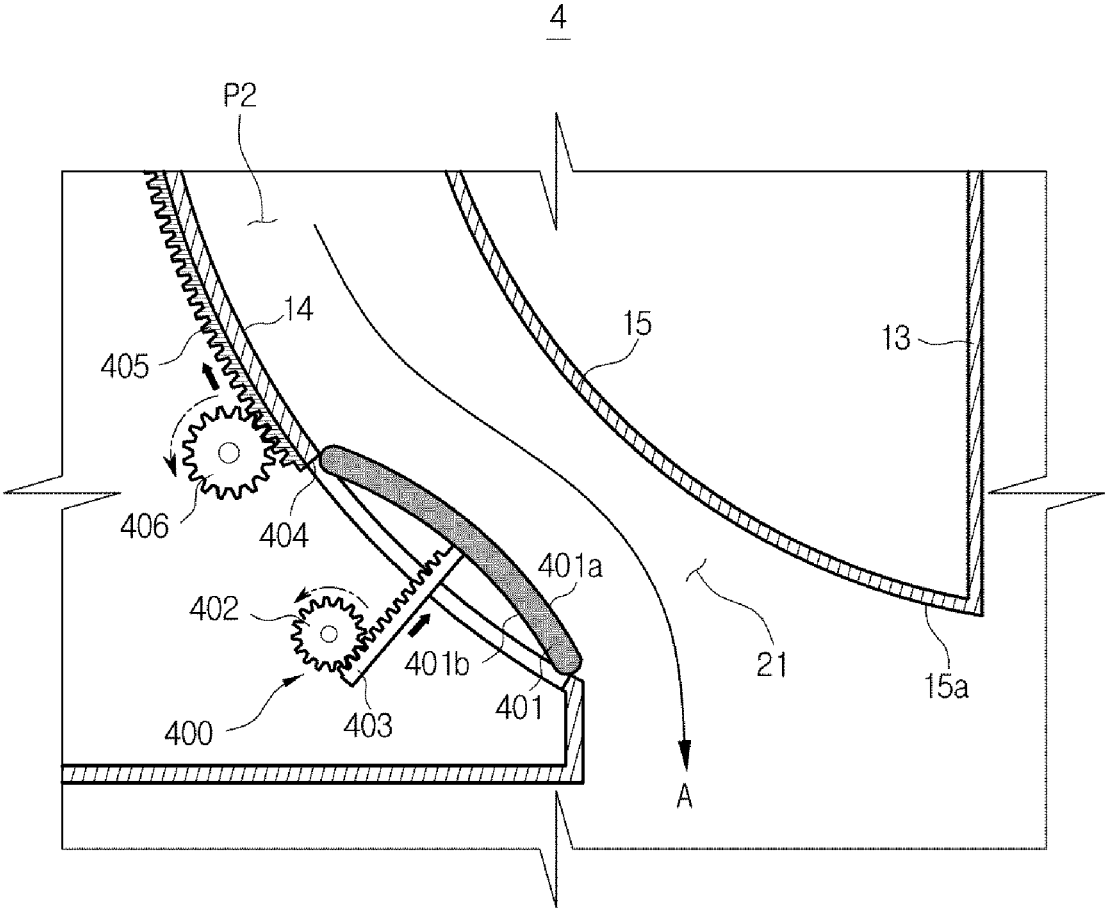
FIGS. 11 and 12 are views illustrating an airflow control unit of an air conditioner according to yet another embodiment of the present disclosure.
Figure 12:
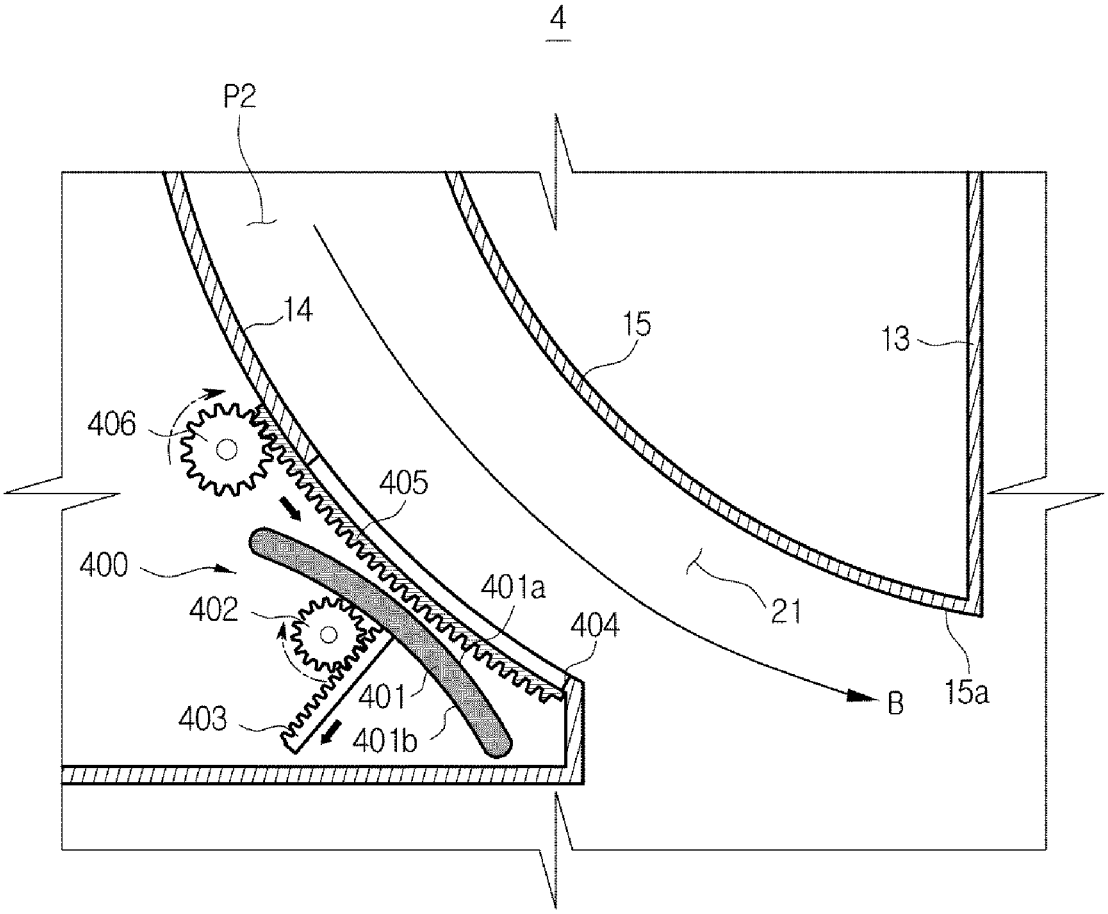

FIGS. 11 and 12 are views illustrating an airflow control unit 400 of an air conditioner 4 according to yet another embodiment of the present disclosure.

The air conditioner 4 according to yet another embodiment of the present disclosure will be described with reference to FIGS. 11 and 12. In describing the embodiment illustrated in FIGS. 11 and 12, like reference numerals may be assigned to elements which are the same as those illustrated in FIGS. 3 and 4, and description thereof may be omitted.

The airflow control unit 400 of the air conditioner 4 is provided at the first guide surface 14, and may protrude from the first guide surface 14 and guide air being discharged from the outlet 21 toward the airflow control unit 400, or may be concealed inside the first guide surface 14 and not interfere with air being discharged from the outlet 21.

A guide member 401 of the airflow control unit 400 may protrude a predetermined height from the first guide surface 14 at a first position as illustrated in FIG. 11 or may be concealed inside the first guide surface 14 at a second position as illustrated in FIG. 12. That is, the guide member 401 of the airflow control unit 400 may be arranged on the outlet 21 at the first position and may deviate from the outlet 21 at the second position. Here, the guide member 401 may move in a vertical direction with respect to a tangent on the first guide surface 14. The guide member 401 may be formed in a curved shape having a predetermined curvature.

Specifically, rotation power generated by an airflow control driving source 402 linearly moves a power transmission member 403. According to the linear movement of the power transmission member 403, the guide member 401 may move between the first position where the guide member 401 protrudes from the first guide surface 14 and the second position where the guide member 401 does not protrude from the first guide surface 14.

Also, the other surface 401*b* of the guide member 401 may be concavely formed to have a predetermined curvature toward the outlet 21 to not interfere with the airflow control driving source 402. Accordingly, the lower housing 13 may be formed to be even slimmer.

The airflow control unit 400 may include a through-hole 404 formed at the first guide surface 14 so that the guide member 401 may pass through the first guide surface 14. The through-hole 404 may be formed to be larger than the guide member 401 by a predetermined size so that the guide member 401 may pass through the through-hole 404.

The airflow control unit 400 may further include a cover member 405 configured to block the through-hole 404 when the guide member 401 is at the second position as illustrated in FIG. 12. The cover member 405 may have a shape corresponding to that of the first guide surface 14 and move along the first guide surface 14.

Specifically, when the guide member 401 of the airflow control unit 400 is at the first position as illustrated in FIG. 11, the cover member 405 moves along the first guide surface 14 in the upward direction to open the through-hole 404. On the other hand, when the guide member 401 of the airflow control unit 400 is at the second position as illustrated in FIG. 12, the cover member 405 moves along the first guide surface 14 in the downward direction to close the through-hole 404.

The airflow control unit 400 may further include a cover member driving source 406 configured to generate power for moving the cover member 405. The cover member driving source 406 may use a motor.

Specifically, the cover member driving source 406 may include a pinion gear, and the cover member 405 may be a curved rack gear having substantially the same curvature as that of the first guide surface 14. In this case, the cover member 405 may be engaged with the cover member driving source 406 and move by converting rotation power of the cover member driving source 406 into power for curved movement of the cover member 405.

According to the embodiment illustrated in FIGS. 11 and 12, when the guide member 401 is at the first position as illustrated in FIG. 11, air being discharged from the outlet 21 is guided in the downward direction by the guide member 401 and is discharged in a substantially vertical direction. That is, airflow in a direction A which is marked in FIG. 11 may be formed in the outlet 21.

On the other hand, when the guide member 401 is at the second position as illustrated in FIG. 12, because the guide member 401 is concealed in a lower portion of the first guide surface 14, air being discharged from the outlet 21 does not encounter the guide member 401, is guided along the first guide surface 14, and is discharged from the outlet 21. That is, airflow in a direction B which is marked in FIG. 12 may be formed in the outlet 21. Here, because the through-hole 404 is closed by the cover member 405, the through-hole 404 does not affect flow of discharged air.

Figure 13:
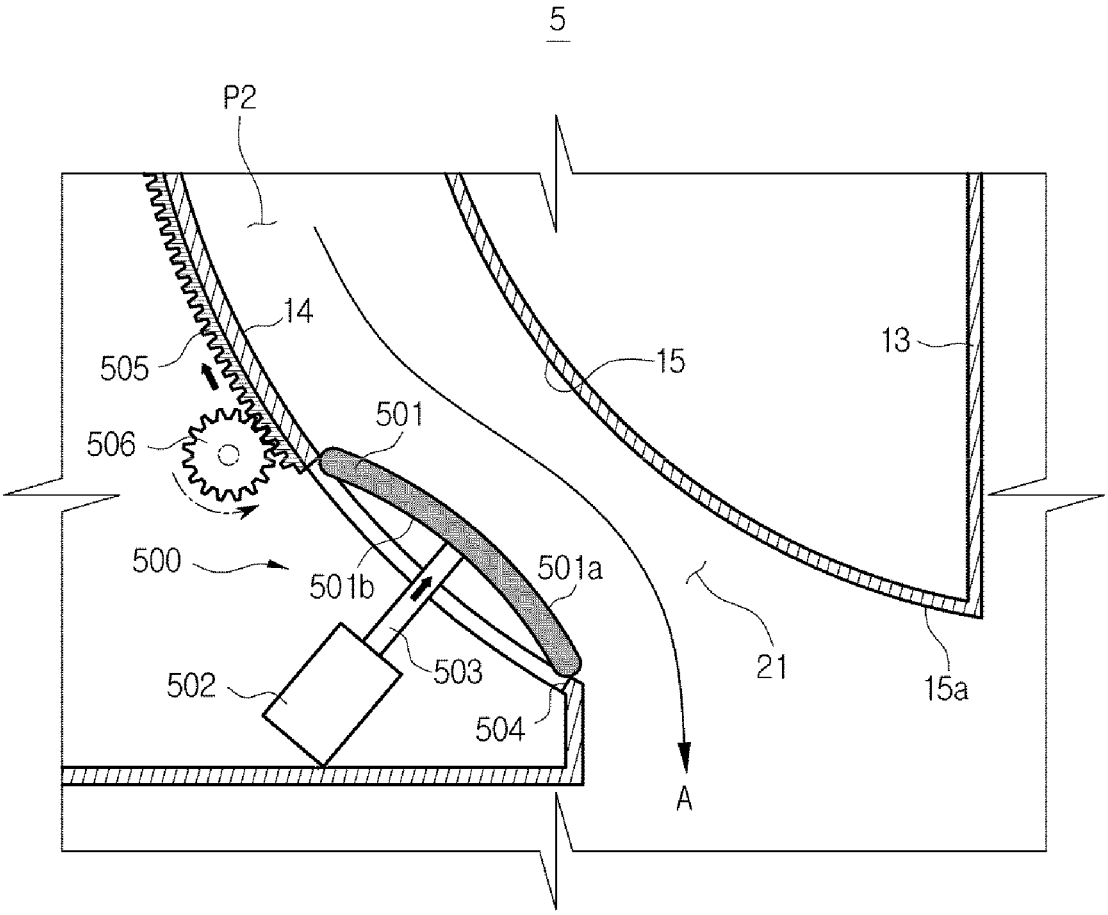
FIGS. 13 and 14 are schematic views illustrating an airflow control unit of an air conditioner according to yet another embodiment of the present disclosure.
Figure 14:
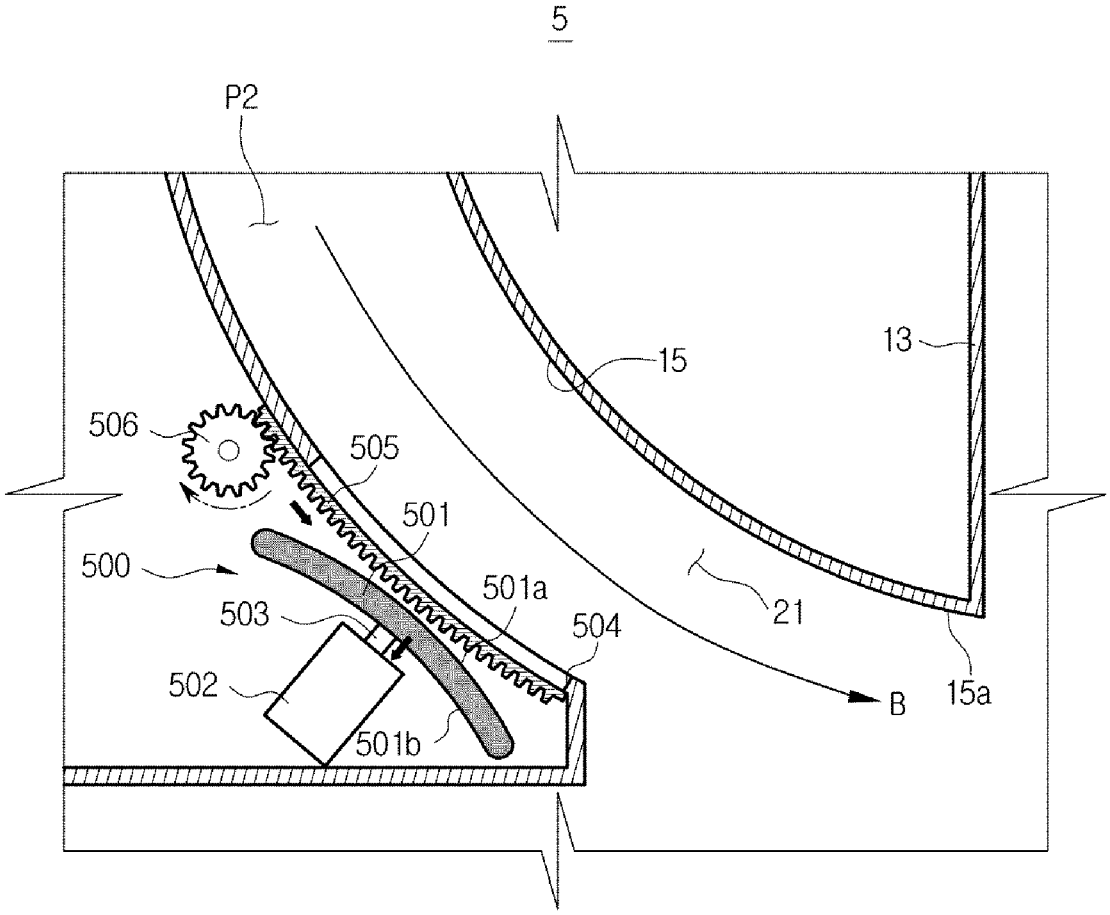

FIGS. 13 and 14 are schematic views illustrating an airflow control unit 500 of an air conditioner 5 according to yet another embodiment of the present disclosure.

The air conditioner 5 according to yet another embodiment of the present disclosure will be described with reference to FIGS. 13 and 14. In describing the embodiment illustrated in FIGS. 13 and 14, like reference numerals may be assigned to elements which are the same as those illustrated in FIGS. 3 and 4, and description thereof may be omitted.

The airflow control unit 500 of the air conditioner 5 may be provided at the first guide surface 14 and may use a hydraulic cylinder 502 to move a guide member 501. Here, the guide member 501 may be formed in a curved shape having a predetermined curvature.

The hydraulic cylinder 502 is fixed inside the lower housing 13, and a power transmission member 503 is provided at one side facing the guide member 501. According to a hydraulic pressure of the hydraulic cylinder 502 being adjusted, the power transmission member 503 moves the guide member 501 between a first position where the guide member 501 protrudes from the outlet 21 and a second position where the guide member 501 is deviated from the outlet 21 and is concealed inside the first guide surface 14.

According to the embodiment illustrated in FIGS. 13 and 14, when the guide member 501 is at the first position as illustrated in FIG. 13, air being discharged from the outlet 21 is guided in the downward direction by the guide member 501 and is discharged in a substantially vertical direction. That is, airflow in a direction A which is marked in FIG. 13 may be formed in the outlet 21.

On the other hand, when the guide member 501 is at the second position as illustrated in FIG. 14, because the guide member 501 is concealed in the lower portion of the first guide surface 14, air being discharged from the outlet 21 does not encounter the guide member 501, is guided along the first guide surface 14, and is discharged from the outlet 21. That is, airflow in a direction B which is marked in FIG. 14 may be formed in the outlet 21. Here, because a through-hole 504 is closed by a cover member 505 that has moved by a cover member driving source 506, the through-hole 504 does not affect flow of discharged air.

Figure 15:
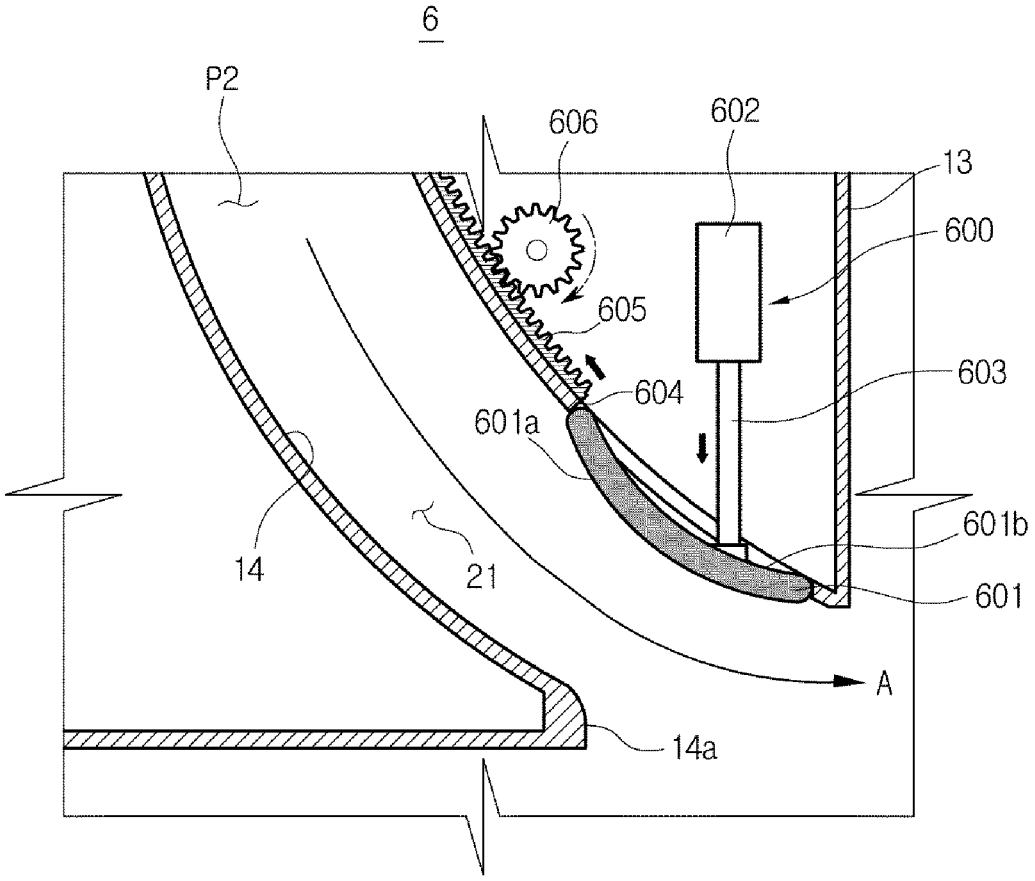
FIGS. 15 and 16 are schematic views illustrating an airflow control unit of an air conditioner according to yet another embodiment of the present disclosure.
Figure 16:
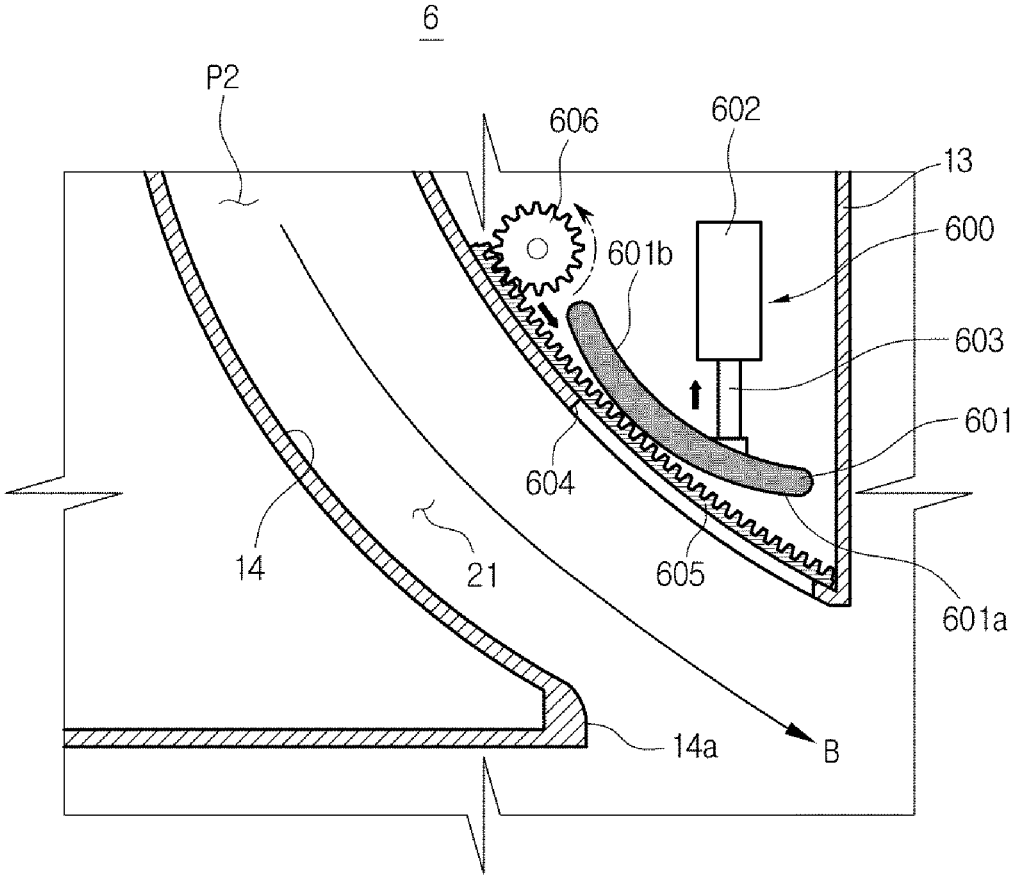

FIGS. 15 and 16 are schematic views illustrating an airflow control unit 600 of an air conditioner 6 according to yet another embodiment of the present disclosure.

The air conditioner 6 according to yet another embodiment of the present disclosure will be described with reference to FIGS. 15 and 16. In describing the embodiment illustrated in FIGS. 15 and 16, like reference numerals may be assigned to elements which are the same as those illustrated in FIGS. 3 and 4, and description thereof may be omitted.

The airflow control unit 600 of the air conditioner 6 may be provided at the second guide surface 15 and guide air being discharged from the outlet 21 to spread even further from the air conditioner 6.

A guide member 601 of the airflow control unit 600 is provided to receive power from an airflow control driving source 602 and be movable between a first position illustrated in FIG. 15 and a second position illustrated in FIG. 16 along the second guide surface 15. Here, although a hydraulic cylinder may be used as the airflow control driving source 602 as illustrated in FIGS. 15 and 16, the airflow control driving source 602 is not limited thereto, and a motor, a pinion gear, and a rack gear may also be used as illustrated in FIGS. 11 and 12.

The guide member 601 may have one surface 601*a* formed in a downwardly convex shape to protrude a predetermined height from the second guide surface 1S. The guide member 601 may be formed in a curved shape having a predetermined curvature.

According to the embodiment illustrated in FIGS. 15 and 16, when the guide member 601 is at the first position as illustrated in FIG. 15, air being discharged from the outlet 21 is guided in the upward direction by the guide member 601 and is discharged in a substantially horizontal direction. That is, airflow in a direction A which is marked in FIG. 15 may be formed in the outlet 21.

On the other hand, when the guide member 601 is at the second position as illustrated in FIG. 16, because the guide member 601 is concealed in an upper portion of the second guide surface 15, air being discharged from the outlet 21 does not encounter the guide member 601, is guided along the second guide surface 15, and is discharged from the outlet 21. That is, airflow in a direction B which is marked in FIG. 16 may be formed in the outlet 21. Here, because a through-hole 604 is closed by a cover member 605 that has moved by a cover member driving source 606, the through-hole 604 does not affect flow of discharged air.

Figure 17:
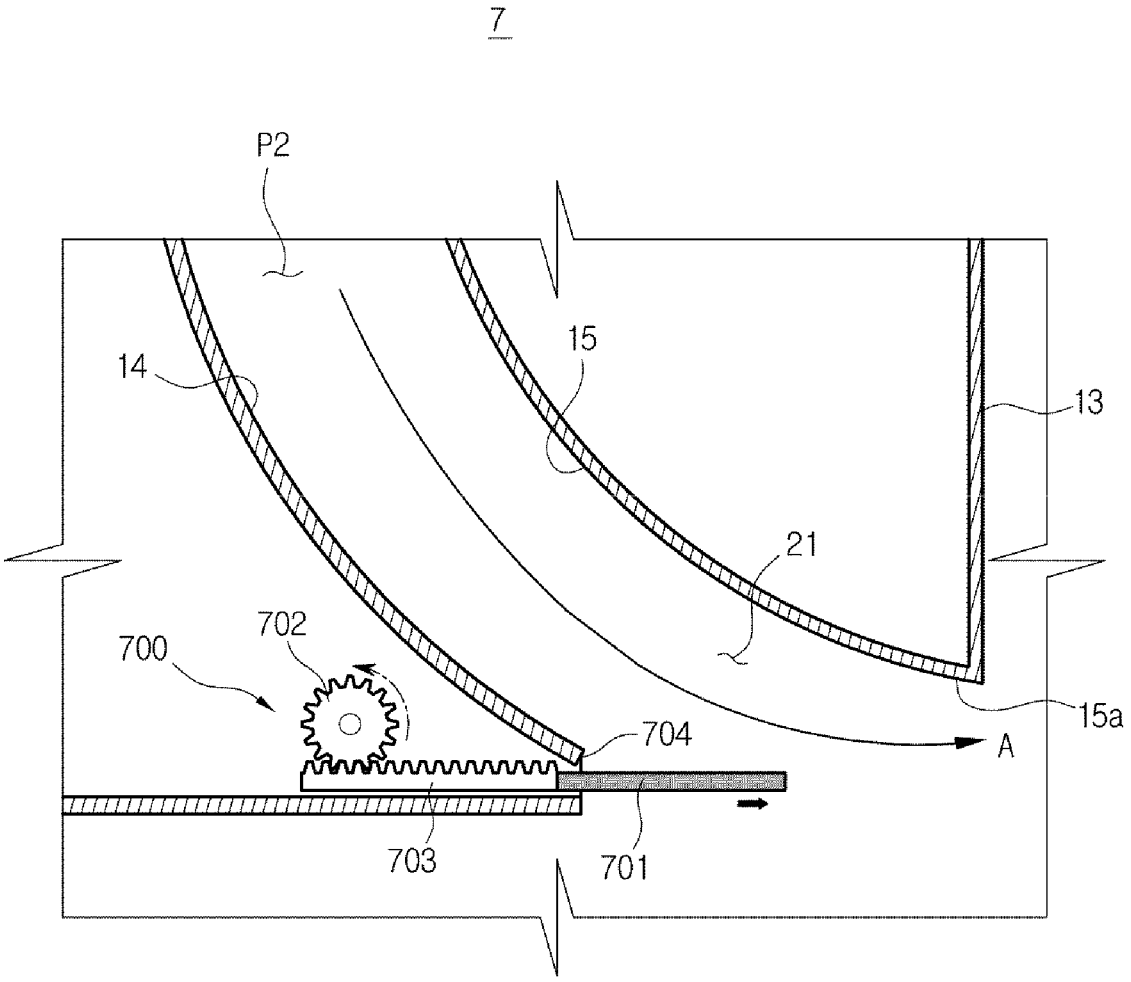
FIGS. 17 and 18 are schematic views illustrating an airflow control unit of an air conditioner according to yet another embodiment of the present disclosure.
Figure 18:
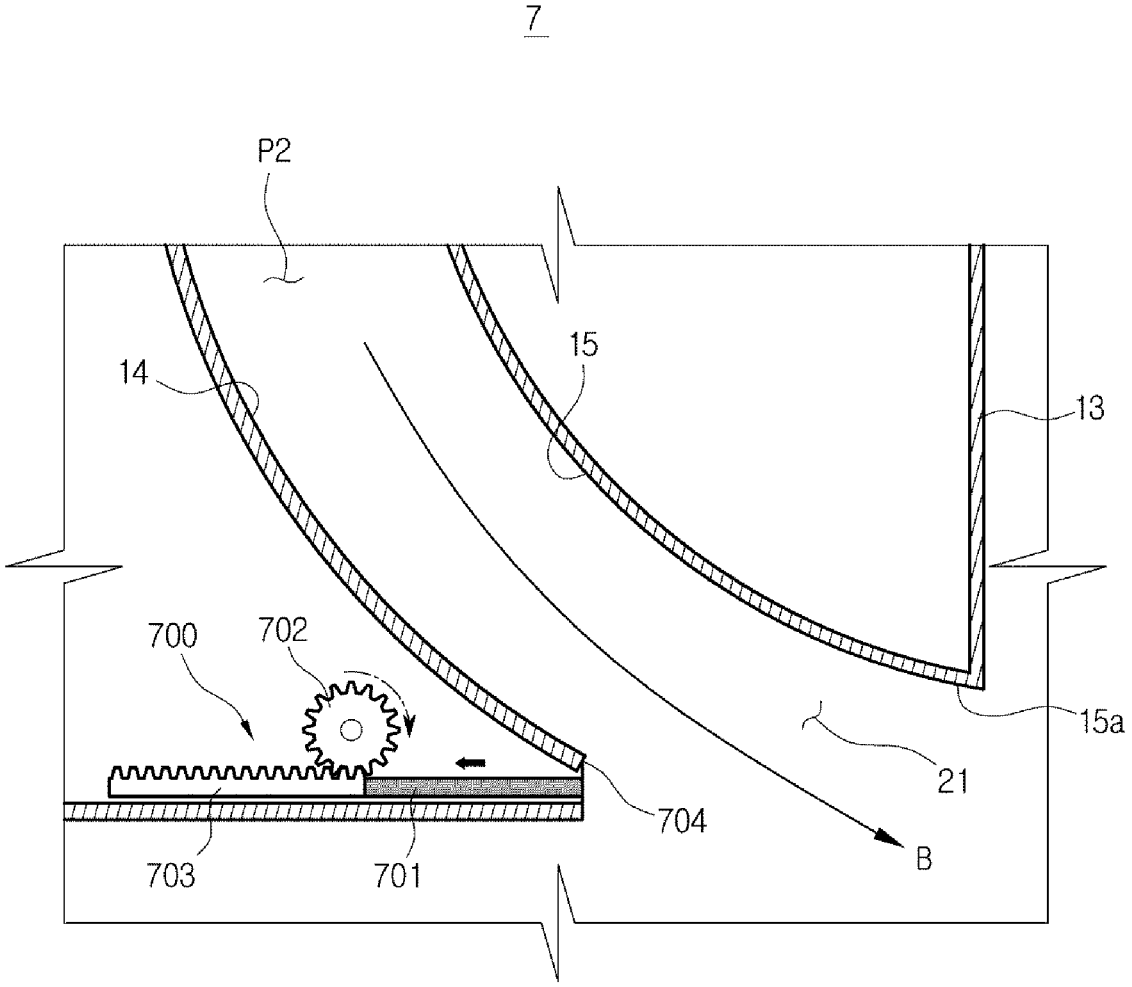

FIGS. 17 and 18 are schematic views illustrating an airflow control unit 700 of an air conditioner 7 according to yet another embodiment of the present disclosure.

The air conditioner 7 according to yet another embodiment of the present disclosure will be described with reference to FIGS. 17 and 18. In describing the embodiment illustrated in FIGS. 17 and 18, like reference numerals may be assigned to elements which are the same as those illustrated in FIGS. 3 and 4, and description thereof may be omitted.

The airflow control unit 700 of the air conditioner 7 is provided at a lower portion of the first guide surface 14, and may protrude in a horizontal direction from one end portion of the outlet 21 from which air is discharged and guide air, or may be concealed in the lower portion of the first guide surface 14 to completely deviate from the outlet 21 and not interfere with air being discharged from the outlet 21.

Unlike in the embodiments described above, the airflow control unit 700 may include a guide member 701 having a flat plate shape instead of a curved shape. The guide member 701 moves between a first position where the guide member 701 guides air being discharged from the outlet 21 by power from an airflow control driving source 702 and a second position where the guide member 701 does not interfere with air being discharged from the outlet 21.

The guide member 701 may include a power transmitter 703 at a portion thereof coming into contact with the airflow control driving source 702 to receive power from the airflow control driving source 702. Specifically, the power transmitter 703 provided at a portion of the guide member 701 may be a rack gear, and a pinion gear may be provided at the airflow control driving source 702. In this case, rotation power of the airflow control driving source 702 is converted into power for linear movement of the guide member 701.

A through-hole 704 may be formed at the lower housing 13 so that the guide member 701 may be inserted into and withdrawn from the through-hole 704.

According to the embodiment illustrated in FIGS. 17 and 18, when the guide member 701 is at the first position as illustrated in FIG. 17, air being discharged from the outlet 21 is guided in the upward direction by the guide member 701 and is discharged in a substantially horizontal direction. That is, airflow in a direction A which is marked in FIG. 17 may be formed in the outlet 21.

On the other hand, when the guide member 701 is at the second position as illustrated in FIG. 18, because the guide member 701 is concealed in the lower portion of the first guide surface 14, air being discharged from the outlet 21 does not encounter the guide member 701, is guided along the first guide surface 14, and is discharged from the outlet 21. That is, airflow in a direction B which is marked in FIG. 18 may be formed in the outlet 21.

Figure 19:
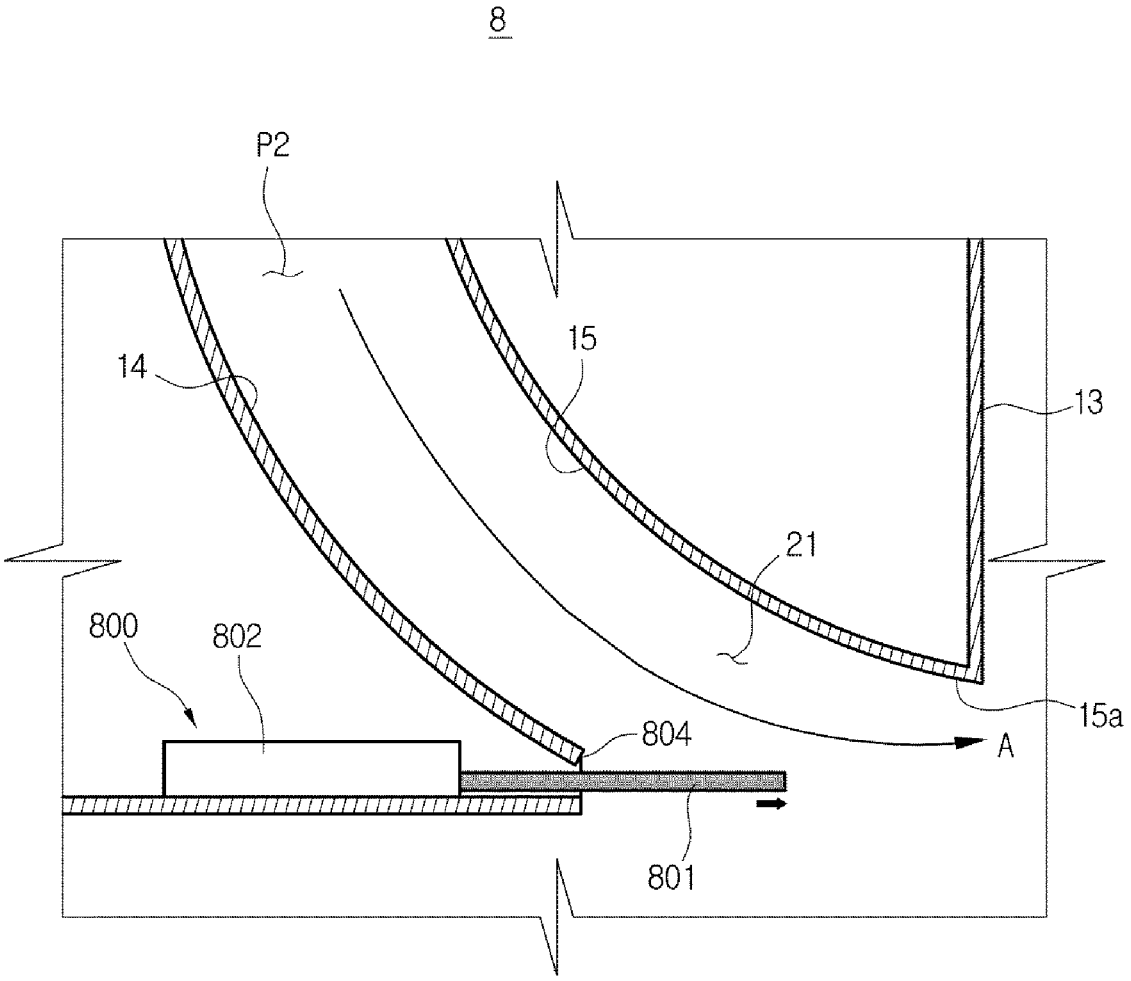
FIGS. 19 and 20 are schematic views illustrating an airflow control unit of an air conditioner according to yet another embodiment of the present disclosure.
Figure 20:
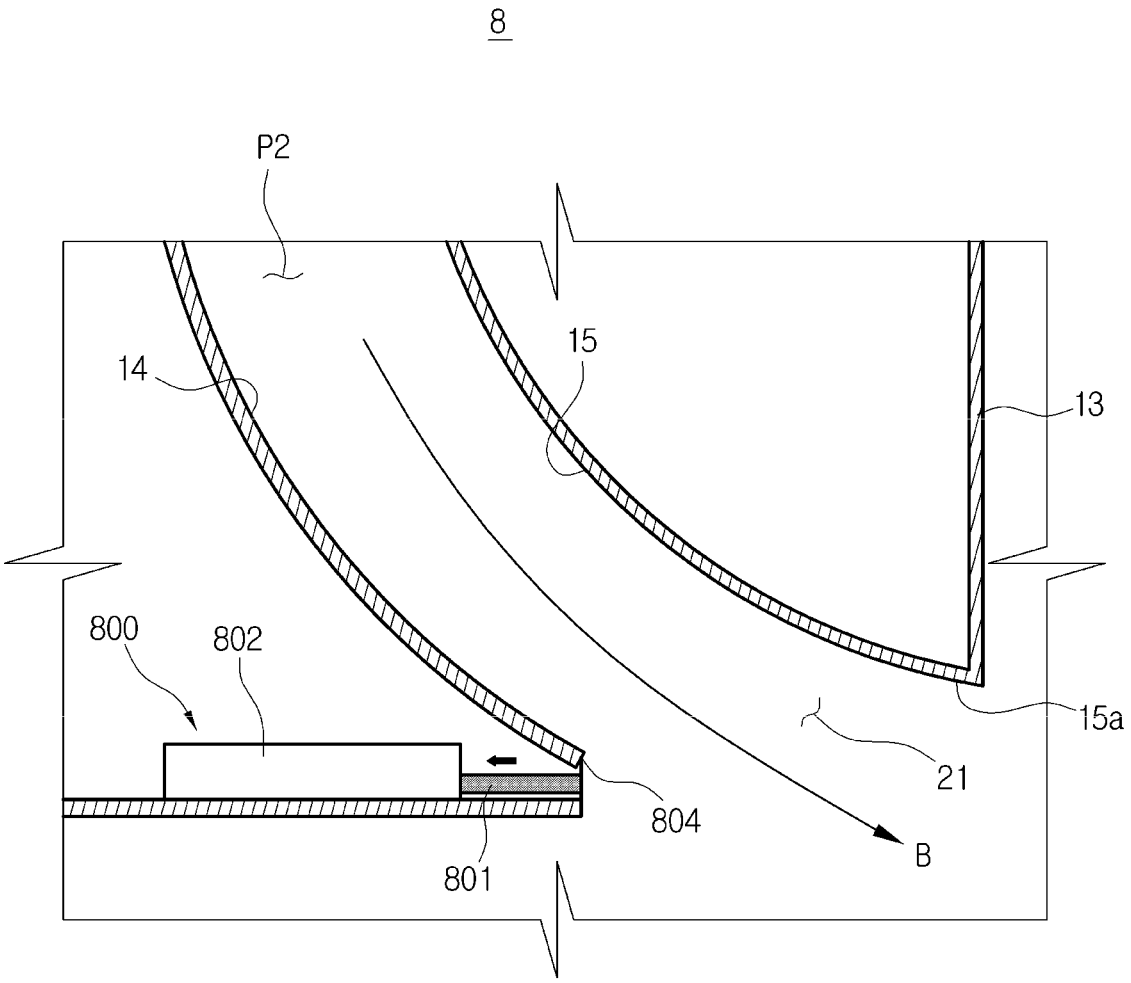

FIGS. 19 and 20 are schematic views illustrating an airflow control unit 800 of an air conditioner 8 according to yet another embodiment of the present disclosure.

The air conditioner 8 according to yet another embodiment of the present disclosure will be described with reference to FIGS. 19 and 20. In describing the embodiment illustrated in FIGS. 19 and 20, like reference numerals may be assigned to elements which are the same as those illustrated in FIGS. 3 and 4, and description thereof may be omitted.

The airflow control unit 800 of the air conditioner 8 may be provided at the lower portion of the first guide surface 14 and use a hydraulic cylinder 802 for moving a guide member 801. Here, the guide member 801 may have a flat shape as in the embodiment illustrated in FIGS. 17 and 18.

The hydraulic cylinder 802 is fixed inside the lower housing 13, and, according to a hydraulic pressure thereof being adjusted, moves the guide member 801 between a first position where the guide member 801 guides air being discharged from the outlet 21 and a second position where the guide member 801 does not interfere with air being discharged from the outlet. That is, the guide member 801 passes through a through-hole 804 and moves to the first position and the second position.

According to the embodiment illustrated in FIGS. 19 and 20, when the guide member 801 is at the first position as illustrated in FIG. 19, air being discharged from the outlet 21 is guided in the upward direction by the guide member 801 and is discharged in a substantially horizontal direction. That is, airflow in a direction A which is marked in FIG. 19 may be formed in the outlet 21.

On the other hand, when the guide member 801 is at the second position as illustrated in FIG. 20, because the guide member 801 is concealed in the lower portion of the first guide surface 14, air being discharged from the outlet 21 does not encounter the guide member 801, is guided along the first guide surface 14, and is discharged from the outlet 21. That is, airflow in a direction B which is marked in FIG. 20 may be formed in the outlet 21.

Figure 21:
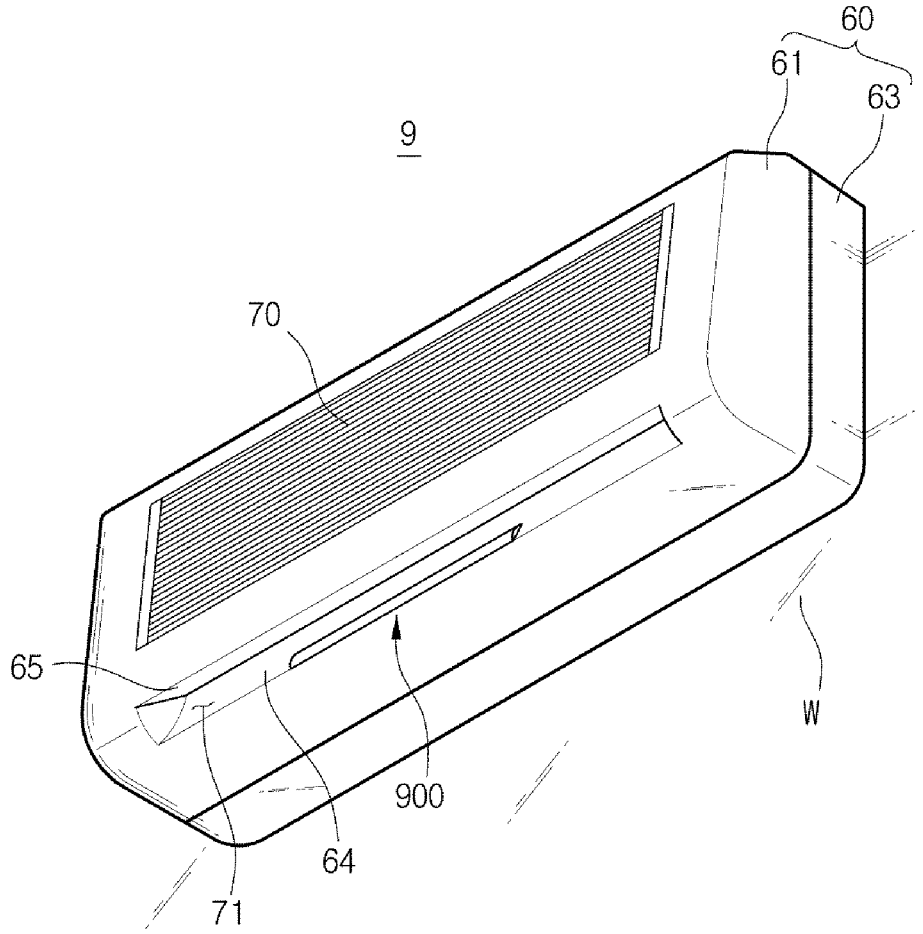
FIG. 21 is a perspective view illustrating an air conditioner according to yet another embodiment of the present disclosure.
Figure 22:
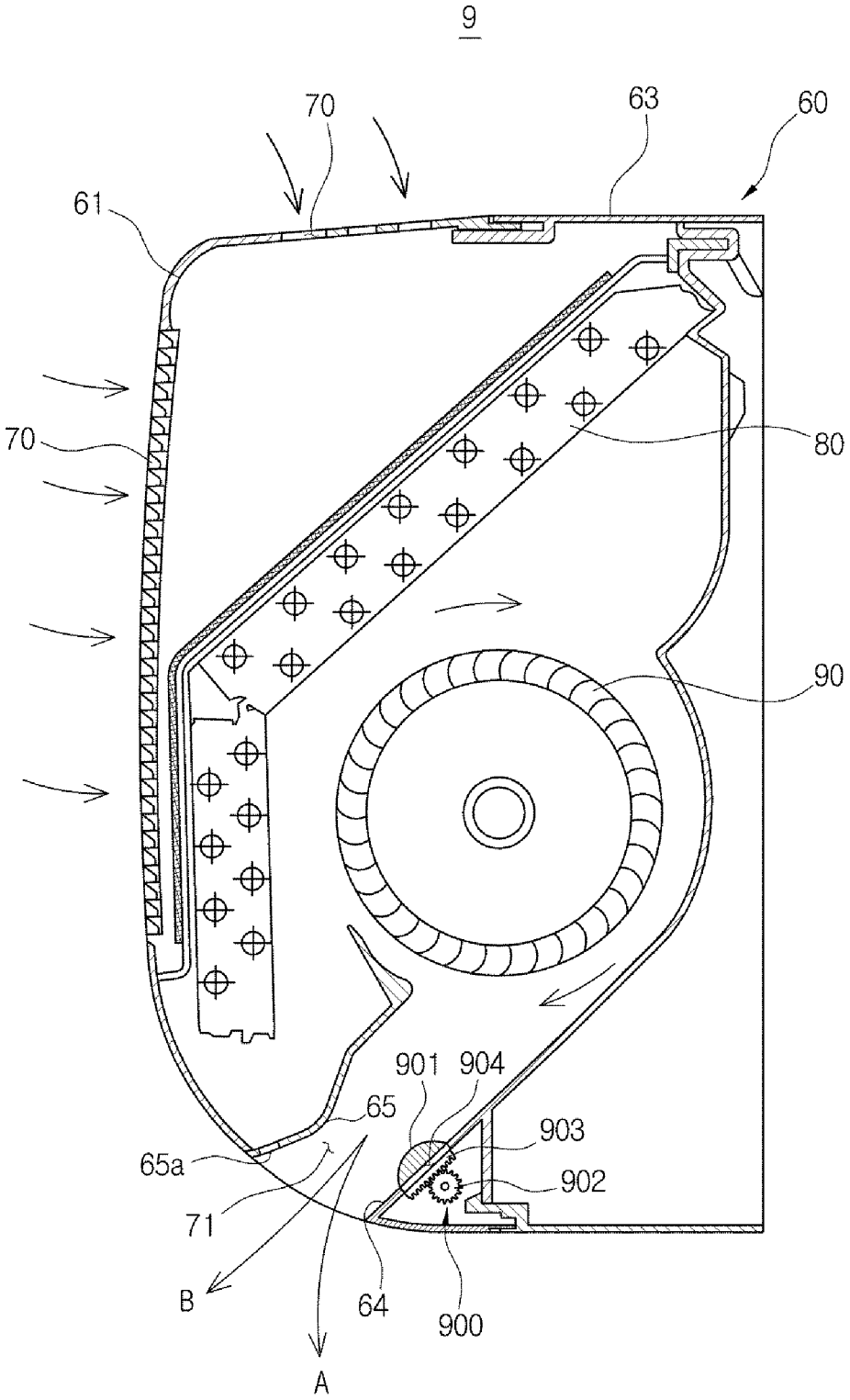
FIG. 22 is a lateral cross-sectional view of the air conditioner illustrated in FIG. 21.

FIG. 21 is a perspective view illustrating an air conditioner 9 according to yet another embodiment of the present disclosure. FIG. 22 is a lateral cross-sectional view of the air conditioner 9 illustrated in FIG. 21.

The air conditioner 9 according to yet another embodiment of the present disclosure will be described with reference to FIGS. 21 and 22. However, in describing the embodiment illustrated in FIGS. 21 and 22, like reference numerals may be assigned to elements which are the same as those in the embodiments described above, and detailed description thereof may be omitted.

The air conditioner 9 may be installed on a wall W. The air conditioner 9 includes a housing 60 having an inlet 70 and an outlet 71, a heat exchanger 80 provided inside the housing 60, and a blower fan 90 configured to circulate air.

The housing 60 may be formed of a rear housing 63 coupled to the wall W and a front housing 61 coupled to a front portion of the rear housing 63.

The inlet 70 having air suctioned therethrough may be formed at a front surface and an upper surface of the front housing 61, and the outlet 71 having air discharged therethrough may be formed at a lower portion of the front housing 61. Consequently, the air conditioner 9 may suction air from front and upper sides, cool or heat the air, and then discharge the air to a lower side.

The housing 60 may have a first guide surface 64 and a second guide surface 65, and the first guide surface 64 and the second guide surface 65 may form the outlet 71.

Referring to FIG. 22, the second guide surface 65 may further include a Coanda curved portion 65*a*. The Coanda curved portion 65*a* may induce airflow being discharged through the outlet 71 to flow in close contact with the Coanda curved portion 65*a*. In FIG. 22, the Coanda curved portion 65*a* may guide air being discharged from the outlet 71 in the upward direction to form substantially horizontal airflow.

The blower fan 90 is arranged inside the housing 60 to circulate air, and may be a cross-flow fan.

The air conditioner 9 may further include an airflow control unit 900 provided at the first guide surface 64 and configured to guide air being discharged from the outlet 71 to control a direction of discharged airflow.

The airflow control unit 900 may include a guide member 901 configured to guide air being discharged from the outlet 71, an airflow control driving source 902 configured to generate power for moving the guide member 901, and a power transmission member 903 configured to transmit power generated by the driving source 902 to the guide member 901.

The guide member 901 may receive power from the airflow control driving device 902 and move between a first position adjacent to one end portion of the outlet 71 from which air is discharged and a second position spaced apart from the end portion of the outlet 71 from which air is discharged. The guide member 901 may move along the first guide surface 64.

When the guide member 901 is at the first position, the guide member 901 may guide air being discharged from the outlet 71 in a downward direction (a direction A in FIG. 22). For this, the guide member 901 may be formed in a curved shape having a predetermined curvature to protrude from the first guide surface 64. When the guide member 901 is at the second position, because the guide member 901 does not interfere with air being discharged from the outlet 71, air being discharged from the outlet 71 may be discharged in a direction B in FIG. 22.

The airflow control driving source 902 and the power transmission member 903 may be provided as a pinion gear and a rack gear, respectively, and the power transmission member 903 may convert rotation power of the airflow control driving source 902 into power for linear movement and move the guide member 901.

Figure 23:
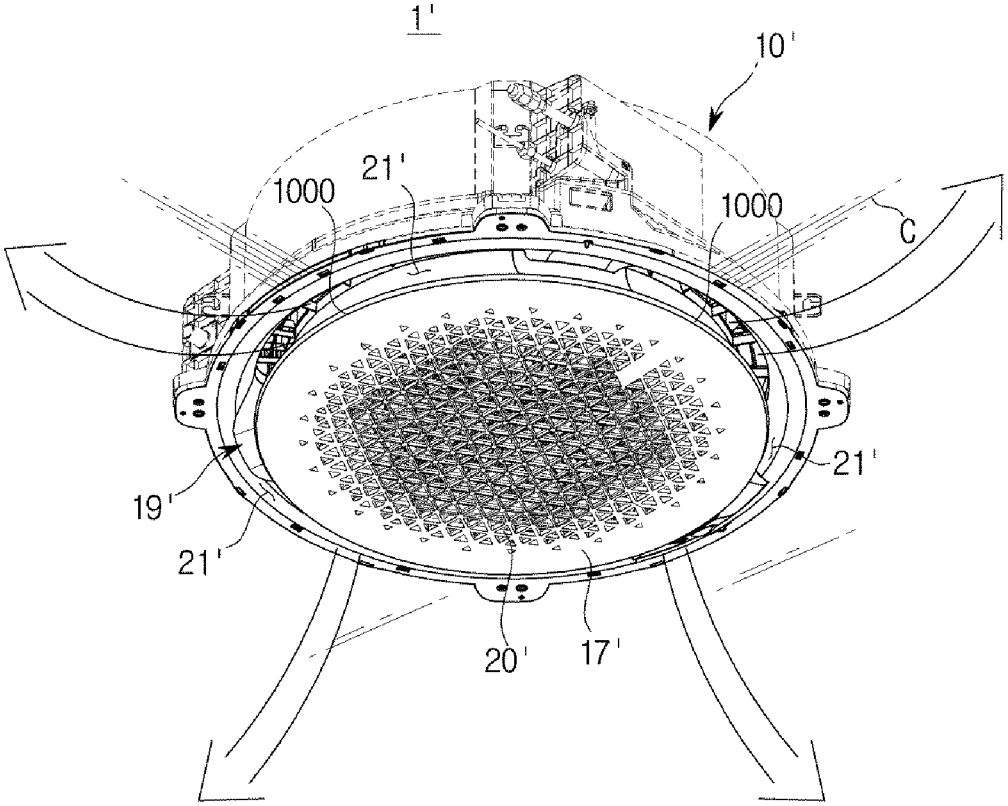
FIG. 23 is a view illustrating an air conditioner according to yet another embodiment of the present disclosure.

FIG. 23 is a view illustrating an air conditioner 1' according to yet another embodiment of the present disclosure. FIGS. 24 to 27 are views illustrating an airflow control unit 1000 illustrated in FIG. 23. FIG. 25 is a view of the airflow control unit 1000 illustrated in FIG. 24 from the top, and FIG. 27 is a view of the airflow control unit 1000 illustrated in FIG. 26 from the top.

The air conditioner 1' according to yet another embodiment of the present disclosure will be described with reference to FIGS. 23 to 25. However, in describing the embodiment illustrated in FIGS. 23 to 25, like reference numerals may be given to elements which are the same as those in the embodiments described above, and detailed description thereof may be omitted.

Referring to FIG. 23, an outlet 21' of the air conditioner 1' may be formed in a circular shape. Accordingly, a housing 10' may also be formed in a circular shape. An inlet 20' may be disposed at a lower portion of the housing 10', a grille 17' may be coupled to the lower portion of the housing 10' to filter dust from air being suctioned into the inlet 20'. The air conditioner 1' may include a lower housing 13', and a Coanda curved portion 15*a*' may be disposed at a second guide plate 15'.

When the outlet 21' is formed in a circular shape and air is discharged in all directions, a relatively high pressure is formed near the outlet 21', and a relatively low pressure is formed near the inlet 20'. Also, because air is discharged in all directions of the outlet 21' and an air curtain is formed, air that should be suctioned into the inlet 20' is unable to be supplied toward the inlet 20'. In this circumstance, air discharged from the outlet 21' is suctioned back into the inlet 20', the re-suctioned air causes dew formation inside the housing 10', loss of discharged air occurs, and perceived performance is degraded.

A bridge 19' according to an embodiment of the present disclosure is provided on the outlet 21' and blocks the outlet 21' by a predetermined length. Accordingly, the outlet 21' may be partitioned into a first section from which air is discharged and a second section blocked by the bridge 19' and from which almost no air is discharged. That is, the bridge 19' may form the second section configured to supply air that will be suctioned into the inlet 20'. Also, the bridge 19' may decrease a pressure difference between the low pressure near the inlet 20' and the high pressure near the outlet 21' and enable air to be smoothly supplied to the inlet 20'.

The air conditioner 1' may further include the airflow control unit 1000 provided at the first guide surface 64 and configured to guide air being discharged from the outlet 21' to control a direction of discharged airflow.

Referring to FIGS. 24 to 27, the airflow control unit 1000 may be provided at a lower portion of a first guide surface 14' and use a cam structure to move a guide member 1001. Here, the guide member 1001 may have a flat plate shape as in the embodiment illustrated in FIGS. 17 and 18.

Figure 24:
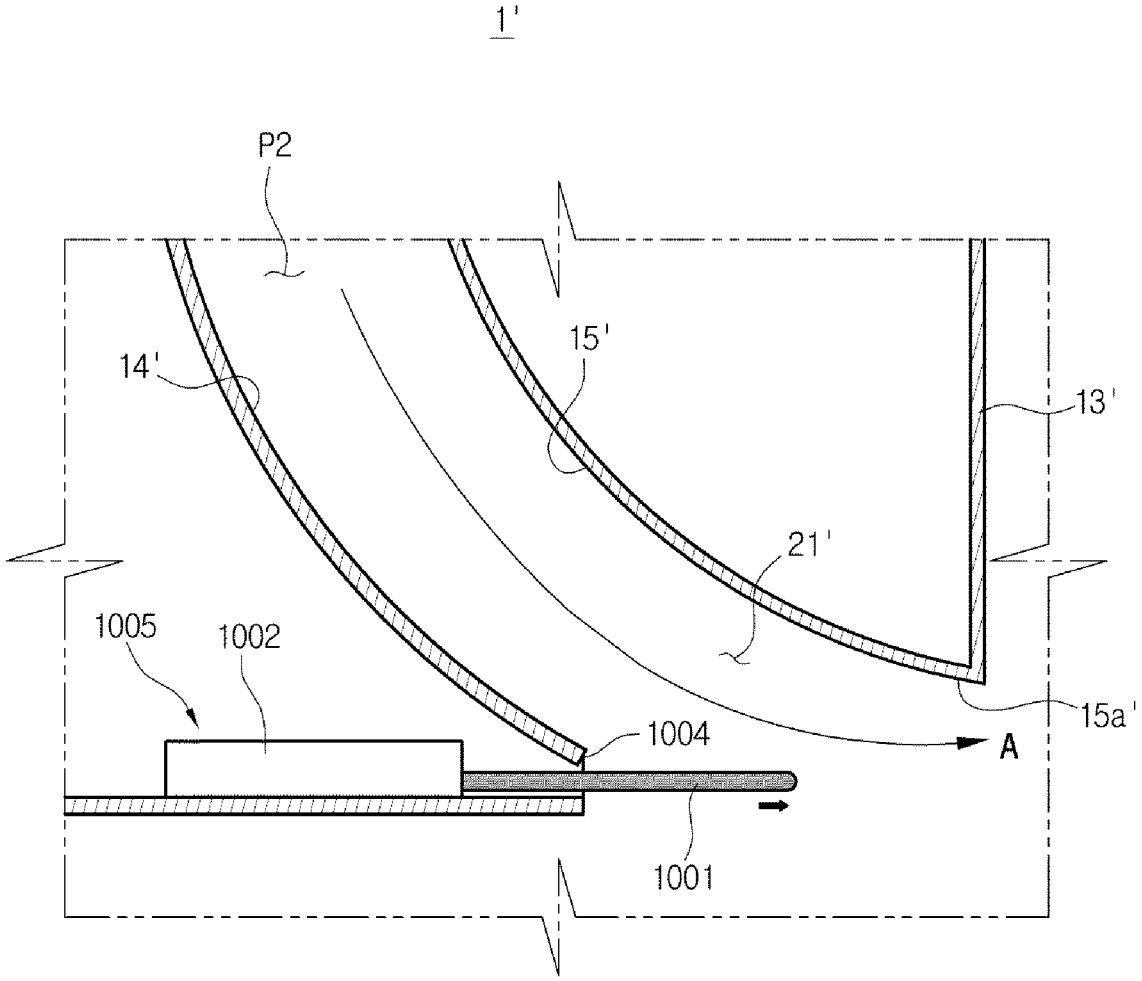
FIGS. 24 to 27 are views illustrating an airflow control unit illustrated in FIG. 23.
Figure 25:
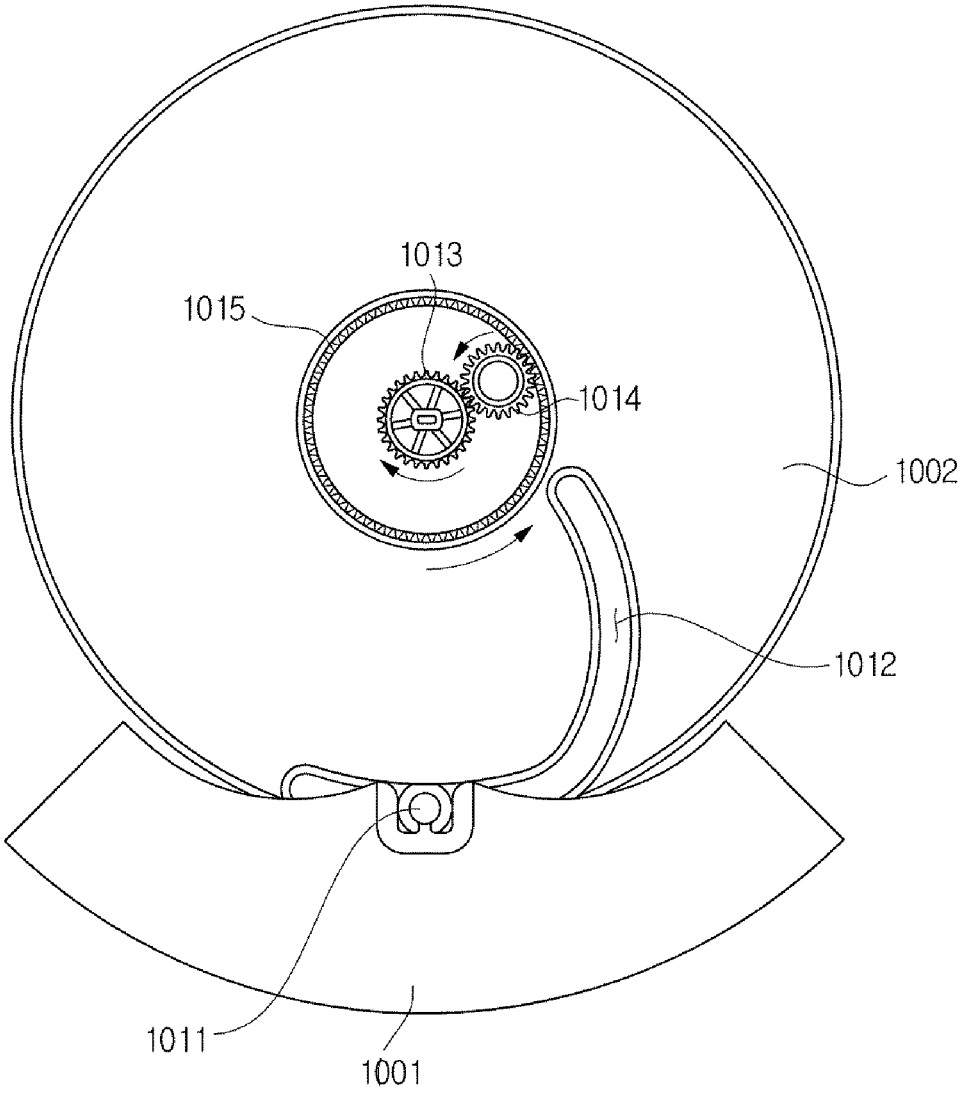
Figure 26:
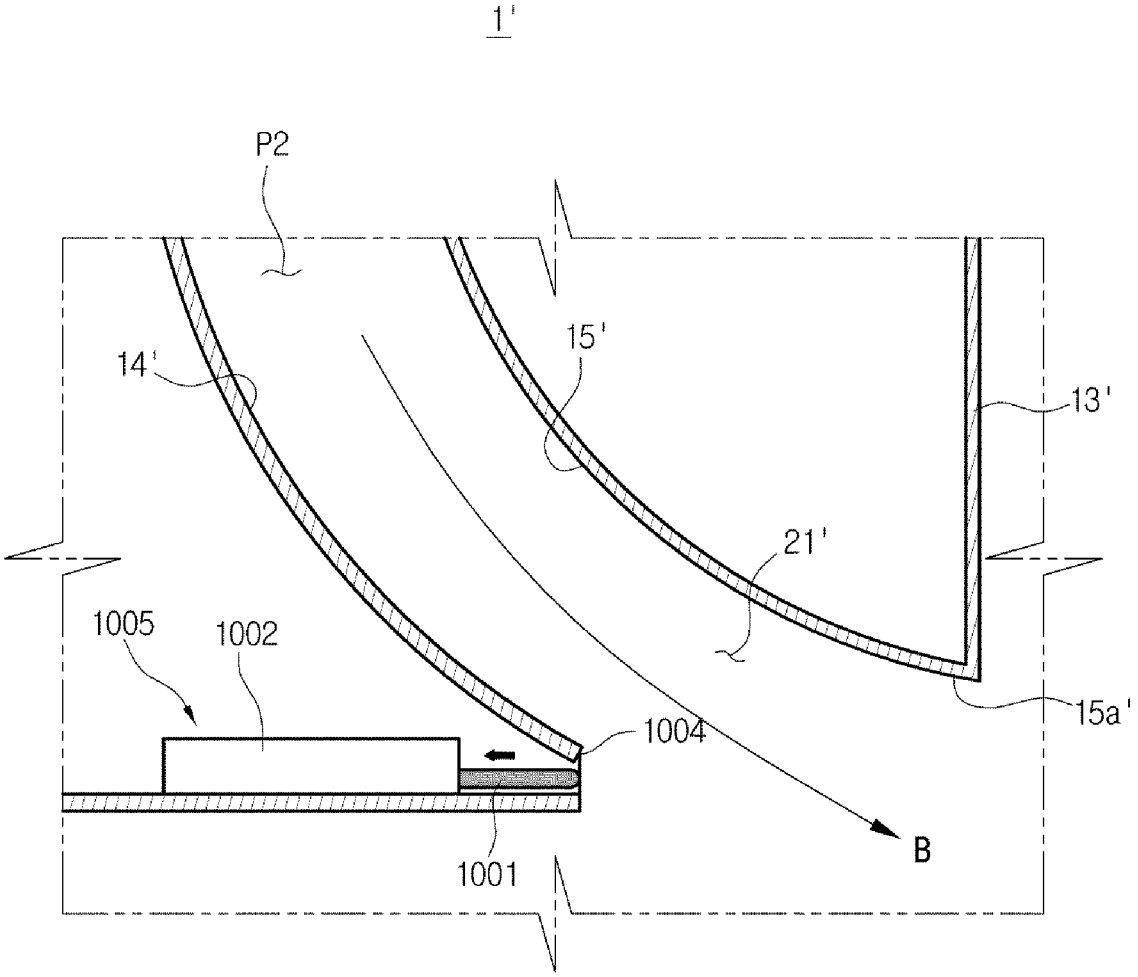
Figure 27:
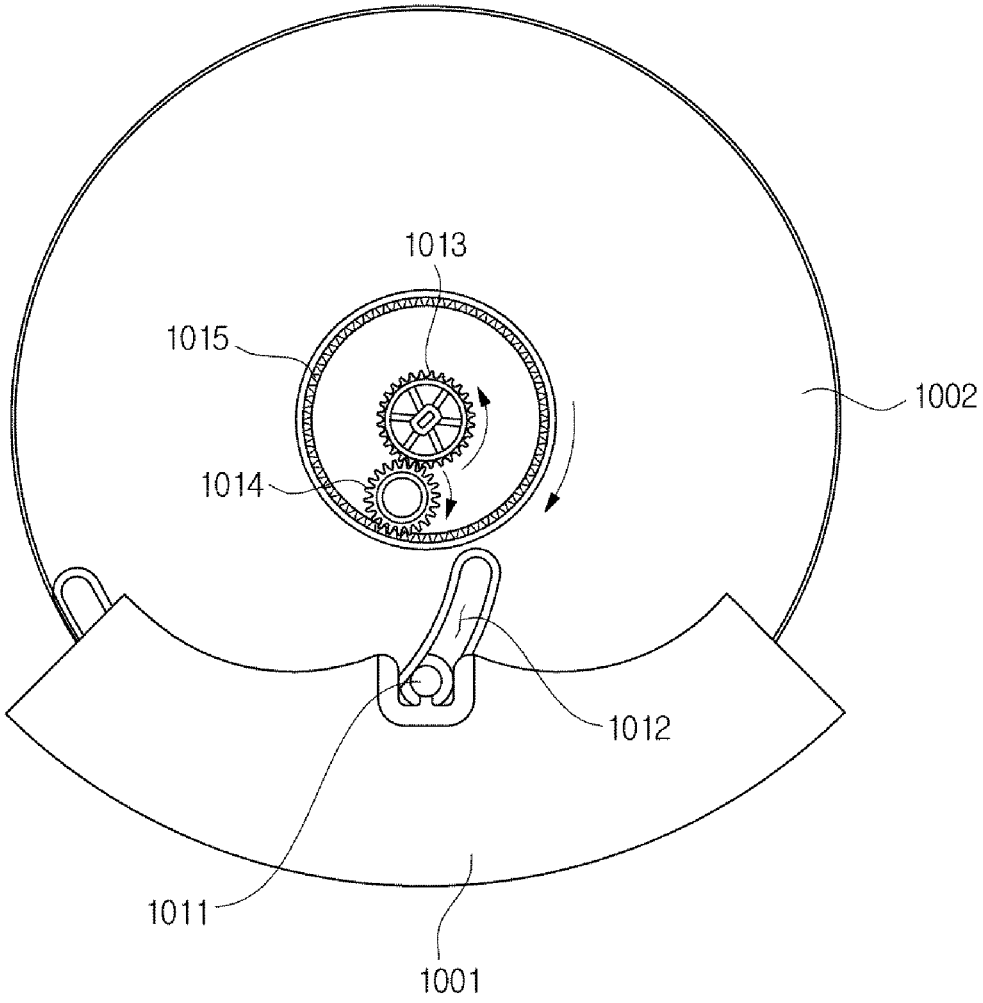

The guide member 1001 may pass through a through-hole 1004 and move to a first position illustrated in FIG. 24 or a second position illustrated in FIG. 26 to control airflow discharged from the outlet 21'. The guide member 1001 may include a guide shaft 1011 inserted into a guide hole 1012 which will be described below, and the guide shaft 1011 may slide inside the guide hole 1012.

A guide surface 1002 includes the guide hole 1012, a first gear 1013, a second gear 1014, and an inner circumferential gear 1015 to move the guide member 1001 to the first position or the second position.

The guide hole 1012 has the guide shaft 1011 sliding therein and is formed in a curved line to move the guide member 1001 to the first position or the second position.

The first gear 1013 may be fixed in the housing 10', receive power from a driving source (not illustrated), and rotate. The second gear 1014 receives power from the first gear 1013 and transmits power to the inner circumferential gear 1015 which will be described below. The inner circumferential gear 1015 may receive power from the second gear 1014 and rotate.

That is, the first gear 1013 starts to rotate clockwise to move the guide member 1001 from a state in which airflow being discharged from the outlet 21' is not controlled as illustrated in FIGS. 26 and 27 to a state illustrated in FIGS. 24 and 25 in which air being discharged from the outlet 21' is controlled. Accordingly, the second gear 1014 rotates counterclockwise. Accordingly, the inner circumferential gear 1015 rotates counterclockwise. Accordingly, the guide shaft 1011 may slide in the guide hole 1012 and move from the second position to the first position.

On the other hand, the first gear 1013 rotates counterclockwise to move the guide member 1001 from the state in which airflow being discharged from the outlet 21' is controlled as illustrated in FIG. 25 to a state illustrated in FIG. 27 in which discharged airflow is not controlled. Accordingly, the second gear 1014 rotates clockwise. Accordingly, the inner circumferential gear 1015 rotates clockwise. Accordingly, the guide shaft 1011 may slide in the guide hole 1012 and move from the first position to the second position.

Furthermore, applying structures of the airflow controls units 100, 200, 300, 400, 500, 600, 700, and 800 illustrated in FIGS. 3, 4, 6 to 20 described above to the air conditioner 1' having the outlet 21' formed in a circular shape illustrated in FIG. 23 is also possible. As described above, because the air conditioners 1, 2, 3, 4, 5, 6, 7, 8, 9, and 1' according to the present disclosure may control discharged airflow without a blade, an amount of discharged air and flow noise may be reduced.

Figure 28:
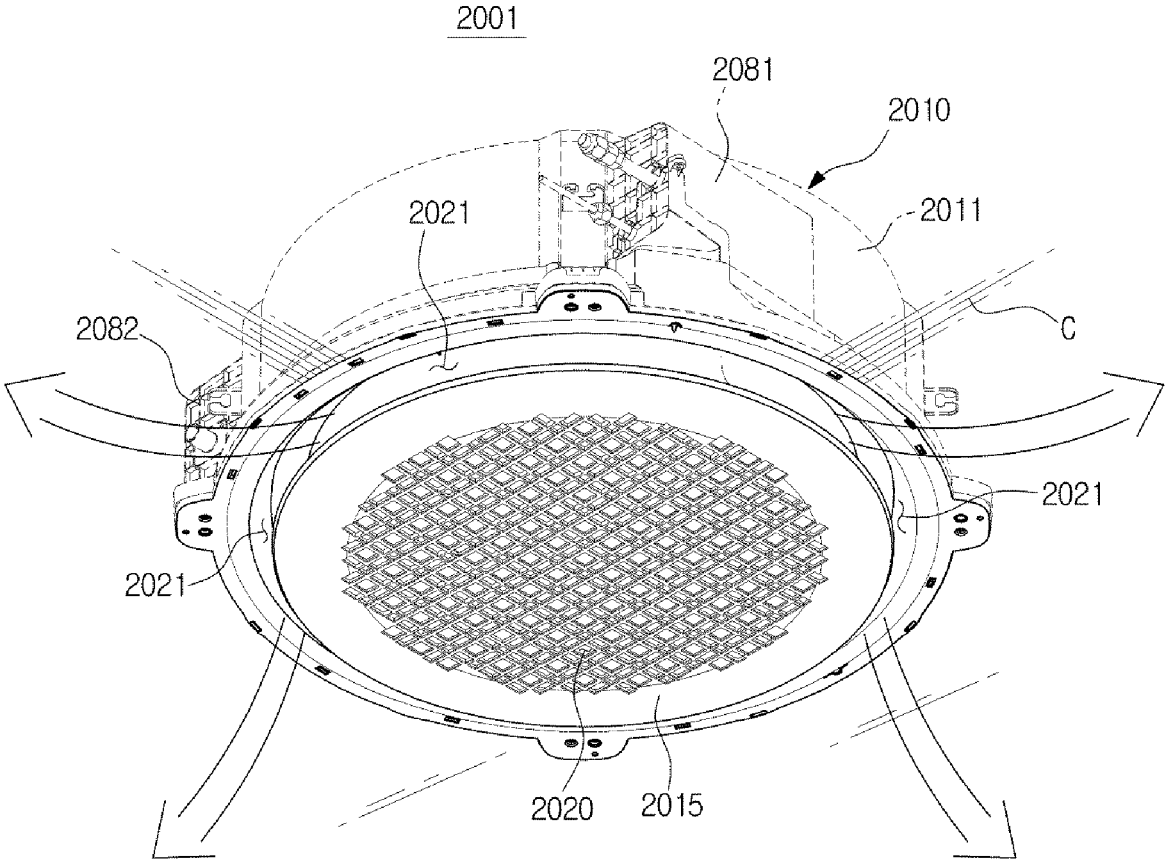
FIG. 28 is a perspective view of an air conditioner according to yet another embodiment of the present disclosure.
Figure 29:
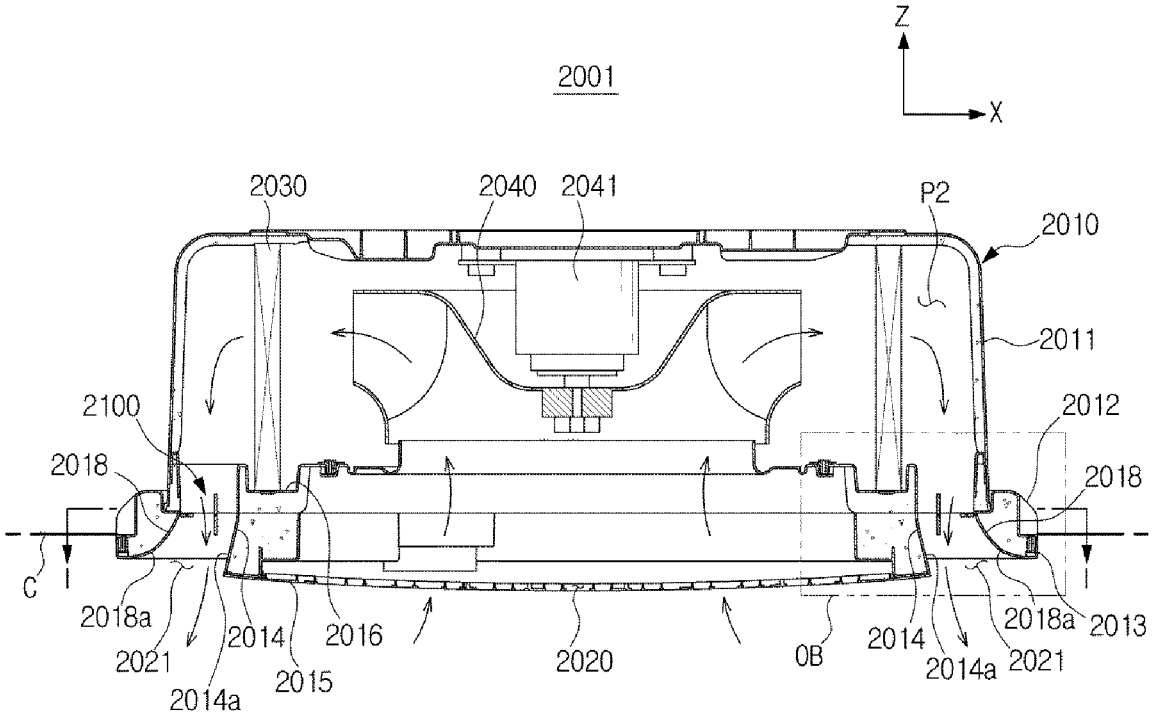
FIG. 29 is a lateral cross-sectional view of the air conditioner illustrated in FIG. 28.
Figure 30:
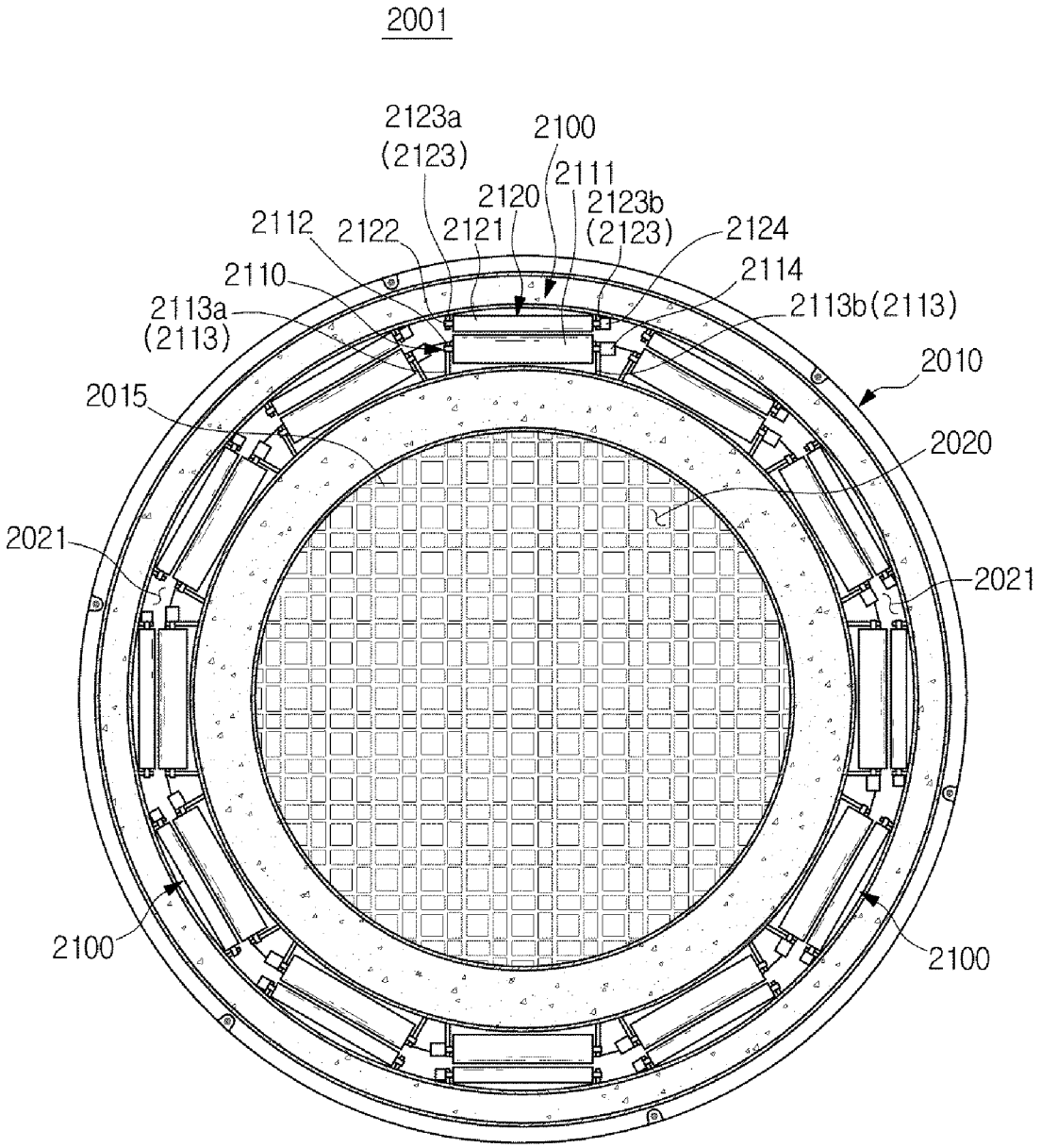
FIG. 30 is a cross-sectional view taken along line-I marked in FIG. 29.

FIG. 28 is a perspective view of an air conditioner 2001 according to yet another embodiment of the present disclosure. FIG. 29 is a lateral cross-sectional view of the air conditioner 2001 illustrated in FIG. 28. FIG. 30 is a cross-sectional view taken along line-I marked in FIG. 29.

Referring to FIGS. 28 to 30, the air conditioner 2001 according to yet another embodiment of the present disclosure will be described.

The air conditioner 2001 may be installed in a ceiling C. At least a portion of the air conditioner 2001 may be buried in the ceiling C.

The air conditioner 2001 may include a housing 2010 having an inlet 2020 and an outlet 2021, a heat exchanger 2030 provided inside the housing 2010, and a blower fan 2040 configured to circulate air.

The housing 2010 may have a substantially circular shape when viewed in the vertical direction. However, the shape of the housing 2010 is not limited thereto, and the housing 2010 may also have an elliptical shape or a polygonal shape. The housing 2010 may be formed of an upper housing 2011 arranged inside the ceiling C, a middle housing 2012 coupled to the bottom of the upper housing 2011, and a lower housing 2013 coupled to the bottom of the middle housing 2012.

An inlet 2020 having air suctioned therethrough may be formed at a central portion of the lower housing 2013, and an outlet 2021 having air discharged therethrough may be formed at outside in a radial direction of the inlet 2020. The outlet 2021 may have a substantially circular shape when viewed in the vertical direction. However, the outlet 2021 is limited thereto and may also include a curved section.

By the above structure, the air conditioner 2001 may suction air from a lower side, cool and heat the air, and then discharge the air back to the lower side.

The lower housing 2013 may have a first guide surface 2014 and a second guide surface 2018 forming the outlet 2021. The first guide surface 2014 may be provided adjacent to the inlet 2020, and the second guide surface 2018 may be provided to be more spaced apart from the inlet 2020 than the first guide surface 2014. The first guide surface 2014 and/or the second guide surface 2018 may include Coanda curved portions 2014*a* and 2018*a* provided at one end portion along a direction in which air is being discharged and configured to guide air being discharged through the outlet 2021. The Coanda curved portions 2014*a* and 2018*a* may induce airflow being discharged through the outlet 2021 to flow in close contact with the Coanda curved portions 2014*a* and 2018*a*.

The first guide surface 2014 and the second guide surface 2018 will be described in detail below together with an airflow control device 2100 which will be described below.

A grille 2015 may be coupled to a bottom surface of the lower housing 2013 to filter dust from air being suctioned into the inlet 2020.

The heat exchanger 2030 may be provided inside the housing 2010 and arranged on a flow passage of air between the inlet 2020 and the outlet 2021. The heat exchanger 2030 may be formed of a tube (not illustrated) having refrigerant flow therethrough and a header (not illustrated) connected to an external refrigerant tube to supply or recover refrigerant to or from the tube. A heat-exchange fin may be provided in the tube to expand a heat dissipation area.

The heat exchanger 2030 may have a substantially circular shape when viewed in the vertical direction. The shape of the heat exchanger 2030 may correspond to the shape of the housing 2010. The shape of the heat exchanger 2030 may correspond to the shape of the outlet 2021. The heat exchanger 2030 may be placed on a drain tray 2016, and condensate generated in the heat exchanger 2030 may be collected in the drain tray 2016.

The blower fan 2040 may be provided inside in a radial direction of the heat exchanger 2030. The blower fan 2040 may be a centrifugal fan configured to suction air in an axial direction and discharge air in a radial direction. A blower motor 2041 configured to drive the blower fan 2040 may be provided in the air conditioner 2001.

By the above configuration, the air conditioner 2001 may suction air from an indoor space, cool the air, and then discharge the air back to the indoor space, or suction air from an indoor space, heat the air, and then discharge the air back to the indoor space.

The air conditioner 2001 may further include a heat exchanger pipe 2081 connected to the heat exchanger 2030 and having refrigerant flow therethrough, and a drain pump 2082 configured to discharge condensate collected in the drain tray 2016 to the outside. The heat exchanger pipe 2081 may be seated on a heat exchanger pipe seating portion (not illustrated) provided at the drain tray 2016, and the drain pump 2082 may be seated on a drain pump seating portion (not illustrated) provided at the drain tray 2016.

Referring to FIGS. 29 and 30, the air conditioner 2001 may include the airflow control device 2100 configured to control discharged airflow of air being discharged from the outlet 2021.

The airflow control device 2100 may be arranged at a substantially upstream portion of the outlet 2021 not to be exposed when the air conditioner 2001 is viewed from the outside. The airflow control device 2100 may be arranged on the flow passage P2 through which air that has passed through the heat exchanger 2030 is discharged. The airflow control device 2100 may be arranged at a portion where the first guide surface 2014 and the second guide surface 2018 forming the outlet 2021 start. The airflow control device 2100 may be provided at a position at which air that has passed through the heat exchanger 2030 is introduced into the first guide surface 2014 or the second guide surface 2018.

A plurality of airflow control devices 2100 may be provided along a circumferential direction of the outlet 2021. Although twelve airflow control devices 2100 are illustrated in FIG. 30 as being provided, the number of airflow control devices 2100 is not limited thereto. Eleven or less or thirteen or more airflow control devices 2100 may be provided, or only one airflow control device 2100 may be provided.

Figure 31:
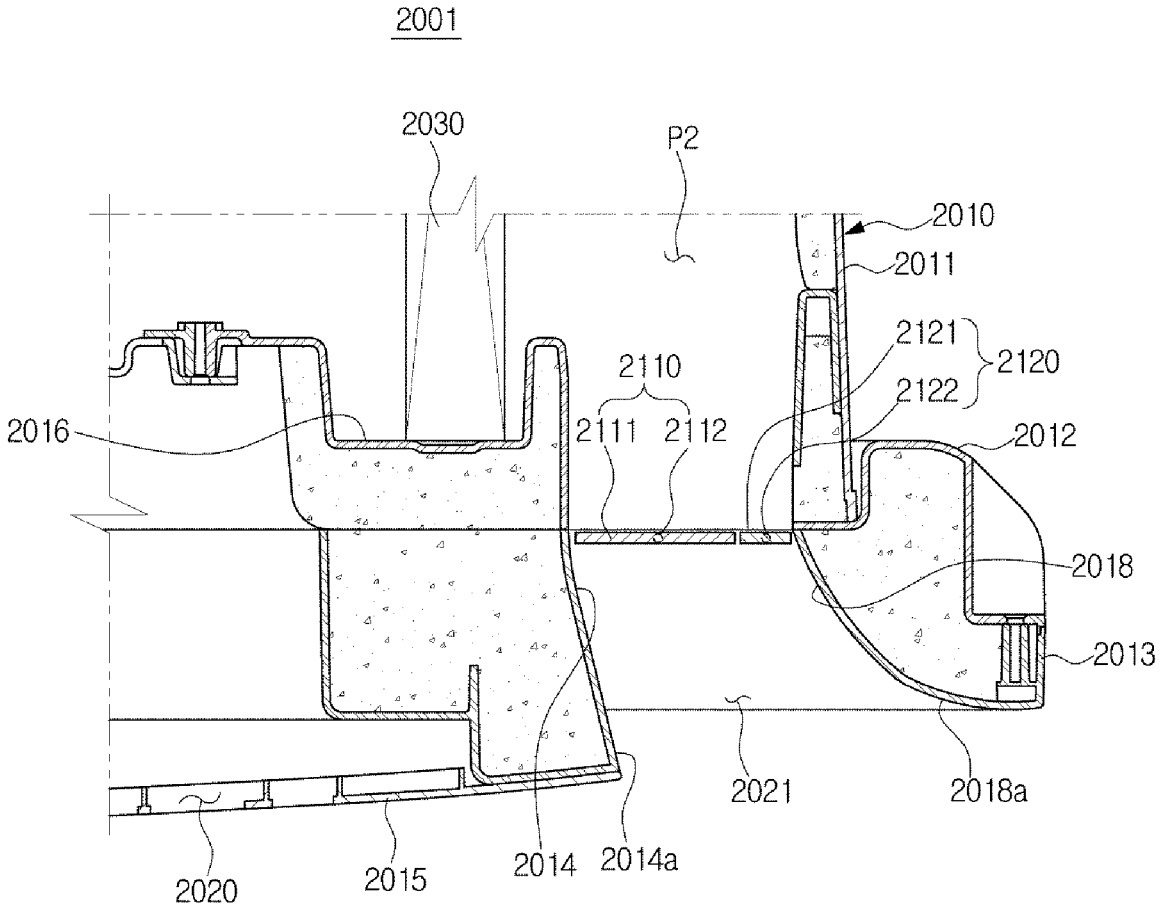
FIG. 31 is an enlarged view of a portion OB marked in FIG. 29.
Figure 32:
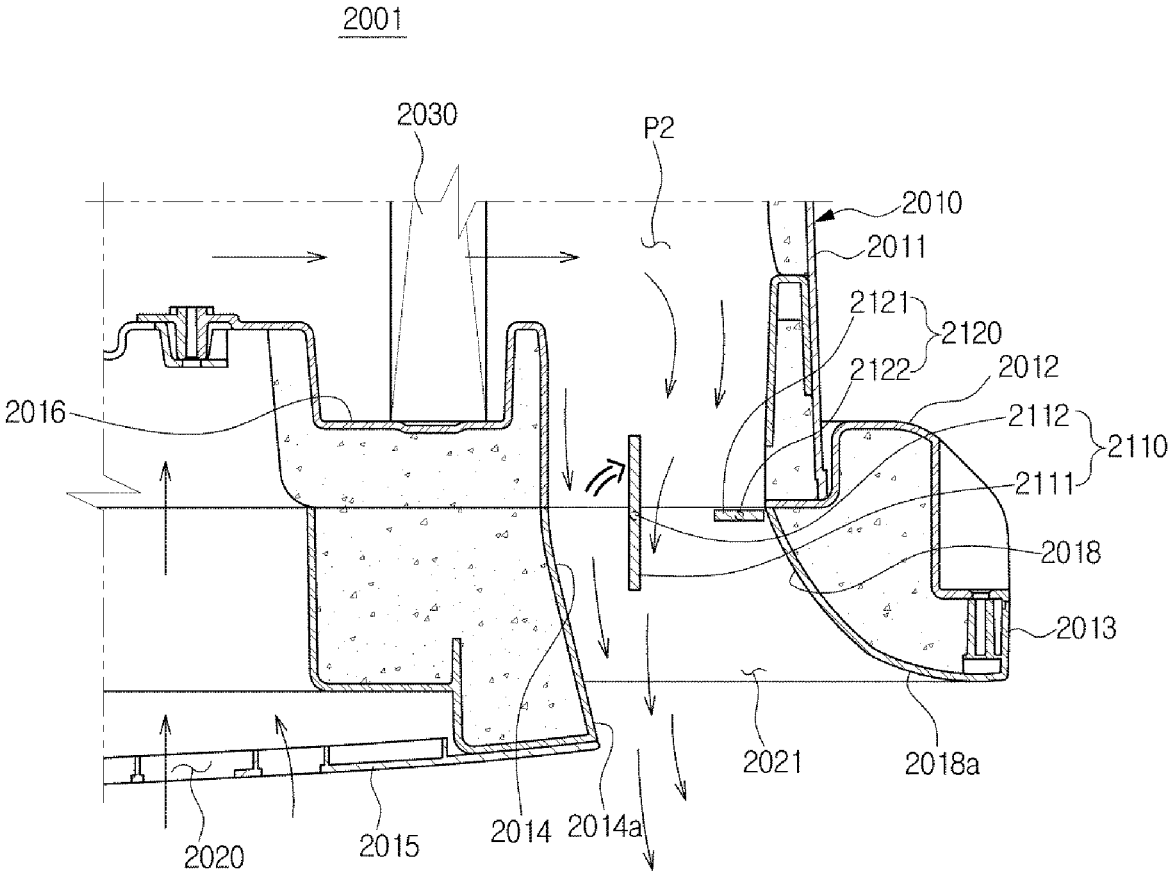
FIGS. 32 and 33 are views illustrating discharged airflow from the air conditioner illustrated in FIG. 28.
Figure 33:
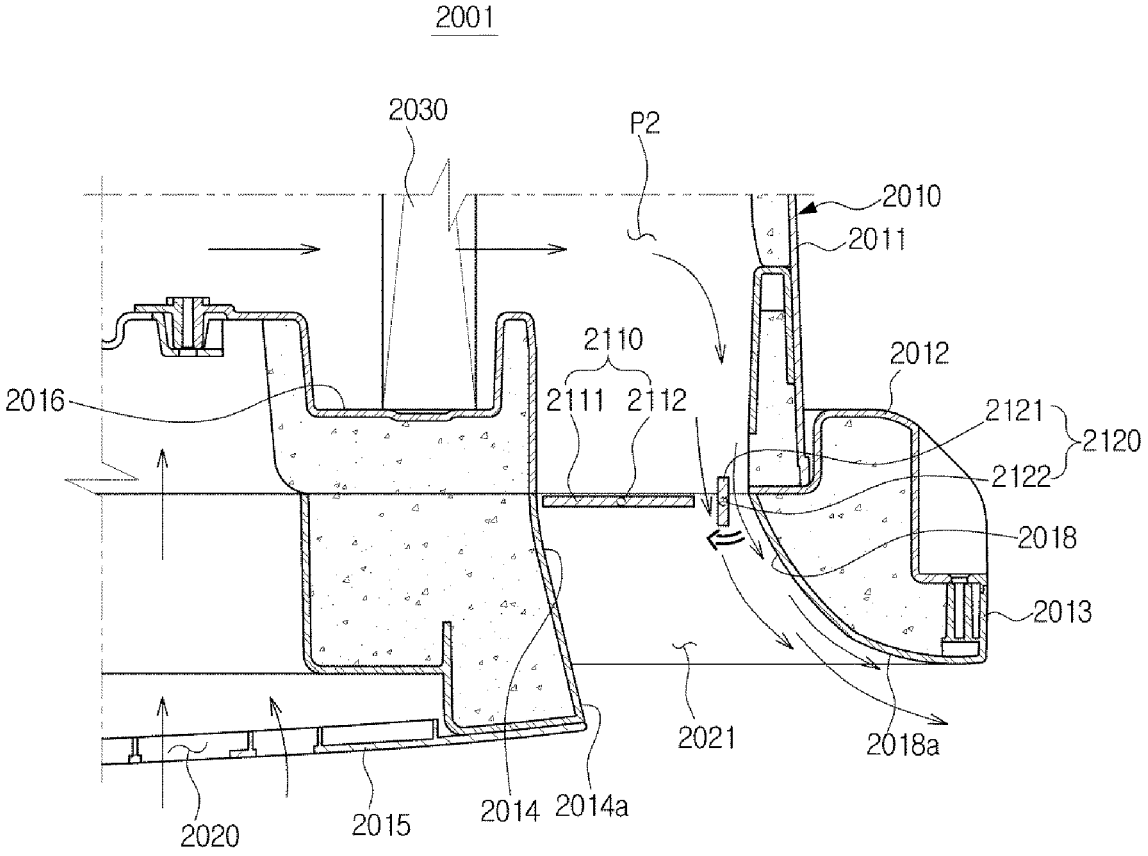

The airflow control device 2100 may include a first damper 2110 configured to open an inner portion along the radial direction of the outlet 2021 and a second damper 2120 configured to open an outer portion along the radial direction of the outlet 2021. Although a size of the second damper 2120 is illustrated in FIG. 31 as being smaller than that of the first damper 2110, embodiments are not limited thereto. The size of the first damper 2110 and the size of the second damper 2120 may be the same, or, conversely, the size of the first damper 2110 may be provided to be smaller than that of the second damper 2120. Furthermore, the first damper 2110 and the second damper 2120 may be driven independent of each other or driven dependent on each other. Also, as illustrated in FIGS. 32 and 33, the first damper 2110 and the second damper 2120 may be driven to only partially open the outlet 2021. Although not illustrated, the first damper 2110 and the second damper 2120 may also simultaneously open the outlet 2021 completely.

The first damper 2110 may be provided inside in the radial direction of the outlet 2021 on the outlet 2021. The first damper 2110 may be provided adjacent to the first guide surface 2014. The first damper 2110 may open a portion of the outlet 2021 so that air that has passed through the heat exchanger 2030 may flow toward the inside in the radial direction of the outlet 2021. The first damper 2110 may include a first opening-and-closing member 2111 configured to selectively open or close a portion of the outlet 2021, a first damper shaft 2112 having the first opening-and-closing member 2111 fixed and coupled thereto, a first shaft support member 2113 configured to rotatably support the first damper shaft 2112, and a first shaft driver 2114 configured to rotate the first damper shaft 2112.

The first opening-and-closing member 2111 may be provided to be rotatable on the outlet 2021 about the first damper shaft 2112 as a rotation axis. A plurality of first opening-and-closing members 2111 may be provided to be spaced apart at predetermined intervals along the circumferential direction of the outlet 2021. Referring to FIG. 30, although the plurality of first opening-and-closing members 2111 are illustrated as being arranged at equal intervals, embodiments are not limited thereto, and the first opening-and-closing members 2111 may also be arranged at different intervals.

The first opening-and-closing member 2111 may be fixed and coupled to the first damper shaft 2112. The first opening-and-closing member 2111 may rotate about the first damper shaft 2112, extending in a direction similar to the circumferential direction of the outlet 2021, as a rotation axis. Accordingly, the first opening-and-closing member 2111 may selectively open or close a portion of the inside along the radial direction of the outlet 2021.

The first damper shaft 2112 may extend along a rotation axis of the first opening-and-closing member 2111. A plurality of first damper shafts 2112 may be provided to be spaced apart at predetermined intervals along the circumferential direction of the outlet 2021. Like the plurality of first opening-and-closing members 2111 described above, the plurality of first damper shafts 2112 may be arranged at equal intervals or arranged at different intervals. Because the plurality of first damper shafts 2112 are respectively fixed and coupled to the plurality of first opening-and-closing members 2111, the plurality of first damper shafts 2112 may be arranged to correspond to arrangement of the plurality of first opening-and-closing members 2111.

The first damper shaft 2112 may rotate while one end thereof is rotatably connected to the first shaft support member 2113 and supported by the first shaft support member 2113. Also, the first damper shaft 2112 may have the other end connected to the first shaft driver 2114. The first shaft driver 2114 may include a driving source (not illustrated) configured to generate power for rotating the first damper shaft 2112. Accordingly, the first damper shaft 2112 may receive power from the first shaft driver 2114 and rotate.

The first shaft support member 2113 may include a first shaft supporter **2113*a* directly connected to the first damper shaft 2112 and configured to directly support the first damper shaft 2112, and a second shaft supporter 2113*b* connected to the first shaft driver 2114 and configured to indirectly support the first damper shaft 2112**.

The first shaft supporter **2113*a* may have one end portion connected to the housing 2010 and the other end portion rotatably connected to the first damper shaft 2112 and may rotatably support the first damper shaft 2112. Specifically, the first shaft supporter 2113*a* may have one end portion supported by being connected to an inner surface of the outlet 2021**.

The second shaft supporter **2113*b* may have one end portion connected to the housing 2010 and the other end portion connected to the first shaft driver 2114 and may support the first shaft driver 2114. Specifically, the second shaft supporter 2113***b* may have one end portion supported by being connected to the inner surface of the outlet 2021. That is, the second shaft supporter 2113*b* may indirectly support the second damper shaft 2112.

The second damper 2120 may be provided outside in the radial direction of the outlet 2021 on the outlet 2021. The second damper 2120 may be provided to selectively open or close the remaining portion of the outlet 2021 that is not opened or closed by the first damper 2110. The second damper 2120 may be provided adjacent to the second guide surface 2018. The second damper 2120 may open a portion of the outlet 2021 so that air that has passed through the heat exchanger 2030 may flow toward the outside in the radial direction of the outlet 2021. The second damper 2120 may include a second opening-and-closing member 2121 configured to selectively open or close a portion of the outlet 2021, a second damper shaft 2122 having the second opening-and-closing member 2121 fixed and coupled thereto, a second shaft support member 2123 configured to rotatably support the second damper shaft 2122, and a second shaft driver 2124 configured to rotate the second damper shaft 2122.

The second opening-and-closing member 2121 may be provided to be rotatable on the outlet 2021 about the second damper shaft 2112 as a rotation axis. A plurality of second opening-and-closing members 2121 may be provided to be spaced apart at predetermined intervals along the circumferential direction of the outlet 2021. Referring to FIG. 30, although the plurality of second opening-and-closing members 2121 are illustrated as being arranged at equal intervals, embodiments are not limited thereto, and the second opening-and-closing members 2121 may also be arranged at different intervals.

The second opening-and-closing member 2121 may be fixed and coupled to the second damper shaft 2122. The second opening-and-closing member 2121 may rotate about the second damper shaft 2122, extending in a direction similar to the circumferential direction of the outlet 2021, as a rotation axis. Accordingly, the second opening-and-closing member 2121 may selectively open or close a portion of the outside along the radial direction of the outlet 2021.

The second damper shaft 2122 may extend along a rotation axis of the second opening-and-closing member 2121. A plurality of second damper shafts 2122 may be provided to be spaced apart at predetermined intervals along the circumferential direction of the outlet 2021. Like the plurality of second opening-end-closing members 2121 described above, the plurality of second damper shafts 2122 may be arranged at equal intervals or arranged at different intervals. Because the plurality of second damper shafts 2122 are respectively fixed and coupled to the plurality of second opening-and-closing members 2121, the plurality of second damper shafts 2122 may be arranged to correspond to arrangement of the plurality of second opening-and-closing members 2121.

The second damper shaft 2122 may rotate while one end thereof is rotatably connected to the second shaft support member 2123 and supported by the second shaft support member 2123. Also, the second damper shaft 2122 may have the other end connected to the second shaft driver 2124. The second shaft driver 2124 may include a driving source (not illustrated) configured to generate power for rotating the second damper shaft 2122. Accordingly, the second damper shaft 2122 may receive power from the second shaft driver 2124 and rotate.

The second shaft support member 2123 may include a third shaft supporter 2123*a* directly connected to the second damper shaft 2122 and configured to directly support the second damper shaft 2122, and a fourth shaft supporter 2123*b* connected to the second shall driver 2124 and configured to indirectly support the second damper shaft 2122.

The third shaft supporter 2123*a* may have one end portion connected to the housing 2010 and the other end portion rotatably connected to the second damper shaft 2122 and may rotatably support the second damper shaft 2122. Specifically, the third shaft supporter 2123*a* may have one end portion supported by being connected to an outer surface of the outlet 2021.

The fourth shaft supporter 2123*b* may have one end portion connected to the housing 2010 and the other end portion connected to the second shaft driver 2124 and may support the second shaft driver 2124. Specifically, the fourth shaft supporter 2123*b* may have one end portion supported by being connected to the inner surface of the outlet 2021. That is, the fourth shaft supporter 2123*b* may indirectly support the second damper shaft 2122.

Configuration for driving the first damper 2110 and the second damper 2120 of the airflow control device 2100 has been described above with reference to FIGS. 29 and 30. However, a configuration for driving the first damper 2110 and the second damper 2120 is not limited thereto and may be any configuration as long as a portion of the inside or a portion of the outside along the radial direction of the outlet 2021 may be selectively opened or closed.

FIG. 31 is an enlarged view of a portion OB marked in FIG. 29. FIGS. 32 and 33 are views illustrating discharged airflow from the air conditioner 1 illustrated in FIG. 28.

An operation in which discharged airflow from the air conditioner 2001 illustrated in FIG. 28 is controlled will be described with reference to FIGS. 31 to 33.

Referring to FIG. 31, when the air conditioner 2001 does not operate, the first damper 2110 and the second damper 2120 of the airflow control device 2100 are arranged in a substantially horizontal direction on the outlet 2021 and are disposed at positions for closing the outlet 2021.

Referring to FIG. 32, when the user attempts to set a direction of discharged airflow that is discharged from the outlet 2021 of the air conditioner 2001 to be along the inside in the radial direction of the outlet 2021, i.e., attempts to set discharged airflow to descend substantially vertically, the first damper 2110 of the airflow control device 2100 opens a portion of the inside along the radial direction of the outlet 2021 by a command from the user. Here, the second damper 2120 closes a portion of the outside along the radial direction of the outlet 2021.

Specifically, as the first damper shaft 2112 that has received power from the first shaft driver 2114 rotates, the first opening-and-closing member 2111 rotates about 90° clockwise or counterclockwise. Accordingly, a portion of the inside of the outlet 2021 is opened to enable air that has passed through the heat exchanger 2030 to pass therethrough.

Air that has passed through the first damper 2110 which is open descends substantially vertically over the first guide surface 2014. Accordingly, the air conditioner 2001 may generate centralized airflow that is capable of intensively cooling or heating a portion adjacent to the air conditioner 2001. The direction of discharged airflow in this case is closer to the inside in the radial direction of the outlet 2021, compared to a case in which the second damper 2120 is open which will be described below. Here, the Coanda curved portion 2014*a* may guide air so that air being discharged may be discharged in a substantially vertical direction.

Also, air that is discharged through a section on the outlet 2021 at which the airflow control device 2100 is not arranged may be drawn toward air passing through the airflow control device 2100 and may be discharged in an airflow direction almost similar to an airflow direction of air passing through the airflow control device 2100.

On the other hand, referring to FIG. 33, when the user attempts to set a direction of discharged airflow that is discharged from the outlet 2021 of the air conditioner 2001 to be along the outside in the radial direction of the outlet 2021, i.e., attempts to set discharged airflow to be wide airflow that spreads widely from the air conditioner 2001, the second damper 2120 of the airflow control device 2100 opens a portion of the outside along the radial direction of the outlet 2021 by a command from the user. Here, the first damper 2110 closes a portion of the inside along the radial direction of the outlet 2021.

Specifically, as the second damper shaft 2122 that has received power from the second shaft driver 2124 rotates, the second opening-and-closing member 2121 rotates about 90° clockwise or counterclockwise. Accordingly, a portion of the outside of the outlet 2021 is opened to enable air that has passed through the heat exchanger 2030 to pass therethrough.

Air that has passed through the second damper 2120 which is open is discharged toward the outside in the radial direction of the outlet 2021 over the second guide surface 2018. Accordingly, the air conditioner 2001 may discharge air toward a portion spaced apart from the air conditioner 2001 and gently cool or heat an entire indoor space. The direction of discharged airflow in this case is closer to the outside in the radial direction of the outlet 2021, compared to the case in which the first damper 2121 is open described above. Here, the Coanda curved portion 2018*a* may guide air so that air being discharged may be discharged in a substantially vertical direction.

Also, air that is discharged through a section on the outlet 2021 at which the airflow control device 2100 is not arranged may be drawn toward air passing through the airflow control device 2100 and may be discharged in an airflow direction almost similar to an airflow direction of air passing through the airflow control device 2100.

In this way, according to the embodiments illustrated in FIGS. 29 to 33, a direction of discharged airflow may be controlled according to a user's request even when the outlet 2021 is formed in a circular shape.

Figure 34:
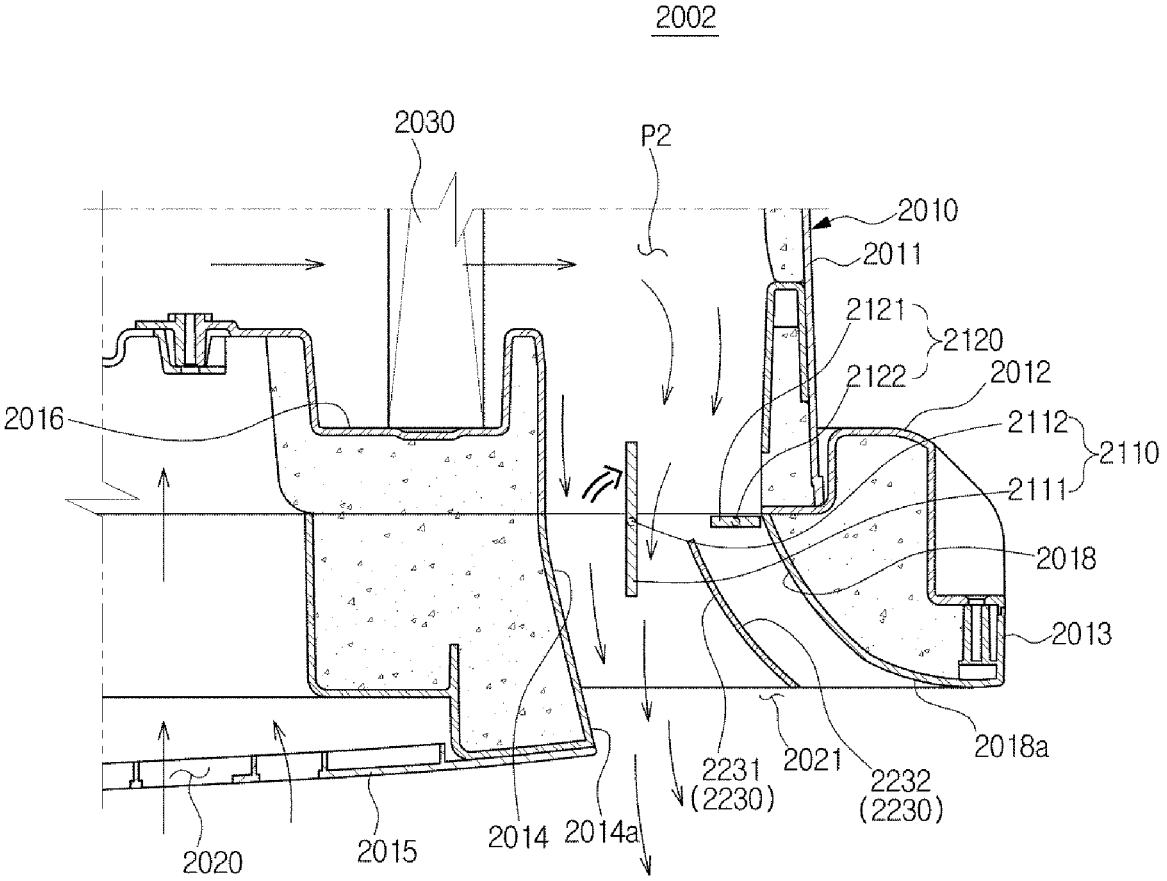
FIGS. 34 and 35 are views illustrating an air conditioner according to yet another embodiment of the present disclosure.
Figure 35:
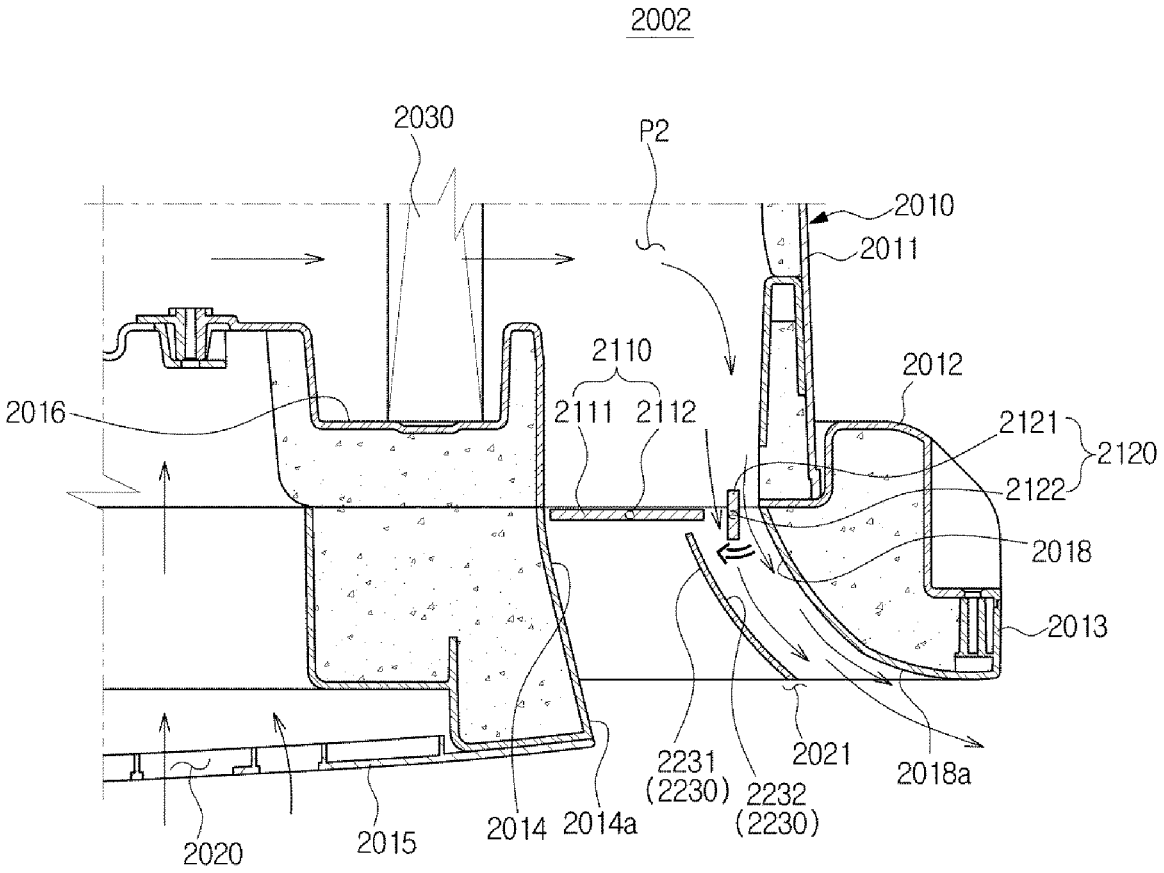

FIGS. 34 and 35 are views illustrating an air conditioner according to yet another embodiment of the present disclosure.

An air conditioner 2002 according to yet another embodiment will be described with reference to FIGS. 34 and 35. However, like reference numerals may be assigned to elements which are the same as those in the embodiments described above, and description thereof may be omitted.

The air conditioner 2002 may further include a guide rib 2230 configured to guide air that has passed through the airflow control device 2100.

The air conditioner 2002 may include the airflow control device 2100 according to the embodiment illustrated in FIG. 31. The airflow control device 2100 may include the first damper 2110 configured to open the inner portion along the radial direction of the outlet 2021 and the second damper 2120 configured to open the outer portion along the radial direction of the outlet 2021.

The first damper 2110 may be provided inside in the radial direction of the outlet 2021 on the outlet 2021. The first damper 2110 may be provided adjacent to the first guide surface 2014. The first damper 2110 may open a portion of the outlet 2021 so that air that has passed through the heat exchanger 2030 may flow toward the inside in the radial direction of the outlet 2021. The first damper 2110 may include the first opening-and-closing member 2111 configured to selectively open or close a portion of the outlet 2021, the first damper shaft 2112 having the first opening-and-closing member 2111 fixed and coupled thereto, the first shaft support member 2113 configured to rotatably support the first damper shaft 2112, and the first shaft driver 2114 configured to rotate the first damper shaft 2112.

The second damper 2120 may be provided outside in the radial direction of the outlet 2021 on the outlet 2021. The second damper 2120 may be provided adjacent to the second guide surface 2018. The second damper 2120 may open a portion of the outlet 2021 so that air that has passed through the heat exchanger 2030 may flow toward the outside in the radial direction of the outlet 2021. The second damper 2120 may include the second opening-and-closing member 2121 configured to selectively open or close a portion of the outlet 2021, the second damper shaft 2122 having the second opening-and-closing member 2121 fixed and coupled thereto, the second shaft support member 2123 configured to rotatably support the second damper shaft 2122, and the second shaft driver 2124 configured to rotate the second damper shaft 2122.

The guide rib 2230 may be provided on a flow passage of air through which air that has passed through the airflow control device 2100 is discharged. The guide rib 2230 may be provided to be progressively inclined toward the outside in the radial direction of the outlet 2021 toward the direction in which air is discharged. Guide ribs 2230 may consecutively extend along the circumferential direction of the outlet 2021. However, embodiments are not limited thereto, and the guide ribs 2230 may be provided to be spaced apart at predetermined intervals while extending along the circumferential direction of the outlet 2021. Here, the guide ribs 2230 may be arranged to correspond to sections in which the airflow control devices 2100 are arranged.

The guide rib 2230 may guide air that has passed through the airflow control device 2100.

Specifically, referring to FIG. 34, when the user attempts to set a direction of discharged airflow that is discharged from the outlet 2021 of the air conditioner 2002 to be along the inside in the radial direction of the outlet 2021, i.e., attempts to set discharged airflow to descend substantially vertically, the first damper 2110 of the airflow control device 2100 opens a portion of the inside along the radial direction of the outlet 2021 by a command from the user. Here, the second damper 2120 closes a portion of the outside along the radial direction of the outlet 2021.

Specifically, as the first damper shaft 2112 that has received power from the first shaft driver 2114 rotates, the first opening-and-closing member 2111 rotates about 90° clockwise or counterclockwise. Accordingly, a portion of the inside of the outlet 2021 is opened to enable air that has passed through the heat exchanger 2030 to pass therethrough.

Air that has passed through the first damper 2110 which is open is discharged substantially vertically by being guided along the first guide surface 2014. Here, the guide rib 2230 may prevent air being discharged while being spaced apart from the first guide surface 2014 from spreading toward the outside in the radial direction of the outlet 2021. Specifically, air being discharged while being spaced apart from the first guide surface 2014 may be prevented from being discharged by spreading toward the outside in the radial direction of the outlet 2021 by a first surface 2231 of the guide rib 2230.

Also, referring to FIG. 35, when the user attempts to set a direction of discharged airflow that is discharged from the outlet 2021 of the air conditioner 2002 to be along the outside in the radial direction of the outlet 2021, the second damper 2120 of the airflow control device 2100 opens a portion of the outside along the radial direction of the outlet 2021 by a command from the user. Here, the first damper 2110 closes a portion of the inside along the radial direction of the outlet 2021.

Specifically, as the second damper shaft 2122 that has received power from the second shaft driver 2124 rotates, the second opening-and-closing member 2121 rotates about 90° clockwise or counterclockwise. Accordingly, a portion of the outside of the outlet 2021 is opened to enable air that has passed through the heat exchanger 2030 to pass therethrough.

Air that has passed through the second damper 2120 which is open is discharged toward the outside in the radial direction of the outlet 2021 by being guided along the second guide surface 2018. Here, the guide rib 2230 may secondly guide air so that air being discharged while being spaced apart from the second guide surface 2018 is discharged toward the outside in the radial direction of the outlet 2021. Specifically, air being discharged by being spaced apart from the second guide surface 2018 may be discharged by spreading toward the outside in the radial direction of the outlet 2021 by a second surface 2232 of the guide rib 2230. Air being guided along the second guide surface 2018 may be guided toward the outside in the radial direction of the outlet 2021 by the Coanda curved portion 2018*a*.

In this way, according to the embodiment illustrated in FIGS. 34 and 35, because air that has passed through the airflow control device 2100 is secondly guided by the guide rib 2230, loss of an amount of discharged air may be reduced, and cooling and beating efficiencies may be increased.

Figure 36:
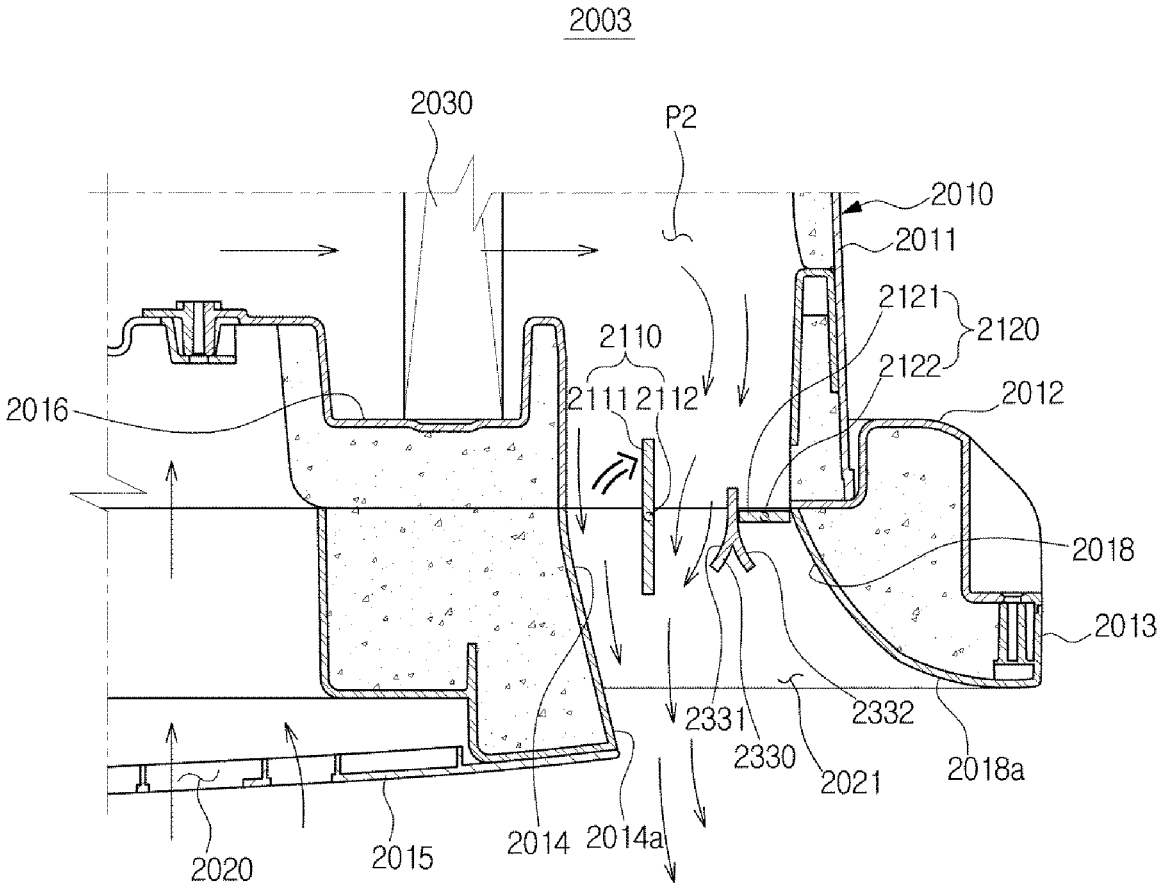
FIGS. 36 and 37 are views illustrating an air conditioner according to yet another embodiment of the present disclosure.
Figure 37:
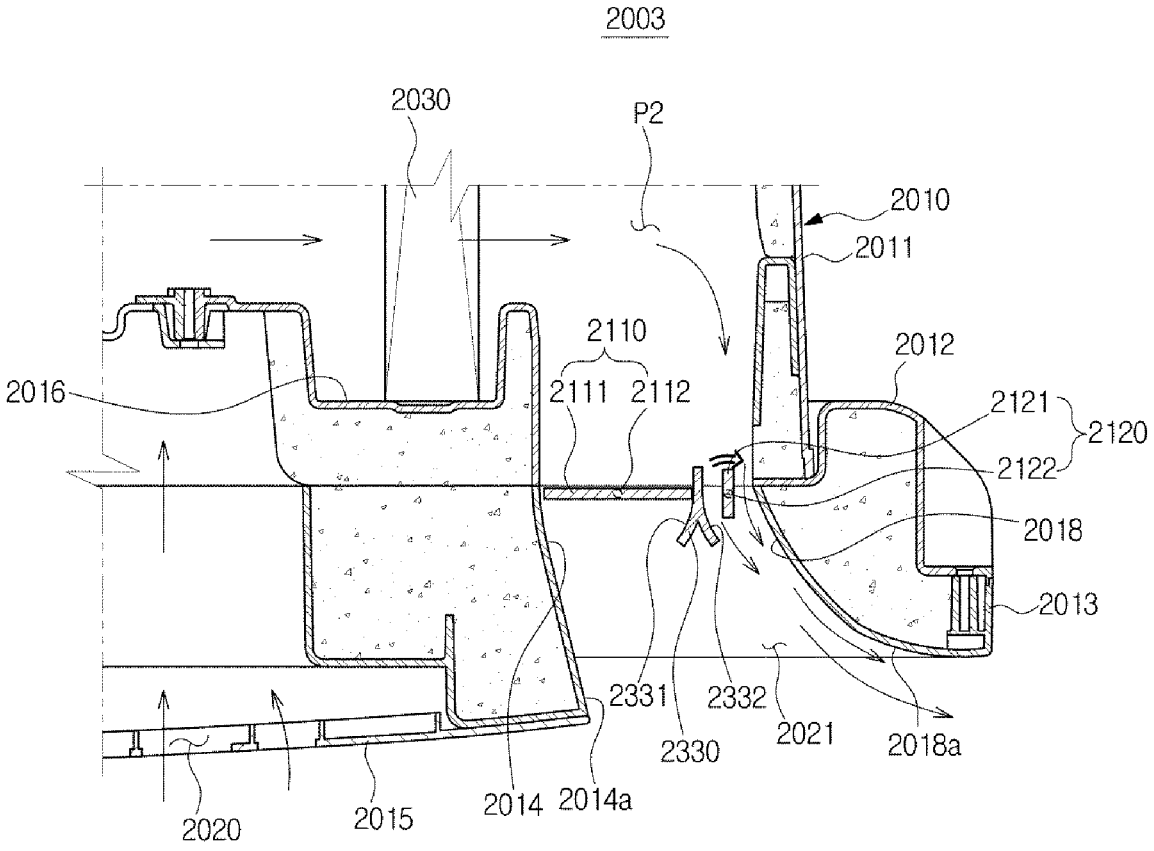

FIGS. 36 and 37 are views illustrating an air conditioner according to yet another embodiment of the present disclosure.

An air conditioner 2003 according to yet another embodiment will be described with reference to FIGS. 36 and 37. However, like reference numerals may be assigned to elements which are the same as those in the embodiments described above, and description thereof may be omitted.

The air conditioner 2003 may further include a guider 2330 configured to guide air passing through the airflow control device 2100 toward the first guide surface 2014 or the second guide surface 2018.

The air conditioner 2003 may include the airflow control device 2100 according to the embodiment illustrated in FIG. 31. The airflow control device 2100 may include the first damper 2110 configured to open the inner portion along the radial direction of the outlet 2021 and the second damper 2120 configured to open the outer portion along the radial direction of the outlet 2021.

The first damper 2110 may be provided inside in the radial direction of the outlet 2021 on the outlet 2021. The first damper 2110 may be provided adjacent to the first guide surface 2014. The first damper 2110 may open a portion of the outlet 2021 so that air that has passed through the heat exchanger 2030 may flow toward the inside in the radial direction of the outlet 2021. The first damper 2110 may include the first opening-and-closing member 2111 configured to selectively open or close a portion of the outlet 2021, the first damper shaft 2112 having the first opening-and-closing member 2111 fixed and coupled thereto, the first shaft support member 2113 configured to rotatably support the first damper shaft 2112, and the first shaft driver 2114 configured to rotate the first damper shaft 2112.

The second damper 2120 may be provided outside in the radial direction of the outlet 2021 on the outlet 2021. The second damper 2120 may be provided adjacent to the second guide surface 2018. The second damper 2120 may open a portion of the outlet 2021 so that air that has passed through the heat exchanger 2030 may flow toward the outside in the radial direction of the outlet 2021. The second damper 2120 may include the second opening-and-closing member 2121 configured to selectively open or close a portion of the outlet 2021, the second damper shaft 2122 having the second opening-and-closing member 2121 fixed and coupled thereto, the second shaft support member 2123 configured to rotatably support the second damper shaft 2122, and the second shaft driver 2124 configured to rotate the second damper shaft 2122.

The guider 2330 may be provided on a flow passage of air through which air that has passed through the airflow control device 2100 is discharged. The guider 2330 may substantially have the shape of the letter "Y" that is rotated by 180°. That is, the guider 2330 may include a first surface 2331 and a second surface 2332 configured to guide air that has passed through the airflow control device 2100 toward the first guide surface 2014 and the second guide surface 2018. The first surface 2331 may be formed to be progressively inclined downward toward the inner surface of the outlet 2021 along the direction in which air is discharged. The second surface 2332 may be formed to be progressively inclined downward toward the outer surface of the outlet 2021 along the direction in which air is discharged.

A plurality of guiders 2330 may consecutively extend along the circumferential direction of the outlet 2021. The plurality of guiders 2330 may be provided to be spaced apart at predetermined intervals while consecutively extending a predetermined distance. Here, the guiders 2330 may be arranged to correspond to sections in which the airflow control devices 2100 are arranged.

However, although the guider 2330 illustrated in FIGS. 36 and 37 is illustrated as having a shape being branched off into two directions toward the direction in which air is discharged, embodiments are not limited thereto, and the guider 2330 may also be provided to have a substantially triangular shape. That is, the guider 2330 may have any shape as long as the shape is able to guide air passing through the airflow control device 2100 to the first guide surface 2014 and the second guide surface 2018.

Referring to FIG. 36, when the user attempts to set a direction of discharged airflow that is discharged from the outlet 2021 of the air conditioner 2003 to be along the inside in the radial direction of the outlet 2021, i.e., attempts to set discharged airflow to descend substantially vertically, the first damper 2110 of the airflow control device 2100 opens a portion of the inside along the radial direction of the outlet 2021 by a command from the user. Here, the second damper 2120 closes a portion of the outside along the radial direction of the outlet 2021.

Specifically, as the first damper shaft 2112 that has received power from the first shaft driver 2114 rotates, the first opening-and-closing member 2111 rotates about 90° clockwise or counterclockwise. Accordingly, a portion of the inside of the outlet 2021 is opened to enable air that has passed through the heat exchanger 2030 to pass therethrough.

Air that has passed through the first damper 2110 which is open is discharged substantially vertically by being guided along the first guide surface 2014. Here, the guider 2330 may prevent air being discharged while being spaced apart from the first guide surface 2014 from spreading toward the outside in the radial direction of the outlet 2021. Specifically, air being discharged while being spaced apart from the first guide surface 2014 may be prevented from being discharged by spreading toward the outside in the radial direction of the outlet 2021 by the first surface 2331 of the guider 2330 and may be guided toward the first guide surface 2014.

Referring to FIG. 37, when the user attempts to set a direction of discharged airflow that is discharged from the outlet 2021 of the air conditioner 2003 to be along the outside in the radial direction of the outlet 2021, the second damper 2120 of the airflow control device 2100 opens a portion of the outside along the radial direction of the outlet 2021 by a command from the user. Here, the first damper 2110 closes a portion of the inside along the radial direction of the outlet 2021.

Specifically, as the second damper shaft 2122 that has received power from the second shaft driver 2124 rotates, the second opening-and-closing member 2121 rotates about 90° clockwise or counterclockwise. Accordingly, a portion of the outside of the outlet 2021 is opened to enable air that has passed through the heat exchanger 2030 to pass therethrough.

Air that has passed through the second damper 2120 which is open is discharged toward the outside in the radial direction of the outlet 2021 by being guided along the second guide surface 2018. Here, the guider 2330 may secondly guide air so that air being discharged while being spaced apart from the second guide surface 2018 is discharged toward the outside in the radial direction of the outlet 2021. Specifically, air being discharged by being spaced apart from the second guide surface 2018 may be discharged by being guided along the second guide surface 2018 and spreading toward the outside in the radial direction of the outlet 2021 by the second surface 2332 of the guider 2330. Air being guided along the second guide surface 2018 may be guided toward the outside in the radial direction of the outlet 2021 by the Coanda curved portion 2018*a*.

In this way, according to the embodiment illustrated in FIGS. 36 and 37, because air that has passed through the airflow control device 2100 is secondly guided by the guider 2330, loss of an amount of discharged air may be reduced, and cooling and heating efficiencies may be increased.

Figure 38:
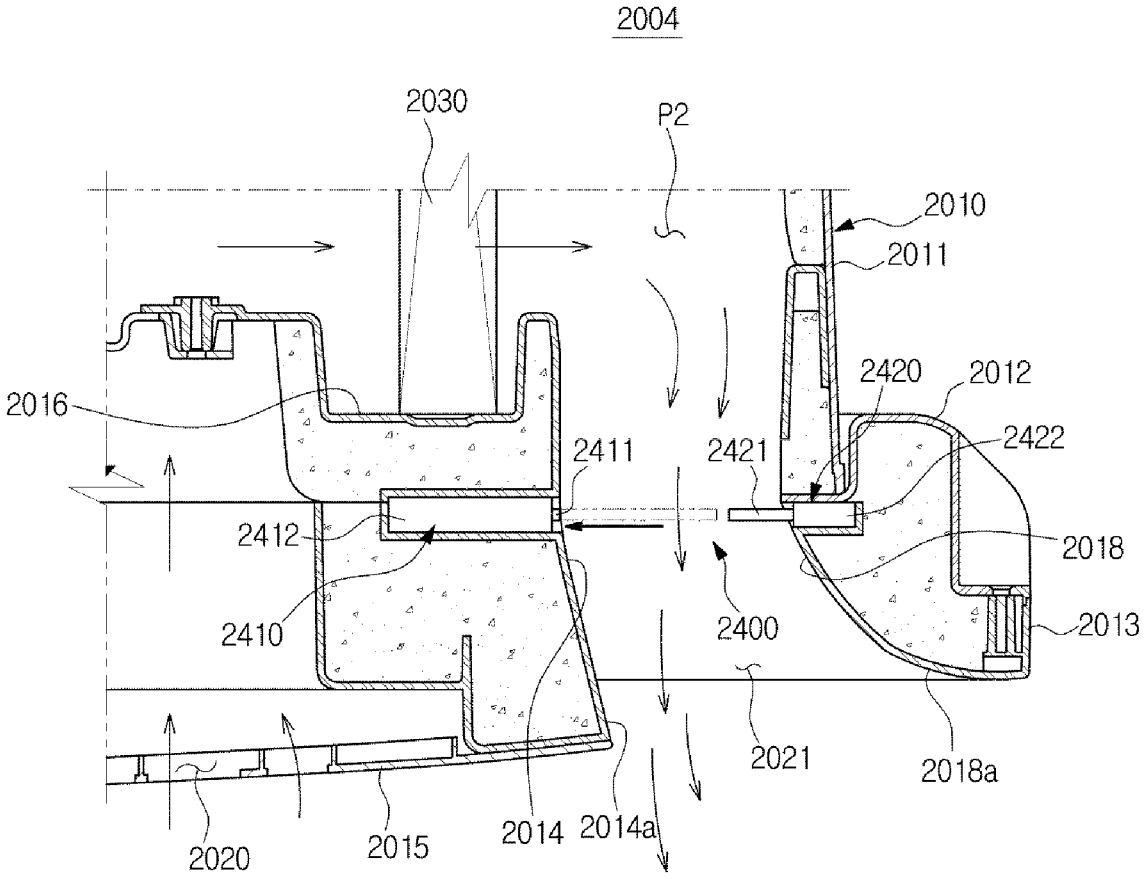
FIGS. 38 and 39 are views illustrating an air conditioner according to yet another embodiment of the present disclosure.
Figure 39:
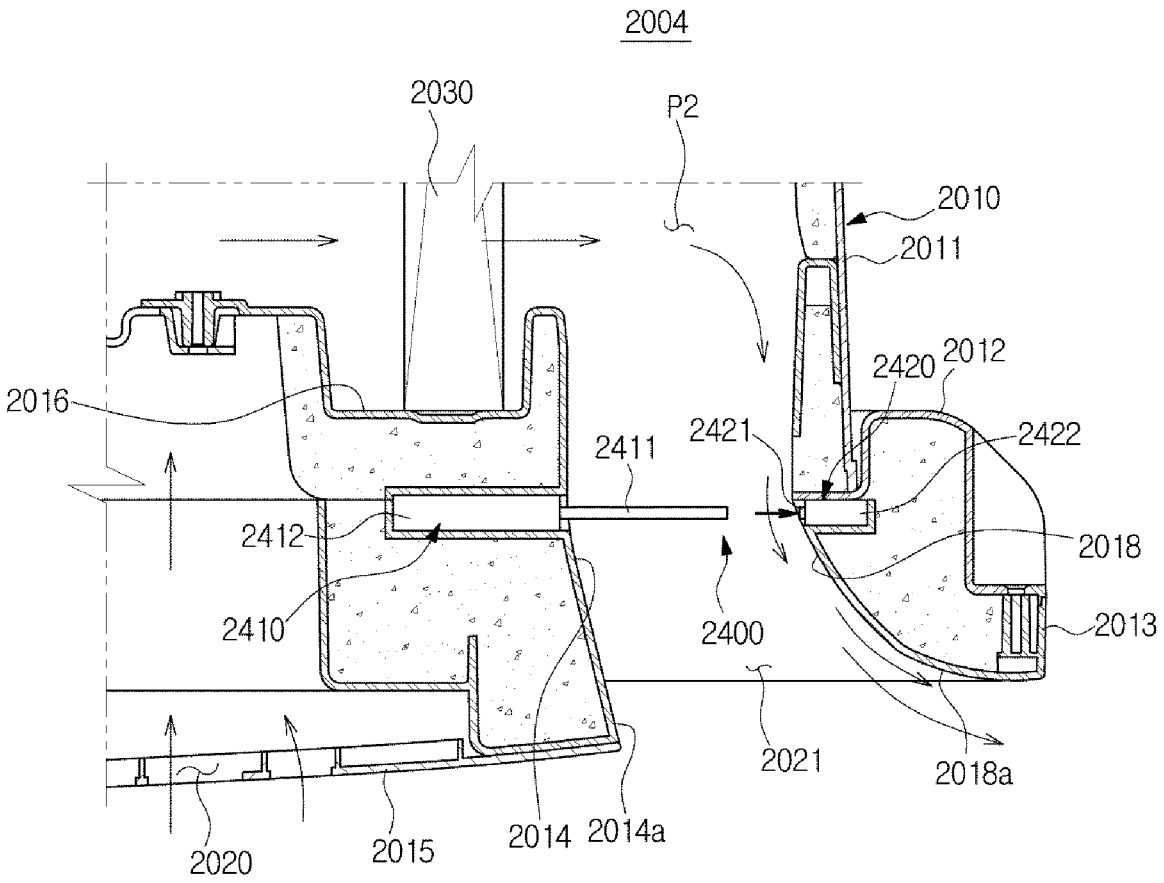

FIGS. 38 and 39 are views illustrating an air conditioner according to yet another embodiment of the present disclosure. An air conditioner 2004 according to yet another embodiment will be described with reference to FIGS. 38 and 39. However, like reference numerals may be assigned to elements which are the same as those in the embodiments described above, and description thereof may be omitted.

The air conditioner 2004 may include an airflow control device 2400 configured to selectively open or close a portion of the outlet 2021 by sliding, instead of rotating as illustrated in FIG. 31.

The airflow control device 2400 of the air conditioner 2004 may include a first damper 2410 configured to open an inner portion along the radial direction of the outlet 2021 and a second damper 2420 configured to open an outer portion along the radial direction of the outlet 2021. Although a size of the second damper 2420 is illustrated in FIG. 11 as being smaller than that of the first damper 2410, embodiments are not limited thereto. The size of the first damper 2410 and the size of the second damper 2420 may be the same, or, conversely, the size of the first damper 2410 may be provided to be smaller than that of the second damper 2420.

The first damper 2410 may be provided inside in the radial direction of the outlet 2021 on the outlet 2021. The first damper 2410 may be provided adjacent to the first guide surface 2014. The first damper 2410 may open a portion of the inside along the radial direction of the outlet 2021 so that air that has passed through the heat exchanger 2030 may flow toward the outlet 2021. The first damper 2410 may include a first opening-and-closing member 2411 configured to selectively open or close a portion of the outlet 2021, and a first opening-and-closing member driver 2412 configured to slide the first opening-and-closing member 2111.

The first opening-and-closing member 2411 may have one end portion connected to the first opening-and-closing member driver 2412, may be slid by the first opening-and-closing member driver 2412, and may selectively open or close a portion of the inside along the radial direction of the outlet 2021. Specifically, the first opening-and-closing member 2411 may be inserted into the inner surface of the outlet 2021 along the radial direction of the outlet 2021 when opening a portion of the outlet 2021 and may be withdrawn from the inner surface of the outlet 2021 when closing the portion of the outlet 2021.

A plurality of first opening-and-closing members 2411 may be provided by being spaced apart at predetermined intervals along the circumferential direction of the outlet 2021. The plurality of first opening-and-closing members 2411 may be arranged at equal intervals or arranged at different intervals.

The first opening-and-closing member driver 2412 slides the first opening-and-closing member 2411. The first opening-and-closing member driver 2412 may be an actuator.

In the embodiment illustrated in FIGS. 38 and 39, because the outlet 2021 has a substantially circular shape, the plurality of first opening-and-closing members 2411 may have a circular shape overall when being inserted into the housing 2010 by a plurality of first opening-and-closing member drivers 2412 and may be configured to be spaced apart from one another when being withdrawn to an outside of the housing 2010.

The second damper 2420 may be provided outside in the radial direction of the outlet 2021 on the outlet 2021. The second damper 2420 may be provided adjacent to the second guide surface 2018. The second damper 2420 may open a portion of the outlet 2021 so that air that has passed through the heat exchanger 2030 may flow toward the outlet 2021. The second damper 2420 may include a second opening-and-closing member 2421 configured to selectively open or close a portion of the outlet 2021, and a second opening-and-closing member driver 2422 configured to slide the second opening-and-closing member 2421.

The second opening-and-closing member 2421 may have one end portion connected to the second opening-and-closing member driver 2422, may be slid by the second opening-and-closing member driver 2422, and may selectively open or close a portion of the outside along the radial direction of the outlet 2021. Specifically, the second opening-and-closing member 2421 may be inserted into the outer surface of the outlet 2021 along the radial direction of the outlet 2021 when opening a portion of the outlet 2021 and may be withdrawn from the outer surface of the outlet 2021 when closing the portion of the outlet 2021.

A plurality of second opening-and-closing members 2421 may be provided by being spaced apart at predetermined intervals along the circumferential direction of the outlet 2021. The plurality of second opening-and-closing members 2421 may be arranged at equal intervals or arranged at different intervals.

The second opening-and-closing member driver 2422 slides the second opening-and-closing member 2421. The second opening-and-closing member driver 2422 may be an actuator.

In the embodiment illustrated in FIGS. 38 and 39, because the outlet 2021 has a substantially circular shape, the plurality of second opening-and-closing members 2421 may have a circular shape overall when being inserted into the housing 2010 by a plurality of second opening-and-closing member drivers 2422 and may be configured to be spaced apart from one another when being withdrawn to the outside of the housing 2010.

By the above configuration, the air conditioner 2004 according to the embodiment illustrated in FIGS. 38 and 39 may selectively open or close the outlet 2021 and control a direction of discharged airflow being discharged from the outlet 2021.

Specifically, referring to FIG. 38, when the user attempts to set a direction of discharged airflow that is discharged from the outlet 2021 of the air conditioner 2004 to be along the inside in the radial direction of the outlet 2021, i.e., attempts to set discharged airflow to descend substantially vertically, the first damper 2410 of the airflow control device 2400 opens a portion of the inside along the radial direction of the outlet 2021 by a command from the user.

Specifically, the first opening-and-closing member 2411 is slid by the first opening-and-closing member driver 2412, is inserted into the inner surface of the outlet 2021, and opens a portion of the inside of the outlet 2021. Accordingly, air that has passed through the heat exchanger 2030 may be discharged through the portion of the inside of the outlet 2021. Here, the second opening-and-closing member 2421 is withdrawn from the outer surface of the outlet 2021 and closes the outside in the radial direction of the outlet 2021.

Air that has passed through the first damper 2410 which is open descends substantially vertically by being guided along the first guide surface 2014. Accordingly, the air conditioner 2004 may generate centralized airflow that is capable of intensively cooling or heating a portion adjacent to the air conditioner 2004. The direction of discharged airflow in this case is closer to the inside in the radial direction of the outlet 2021, compared to a case in which the second damper 2420 is open which will be described below. Here, the Coanda curved portion 2014*a* may guide air so that air being discharged may be discharged in a substantially vertical direction.

Also, air that is discharged through a section on the outlet 2021 at which the airflow control device 2400 is not arranged may be drawn toward air passing through the airflow control device 2100 and may be discharged in an airflow direction almost similar to an airflow direction of air passing through the airflow control device 2100.

On the other hand, referring to FIG. 39, when the user attempts to set a direction of discharged airflow that is discharged from the outlet 2021 of the air conditioner 2004 to be along the outside in the radial direction of the outlet 2021, i.e., attempts to set discharged airflow to descend substantially vertically, the first damper 2410 of the airflow control device 2400 opens a portion of the outside along the radial direction of the outlet 2021 by a command from the user.

Specifically, the second opening-and-closing member 2421 is slid by the second opening-and-closing member driver 2422, is inserted into the inner surface of the outlet 2021, and opens a portion of the outside of the outlet 2021. Accordingly, air that has passed through the heat exchanger 2030 may be discharged through the portion of the outside of the outlet 2021. Here, the first opening-and-closing member 2411 is withdrawn from the outer surface of the outlet 2021 and closes the outside in the radial direction of the outlet 2021.

Air that has passed through the second damper 2420 which is open is guided along the second guide surface 2018 and discharged by spreading toward the outside in the radial direction of the outlet 2021. Accordingly, the air conditioner 2004 may discharge air toward a portion spaced apart from the air conditioner 2004 and gently cool or heat an entire indoor space. The direction of discharged airflow in this case is closer to the outside in the radial direction of the outlet 2021, compared to the case in which the first damper 2410 is open described above. Here, the Coanda curved portion 2018*a* may guide air so that air being discharged may be discharged in a substantially vertical direction.

Also, air that is discharged through a section on the outlet 2021 at which the airflow control device 2400 is not arranged may be drawn toward air passing through the airflow control device 2100 and may be discharged in an airflow direction almost similar to an airflow direction of air passing through the airflow control device 2100.

In this way, according to the embodiment illustrated in FIGS. 38 and 39, a direction of discharged airflow may be controlled according to a user's request even when the outlet 2021 is formed in a circular shape.

Figure 40:
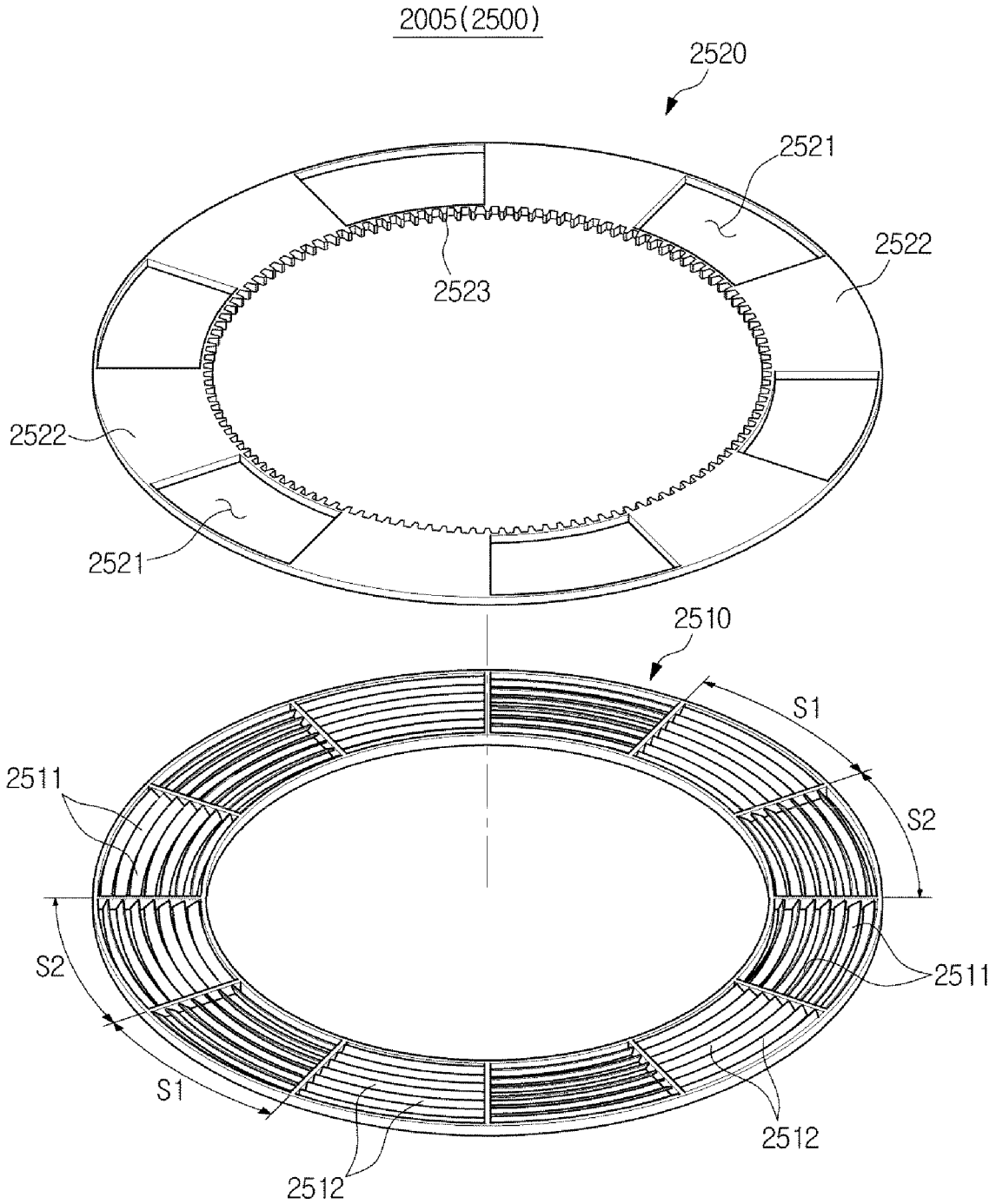
FIG. 40 is a view illustrating yet another embodiment of the airflow control device of the air conditioner illustrated in FIG. 31.
Figure 41:
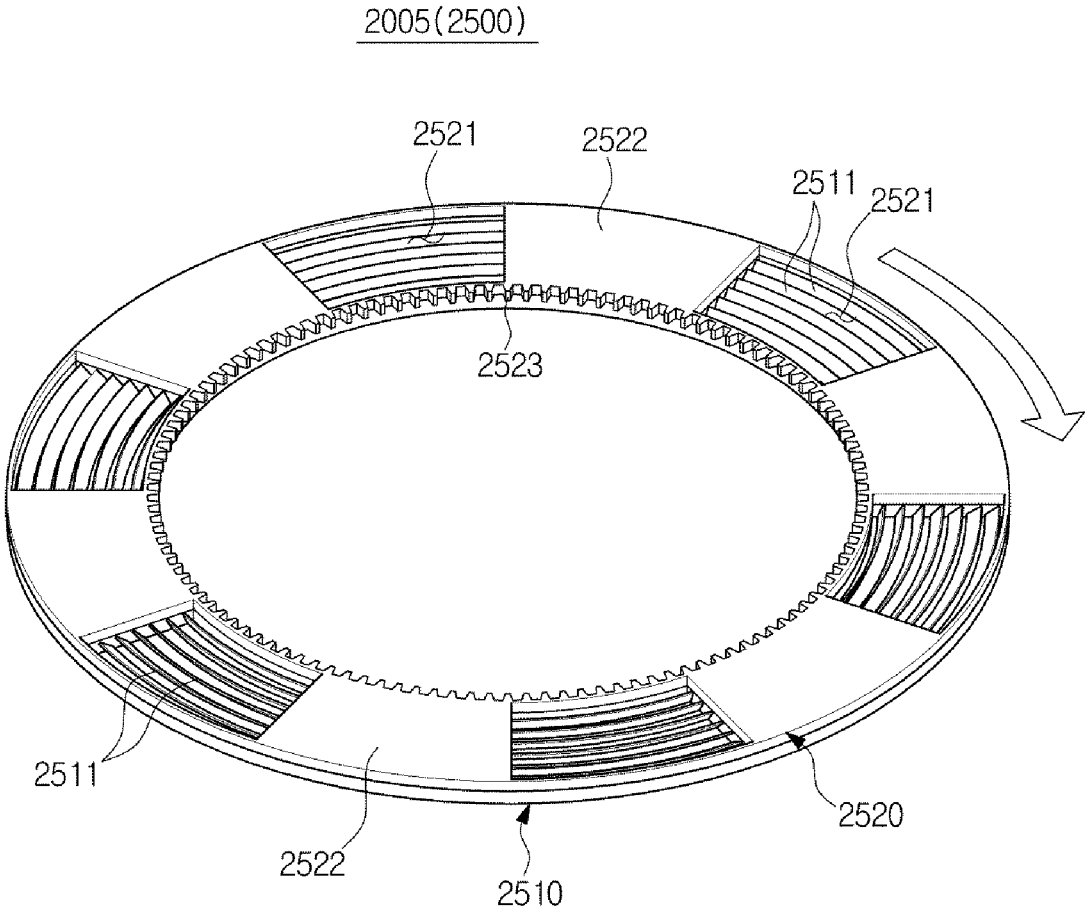
FIGS. 41 and 42 are views illustrating a case in which an airflow control device illustrated in FIG. 40 controls discharged airflow to be in a first direction.
Figure 42:
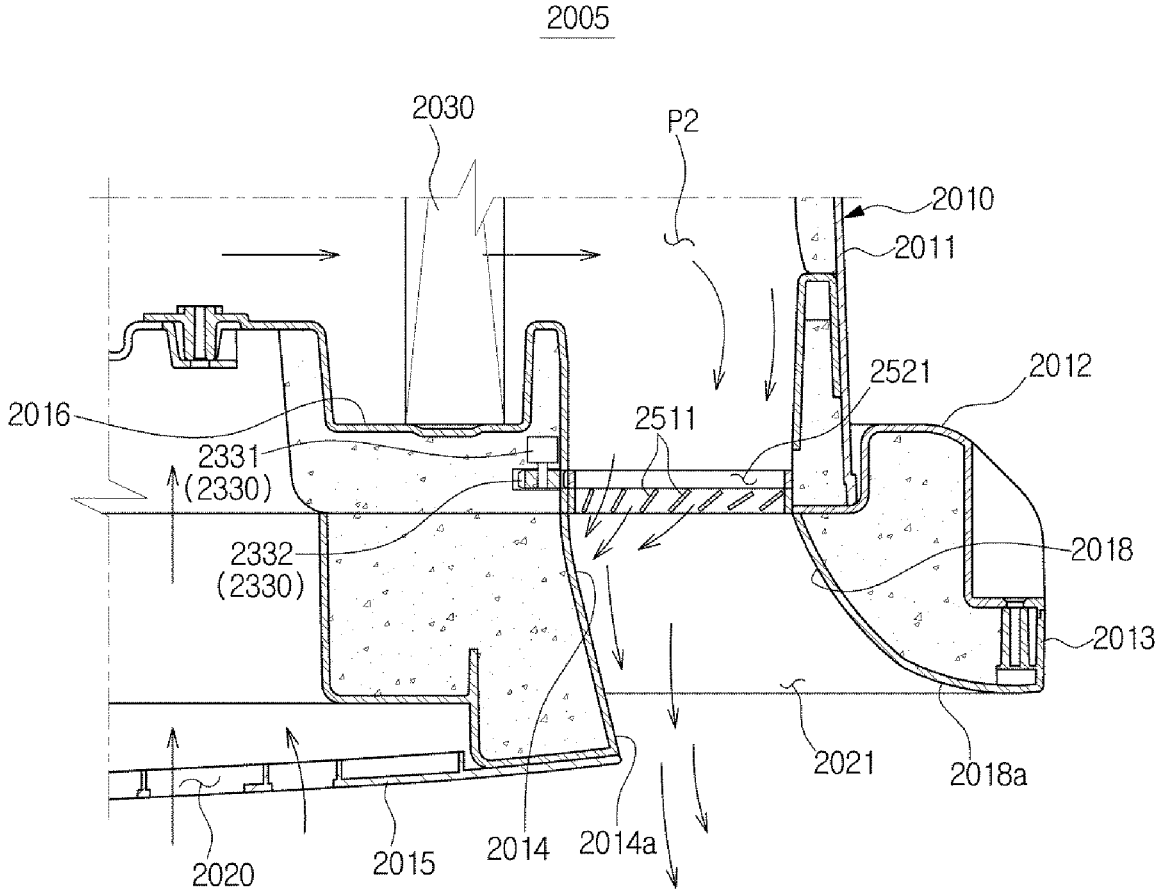
Figure 43:
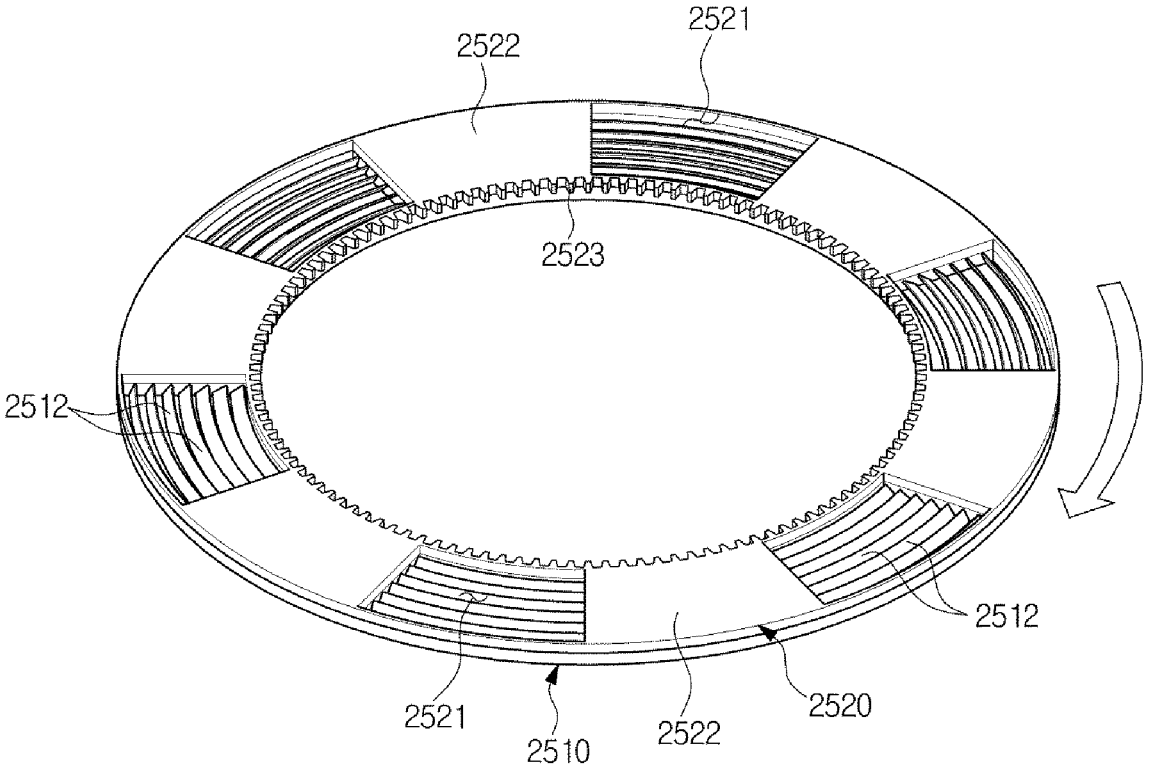
FIGS. 43 and 44 are views illustrating a case in which the airflow control device illustrated in FIG. 40 controls discharged airflow to be in a second direction.
Figure 44:
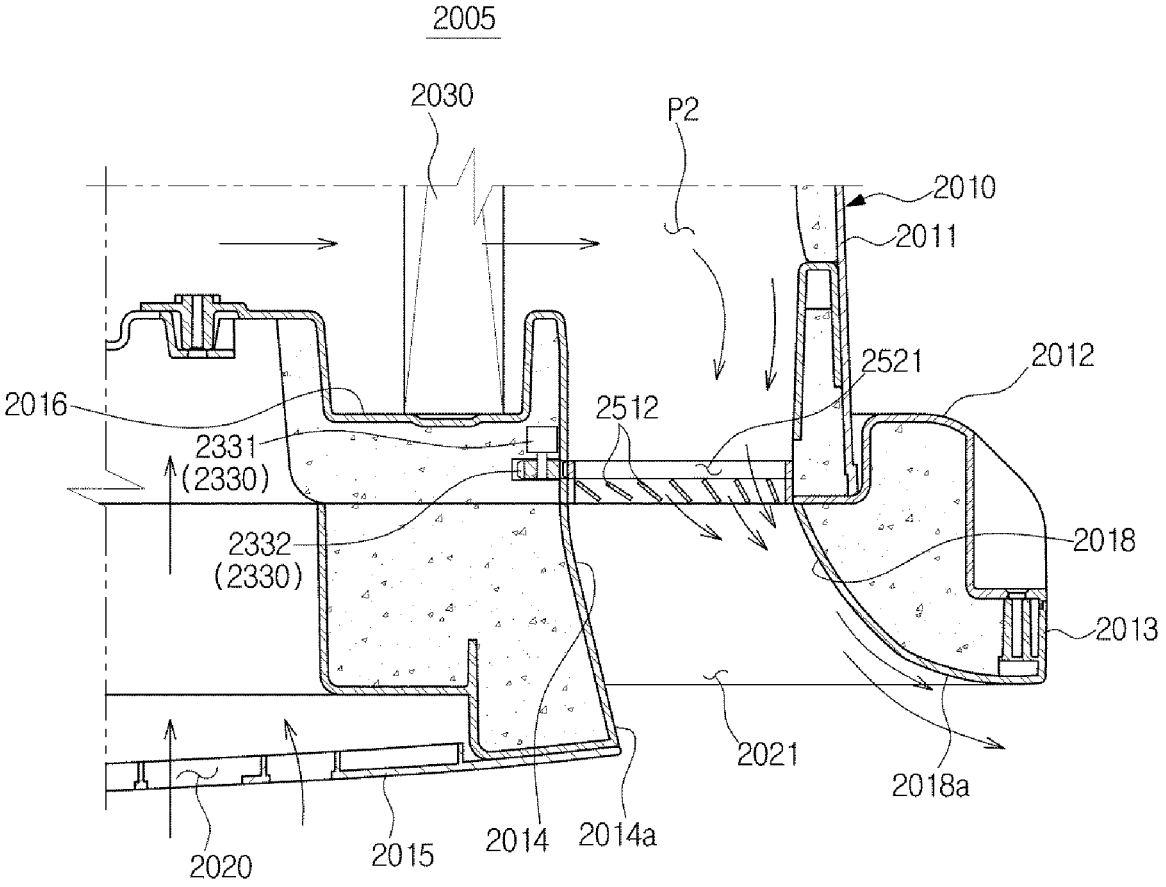

FIG. 40 is a view illustrating yet another embodiment of the airflow control device 2100 of the air conditioner 2001 illustrated in FIG. 31. FIGS. 41 and 42 are views illustrating a case in which an airflow control device 500 illustrated in FIG. 40 controls discharged airflow to be in a first direction. FIGS. 43 and 44 are views illustrating a case in which the airflow control device 2500 illustrated in FIG. 40 controls discharged airflow to be in a second direction.

The airflow control device 2500 of an air conditioner 2005 according to yet another embodiment of the present disclosure will be described with reference to FIGS. 40 to 44. However, like reference numerals may be assigned to elements which are the same as those in the embodiments described above, and description thereof may be omitted.

The air conditioner 2005 may have the outlet 2021 formed in a substantially circular shape and include the airflow control device 2500 configured to guide air that has passed through the heat exchanger 2030 to the first guide surface 2014 or the second guide surface 2018. The airflow control device 2500 may be provided at an upstream portion of the outlet 2021 along the circumferential direction of the outlet 2021. The airflow control device 2500 may be provided at a portion where the first guide surface 2014 and the second guide surface 2018 start. The airflow control device 2500 may be provided to have a shape and a size which are substantially the same as those of a cross-section along the radial direction of the outlet 2021.

The airflow control device 2500 may include a guide member 2510 configured to guide air that has passed through the heat exchanger 2030 toward the first guide surface 2014 or the second guide surface 2018, and an opening-and-closing member 2520 configured to selectively open or close a portion of the guide member 2510.

The guide member 2510 extends along the circumferential direction of the outlet 2021, and may include a first section S1 having a first guide member 2511 formed therein and a second section S2 having a second guide member 2512 formed therein. However, although six first sections S1 and six second sections S2 are illustrated in FIG. 40 as being formed, embodiments are not limited thereto, and five or less or seven or more first sections S1 and second sections S2 may be formed. Furthermore, only one first section S1 or second section S2 may be formed, and the number of first sections S1 may be different from the number of second sections S2. The first section S1 and the second section S2 may be alternately arranged along the circumferential direction of the guide member 2510. The first section S1 and the second section S2 may be alternately provided along the circumferential direction of the guide member 2510.

The first guide member 2511 configured to guide air that has passed through the heat exchanger 2030 toward the first guide surface 2014 may be provided in the first section S1 of the guide member 2510. A plurality of first guide members 2511 may be provided as illustrated in FIG. 40, or, although not illustrated, a single first guide member 2511 may be provided.

The fast guide member 2511 may extend along the circumferential direction of the outlet 2021. The first guide member 2511 may be provided to be progressively inclined toward the first guide surface 2014 toward a direction in which air is discharged. Accordingly, the first guide member 2511 may guide air moving toward the outlet 2021 toward the first guide surface 2014.

Also, when the plurality of first guide members 2511 are provided, because the plurality of first guide members 2511 progressively recede from the first guide surface 2014 toward the outside in the radial direction of the outlet 2021, the plurality of first guide members 2511 may be provided to have a slope that gradually becomes horizontal toward the outside in the radial direction of the outlet 2021. That is, the plurality of first guide members 2511 may be provided so that the slope thereof with respect to the radial direction of the guide member 2510 is decreased as the plurality of first guide members 2511 recede from the first guide surface 2014. Accordingly, the first guide members 2511 may guide air toward the first guide surface 2014 even when arranged to be far from the first guide surface 2014 toward the outside in the radial direction of the outlet 2021.

The second guide member 2512 configured to guide air that has passed through the heat exchanger 2030 toward the second guide surface 2018 may be provided in the second section S2 of the guide member 2510. A plurality of second guide members 2512 may be provided as illustrated in FIG. 40, or, although not illustrated, a single second guide member 2512 may be provided.

The second guide member 2512 may extend along the circumferential direction of the outlet 2021. The second guide member 2512 may be provided to be progressively inclined toward the second guide surface 2018 toward the direction in which air is discharged. Accordingly, the second guide member 2512 may guide air moving toward the outlet 2021 toward the second guide surface 2018.

Also, when the plurality of second guide members 2512 are provided, because the plurality of second guide members 2512 progressively recede from the second guide surface 2018 toward the inside in the radial direction of the outlet 2021, the plurality of second guide members 2512 may be provided to have a slope that gradually becomes horizontal toward the outside in the radial direction of the outlet 2021. That is, the plurality of second guide members 2512 may be provided so that the slope thereof with respect to the radial direction of the guide member 2510 is decreased as the plurality of second guide members 2512 recede from the second guide surface 2018. Accordingly, the second guide members 2512 may guide air toward the second guide surface 2018 even when arranged to be far from the second guide surface 2018 toward the inside in the radial direction of the outlet 2021.

The opening-and-closing member 2520 may be configured at an upper side of the guide member 2510 to rotate about the center in a radial direction of the opening-and-closing member 2520 as a rotation axis. The rotation axis of the opening-and-closing member 2520 may be provided to correspond to the center along the radial direction of the outlet 2021 and the center along the radial direction of the guide member 2510. Accordingly, the opening-and-closing member 2520 may selectively open or close the first section S1 and the second section S2 of the guide member 2510.

The opening-and-closing member 2520 may include an opener 2521 configured to open the first section S1 and the second section S2 and a blocker 2522 configured to close the first section S1 and the second section S2. The number of openers 2521 and blockers 2522 may correspond to the number of first sections S1 and second sections S2 of the guide member 2510. When a plurality of openers 2521 and blockers 2522 are provided, the openers 2521 and the blockers 2522 may be alternately arranged along the circumferential direction of the opening-and-closing member 2520.

The opener 2521 may be formed to be hollow to open the first section S1 and the second section S2. The opener 2521 may be provided to have a size and a shape that correspond to those of the first section S1 and/or the second section S2 of the guide member 2510. Accordingly, the opener 2521 may selectively open the first section S and the second section S2.

The blocker 2522 may be provided to have a size and a shape that correspond to those of the first section S1 and/or the second section S2 of the guide member 2510. Accordingly, the blocker 2521 may selectively close the first section S1 and the second section S2.

The opener 2521 and the blocker 2522 may be provided to correspond to shapes, sizes, or arrangements of the first section S1 and the second section S2.

The opening-and-closing member 2520 may further include an opening-and-closing driver 2530 provided to be rotatable about the center in the radial direction as a rotation axis.

The opening-and-closing driver 2530 may include an opening-and-closing driving source 2531 provided inside the housing 2010 and configured to generate power, and an opening-and-closing power transmitter 2532 configured to transmit power generated by the opening-and-closing driving source 2531 to the opening-and-closing member 2520.

The opening-and-closing driving source 2531 may be provided inside the housing 2010 at the inside in the radial direction of the opening-and-closing member 2520. However, embodiments are not limited thereto, and the opening-and-closing driving source 2531 may be provided inside the housing 2010 at the outside in the radial direction of the opening-and-closing member 2520 or may be provided outside the housing 2010. The opening-and-closing driving source 2531 may be a motor.

The opening-and-closing power transmitter 2532 may transmit power generated by the opening-and-closing driving source 2531 to the opening-and-closing member 2520 to enable the opening-and-closing member 2520 to rotate.

Specifically, the opening-and-closing power transmitter 2532 may be provided as a gear, and the opening-and-closing member 2520 may include a gear tooth 2523 formed at an inner circumferential surface thereof and configured to receive power by being engaged with a gear of the opening-and-closing power transmitter 2532. By the above configuration, the opening-and-closing member 2520 may receive power generated by the opening-and-closing driving source 2531 through the opening-and-closing power transmitter 2532 and rotate about the center in the radial direction of the opening-and-closing member 2520 as a rotation axis. However, a configuration of the opening-and-closing power transmitter 2532 is not limited thereto, and may be any configuration as long as a configuration is capable of rotating the opening-and-closing member 2520. Also, the guide member 2510, instead of the opening-and-closing member 2520, may be configured to receive power from the opening-and-closing power transmitter 2532 and rotate. In this case, a gear tooth may be formed at an inner circumferential surface of the guide member 2510, and the opening-and-closing power transmitter 2532 may be engaged with the inner circumferential surface of the guide member 2510.

An operation in which discharged airflow of the air conditioner 2005 including the airflow control device 2500 illustrated in FIG. 40 is controlled will be described with reference to FIGS. 41 to 44.

Referring to FIGS. 41 and 42, when the user attempts to set a direction of discharged airflow that is discharged from the outlet 2021 of the air conditioner 2005 to be along the inside in the radial direction of the outlet 2021 (the first direction), the opening-and-closing member 2520 of the airflow control device 2500 is rotated to a position for opening the first section S1 of the guide member 2510 by a command from the user. Accordingly, all first sections S1 of the guide member 2510 are opened, and all second sections S2 thereof are closed by the blocker 2522. Consequently, all of air that has passed through the heat exchanger 2030 passes through the airflow control device 2500 only through the first sections S1.

Here, air passing through the first section S1 may be guided toward the first guide surface 2014 by the first guide member 2511. Air guided toward the first guide surface 2014 is guided along the first guide surface 2014 and descend in a substantially vertical direction. That is, a direction of discharged airflow may be set to be closer to the inside in the radial direction of the outlet 2021, compared to a case in which air is guided along the second guide surface 2018 and discharged. Accordingly, the air conditioner 2005 may intensively cool or heat a portion adjacent to the air conditioner 2005. Here, the Coanda curved portion 2014*a* provided at one end portion of the first guide surface 2014 may more effectively guide air being discharged from the outlet 2021 so that air may form vertically descending airflow.

On the other hand, referring to FIGS. 43 and 44, when the user attempts to set a direction of discharged airflow that is discharged from the outlet 2021 of the air conditioner 2005 to be along the outside in the radial direction of the outlet 2021 (the second direction), the opening-and-closing member 2520 of the airflow control device 2500 is rotated to a position for opening the second section S2 of the guide member 2510 by a command from the user. Accordingly, all second sections S2 of the guide member 2510 are opened, and all first sections S1 thereof are closed by the blocker 2522. Consequently, all of air that has passed through the heat exchanger 2030 passes through the airflow control device 2500 only through the second sections S2.

Here, air passing through the second section S2 may be guided toward the second guide surface 2018 by the second guide member 2512. Air guided toward the second guide surface 2018 is guided along the second guide surface 2018 and widely spreads toward the outside in the radial direction of the outlet 2021. That is, the air conditioner 2005 may discharge air toward a portion spaced apart from the air conditioner 2005, and, consequently, the air conditioner 2005 may gently cool or heat an entire indoor space. Here, the Coanda curved portion 2018*a* provided at one end portion of the second guide surface 2018 may more effectively guide air being discharged from the outlet 2021 by the outlet 2021 so that air may be discharged by spreading toward the outside in the radial direction of the outlet 2021.

In this way, according to the embodiment illustrated in FIGS. 40 to 44, a direction of discharged airflow may be controlled according to a user's request even when the outlet 2021 is formed in a circular shape.

As described above, the air conditioners 2001, 2002, 2003, 2004, and 2005 according to the present disclosure may control a direction of discharged airflow discharged from the outlet 2021 having a circular shape with a relatively simple configuration, and, because the outlet 2021 having a circular shape is provided, air may be discharged in all directions along the circumferences of the air conditioners 2001, 2002, 2003, 2004, and 2005, and cooling and heating blind spots may be minimized.

Figure 45:
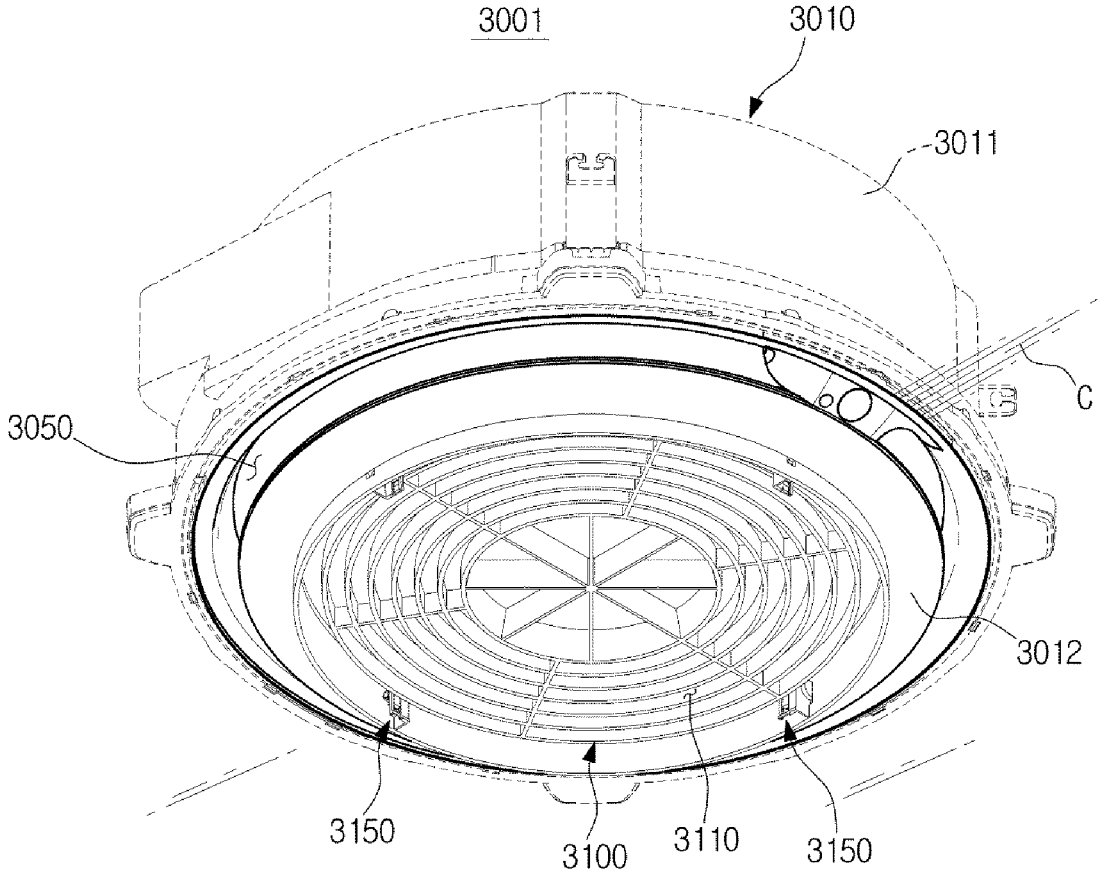
FIG. 45 is a perspective view of an air conditioner according to yet another embodiment of the present disclosure.
Figure 46:
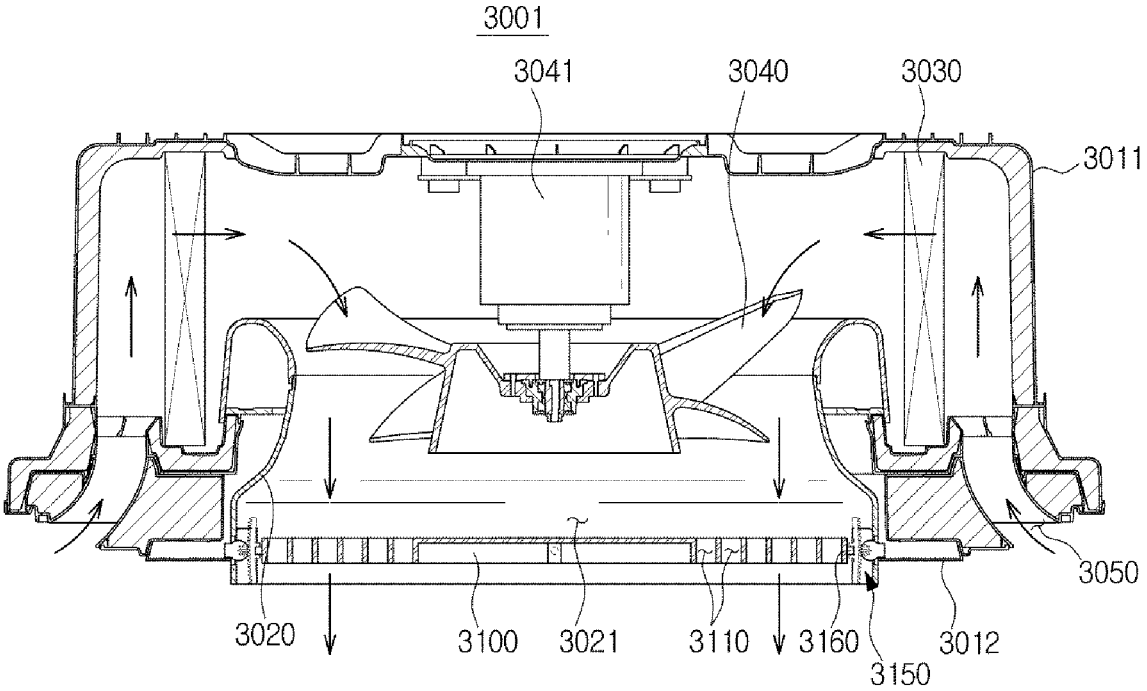
FIG. 46 is a lateral cross-sectional view of the air conditioner illustrated in FIG. 45.

FIG. 45 is a perspective view of an air conditioner 3001 according to yet another embodiment of the present disclosure. FIG. 46 is a lateral cross-sectional view of the air conditioner 3001 illustrated in FIG. 45.

The air conditioner 3001 may be installed on a ceiling C. At least a portion of the air conditioner 3001 may be buried in the ceiling C.

The air conditioner 3001 may include a housing 3010 provided in a substantially cylindrical shape, a heat exchanger 3030 provided inside the housing 3010, and a blower fan 3040 configured to circulate air.

The housing 3010 may have a substantially circular shape when viewed in the vertical direction. However, the shape of the housing 3010 is not limited thereto, and the housing 3010 may also have an elliptical shape or a polygonal shape. The housing 3010 may be formed of an upper housing 3011 arranged inside the ceiling C, and a lower housing 3012 coupled below the upper housing 3011, arranged outside the ceiling C, and exposed to the outside. However, embodiments are not limited thereto, and a middle housing may be further arranged between the upper housing 3011 and the lower housing 3012.

A discharge grille 3100 including an outlet 3110 from which air is discharged may be arranged at a central portion of the lower housing 3012, and a driving device 3150 configured to move the discharge grille 3100 in a vertical direction to change a direction in which the discharge grille 3100 is arranged may be arranged at an outer circumferential surface of the discharge grille 3100. The driving device 3150 will be described in detail below.

An inlet 3050 through which air is suctioned into the housing 3010 by the blower fan 3040 may be formed at an outside in a radial direction of the discharge grille 3100 and an outside in a radial direction of the heat exchanger 3030. Specifically, the inlet 3050 may be provided in a ring shape at a lower surface of the lower housing 3012.

The blower fan 3040 may be provided at an inside in the radial direction of the heat exchanger 3030 and may be driven by a blower motor 3041. The blower fan 3040 may include an axial-flow fan or a mixed-flow fan. That is, air in a radial direction of the blower fan 3040 may be suctioned and discharged toward a rotating shaft of the blower fan.

Accordingly, air may be suctioned into the housing 3010 through the inlet arranged at the outside in the radial direction of the heat exchanger 3030 by operation of the blower fan 3040, air may be moved toward the heat exchanger 3030 arranged at an inside in a radial direction of the inlet 3050, and air inside the housing 3010 may be heat-exchanged with the heat exchanger 3030 and introduced into the blower fan 3040.

Then, heat-exchanged air may be discharged toward the rotating shaft of the blower fan 3040, i.e., toward a lower side of a central portion of the blower fan 3040, by the blower fan 3040. Accordingly, air may be discharged toward the outside of the housing 310 through the outlet 3110 along a discharge guide 3020. By such a configuration, the air conditioner 3001 may suction air from an indoor space, cool the air, and then discharge the air back to the indoor space, or suction air from an indoor space, heat the air, and then discharge the air back to the indoor space.

The heat exchanger 3030 may be provided inside the housing 3010 and may be arranged on a flow passage of air between the inlet 3050 and the outlet 3110. The heat exchanger 3030 may be formed of a tube (not illustrated) through which refrigerant flows, and a header (not illustrated) connected to an external refrigerant tube to supply or recover refrigerant to or from the tube. A heat-exchange fin may be provided in the tube to expand a heat dissipation area.

The heat exchanger 3030 may have a substantially ring shape when viewed in the vertical direction. The shape of the heat exchanger 3030 may correspond to the shape of the housing 3010. The shape of the heat exchanger 3030 may correspond to the shape of the inlet 3050. The heat exchanger 3030 may be placed on a drain tray 3016, and condensate generated in the heat exchanger 3030 may be collected in the drain tray 3016.

Hereinafter, the discharge grille 3100 and the driving device 3150 configured to move the discharge grille 3100 will be described in detail.

Figure 47:
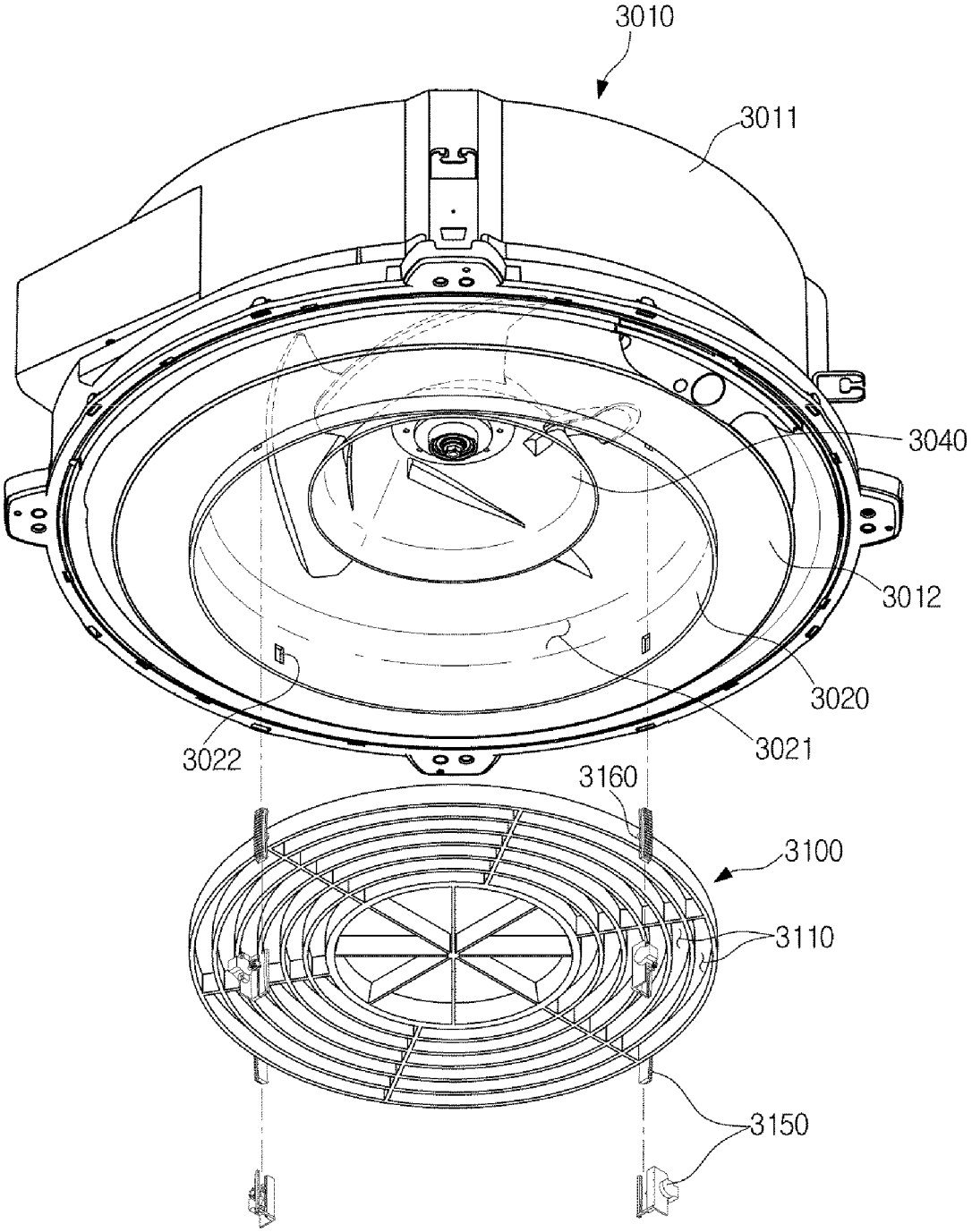
FIG. 47 is an exploded perspective view of a partial configuration of the air conditioner according to yet another embodiment of the present disclosure.
Figure 48:
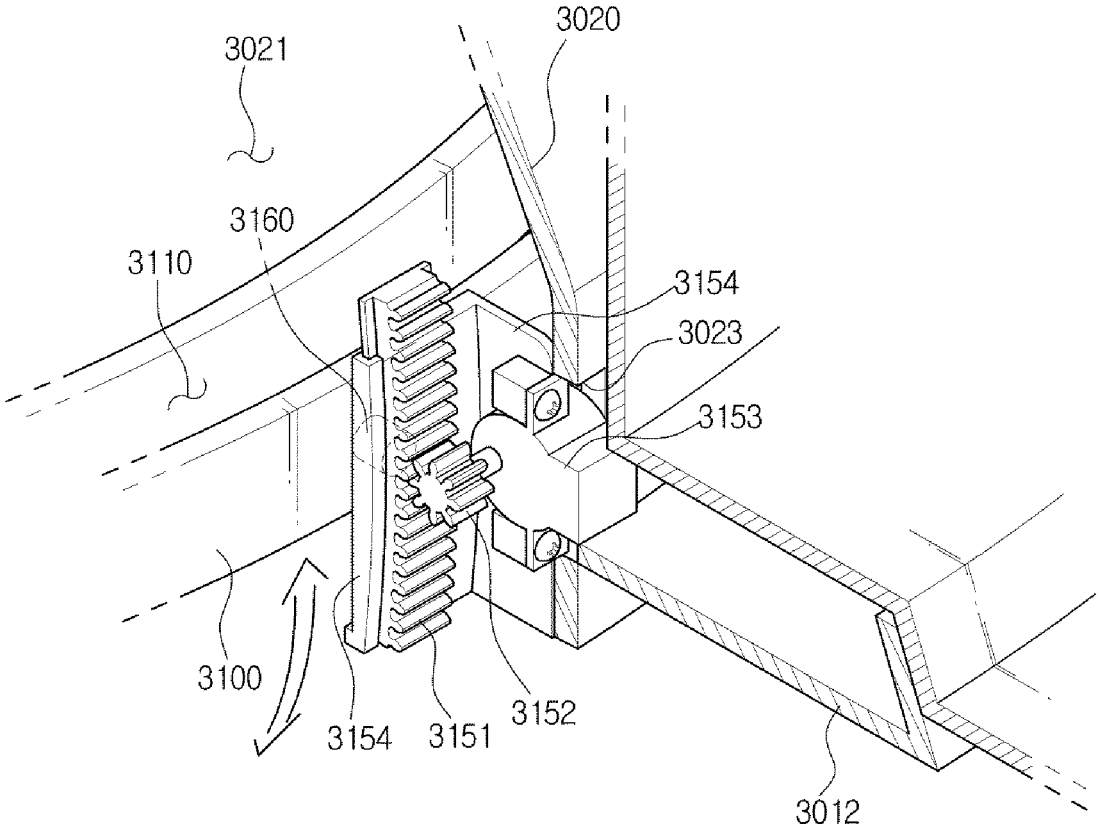
FIG. 48 is an enlarged perspective view of a driving device of the air conditioner according to yet another embodiment of the present disclosure.
Figure 49:
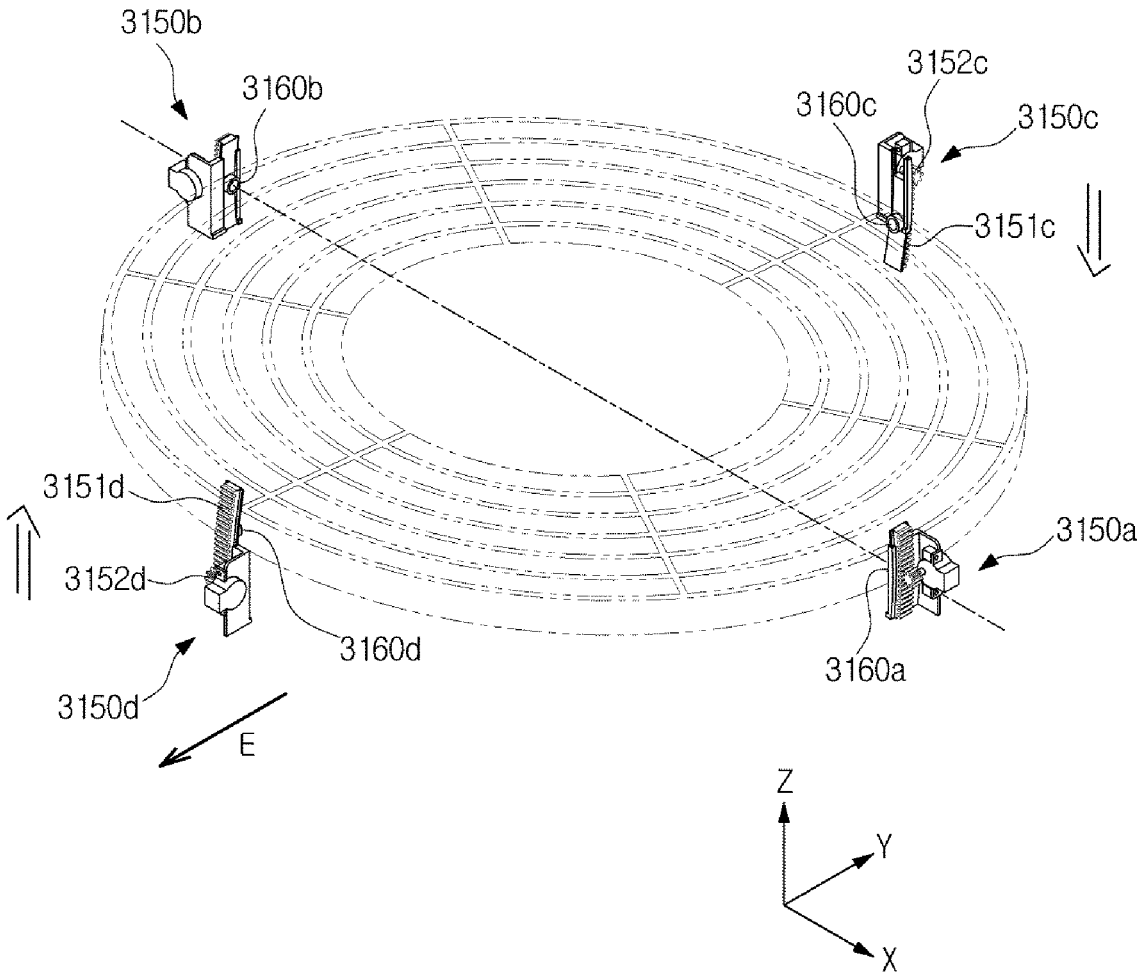
FIGS. 49 and 50 are views illustrating a state in which four driving devices of the air conditioner according to yet another embodiment of the present disclosure is being operated.
Figure 50:
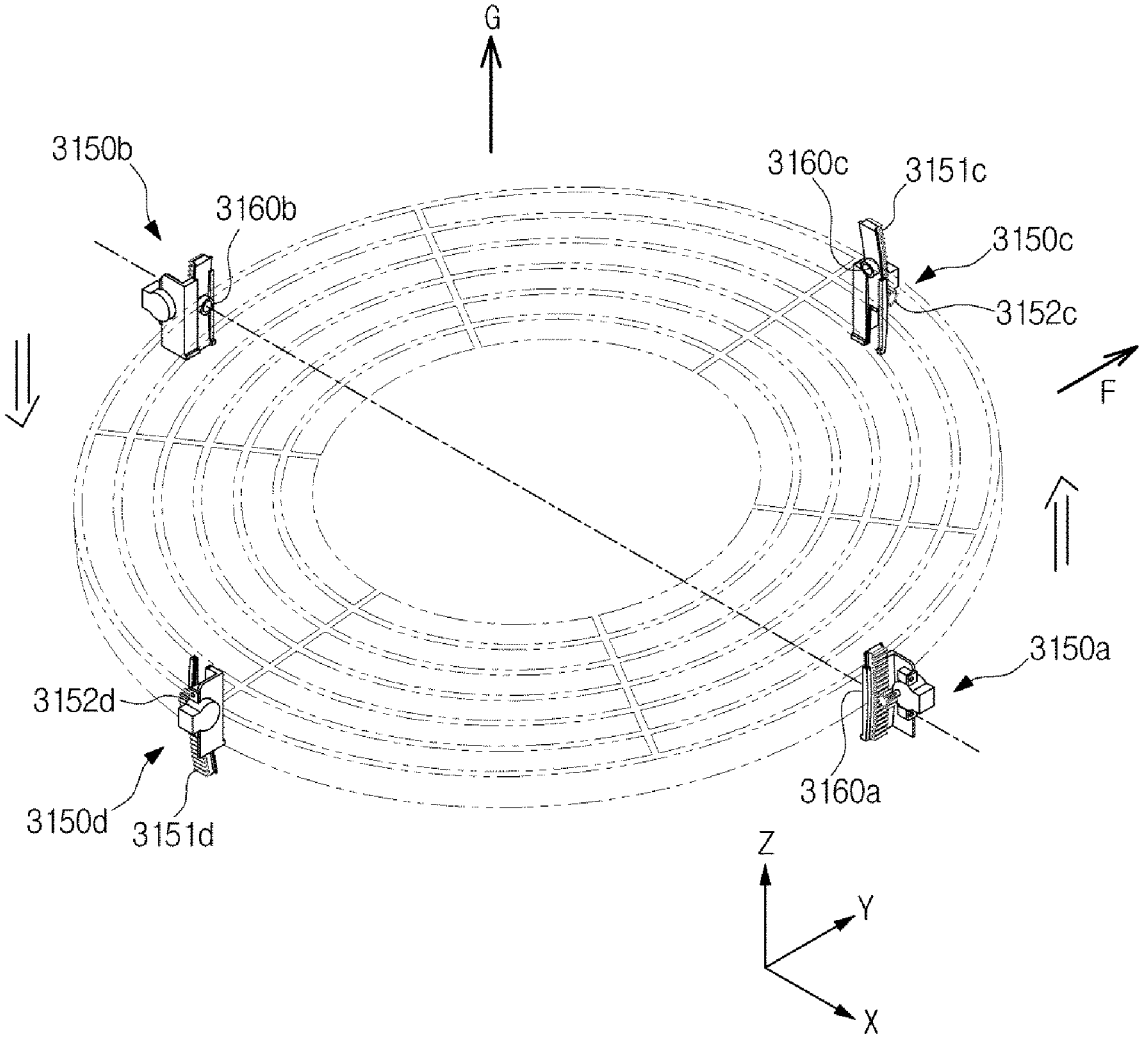
Figure 51:
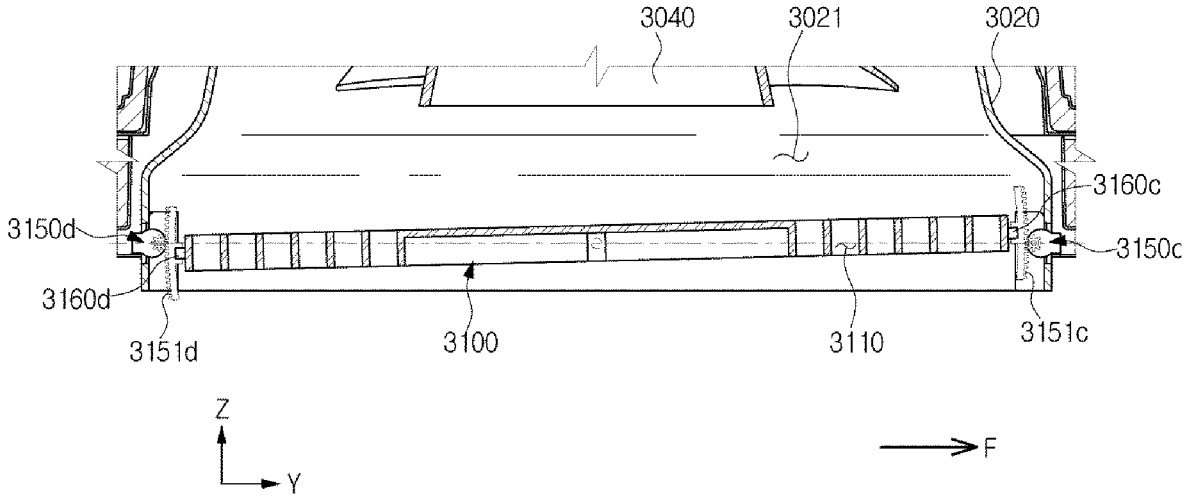
FIG. 51 is a lateral cross-sectional view of a part of the air conditioner in a state in which a portion of a discharge grille is moved downward by the driving device of the air conditioner illustrated in FIG. 46.
Figure 52:
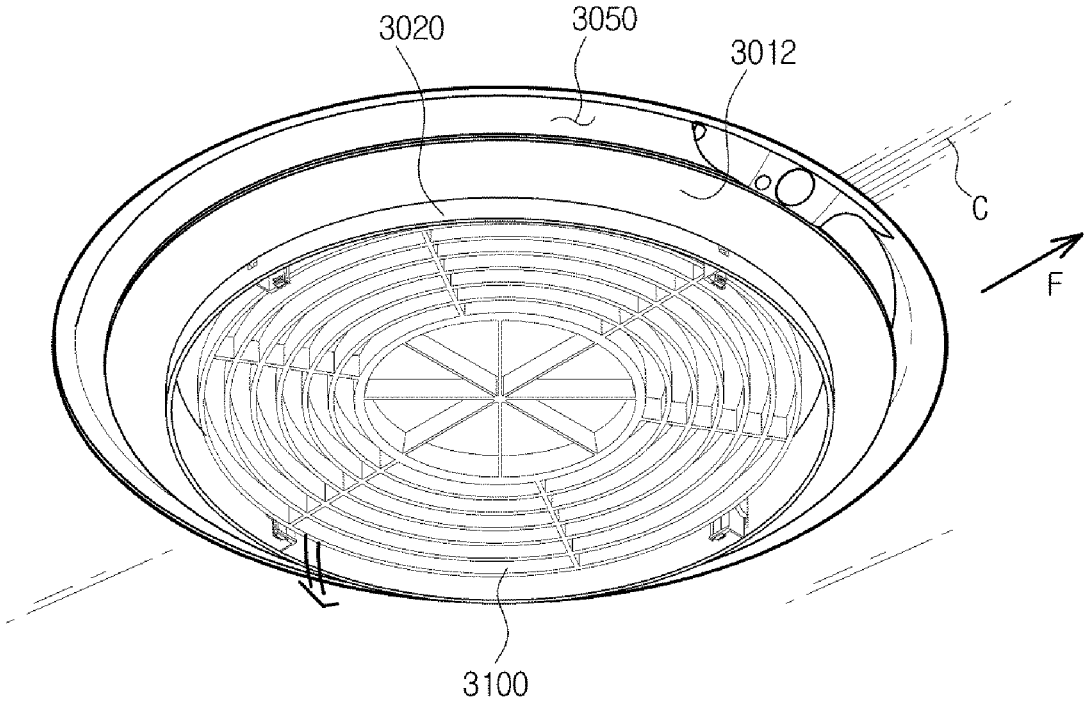
FIG. 52 is a perspective view of the air conditioner in the state illustrated in FIG. 51.
Figure 53:
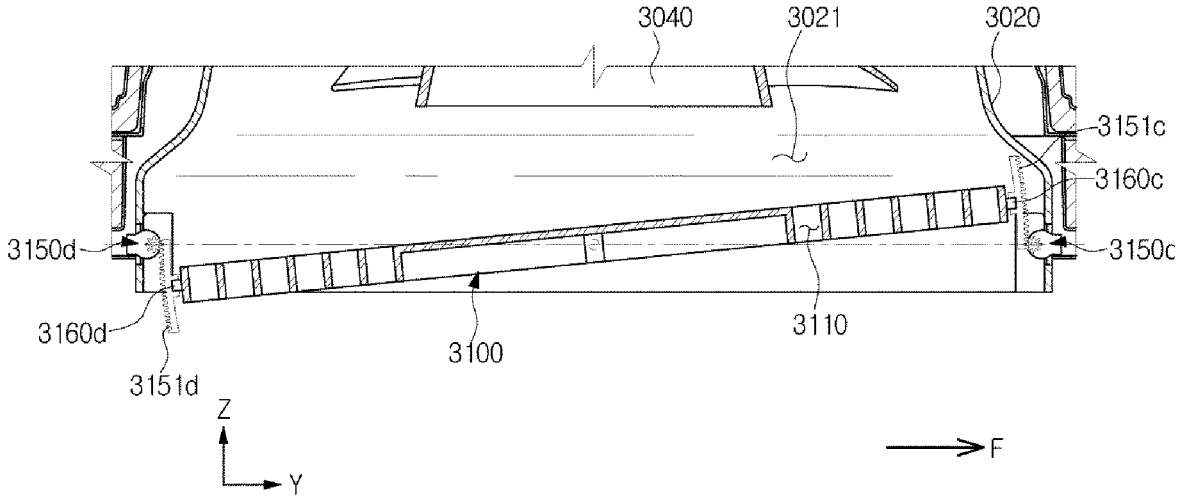
FIG. 53 is a lateral cross-sectional view of the air conditioner in a state in which the discharge grille is moved further downward by the driving device of the air conditioner illustrated in FIG. 51.
Figure 54:
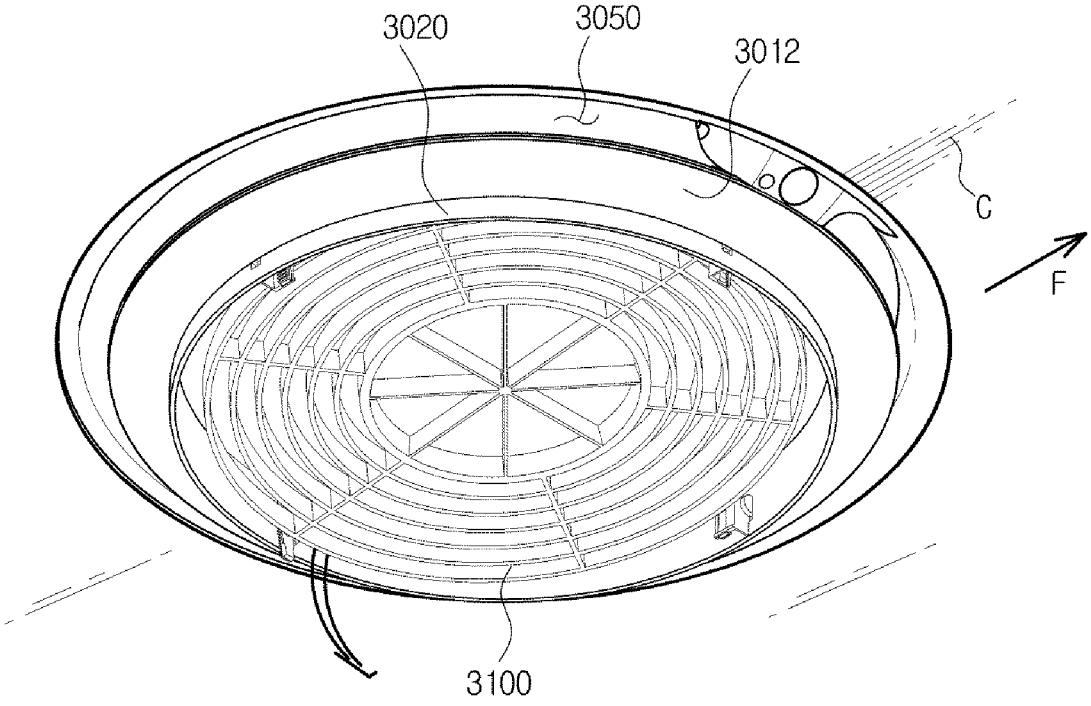
FIG. 54 is a perspective view of the air conditioner in the state illustrated in FIG. 53.
Figure 55:
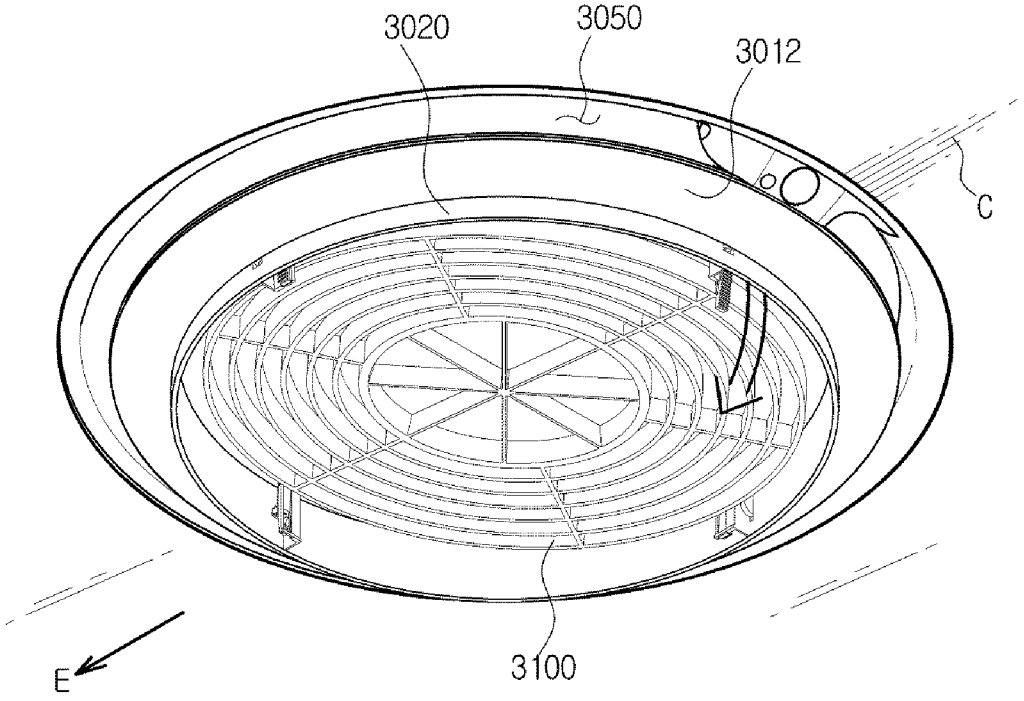
FIG. 55 is a perspective view of the air conditioner in a state in which the discharge grille is moved to the opposite side by the driving device from the state illustrated in FIG. 49.

FIG. 47 is an exploded perspective view of a partial configuration of the air conditioner according to yet another embodiment of the present disclosure, FIG. 48 is an enlarged perspective view of a driving device of the air conditioner according to yet another embodiment of the present disclosure, FIGS. 49 and 50 are views illustrating a state in which four driving devices of the air conditioner according to yet another embodiment of the present disclosure is being operated. FIG. 51 is a lateral cross-sectional view of a part of the air conditioner in a state in which a portion of a discharge grille is moved downward by the driving device of the air conditioner illustrated in FIG. 46, FIG. 52 is a perspective view of the air conditioner in the state illustrated in FIG. 51, FIG. 53 is a lateral cross-sectional view of the air conditioner in a state in which the discharge grille is moved further downward by the driving device of the air conditioner illustrated in FIG. 51, FIG. 54 is a perspective view of the air conditioner in the state illustrated in FIG. 53, and FIG. 55 is a perspective view of the air conditioner in a state in which the discharge grille is moved to the opposite side by the driving device from the state illustrated in FIG. 49.

As illustrated in FIG. 47, the discharge grille 3100 may be arranged below the blower fan 3040 and provided at a central side of the lower housing 3012. The discharge grille 3100 may include the outlet 3110 through which air being discharged toward the outside of the housing 3010 by the blower fan 3040 passes.

Specifically, the discharge grille 3100 may be arranged at an opening 3021 of the discharge guide 3020 that forms a discharge flow passage through which air being discharged by the blower fan 3040 is conveyed. Air flowing along the discharge guide 3020 may be discharged toward the outside of the housing 3010 through the discharge grille 3100.

The discharge grille 3100 may preferably be provided in the shape of a circular plate, but the shape is not limited thereto, and may also be provided in the shape of a polygonal plate.

The driving device 3150 may be arranged at an edge of the discharge grille 3100. Specifically, a plurality of driving devices 3150 may be provided. The number of driving devices 3150 according to the present disclosure may be four. However, the number of driving devices 3150 is not limited to the embodiment of the present disclosure, and may be other numbers.

The plurality of driving devices 3150 may be arranged by being coupled to the edge of the discharge grille 3100, i.e., an outer circumferential surface of the discharge grille 3100, and be spaced apart from one another. Preferably, the driving devices 3150 may be arranged to be symmetrically spaced apart from one another with respect to the discharge grille 3100.

The driving device 3150 may move at least one side of the discharge grille 3100 in the vertical direction to enable the discharge grille 3100 to be arranged in various directions. That is, the driving device 3150 may be provided to be elongatable in the vertical direction and adjust a height of a coupling portion 3160 of the discharge grille 3100 coupled to the driving device 3150 at the discharge grille 3100 to enable the discharge grille 3100 to be arranged by forming various angles.

However, the driving device 3150 is not limited to the embodiment of the present disclosure. The driving device 3150 may not be directly coupled to the discharge grille 3100, may be arranged between the discharge grille 3100 and the discharge guide 3020, and may be coupled to a separate element coupled to the discharge grille 3100 to move the discharge grille 3100.

The discharge grille 3100 provided at the opening 3021 of the discharge guide 3020 is an element through which air being discharged toward the outside of the housing 3010 by the blower fan 3040 passes. As described above, the discharge grille 3100 may include the outlet 3110 through which air being discharged passes.

Accordingly, the outlet 3110 faces a direction in which the discharge grille 3100 is arranged, air being discharged is discharged in the direction faced by the outlet 3110, and discharged airflow may be formed in the direction of the outlet 3110.

Consequently, discharged airflow may be more easily controlled, compared to the related art in which angles of a plurality of blades are adjusted to control discharged airflow, by adjusting a direction in which the discharge grille 3100 is arranged. This will be described in detail below.

As illustrated in FIG. 48, the driving device 3150 may be elongated in the shape of a rack-pinion gear in the vertical direction. The driving device 3150 may include a rack gear 3151 arranged at the coupling portion 3160 of the discharge grille 3100, a pinion gear 3152 coupled to the inside of the housing 3010 and engaged with the rack gear 3151, a driving motor 3153 configured to transmit a driving force to the pinion gear 3152, and a rack guide 3154 configured to guide the rack gear 3151 in the vertical direction. Also, although not illustrated in the drawings, a stopper (not illustrated) in the form of a protrusion configured to prevent the rack gear 3151 from being separated from the driving device 3150 may be provided above the rack gear 3151.

The rack gear 3151 may be provided to extend in the vertical direction and may be arranged at the edge of the discharge grille 3100. That is, four rack gears 3151 may be symmetrically arranged at 90° intervals with respect to the circumferential direction of the discharge grille 3100 along the edge of the discharge grille 3100.

The rack gear 3151 may be engaged with the pinion gear 3152 and move in the vertical direction, and, as the rack gear 3151 moves in the vertical direction, the coupling portion 3160 of the discharge grille 3100 coupled to the rack gear 3151 may be moved in the vertical direction.

Four coupling portions 3160 may be provided at the edge of the discharge grille 3100 to correspond to the four rack gears 3151. Heights at which the four coupling portions 3160 are arranged may be adjusted by lifting or lowering the rack gears 3151, and, accordingly, the arrangement of the discharge grille 3100 may be adjusted. The will be described in detail below with a method of controlling discharged airflow according to an embodiment of the present disclosure.

The pinion gear 3152 may be arranged to be engaged with the rack gear 3151, be coupled to a rotating shaft of the driving motor 3153, transmit a rotational force of the driving motor 3153 to the rack gear 3151, and enable the rack gear 3151 to be lifted and lowered.

In terms of the driving motor 3153, a portion of the driving motor 3153 corresponding to the pinion gear 3152 may be arranged at an inside of the discharge guide 3020, and the other portion thereof may be inserted into an outside of the discharge guide 3020 through an insertion groove 3022 provided at the discharge guide 3020 and arranged inside the lower housing 3012.

The rack guide 3154 may extend in an extending direction of the rack gear 3151, be provided in the form of surrounding both sides of the rack gear 3151 to guide the rack gear 3151 so that the rack gear 3151 may be moved in the vertical direction, and prevent the rack gear 3151 from being separated from the driving device 3150.

The rack guide 3154 may be screw-coupled to a side adjacent to the insertion groove 3022 together with the driving motor 3153. However, embodiments are not limited thereto, and the rack guide 3154 may be integrally formed with the discharge guide 3020 or the lower housing 3012, or may be independently coupled to the discharge guide 3020 or the lower housing 3012 through a separate element.

Hereinafter, a method of controlling discharged airflow by the discharge grille 3100 being moved by the driving device 3150 will be described in detail.

As illustrated in FIGS. 49 and 50, the plurality of driving devices 3150 may be arranged at equal intervals at the edge of the discharge grille 3100. One driving device 3150 or two driving devices 3150 may be formed, but, preferably, at least three driving devices 3150 may be formed.

When elongated lengths of at least two driving devices 3150 among the plurality of driving devices 3150 are different, at least two coupling portions 3160 among the plurality of coupling portions 3160 of the discharge grille 3100 coupled to the driving devices 3150 may be arranged at different positions in the vertical direction, and the discharge grille 3100 may be obliquely arranged.

Here, when three or more driving devices 3150 are provided, elongated heights of three driving devices 3150 may be adjusted, and the discharge grille 3100 may be arranged to be inclined in all directions around 360° with respect to a central axis of the housing 3010. Thus, the outlet 3110 provided at the discharge grille 3100 may face all radial directions of the heat exchanger 3030 or all radial directions of the discharge grille 3100.

Accordingly, because discharged airflow being discharged through the outlet 3110 is formed in a direction faced by the discharge grille 3100, air may be discharged in all directions with respect to a side surface of the housing 3010.

When the driving device 3150 does not operate, because the discharge grille 3100 is arranged at a horizontal position with respect to the lower housing 3012, the outlet 3110 may be arranged to face a lower side of the housing 3010, and air discharged by passing through the outlet 3110 may form descending airflow and generate centralized airflow below the air conditioner 3001.

However, when the driving device 3150 is elongated, the discharge grille 3100 may be obliquely arranged with respect to the lower housing 3012, the outlet 3110 may face a direction in which the discharge grille 3100 is obliquely arranged, and discharged airflow may be formed in the direction faced by the outlet 3110.

As described above, the plurality of driving devices 3150 may have different elongated lengths, i.e., as lifted and lowered lengths of the rack gears 3151 are changed, vertical heights of the coupling portions 3160 corresponding thereto are changed. Thus, the discharge grille 3100 may be arranged so that the outlet 3110 may face all side directions, a direction in which discharged airflow is generated may be adjusted by the arrangement of the discharge grille 3100, and discharged airflow may be easily controlled.

Specifically, as illustrated in FIG. 49, a first driving device 3150*a* and a second driving device 3150*b* symmetrically provided along any X-axis and a third driving device 3150*c* and a fourth driving device 3150*d* symmetrically provided along a Y-axis may be arranged to be spaced apart at equal intervals at the discharge grille 3100 as the plurality of driving devices 3150.

When discharged airflow in the Y-axis direction (a direction E) in which the fourth driving device 3150*d* is arranged is required to be formed, the third driving device 3150*c* and the fourth driving device 3150*d* arranged in the direction E may be elongated in the vertical direction (a direction Z) so that the discharge grille 3100 heads toward the direction E.

That is, a rack gear 3151*d* of the fourth driving device 3150*d* arranged in the direction E may be lifted by rotation of a pinion gear 3152*d*, a rack gear 3151*c* of the third driving device 3150*c* may be lowered by rotation of a pinion gear 3152*c*, and the discharge grille 3100 may be arranged to be inclined toward the direction E.

A coupling portion 3160*d* corresponding to the fourth driving device 3150*d* is moved upward with respect to a Z-axis as the rack gear 3151*d* of the fourth driving device 3150*d* is lifted, and a coupling portion 3160*c* corresponding to the third driving device 3150*c* is moved downward with respect to the Z-axis as the rack gear 3151*c* of the third driving device 3150*c* is lowered. In this way, the discharge grille 3100 may be arranged to be inclined by a height different between the two coupling portions 3160*c* and 3160*d*.

The pinion gear 3152*c* of the third driving device 3150*c* and the pinion gear 3152*d* of the fourth driving device 3150*d* may be rotated in opposite directions from each other, may be respectively lowered and lifted, and may cause the discharge grille 3100 to be obliquely arranged.

As illustrated in FIG. 50, when discharged airflow in a Y-axis direction (a direction F) in which the third driving device 3150*c* is arranged, which is the opposite direction of the direction E, is required to be formed, opposite to heading toward the direction E as described above, the rack gear 3151*d* of the fourth driving device 3150*d* may be lowered by rotation of the pinion gear 3152*d*, the rack gear 3151*c* of the third driving device 3150*c* may be lifted by rotation of the pinion gear 3152*c*, and the discharge grille 3100 may be arranged to be inclined toward the direction F.

That is, each of the pinion gear 3152*c* of the third driving device 3150*c* and the pinion gear 3152*d* of the fourth driving device 3150*d* is rotated in the opposite direction from the rotating direction when the discharge grille 3100 is arranged in the direction E, and the discharge grille 3100 may be arranged to be inclined in the direction F.

Although not illustrated in the drawings, by such an operation, the discharge grille 3100 may be arranged toward the X-axis direction by elongation toward the Z-axis direction of the first driving device 3150*a* and the second driving device 3150*b* arranged in the X-axis direction when discharged airflow in the X-axis direction is required to be formed.

Also, when discharged airflow in any one direction G that crosses the X-axis and the Y-axis (see FIG. 50) is required to be formed, at least two driving devices 3150*b* and 3150*c* which are adjacent to the direction G may move the coupling portions 3160*b* and 3160*c* corresponding thereto upward, at least two driving devices 3150*a* and 31504 which are arranged in the opposite side of the direction G may move the coupling portions 3160*a* and 3160*d* corresponding thereto downward, and the discharge grille 3100 may be arranged to head toward the direction G.

Here, the direction G may be any direction with respect to the X-axis and the Y-axis, instead of the direction illustrated in FIG. 50. The discharge grille 3100 may be arranged in all directions G by the four driving devices 3150.

As illustrated in FIGS. 51 and 53, a height to which the driving device 3150 is lifted may vary according to a direction in which discharged airflow is attempted to be formed. When only a portion of discharged airflow is attempted to be formed toward the direction F, only a portion of the rack gear 3151*d* of the fourth driving device 3150*d* may be lifted and only a portion of the rack gear 3151*c* of the third driving device 3150*c* may be lowered as illustrated in FIG. 51.

Accordingly, the coupling portion 3160*d* corresponding to the fourth driving device 3150*d* and the coupling portion 3160*c* corresponding to the third driving device 3150*c* may be arranged without having a large height difference. Consequently, because an angle at which the discharge grille 3100 is inclined is not large, the discharged airflow formed toward the direction F may have a small size, and most of the discharged airflow may be formed to be descending airflow.

Unlike the above, as illustrated in FIG. 53, an elongation difference between the third driving device 3150*c* and the fourth driving device 3150*d* may be increased, the coupling portions 3160*c* and 3160*d* may thus be arranged to have a large height difference, an angle at which the discharge grille 3100 is inclined may be further increased, and a larger amount of air may be discharged toward the direction F compared to the state illustrated in FIG. 51.

As illustrated in FIGS. 52 and 54, the discharge grille 3100 may be arranged to be further inclined toward the direction F when more discharged airflow is attempted to be formed in the direction F. When the outlet 3110 is arranged to be closer to the direction F, discharged airflow passing through the outlet 3110 is formed in the direction faced by the outlet 3110, and discharged airflow that is closer to the direction F may be formed.

Also, as illustrated in FIG. 55, to form discharged airflow toward the direction E, which is the opposite direction of the direction F, the discharge grille 3100 may be obliquely arranged so that the outlet 3110 is in the direction E.

Heights to which the driving devices 3150*a*, 3150*b*, 3150*c*, and 3150*d* are lifted may be controlled independently from each other by a controller (not illustrated). When the user designates a desired air blowing direction and inputs the information in the controller (not illustrated), the controller (not illustrated) may analyze a directional value related to the information, control heights to which the driving devices 3150*a*, 3150*b*, 3150*c*, and 3150*d* are elongated, control a direction and a slope in which the discharge grille 3100 is arranged, and, accordingly, control discharged airflow formed in the air conditioner 3001.

As illustrated in FIGS. 51 and 53, a height to which the coupling portion 3160 may be moved may be set according to a length of the rack gear 3151. That is, a height to which the rack gear 3151 vertically extends may be the maximum distance that may be formed between the plurality of coupling portions 3160. Consequently, as the length of the rack gear 3151 is longer, an angle at which the discharge grille 3100 may be arranged may be larger and more discharged airflow may be formed sideward. Accordingly, the length in which the rack gear 3151 vertically extends is not limited to the embodiment of the present disclosure and may be set in consideration of a direction of air that has to be discharged sideward by the air conditioner 3001.

Hereinafter, a driving device according to yet another embodiment of the present disclosure will be described. Because elements other than the driving device, which will be described below, are the same as those of the air conditioner 3001 according to the embodiment described above, overlapping descriptions will be omitted.

Figure 56:
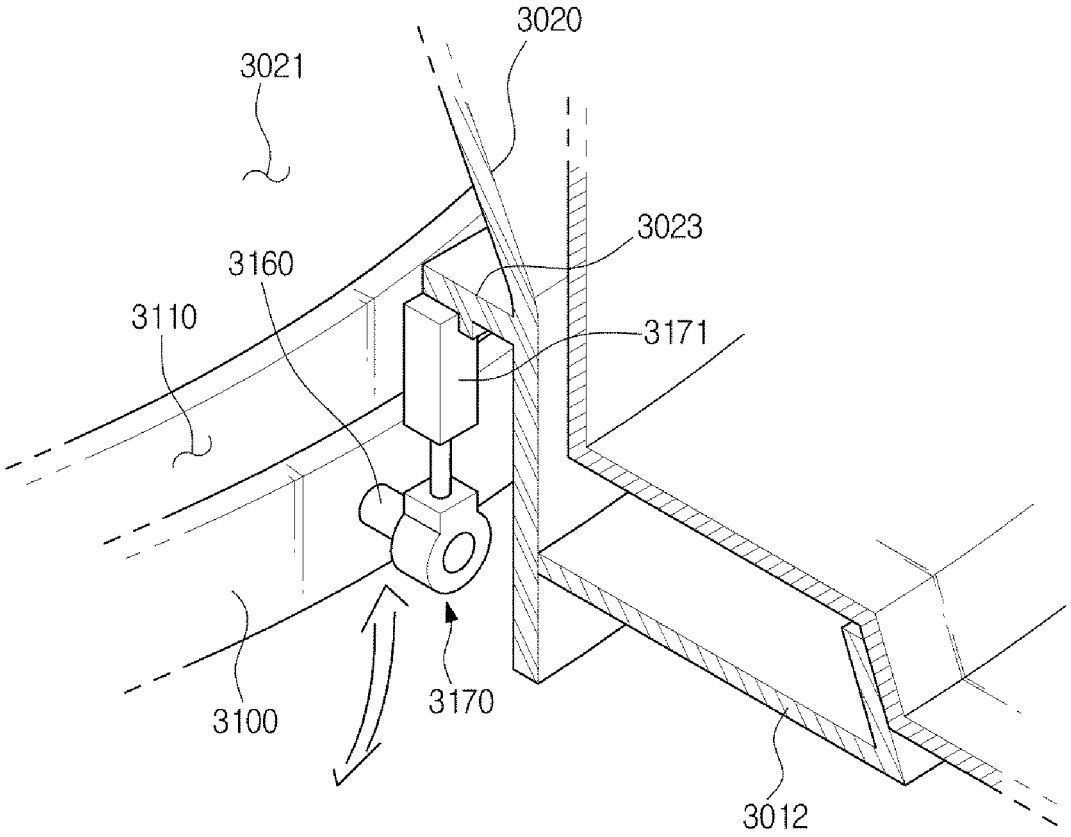
FIG. 56 is an enlarged perspective view of the driving device of the air conditioner according to yet another embodiment of the present disclosure.
Figure 57:
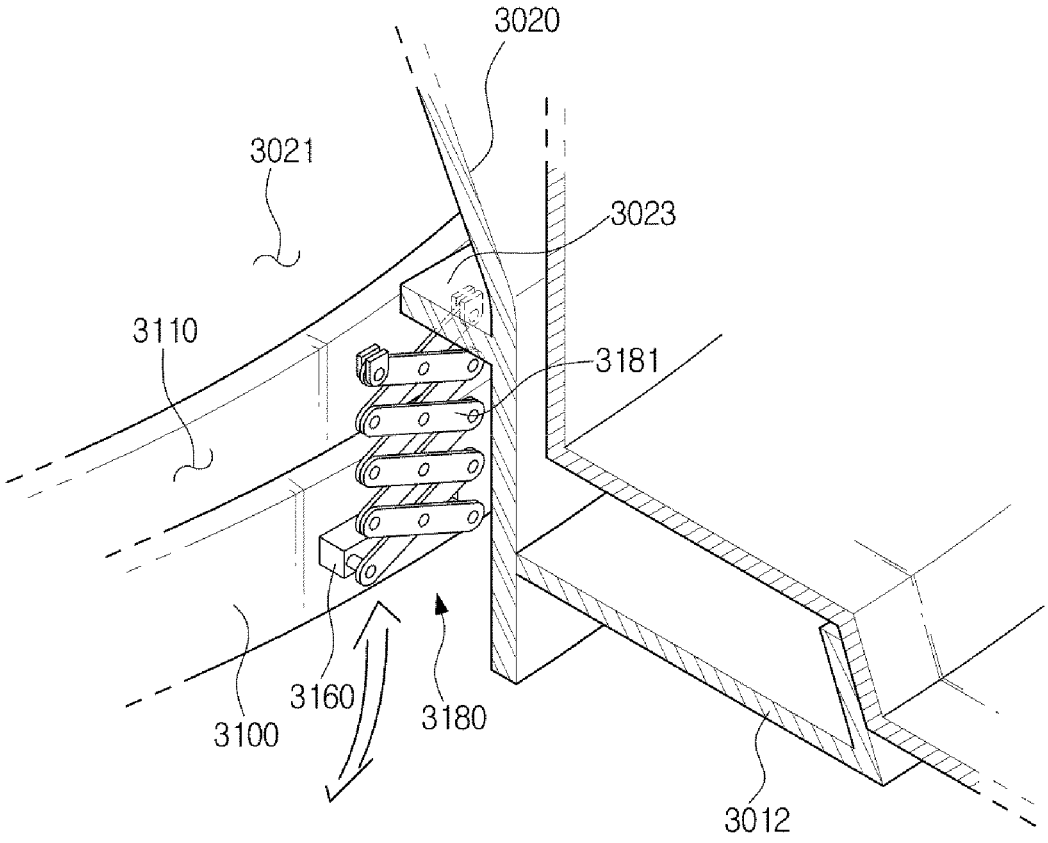
FIG. 57 is an enlarged perspective view of the driving device of the air conditioner according to yet another embodiment of the present disclosure.

Although a driving device may be provided in the form using the rack gear 3151 and the pinion gear 3152 as in yet another embodiment of the present disclosure described above, the driving device may also be formed as a driving device 3170 including an actuator or a driving device 3180 including a multi-link as illustrated in FIGS. 56 and 57.

As illustrated in FIG. 56, the driving device 3170 may include an actuator 3171 extending in the vertical direction. As the actuator 3171 is elongated in the vertical direction, a position at which a coupling portion 3160 corresponding to the driving device 3170 is arranged may be shifted in the vertical direction, and the discharge grille 3100 may be obliquely arranged with respect to the lower housing 3012.

One end of the actuator 3171 may be coupled to an edge of the discharge grille 3100. That is, one end of the actuator 3171 may be coupled to the coupling portion 3160 of the discharge grille 3100, and the other end of the actuator 3171 may be coupled to a coupling protrusion 3023 protruding toward the inside of the discharge guide 3020.

Accordingly, the actuator 3171 may be supported by the coupling protrusion 3023 within the discharge guide 3020 and provided to be elongatable downward. The position of the coupling portion 3160 may be set according to a length in which the actuator 3171 is elongated downward.

Also, as illustrated in FIG. 57, the driving device 3180 may include a multi-link 3181 extending in the vertical direction. The multi-link 3181 may have a plurality of inks scissor-coupled by a hinge, and a length thereof may be elongated in one direction. Accordingly, the multi-link 3181 may be arranged in the vertical direction and elongated in the vertical direction, a position at which a coupling portion 3160 corresponding to the driving device 3180 is arranged may be shifted in the vertical direction, and the discharge grille 3100 may be obliquely arranged with respect to the lower housing 3012.

One end of the multi-link 3181 may be coupled to an edge of the discharge grille 3100. That is, one end of the multi-link 3181 may be coupled to the coupling portion 3160 of the discharge grille 3100, and the other end of the multi-link 3181 may be coupled to the coupling protrusion 3023 protruding toward the inside of the discharge guide 3020.

Accordingly, the multi-link 3181 may be supported by the coupling protrusion 3023 within the discharge guide 3020 and provided to be elongatable downward. The position of the coupling portion 3160 may be set according to a length in which the multi-link 3181 is elongated downward.

Hereinafter, an air conditioner 3001' according to yet another embodiment of the present disclosure will be described. Because elements other than the element, which will be described below, are the same as those of the air conditioner 3001 according to yet another embodiment described above, descriptions thereof will be omitted.

Figure 58:
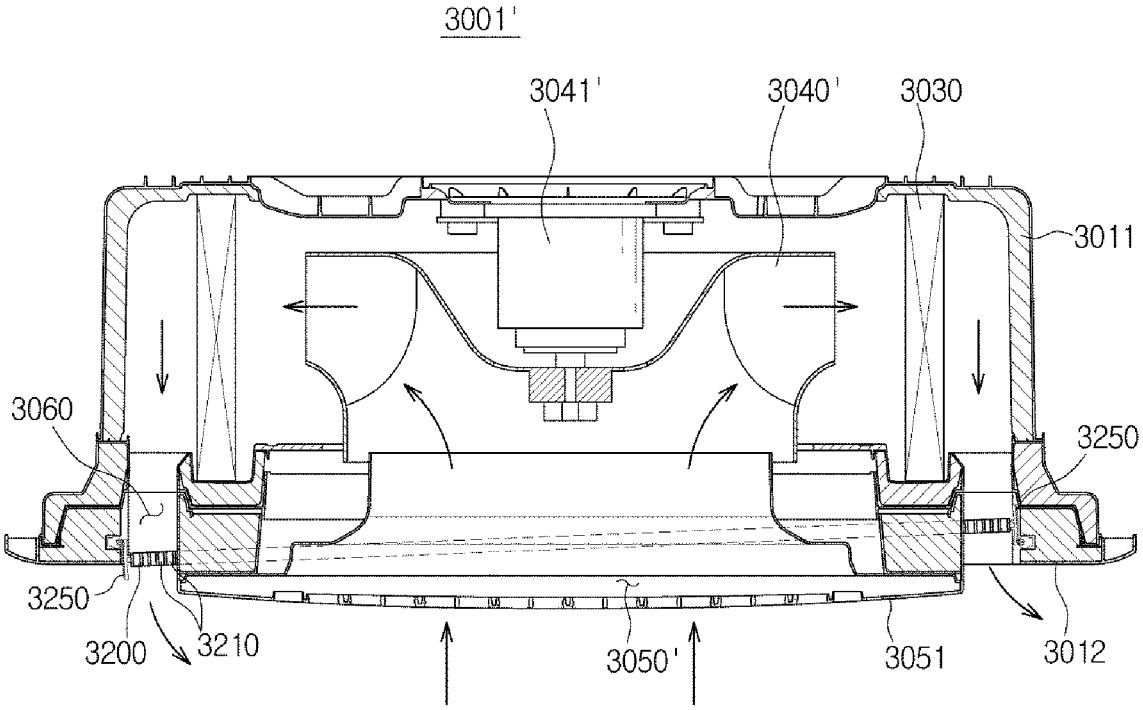
FIG. 58 is a lateral cross-sectional view of an air conditioner in a state in which a discharge grille is moved downward by a driving device of the air conditioner according to yet another embodiment of the present disclosure.
Figure 59:
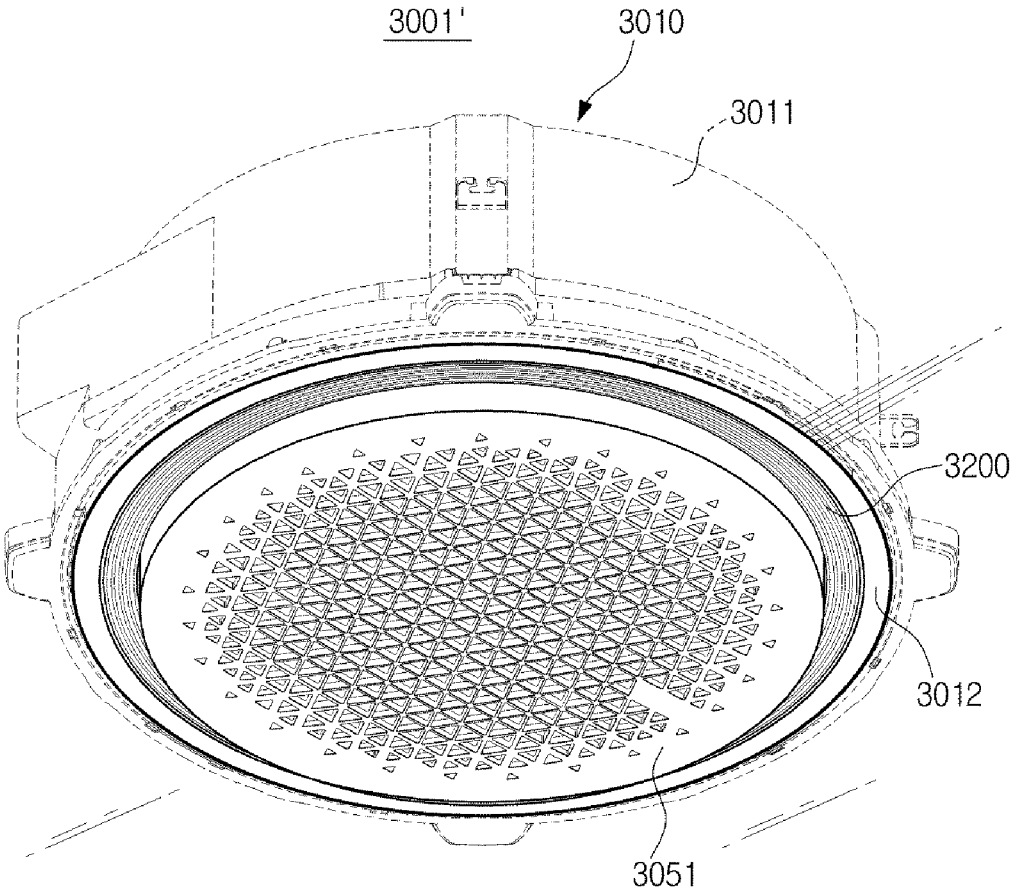
FIG. 59 is a perspective view of the air conditioner illustrated in FIG. 58.
Figure 60:
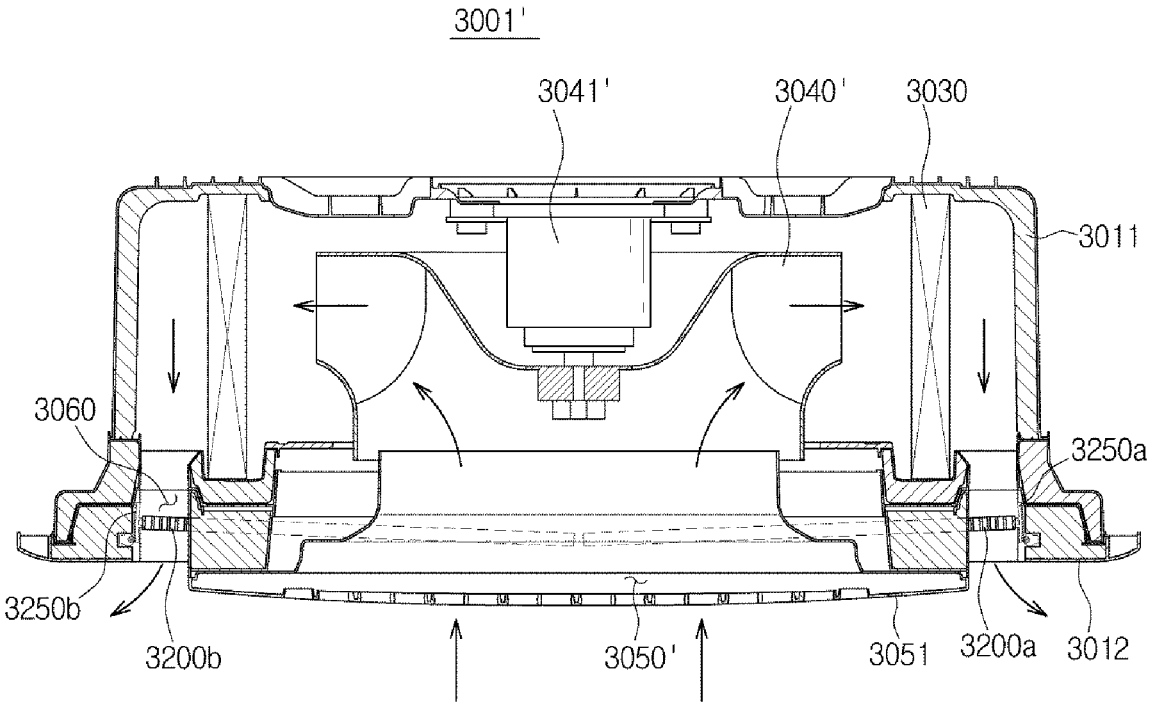
FIG. 60 is a lateral cross-sectional view of an air conditioner in a state in which a discharge grille is moved downward by a driving device of the air conditioner according to yet another embodiment of the present disclosure.
Figure 61:
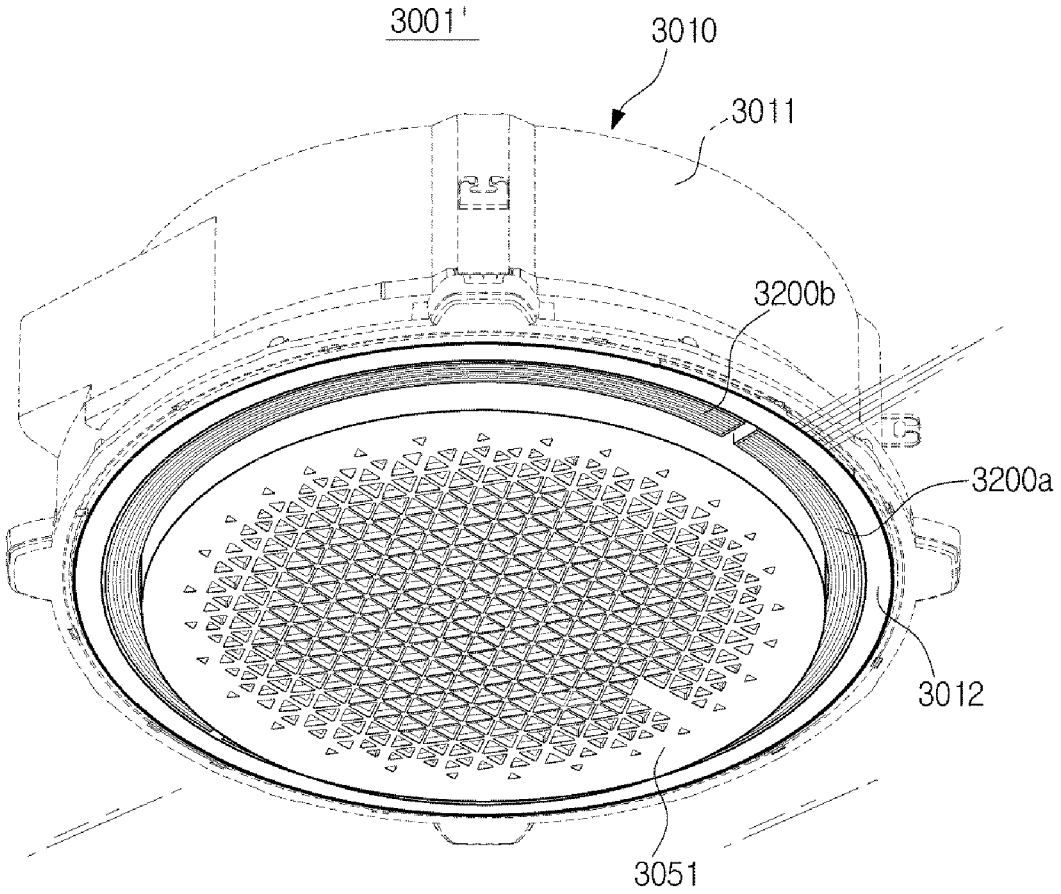
FIG. 61 is a perspective view of the air conditioner illustrated in FIG. 60.

FIG. 58 is a lateral cross-sectional view of an air conditioner in a state in which a discharge grille is moved downward by a driving device of the air conditioner according to yet another embodiment of the present disclosure, FIG. 59 is a perspective view of the air conditioner illustrated in FIG. 58, FIG. 60 is a lateral cross-sectional view of an air conditioner in a state in which a discharge grille is moved downward by a driving device of the air conditioner according to yet another embodiment of the present disclosure, and FIG. 61 is a perspective view of the air conditioner illustrated in FIG. 60.

As illustrated in FIG. 58, an inlet 3050' through which air is suctioned may be arranged at the central portion of the lower housing 3012. The discharge flow passage provided so that air suctioned through the inlet 3050' is heat-exchanged with the heat exchanger 3030 and discharged may be formed at an outside in a radial direction of the inlet 3050' and the outside in the radial direction of the heat exchanger 3030. Also, an opening 3060 through which air flowing along the discharge flow passage is discharged toward the outside of the housing 3010 may be provided at the outside in the radial direction of the heat exchanger 3030 in the lower housing 3012.

The discharge flow passage may be provided in a ring shape by the heat exchanger 3030 provided in a ring shape and the housing 3010 provided in a cylindrical shape. One side of the discharge flow passage 3050 may be connected to the heat exchanger 3030, and the other side thereof may be connected to the opening 3050 provided near the lower housing 3012.

By the above structure, the air conditioner 3001' may suction air from a lower side, cool and heat the air, and then discharge the air back to the lower side.

A blower fan 3040' may be provided at the inside in the radial direction of the heat exchanger 3030. The blower fan 3040' may be a centrifugal fan configured to suction air in the axial direction and discharge air in a radial direction. A blower motor 3041' configured to drive the blower fan 3040' may be provided in the air conditioner 3011'.

A discharge grille 3200 may be arranged at the opening 3060 of the discharge flow passage. The discharge grille 3200 may include a plurality of outlets 3210 through which air being discharged toward the outside of the housing 3010 passes by the blower fan 3040'.

Although the discharge grille 3200 may preferably be provided in the shape of a ring-shaped plate, embodiments are not limited thereto, and the discharge grille 3200 may be provided in the shape of a polygonal plate. Specifically, the discharge grille 3200 may have a shape corresponding to that of the opening 3060 of the discharge flow passage. That is, when the opening 3060 is formed in a polygonal shape, the discharge grille 3200 may be formed in a polygonal ring shape corresponding to the shape of the opening 3060.

A driving device 3250 may be arranged at an edge of the discharge grille 3200. Specifically, a plurality of driving devices 3250 may be provided. The number of driving devices 3250 according to the present disclosure may be four. However, the number of driving devices 3150 is not limited to the embodiment of the present disclosure, and may be other numbers.

The plurality of driving devices 3250 may be arranged by being coupled to the edge of the discharge grille 3200, i.e., an outer circumferential surface of the discharge grille 3200, and be spaced apart from one another. Preferably, the driving devices 3250 may be arranged to be symmetrically spaced apart from one another with respect to the discharge grille 3200.

At least two driving devices 3250 among the plurality of driving devices 3250 may be elongated in different lengths with respect to the vertical direction of the housing 3010 as in the embodiment described above. Thus, the discharge grille 3200 may be obliquely arranged with respect to the lower housing 3012, and discharged airflow may be controlled.

When the plurality of driving devices 3250 operate, as illustrated in FIG. 59, one side of the discharge grille 3200 provided in a ring shape may be lowered toward the lower side of the lower housing 3012, the other side of the discharge grille 3200 may be lifted toward the upper side of the lower housing 3012, and the discharge grille 3200 may be obliquely arranged.

As illustrated in FIGS. 60 and 61, ring-shaped discharge grilles 3200 may be separately provided. According to yet another embodiment of the present disclosure, two discharge grilles 3200*a* and 3200*b* may be separately formed. However, embodiments are not limited thereto, and three or more discharge grilles may be separately formed.

When the plurality of discharge grilles 3200*a* and 3200*b* are provided, a plurality of driving devices 3250*a* and 3250*b* corresponding thereto may be provided, and the plurality of driving devices 3250*a* and 3250*b* may be controlled independently.

Accordingly, although the discharge grille 3200 described above may be arranged toward one side by the driving device 3250 and form discharged airflow toward one side, the plurality of discharge grilles 3200*a* and 3200*b* may be arranged in different directions independently from each other and thus form discharged airflow in a plurality of directions.

Hereinafter, an air conditioner 3001" according to yet another embodiment of the present disclosure will be described. Because elements other than elements, which will be described below, are the same as those of the air conditioner 3001 according to yet another embodiment described above, descriptions thereof will be omitted.

Figure 62:
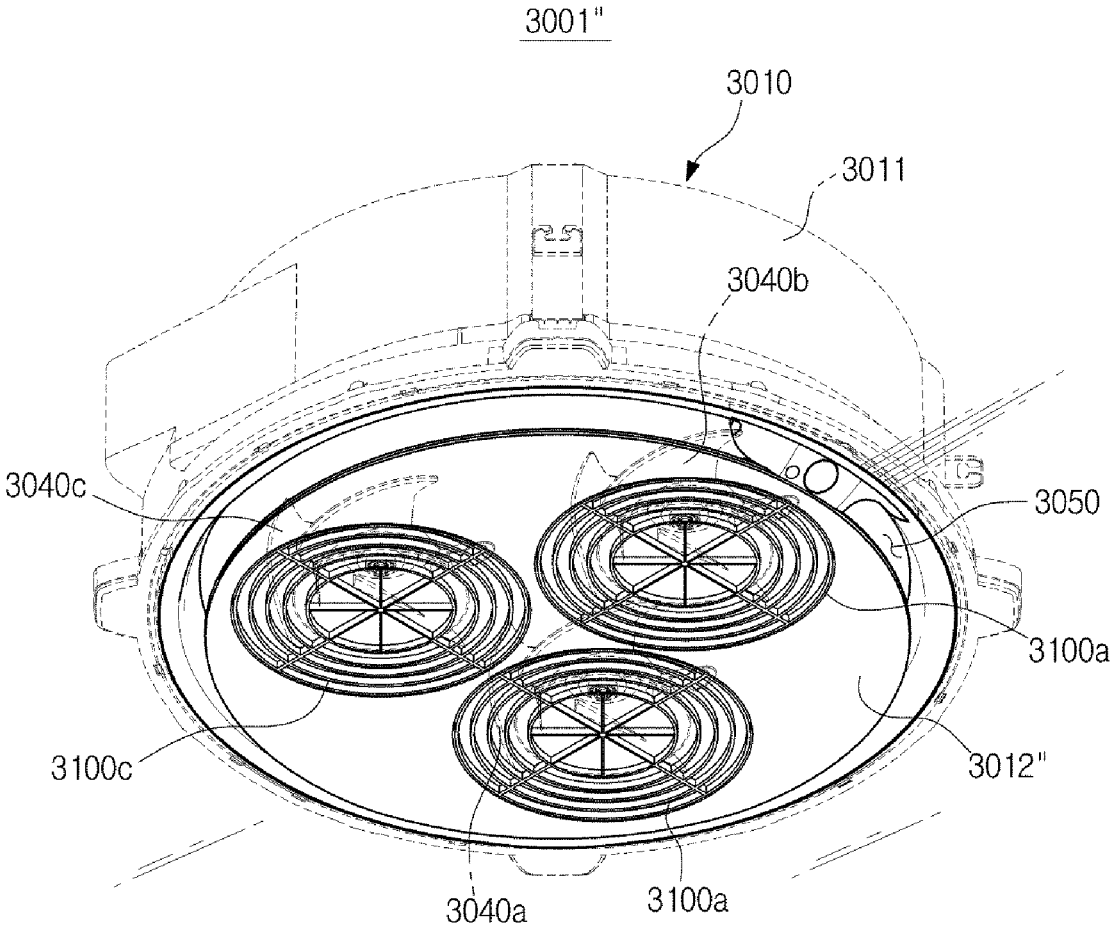
FIG. 62 is a perspective view of an air conditioner according to yet another embodiment of the present disclosure.

FIG. 62 is a perspective view of an air conditioner according to yet another embodiment of the present disclosure.

A plurality of blower fans 3040*a*, 3040*b*, and 3040*c* may be formed inside the housing 3010 of the air conditioner 3001" according to yet another embodiment of the present disclosure. As the plurality of blower fans 3040*a*, 3040*b*, and 3040*c* are formed, blower motors (not illustrated) and discharge guides (not illustrated) arranged adjacent to the blower fans 3040*a*, 3040*b*, and 3040*c* may be provided to correspond to the number of blower fans 3040*a*. 3040*b*, and 3040*c*.

Openings provided to enable air flowing by the blower fans 3040*a*, 3040*b*, and 3040*c* to be discharged toward the outside of the housing 3010 may be provided in the lower housing 3012 to correspond to the number of blower fans 3040*a*, 3040*b*, and 3040*c*. Accordingly, three openings may be formed in the lower housing 3012 according to yet another embodiment of the present disclosure.

Discharge grilles 3100*a*, 3100*b*, and 3100*c* having sizes corresponding to the openings may be provided in the three openings. The discharge grilles 3100*a*, 3100*b*, and 3100*c* may be obliquely arranged with respect to the lower housing 3012 by a plurality of driving devices (not illustrated) arranged at edges of the discharge grilles 3100*a*, 3100*b*, and 3100*c* and control discharged airflow.

Each of the discharge grilles 3100*a*, 3100*b*, and 3100*c* may be controlled independently by the plurality of driving devices (not illustrated) and independently control discharged airflow. Accordingly, the plurality of discharge grilles 3100*a*, 3100*b*, and 3100*c* may be arranged independently in different directions and form discharged airflow which are formed in a plurality of directions.

The blower fans 3040*a*, 3040*b*, and 3040*c* may be provided to be respectively coupled to the discharge grilles 3100*a*, 3100*b*, and 3100*c* arranged below the blower fans 3040*a*, 3040*b*, and 3040*c*. Here, the blower motors (not illustrated) and the discharge guides (not illustrated) provided to be adjacent to the blower fans 3040*a*, 3040*b*, and 3040*c* may also be provided to be coupled to the blower fans 3040*a*, 3040*b*, and 3040*c*, in addition to the blower fans 3040*a*, 3040*b*, and 3040*c* and the discharge grilles 3100*a*, 3100*b*, and 3100*c*. Accordingly, when the discharge grilles 3100*a*, 3100*b*, and 3100*c* are moved by the driving devices (not illustrated), the blower fans 3040*a*, 3040*b*, and 3040*c*, the blower motors, and the discharge guides may be moved by being interlocked in an assembly form.

That is, when the discharge grilles 3100*a*, 3100*b*, and 3100*c* are obliquely arranged in a predetermined direction by the driving devices (not illustrated), the blower fans 3040*a*, 3040*b*, and 3040*c* may be obliquely arranged by being interlocked to the discharge grilles 3100*a*, 3100*b*, and 3100*c*.

Accordingly, by rotating shafts of the blower fans 3040*a*, 3040*b*, and 3040*c* being arranged to correspond to sides at which the discharge grilles 3100*a*, 3100*b*, and 3100*c* are arranged, the blower fans 3040*a*, 3040*b*, and 3040*c* may blow air toward a direction in which the discharge grilles 3100*a*, 3100*b*, and 3100*c* are arranged. In other words, air blowing directions of the blower fans 3040*a*, 3040*b*, and 3040*c* may be controlled by the driving devices (not illustrated), and discharged airflow generated thereby may be directly controlled.

Hereinafter, an air conditioner 3001*a* according to yet another embodiment of the present disclosure will be described. Because elements other than elements, which will be described below, are the same as those of the air conditioner 3001 according to yet another embodiment described above, descriptions thereof will be omitted.

Figure 63:
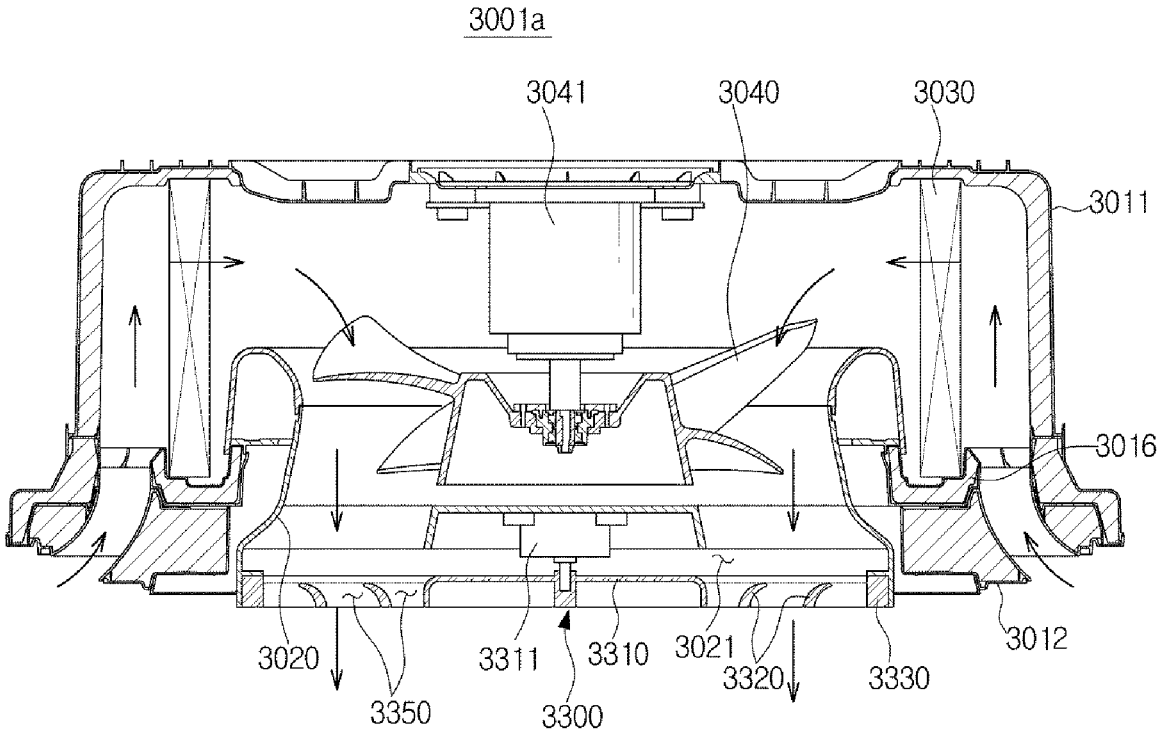
FIG. 63 is a lateral cross-sectional view of an air conditioner according to yet another embodiment of the present disclosure.
Figure 64:
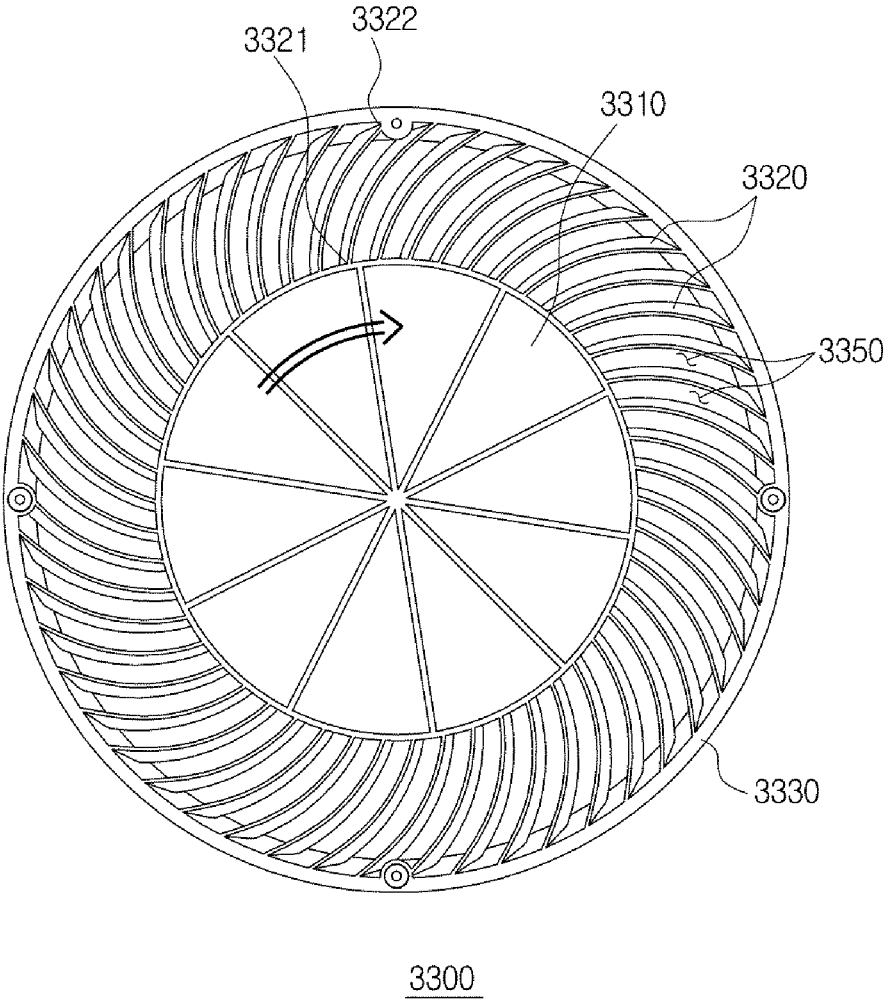
FIGS. 64 to 66 are views illustrating a state in which a shape of a discharge grille of the air conditioner is changed according to yet another embodiment of the present disclosure.
Figure 65:
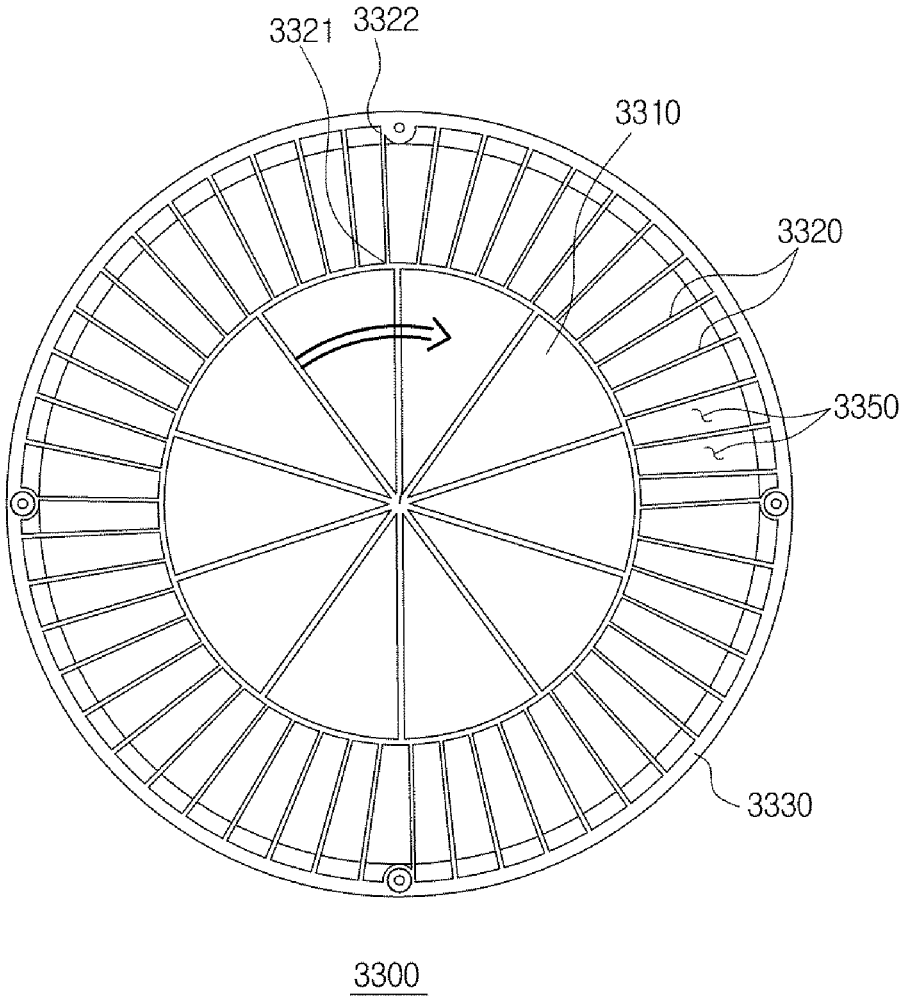
Figure 66:
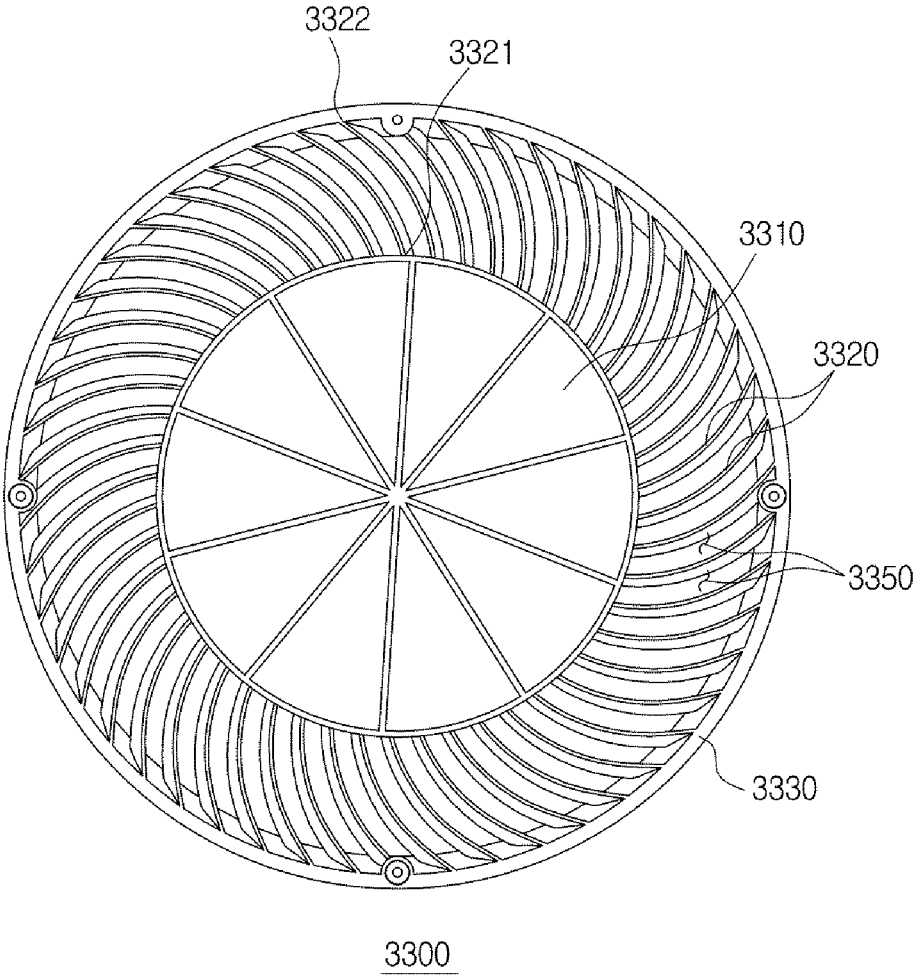
Figure 67:
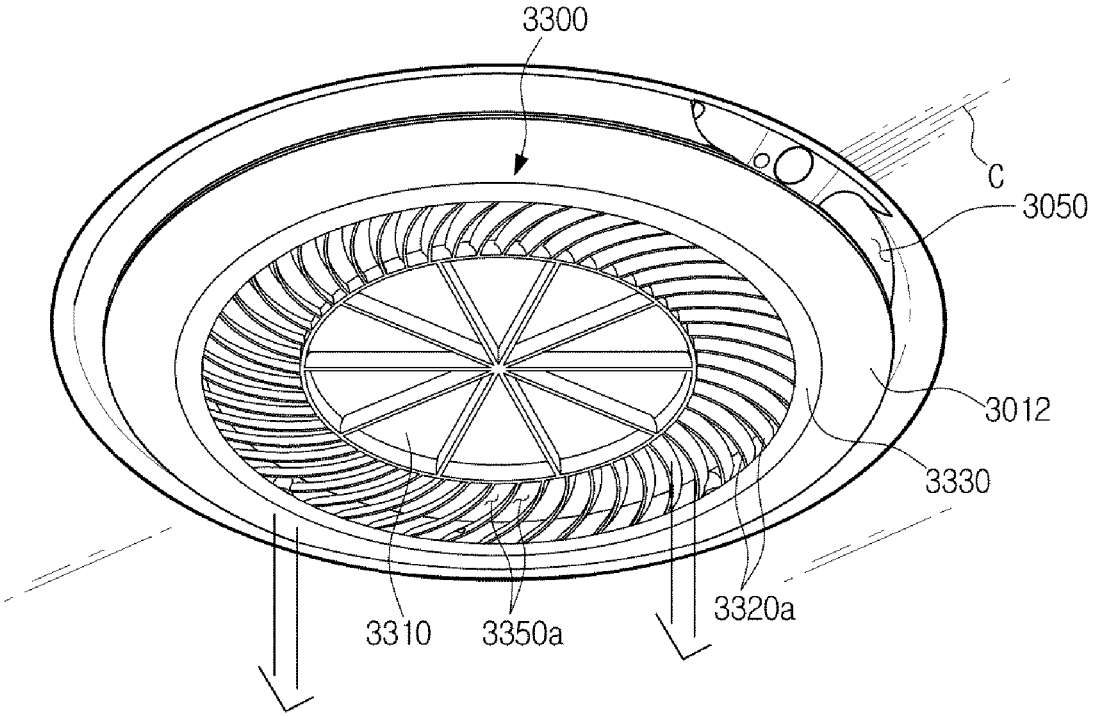
FIG. 67 is a rear view of the air conditioner according to yet another embodiment of the present disclosure.
Figure 68:
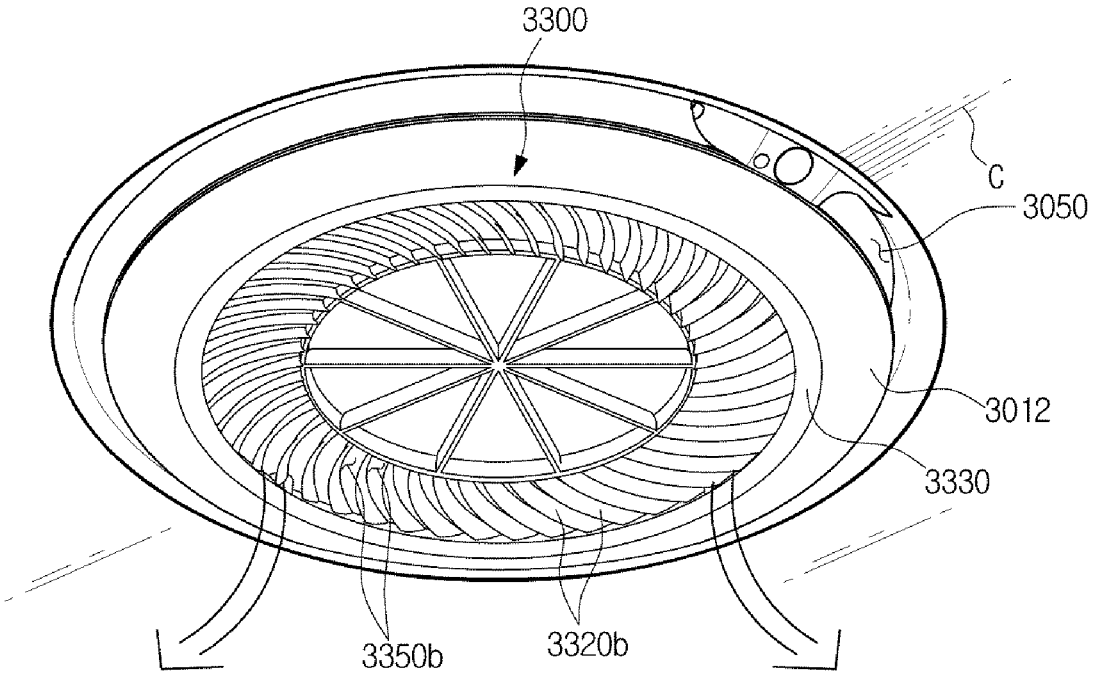
FIG. 68 is a view illustrating a state in which a shape of a blade of the discharge grille of the air conditioner illustrated in FIG. 67 is changed.
Figure 69:
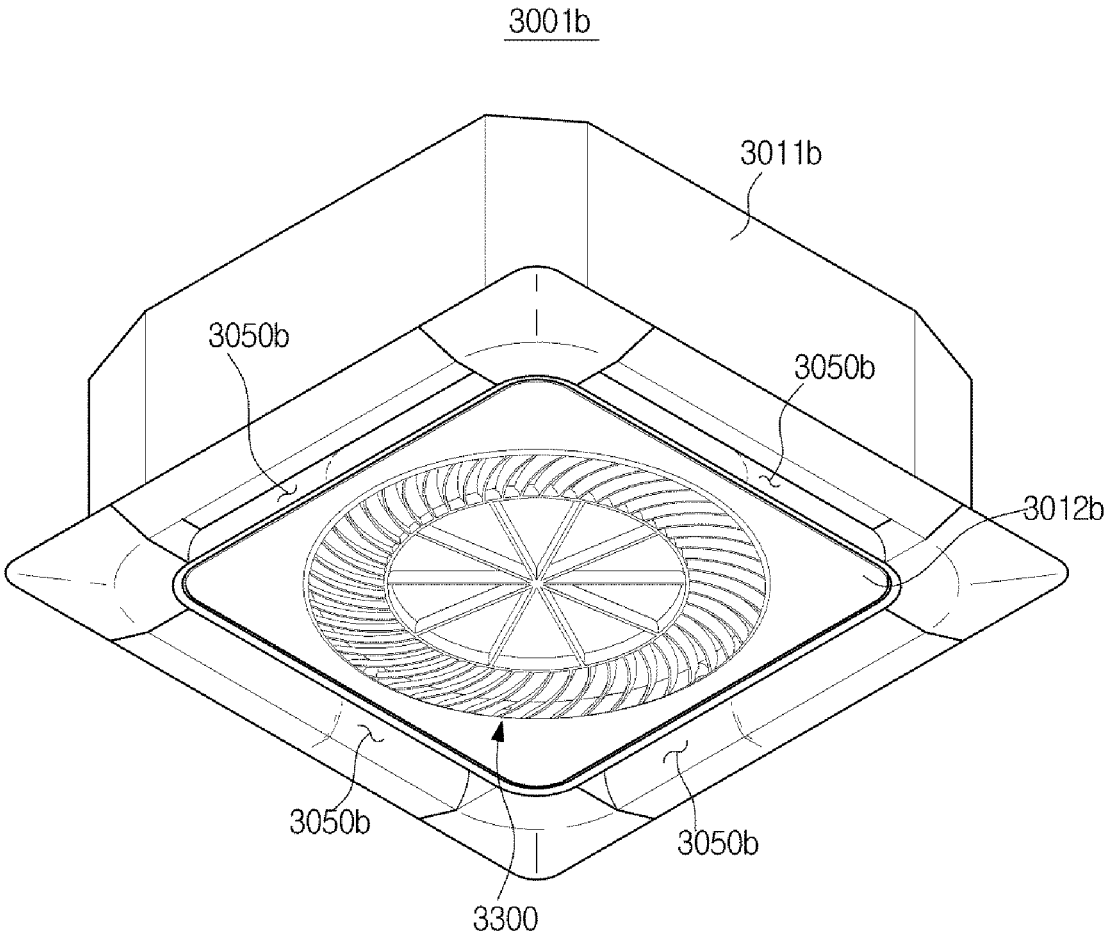
FIG. 69 is a perspective view of an air conditioner according to yet another embodiment of the present disclosure.

FIG. 63 is a lateral cross-sectional view of an air conditioner according to yet another embodiment of the present disclosure, FIGS. 64 to 66 are views illustrating a state in which a shape of a discharge grille of the air conditioner is changed according to yet another embodiment of the present disclosure, FIG. 67 is a rear view of the air conditioner according to yet another embodiment of the present disclosure, and FIG. 68 is a view illustrating a state in which a shape of a blade of the discharge grille of the air conditioner illustrated in FIG. 67 is changed.

As illustrated in FIG. 63, a discharge grille 3300 including an outlet 3350 provided to have air blown by the blower fan 3040 pass therethrough to be discharged toward the outside of the housing 3010 may be arranged at the opening 3021 of the discharge guide 3020.

The discharge grille 3300 may be coupled to the opening 3021 so that air flowing along the discharge guide 3020 passes through the discharge grille 3300 and is discharged toward the outside of the housing 3010.

The discharge grille 3300 may preferably be provided in the shape of a circular plate, but the shape is not limited thereto, and may also be provided in the shape of a polygonal plate. The discharge grille 3300 may be provided in a shape corresponding to that of the opening 3021. Thus, when the opening 3021 is formed in a polygonal shape, the discharge grille 3300 may be provided in a polygonal shape corresponding to that of the opening 3021.

The discharge grille 3300 may include a hub 3310 provided at a central portion of the discharge grille 3300, a ring-shaped frame 3330 arranged at an outside in a radial direction of the hub 3310, and a plurality of blades 3320 arranged between the hub 3310 and the frame 3330 and configured to form the outlet 3350.

The hub 3310 may be arranged at the central portion of the discharge grille 3300 as described above and may be rotatably provided. A driving device 3311 configured to transmit a rotational force to make the hub 3310 rotatable in one direction or the other direction may be provided above the hub 3310.

As illustrated in FIGS. 64 to 66, the plurality of blades 3320 may be arranged between the hub 3310 and the frame 3330. The outlet 3350 through which air is discharged may be formed between the plurality of blades 3320.

Because the plurality of blades 3320 may include a soft material, the shape of the plurality of blades 3320 may be changed by interlocking with the hub 3310 when the hub 3310 is rotated.

The plurality of blades 3320 may each include a first contact portion 3321 provided at one end of the blade 3320 and coupled to the hub 3310 and a second contact portion 3322 provided at the other end of the blade 3320 and coupled to the frame 3330.

Here, the second contact portion 3322 is always arranged at the same position by being coupled to the frame 3330. However, the first contact portion 3321 may have a position changed by being interlocked to rotation of the hub 3310.

That is, the shape of the blade 3320 may be deformed according to a direction in which the first contact portion 3321 is rotated by being interlocked to the rotation of the hub 3310. When the hub 3310 is rotated clockwise, the first contact portion 3321 may also be rotated clockwise as illustrated in FIG. 64.

As the first contact portion 3321 is rotated clockwise due to the clockwise rotation of the hub 3310, a section in which the first contact portion 3321 and the second contact portion 3322 are arranged in the radial direction of the hub 3310 may be formed as illustrated in FIG. 65.

Then, as illustrated in FIG. 66, as the hub 3310 continues to be rotated, the first contact portion 3321 may be further rotated clockwise from the state of being arranged in the radial direction with the second contact portion 3322 and may be arranged clockwise past the second contact portion 3322. Here, by the first contact portion 3321 being rotated clockwise by crossing a position at which the second contact portion 3322 is arranged, the blade 3320 may be deformed in a shape having a direction heading toward a clockwise direction.

That is, the blade 3320 may have a shape deformed in the clockwise direction in which the blade 3320 is rotated. Accordingly, the outlet 3350 formed between the plurality of blades 3320 may also be formed in the clockwise direction.

Conversely, although not illustrated in the drawings, when the hub 3310 is rotated counterclockwise, the blade 3320 may be rotated counterclockwise and have a shape inverted in a direction opposite to the clockwise direction.

As described above, because the blade 3320 may include a soft material, the shape of the blade 3320 may be formed by rotation of the first contact portion 3321 along a direction in which the first contact portion 3321 is rotated. When rotation of the first contact portion 3321 is ended, a shape of the blade 3320 formed at a position up to which the first contact portion 3321 is rotated may remain unchanged.

The blower fan 3040 may include an axial-flow fan or a mixed-flow fan for central discharge. Accordingly, air introduced into the blower fan 3040 may include a rotational force formed along a rotating direction of the blower fan 3040 and be discharged toward the outside of the housing 3010.

Air having the rotational force is discharged by passing through the discharge grille 3300. When a direction in which the shape of the blade 3320 is formed matches a direction in which air is rotated, the air having the rotational force may pass through the discharge grille 330 while keeping its direction without a large restriction. Here, because the air passing through the discharge grille 3300 keeps its direction, centralized airflow may be formed below the housing 3010 toward which the discharge grille 3300 is headed.

When a direction in which a blade 3320*a* illustrated in FIG. 67 is formed is assumed as being identical to a rotating direction of the blower fan 3040, a direction of air may be unchanged, and discharged airflow may be formed as centralized airflow formed below the housing 3010 even after air has passed through an outlet 3350*a*.

On the other hand, when a direction in which the blade 3320 is formed is a direction opposite to that in which air is rotated, air having a rotational force may lose its direction because a direction in which air is rotated when passing through the discharge grille 3300 does not match a direction in which the blade 3320 is formed. Accordingly, air passing through the discharge grille 3300 having the blade 3320 formed in a direction opposite to that in which air is rotated may not form centralized airflow, may lose its direction, and form wide airflow that spreads in all directions.

When a direction in which a blade 3320*b* illustrated in FIG. 68 is formed is assumed as being a direction opposite to the rotating direction of the blower fan 3040, air that has passed through an outlet 3350*b* may lose its direction, centralized airflow may not be generated below, a direction of air may be changed by the blade 3320*b*, and air may head toward all directions.

Accordingly, wide airflow may be generated when a direction in which the blade 3320*b* is formed is opposite to the rotating direction of the blower fan 3040.

Hereinafter, an air conditioner 3001*b* according to yet another embodiment of the present disclosure will be described. Because elements other than elements, which will be described below, are the same as those of the air conditioner 3001*a* according to yet another embodiment described above, descriptions thereof will be omitted.

The discharge grille 3300 may also be applied to the air conditioner 3001*b* formed by a general quadrilateral housing as in the yet another embodiment of the present disclosure.

The air conditioner 3001*b* according to yet another embodiment of the present disclosure may have a heat exchanger (not illustrated) provided in a quadrilateral shape arranged inside an upper housing 3011*b*, and, by the quadrilateral heat exchanger, have inlets 3050*b* formed in a four-way shape to be adjacent to the heat exchanger (not illustrated).

Air suctioned through the four inlets 3050*b* may pass through the discharge grille 3300 via the heat exchanger (not illustrated) and the blower fan 3040 and be discharged toward the outside of the housing. Here, the shape of the blade 3320 is changed due to rotation of the hub 3310 in the discharge grille 3300, and as the shape of the blade 3320 is changed, discharged airflow being discharged through the outlet 3350 may be easily controlled.

Figure 70:
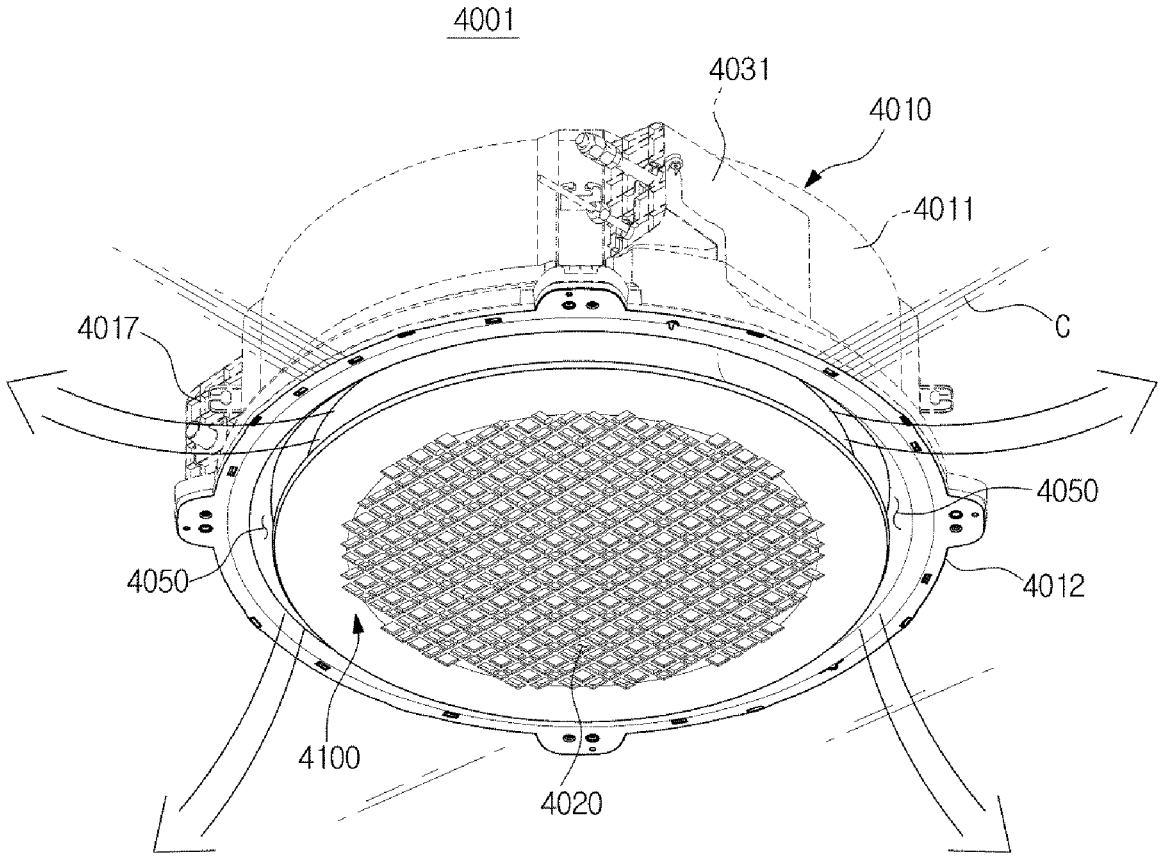
FIG. 70 is a perspective view of an air conditioner according to yet another embodiment of the present disclosure.
Figure 71:
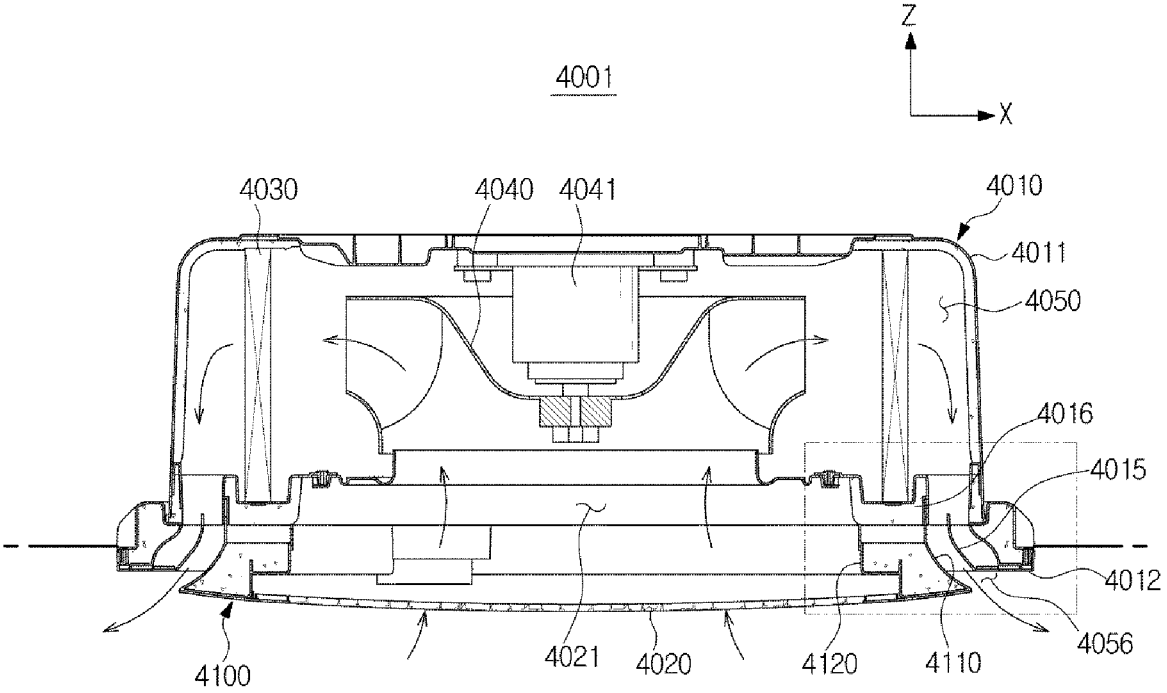
FIG. 71 is a lateral cross-sectional view of the air conditioner illustrated in FIG. 70.

FIG. 70 is a perspective view of an air conditioner 4001 according to yet another embodiment of the present disclosure. FIG. 71 is a lateral cross-sectional view of the air conditioner 4001 illustrated in FIG. 70.

The air conditioner 4001 may be installed in a ceiling C. At least a portion of the air conditioner 4001 may be buried in the ceiling C.

The air conditioner 4001 may include a housing 4010 provided in a substantially cylindrical shape, a heat exchanger 4030 provided inside the housing 4010, and a blower fan 4040 configured to circulate air.

The housing 4010 may have a substantially circular shape when viewed in the vertical direction. However, the shape of the housing 4010 is not limited thereto, and the housing 4010 may also have an elliptical shape or a polygonal shape. The housing 4010 may be formed of an upper housing 4011 arranged inside the ceiling C, and a lower housing 4012 coupled below the upper housing 4011, arranged outside the ceiling C, and exposed to the outside. However, embodiments are not limited thereto, and a middle housing may be further arranged between the upper housing 4011 and the lower housing 4012.

An inlet 4020 through which air is suctioned and an airflow control lifting unit 4100 including the inlet 4020 may be arranged at a central portion of the lower housing 4013. The airflow control lifting unit 4100 will be described in detail below.

A discharge flow passage 4050 provided to enable air suctioned through the inlet 4020 to be heat-exchanged with the heat exchanger 4030 and discharged may be formed at an outside in a radial direction of the inlet 4020 and an outside in a radial direction of the heat exchanger 4030. The discharge flow passage 4050 may have a substantially ring shape when viewed in the vertical direction. However, embodiments are not limited thereto, and the discharge flow passage 4050 may also be provided to include a curved section.

The discharge flow passage 4050 may be provided in a ring shape by the heat exchanger 4030 provided in a ring shape and the housing 4010 provided in a cylindrical shape. One side of the discharge flow passage 4050 may be connected to the heat exchanger 4030, and the other side thereof may be connected to an outlet 4056 provided near the lower housing 4012.

By the above structure, the air conditioner 4001 may suction air from a lower side, cool and heat the air, and then discharge the air back to the lower side.

A grille (not illustrated) may be coupled to an upper side of the inlet 4020 to filter dust from air being suctioned through the inlet 4020.

The heat exchanger 4030 may be provided inside the housing 4010 and may be arranged on a flow passage of air between the inlet 4020 and the outlet 4056. The heat exchanger 4030 may be formed of a tube (not illustrated)

having refrigerant flow therethrough and a header (not illustrated) connected to an external refrigerant tube to supply or recover refrigerant to or from the tube. A heat-exchange fin may be provided in the tube to expand a heat dissipation area.

The heat exchanger 4030 may have a substantially circular shape when viewed in the vertical direction. The shape of the heat exchanger 4030 may correspond to the shape of the housing 4010. The shape of the heat exchanger 4030 may correspond to the shape of the outlet 4056. The heat exchanger 4030 may be placed on a drain tray 4016, and condensate generated in the heat exchanger 4030 may be collected in the drain tray 4016.

The blower fan 4040 may be provided inside in a radial direction of the heat exchanger 4030. The blower fan 4040 may be a centrifugal fan configured to suction air in an axial direction and discharge air in a radial direction. A blower motor 4041 configured to drive the blower fan 4040 may be provided in the air conditioner 4001.

By the above configuration, the air conditioner 4001 may suction air from an indoor space, cool the air, and then discharge the air back to the indoor space, or suction air from an indoor space, heat the air, and then discharge the air back to the indoor space.

The air conditioner 4001 may further include a heat exchanger pipe 4031 connected to the heat exchanger 4030 from outside of the housing 4010 and having refrigerant flow therethrough, and a drain pipe 4017 configured to discharge condensate collected in the drain tray 4016 to the outside. The heat exchanger pipe 4031 and the drain pipe 4017 may be connected to the outside via one side of the upper housing 4011.

Hereinafter, the airflow control lifting unit 4100 and an airflow control member 4200 will be described in detail.

Figure 72:
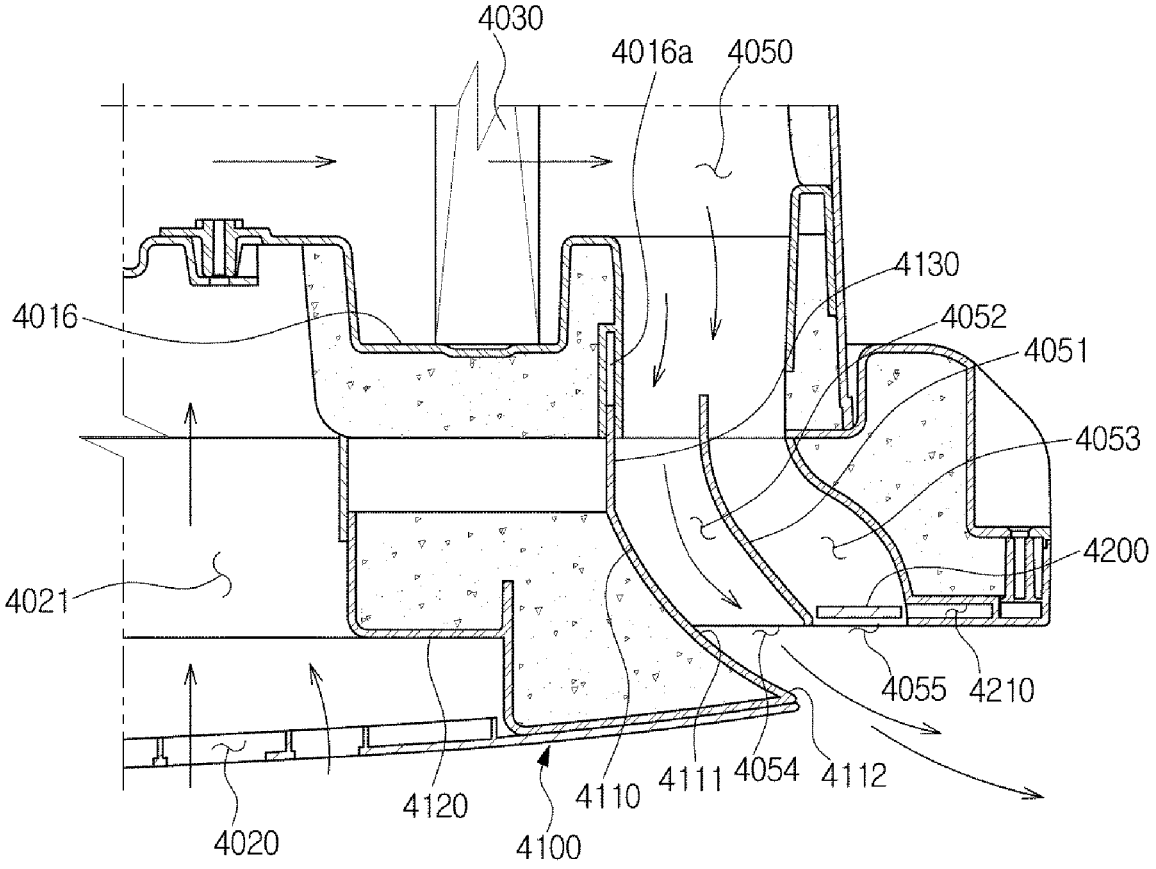
FIG. 72 is an enlarged view of a portion marked in FIG. 71.
Figure 73:
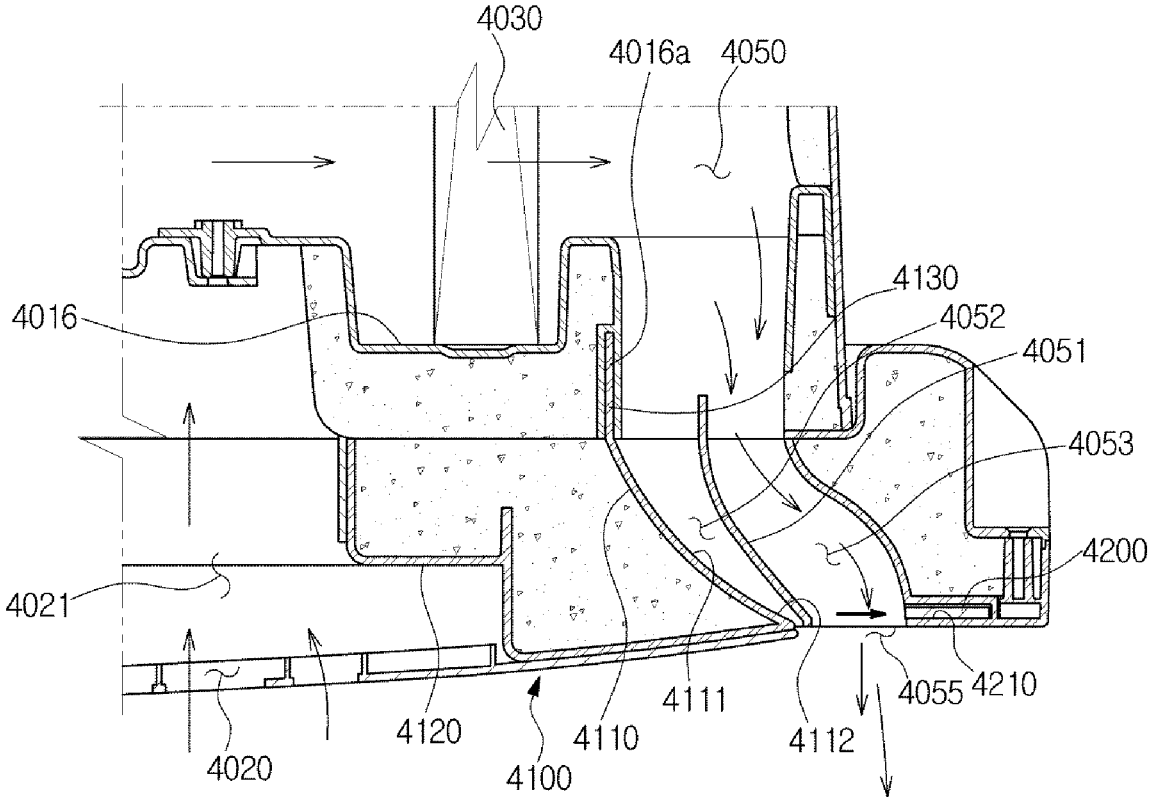
FIG. 73 is an enlarged view of a portion corresponding to that marked in FIG. 71 when an airflow control lifting unit of the air conditioner is lifted according to yet another embodiment of the present disclosure.
Figure 74:
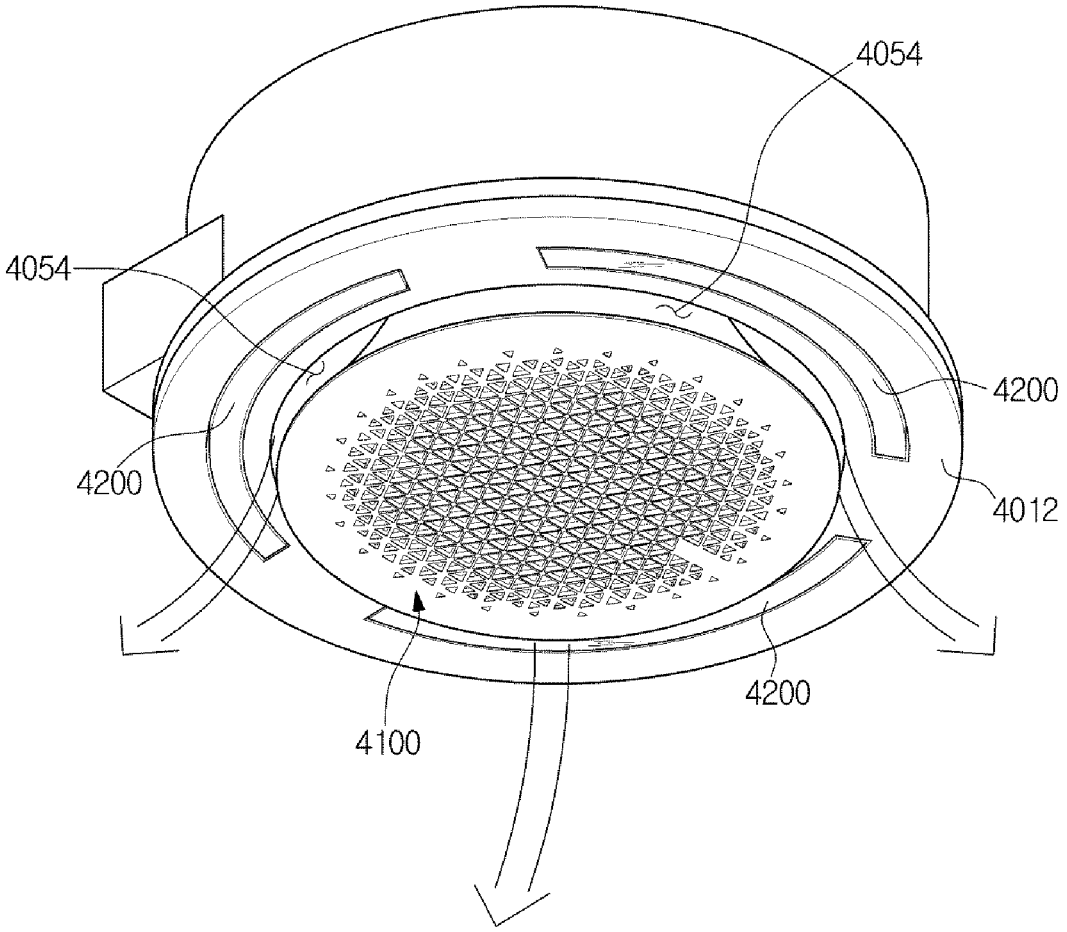
FIG. 74 is a perspective view when the airflow control lifting unit of the air conditioner is lowered according to yet another embodiment of the present disclosure.
Figure 75:
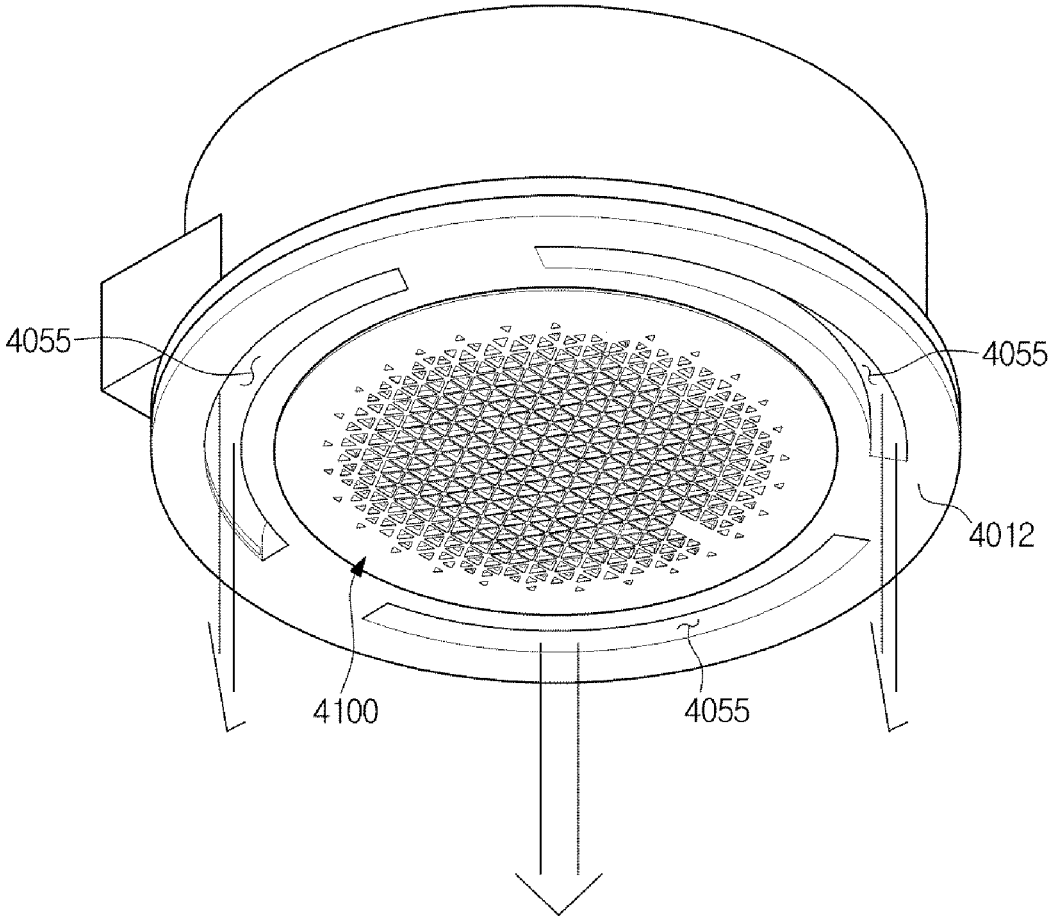
FIG. 75 is a perspective view when the airflow control lifting unit of the air conditioner is lifted according to yet another embodiment of the present disclosure.

FIG. 72 is an enlarged view of a portion marked in FIG. 71, FIG. 73 is an enlarged view of a portion corresponding to that marked in FIG. 71 when an airflow control lifting unit of the air conditioner is lifted according to yet another embodiment of the present disclosure, FIG. 74 is a perspective view when the airflow control lifting unit of the air conditioner is lowered according to yet another embodiment of the present disclosure, and FIG. 75 is a perspective view when the airflow control lifting unit of the air conditioner is lifted according to yet another embodiment of the present disclosure.

As illustrated in FIGS. 71 and 72, the airflow control lifting unit 4100 may be arranged at a central side of the lower housing 4012. The airflow control lifting unit 4100 may be provided in a substantially cylindrical shape.

An outer circumferential surface 4110 of the airflow control lifting unit 4100 may form one side of the discharge flow passage 4050, and an inner circumferential surface 4120 of the lifting unit 4100 may form a suction flow passage 4021 configured to connect the inlet 4020 to the blower fan 4040 to enable air suctioned through the inlet 4020 to be introduced into the blower fan 4040.

The airflow control lifting unit 4100 may be arranged below the drain tray 4016 and may be liftably provided below the drain tray 4016.

The airflow control lifting unit 4100 may include a lifting guide 4130 extending upward. When the airflow control lifting unit 4100 is being lifted, the lifting guide 4130 may guide the airflow control lifting unit 4100 so that the airflow control lifting unit 4100 moves upward or downward.

Specifically, the drain tray 416 may include a guide groove 4016*a* provided to correspond to the lifting guide 4130, and lifting of the airflow control lifting unit 4100 may be guided by the lifting guide 4130 vertically sliding in the guide groove 4016*a*.

As illustrated in FIG. 72, when the airflow control lifting unit 4100 is being lowered, the lifting guide 4130 may slide downward in the guide groove 4016*a*, and at least a portion of the lifting guide 4130 may be deviated from the guide groove 4016*a*. Accordingly, the airflow control lifting unit 4100 may be lowered as much as a length by which the lifting guide 4130 is deviated from the guide groove 4016*a*.

Also, as illustrated in FIG. 73, when the airflow control lifting unit 4100 is being lifted, the lifting guide 4130 may slide upward in the guide groove 4016*a*, and the lifting guide 4130 may be inserted into the guide groove 4016*a*. Accordingly, the airflow control lifting unit 4100 may be lifted as much as a length by which the lifting guide 4130 is inserted into the guide groove 4016*a*.

When the airflow control lifting unit 4100 is lifted, an upper surface of the airflow control lifting unit 4100 may be arranged to be adjacent to a lower surface of the drain tray 4016.

The airflow control lifting unit 4100 may include a driving device (not illustrated) configured to lift the airflow control lifting unit 4100. The driving device (not illustrated) may include an element such as a rack pinion and a driving motor and move the airflow control lifting unit 4100 in the vertical direction.

However, embodiments are not limited to yet another embodiment of the present disclosure, and the lifting guide 4130 may guide upward movement of the airflow control lifting unit 4100 by being inserted into a guide groove provided in an element other than the drain tray 4016. That is, the lifting guide 4130 may be inserted into a guide groove in any element that may be provided inside the upper housing 4011, or a separate guide element may be arranged.

When the airflow control lifting unit 4100 is lowered, an outer circumferential surface of the lifting guide 4130 may form one side of the discharge flow passage 4050. That is, when the airflow control lifting unit 4100 is lowered, the lifting guide 4130 is deviated from the guide groove 4106*a* and exposed to the outside. An exposed surface of the lifting guide 4130 is arranged to be in contact with one side of the discharge flow passage 4050 and forms one side of the discharge flow passage 4050.

Specifically, the discharge flow passage 4050 may be provided in a ring-shaped space by being partitioned by an inner circumferential surface of the upper housing 4011 and the outer circumferential surface 4100 of the airflow control lifting unit 4100 or being partitioned by the airflow control lifting unit 4100 and the outer circumferential surface of the lifting guide 4130 when the airflow control lifting unit 4100 is lowered. Each of the upper housing 4011 and the airflow control lifting unit 4100 may be formed in a substantially cylindrical shape as described above, and a ring-shaped space may be formed.

However, embodiments are not limited to yet another embodiment of the present disclosure, and the discharge flow passage 4050 may be provided in various shapes according to shapes of the upper housing 4011 and the airflow control lifting unit 4100. That is, when the inner circumferential surface of the upper housing 4011 and the airflow control lifting unit 4100 are formed in an elliptical shape or a shape having a curved surface, the discharge flow passage 4050 may be formed as a space having a shape corresponding thereto.

A divider 4051 extending in a direction corresponding to a circumferential direction of the discharge flow passage 4050 to partition a portion of the discharge flow passage 4050 may be provided inside the discharge flow passage 4050.

The divider 4051 may extend from a side adjacent to the outlet 4056 or may extend from the lower housing 4012 toward the inside of the discharge flow passage 4050. However, embodiments are not limited to yet another embodiment of the present disclosure, and the divider 4051 may extend from one side of the upper housing 4011 toward the inside of the discharge flow passage 4050.

By the divider 4051, the discharge flow passage 4050 adjacent to the outlet 4056 may be partitioned into an inner circumferential discharge flow passage 4052 and an outer circumferential discharge flow passage 4053. Specifically, the inner circumferential discharge flow passage 4052 may be formed between the divider 4051 and the outer circumferential surface 4110 of the airflow control lifting unit 4100 forming the inner circumferential surface of the discharge flow passage 4050, and the outer circumferential discharge flow passage 4053 may be formed between the divider 4051 and the inner circumferential surface of the upper housing 4011 forming the outer circumferential surface of the discharge flow passage 4050.

Because the divider 4051 is extended from a side adjacent to the outlet 4056 as described above, the outlet 4056 connected to the inner circumferential discharge flow passage 4052 may be defined as a first outlet 4054, and the outlet 4056 connected to the outer circumferential discharge flow passage 4053 may be defined as a second outlet 4055.

That is, the outlet 4056 may be partitioned into a plurality of outlets by the divider 4051. Consequently, air passing through the discharge flow passage 4050 may be discharged to the outside of the housing 4010 through the first outlet 4054 or the second outlet 4055 along the inner circumferential discharge flow passage 4052 or the outer circumferential discharge flow passage 4053.

As described above, the air conditioner 4001 according to an embodiment of the present disclosure includes the discharge flow passage 4050 formed in a ring shape and the outlet 4056 having at least a portion corresponding to the ring-shaped discharge flow passage 4050.

In a case of a conventional air conditioner, a housing and a heat exchanger are provided in a quadrilateral shape, and accordingly, an outlet is formed in a quadrilateral shape. Due to the outlet being provided in the quadrilateral shape, the outlet cannot be arranged to cover the whole outer portion of a heat exchanger along a perimeter of the heat exchanger. Accordingly, there are problems in that a section from which discharged airflow is discharged is limited and airflow is not smoothly delivered to a portion without an outlet.

However, the air conditioner 4001 according to yet another embodiment of the present disclosure may deliver airflow to all directions without a blind spot by having the discharge flow passage 4050 formed in a ring shape and the outlet 4056 having a ring shape corresponding to that of the discharge flow passage 4050.

Because the outlet of the air conditioner according to yet another embodiment of the present disclosure has a ring shape as described above unlike the conventional air conditioner, a blade configured to control discharged airflow is difficult to be arranged inside the outlet. It is disadvantageous to arrange a blade shaft inside the outlet provided in a ring shape, and it is difficult for a blade to rotate inside the ring-shaped outlet. Accordingly, the air conditioner 4001 including the ring-shaped discharge flow passage 4050 according to yet another embodiment of the present disclosure has to control discharged airflow that is discharged from the outlet 4056 by an element other than a blade.

For this, the liftable airflow control lifting unit 4100 described above and the airflow control member 4200 which will be described below may be driven to control discharged airflow. Specifically, the air conditioner 4001 should form descending airflow that centralizes discharged airflow downward or wide airflow that makes discharged airflow head toward all directions according to circumstances and form airflow according to a user's need.

That is, although an air conditioner including a blade controls descending airflow and wide airflow by changing an arrangement angle of the blade, the air conditioner 4001 according to yet another embodiment of the present disclosure may control descending airflow and wide airflow by driving the airflow control lifting unit 4100 and the airflow control member 4200.

Also, when discharged airflow is controlled without using a blade as in yet another embodiment of the present disclosure, the problems in that an amount of discharged air is decreased due to airflow being interfered by a blade and flow noise is increased due to turbulent flow generated around the blade may be solved.

A curved portion 4111 including a curved surface and extending downward may be provided below the outer circumferential surface 4110 of the airflow control lifting unit 4100. Specifically, the curved portion 4111 has a curved shape formed in an outward direction of a radial direction of the discharge flow passage 4050 and may extend toward a lower side of the airflow control lifting unit 4100.

Accordingly, the first outlet 4054 may be formed by a lower end of the curved portion 4111 and a lower end of the divider 4051.

Air passing through the inner circumferential discharge flow passage 4052 is discharged toward the outside of the housing 4010 through the first outlet 4054 along the curved portion 4111. Such air is discharged through the first outlet 4054 along the curved portion 4111. Consequently, air being discharged through the first outlet 4054 forms discharged airflow heading toward a direction corresponding to the outward direction of the radial direction of the discharge flow passage 4050.

That is, air being discharged through the first outlet 4054 may form wide airflow that spreads in all directions.

Also, air being discharged through the second outlet 4055 along the outer circumferential discharge flow passage 4053 may be discharged in a downward direction toward which the second outlet 4055 is headed. Consequently, air being discharged through the second outlet 4055 may form descending airflow that heads downward.

Accordingly, when the inner circumferential discharge flow passage 4052 and the first outlet 4054 are controlled or the outer circumferential discharge flow passage 4053 and the second outlet 4055 are controlled, wide airflow and descending airflow may be selectively generated.

That is, when the inner circumferential discharge flow passage 4052 and the first outlet 4054 or the outer circumferential discharge flow passage 4053 and the second outlet 4055 are opened and closed alternately, wide airflow and descending airflow may be selectively formed.

Specifically, when the inner circumferential discharge flow passage 4052 or the first outlet 4054 is opened and the outer circumferential discharge flow passage 4053 or the second outlet 4055 is closed, all of air being discharged from the housing 4010 may be discharged along the curved portion 4111 and form wide airflow.

Also, when the inner circumferential discharge flow passage 4052 or the first outlet 4054 is closed and the outer circumferential discharge flow passage 4053 or the second outlet 4055 is opened, all of air being discharged from the housing 4010 may be discharged through the second outlet 4055 and form descending airflow.

The inner circumferential discharge flow passage 4052 or the first outlet 4054 may be opened and closed by the airflow control lifting unit 4100. When the airflow control lifting unit 4100 is lifted, a closing portion 4112 provided at one side of the curved portion 4111 may be provided to be adjacent to a lower end portion of the divider 4051 as illustrated in FIG. 73 and close the inner circumferential discharge flow passage 4052 or the first outlet 4054. Here, the outer circumferential surface of the airflow control lifting device 4100 may close a space of the first outlet 4054 and restrict flow of air being discharged from the first outlet 4054 through the inner circumferential discharge flow passage 4052.

The closing portion 4112 may be provided as a portion of the curved portion 4111 as in yet another embodiment of the present disclosure. However, embodiments are not limited thereto, and the closing portion 4112 may be a separate element arranged on the outer circumferential surface 4110.

Also, the closing portion 4112 may be arranged to be adjacent to the lower end of the divider 4051 and block a flow passage formed by the first outlet. Embodiments are not limited thereto, and the closing portion 4112 may be arranged to be in contact with the lower end of the divider 4051 and completely close the first outlet 4054.

When the airflow control lifting unit 4100 is being lowered, a gap may be formed between the closing portion 4112 and the lower end of the divider 4051. Accordingly, the first outlet 4054 may be opened, and air being discharged may be discharged through the first outlet 4054 along the inner circumferential discharge flow passage 4052.

The outer circumferential discharge flow passage 4053 and the second outlet 4055 may be opened and closed by the airflow control member 4200.

The airflow control member 4200 may be provided in a plate shape corresponding to that of the outer circumferential discharge flow passage 4053 or the second outlet 4055. That is, the airflow control member 4200 may have a size corresponding to an area of at least the second outlet 4055 to be able to close the second outlet 4055. Also, the airflow control member 4200 may be slidably provided. The airflow control member 4200 may be arranged on the outer circumferential discharge flow passage 4053 or the second outlet 4055, slide as illustrated in FIG. 73, and be inserted into a sliding groove 4210 provided at an outside in the radial direction of the discharge flow passage 4050.

The airflow control member 4200 may include a driving device (not illustrated) configured to slide the airflow control member 4200. The driving device (not illustrated) may include an element such as rack pinion and a driving motor and slide the airflow control member 4200.

When the airflow control member 4200 is arranged on the outer circumferential discharge flow passage 4053 or the second outlet 4055 as illustrated in FIG. 72, the second outlet 4055 is closed. Accordingly, air being discharged toward the outside of the housing 4010 is restricted from being discharged through the second outlet 4055.

However, when the airflow control member 4200 is slid into the sliding groove 4210 as illustrated in FIG. 73, the outer circumferential discharge flow passage 4053 or the second outlet 4055 may be opened, and air being discharged may be discharged through the second outlet 4055. Because the second outlet 4055 is formed toward the lower side of the housing 4010, air discharged through the second outlet 4055 may form descending airflow.

The airflow control member 4200 is not limited to the yet another embodiment of the present disclosure. The outer circumferential discharge flow passage 4053 or the second outlet 4055 may be opened and closed by rotation of the airflow control member 4200 as well as sliding of the airflow control member 4200. That is, the outer circumferential discharge flow passage 4053 or the second outlet 4055 may be opened and closed according to an angle at which the airflow control member 4200 is rotated.

As described above, air discharged through the first outlet 4054 may form wide airflow, and air discharged through the second outlet 4055 may form descending airflow. Consequently, when the airflow control lifting unit 4100 is being lowered and the airflow control member 4200 is arranged on the outer circumferential discharge flow passage 4053 or the second outlet 4055 as illustrated in FIGS. 72 and 74, the first outlet 4054 is opened, and the second outlet 4055 is closed. Consequently, all of air discharged toward the outside of the housing 4010 is discharged through the first outlet 4054 and may thus form wide airflow.

Also, when the airflow control lifting unit 4100 is being lifted and the airflow control member 4200 is slid and inserted into the sliding groove 4210 as illustrated in FIGS. 73 and 75, the first outlet 4054 is closed, and the second outlet 4055 is opened. Consequently, all of air discharged toward the outside of the housing 4010 is discharged through the second outlet 4055 and may thus form descending airflow.

Consequently, the airflow control lifting device 4100 and the airflow control member 4200 may control a direction of discharged airflow by alternately opening or closing the inner circumferential discharge flow passage 4052 or the first outlet 4054 and the outer circumferential discharge flow passage 4053 or the second outlet 4055.

However, embodiments are not limited to the embodiment of the present disclosure, and the airflow control lifting device 4100 and the airflow control member 4200 may discharge air by partially opening the inner circumferential discharge flow passage 4052 or the first outlet 4054 and the outer circumferential discharge flow passage 4053 or the second outlet 4055, instead of completely closing or opening the inner circumferential discharge flow passage 4052 or the first outlet 4054 and the outer circumferential discharge flow passage 4053 or the second outlet 4055.

Accordingly, an amount of airflow discharged from each of the first outlet 4054 and the second outlet 4055 is changed according to a degree to which each of the first outlet 4054 and the second outlet 4055 are opened. Airflow discharged from the first outlet 4054 and airflow discharged from the second outlet 4055 may be mixed and form discharged airflow heading toward various directions.

Figure 78:
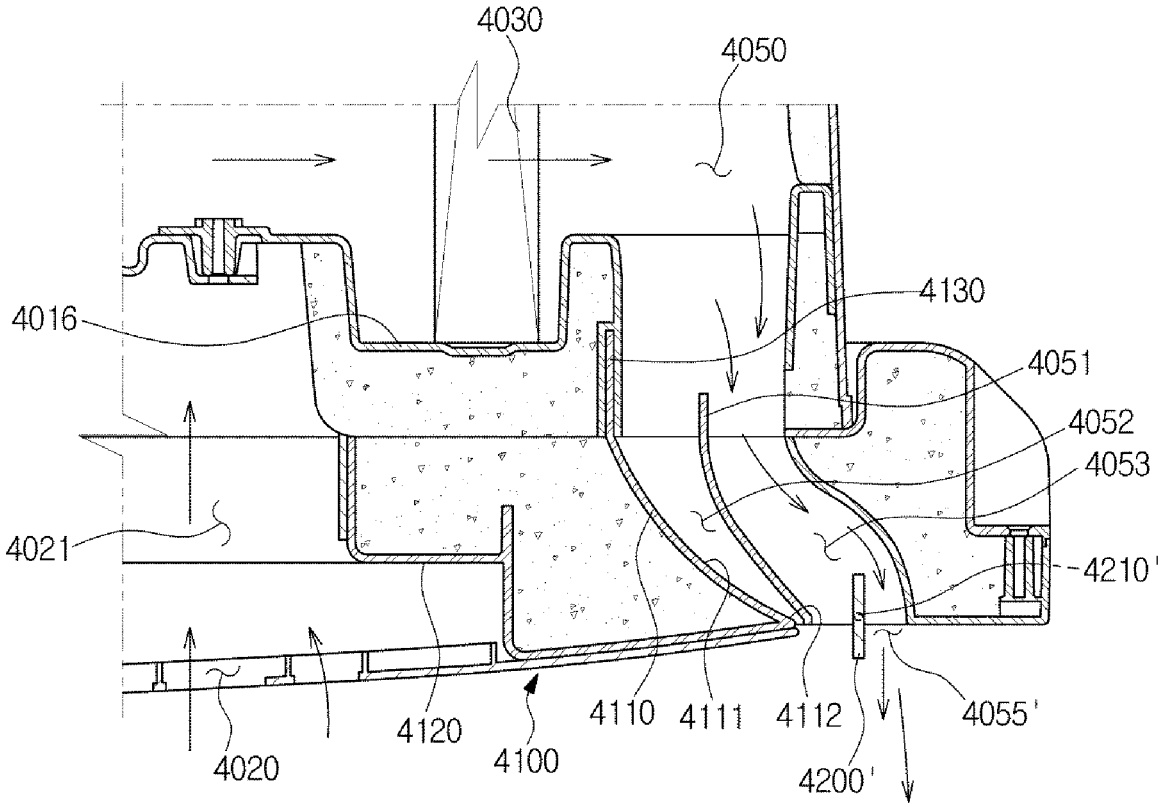
FIG. 78 is an enlarged lateral cross-sectional view of a portion when an airflow control lifting unit of the air conditioner is lifted according to yet another embodiment of the present disclosure.
Figure 79:
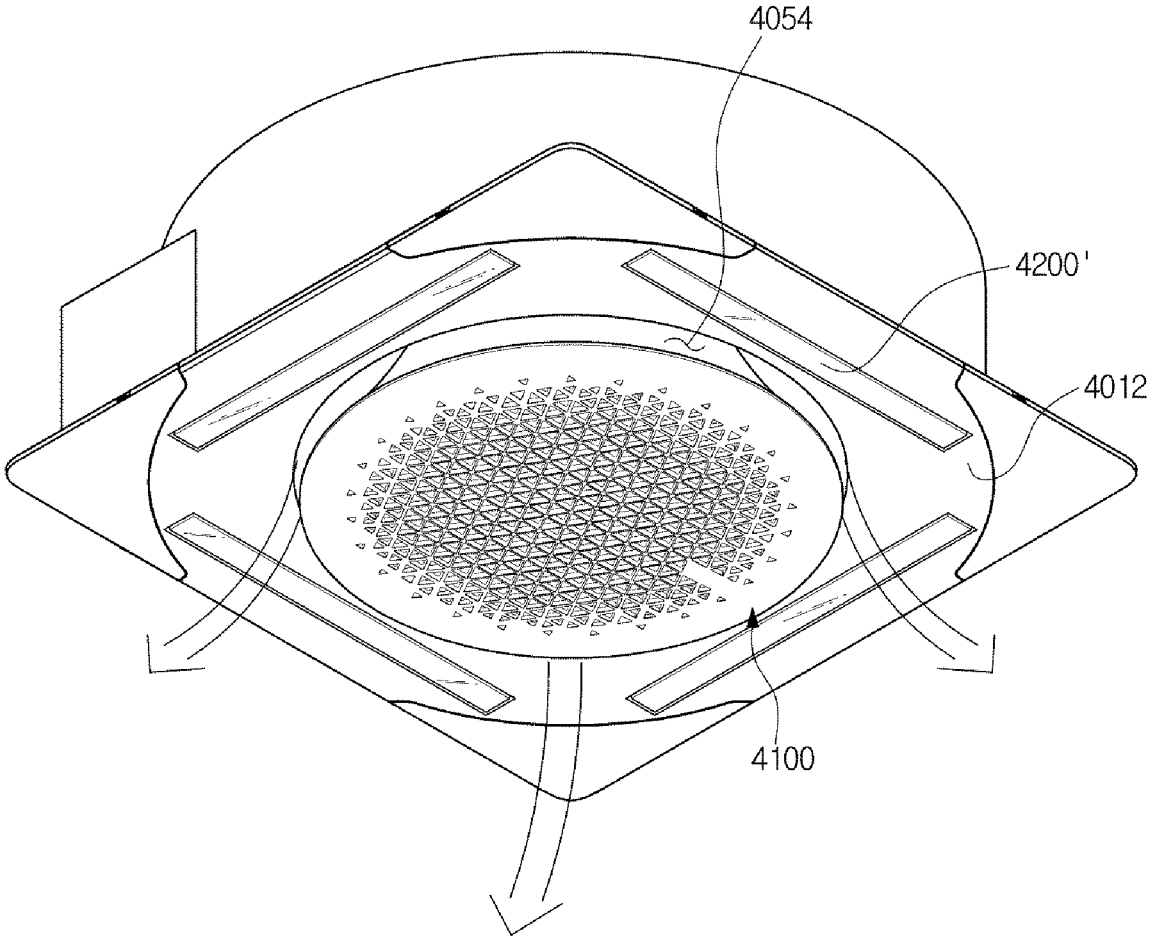
FIG. 79 is a perspective view when the airflow control lifting unit of the air conditioner is lowered according to yet another embodiment of the present disclosure.
Figure 80:
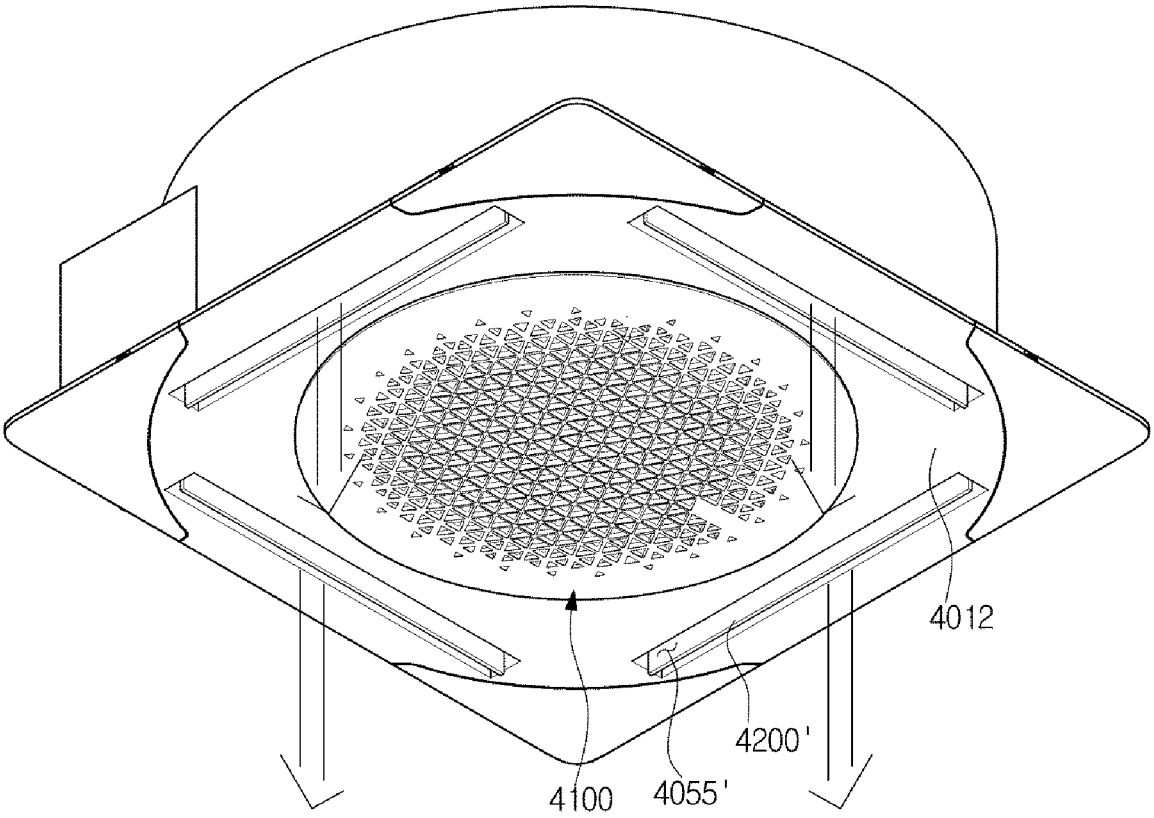
FIG. 80 is a perspective view when the airflow control lifting unit of the air conditioner is lifted according to yet another embodiment of the present disclosure.

Hereinafter, yet another embodiment will be described. Because elements other than a second outlet 4055' and an airflow control member 4200', which will be described below, are the same as those according to yet another embodiment described above, overlapping descriptions will be omitted FIG. 76 is a rear view of an air conditioner according to yet another embodiment of the present disclosure, FIG. 77 is an enlarged lateral cross-sectional view of a portion when an airflow control lifting unit of the air conditioner is lowered according to yet another embodiment of the present disclosure, FIG. 78 is an enlarged lateral cross-sectional view of a portion when an airflow control lifting unit of the air conditioner is lifted according to yet another embodiment of the present disclosure, FIG. 79 is a perspective view when the airflow control lifting unit of the air conditioner is lowered according to yet another embodiment of the present disclosure, and FIG. 80 is a perspective view when the airflow control lifting unit of the air conditioner is lifted according to yet another embodiment of the present disclosure.

Figure 76:
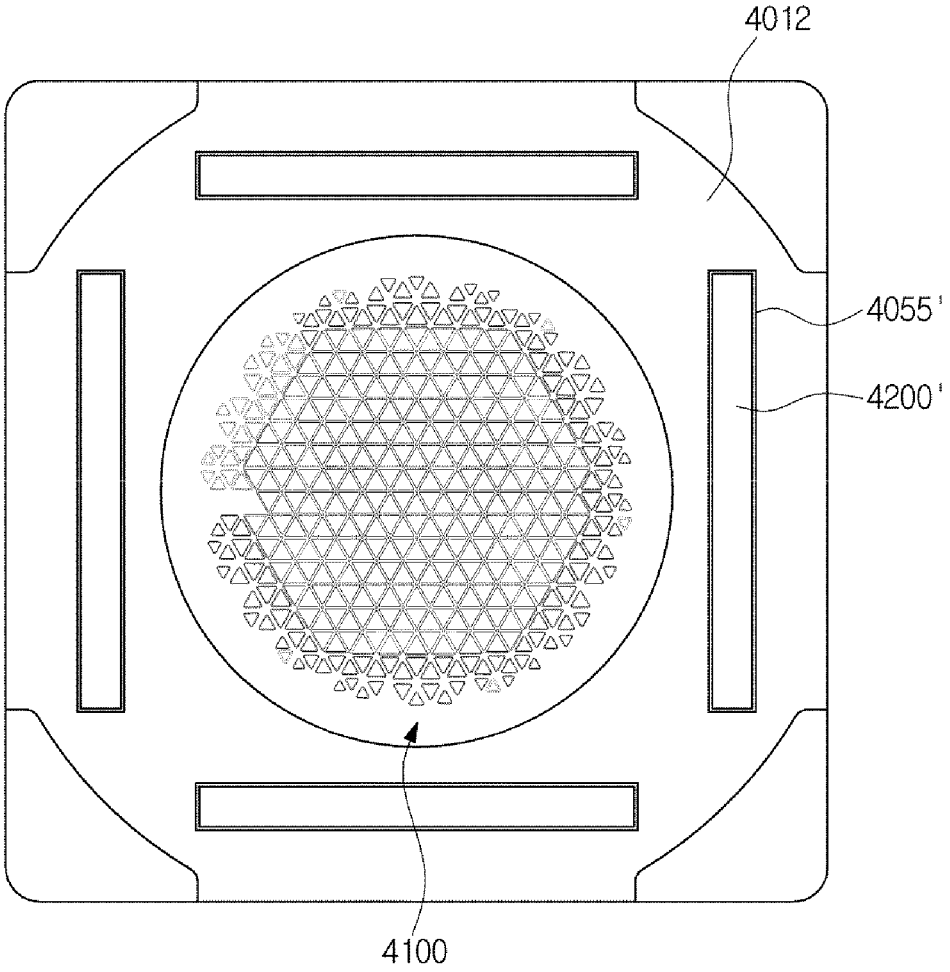
FIG. 76 is a rear view of an air conditioner according to yet another embodiment of the present disclosure.

As illustrated in FIG. 76, the second outlet 4055' may be formed in a rectangular shape. Also, the airflow control member 4200' provided inside the second outlet 4055' may be provided in a rectangular shape corresponding to that of the second outlet 4055'

The airflow control member 4200' may be provided to be rotatable about a rotating shaft 4210' formed to correspond to a longitudinal direction. The second outlet 4055' may be opened and closed by rotation of the airflow control member 4200'.

Figure 77:
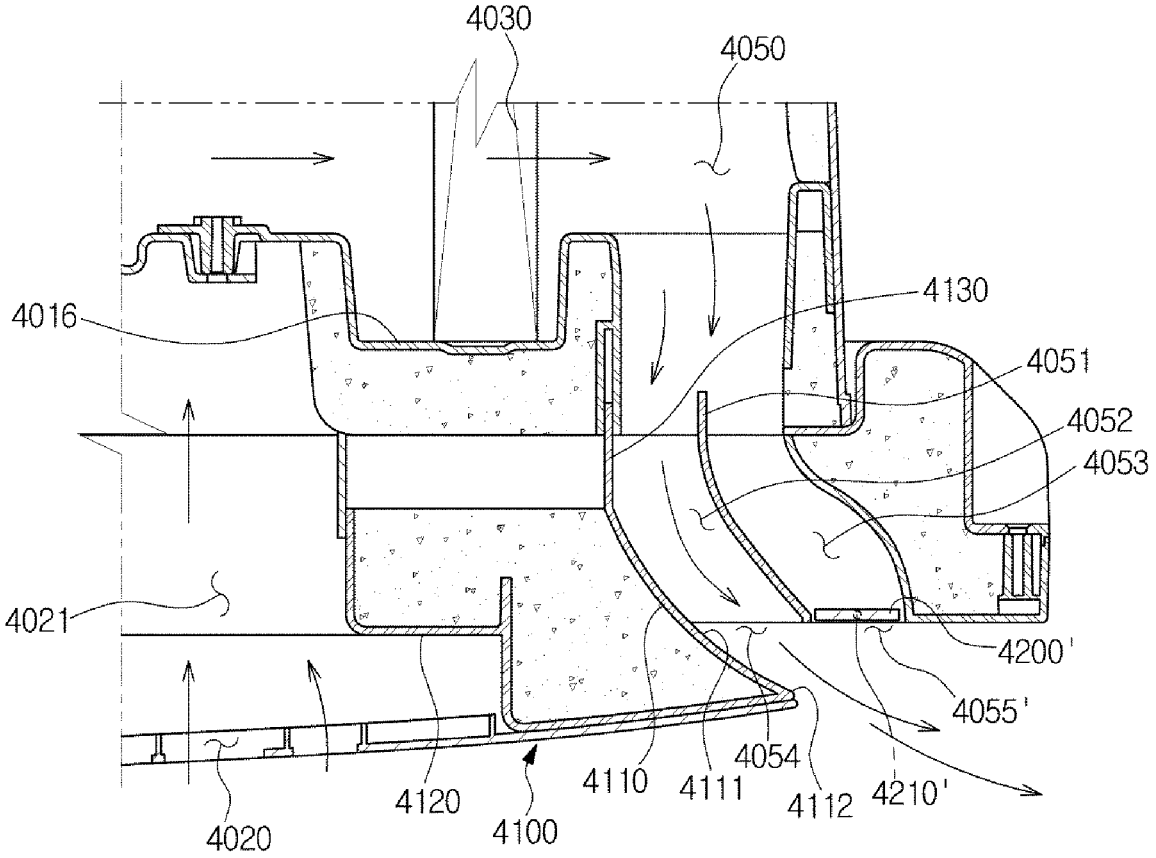
FIG. 77 is an enlarged lateral cross-sectional view of a portion when an airflow control lifting unit of the air conditioner is lowered according to yet another embodiment of the present disclosure.

That is, when the airflow control member 4200' is arranged at a level with the second outlet 4055' as illustrated in FIG. 77, the second outlet 4055' is closed and air on the discharge flow passage 4050 is discharged through the first outlet 4054.

However, when the airflow control member 4200' is rotated about the rotating shaft 4210' and is arranged in a direction perpendicular to the second outlet 4055' as illustrated in FIG. 78, the second outlet 4055' is opened and air on the discharge flow passage 4050 is discharged through the second flow passage 4055'.

The airflow control member 4200' may include a driving device (not illustrated) configured to rotate the airflow control member 4200'. The driving device (not illustrated) may include an element such as driving motor and rotate the airflow control member 4200' by transmitting a rotational force of the driving motor to the airflow control member 4200'.

When the second outlet 4055' is provided in a rectangular shape as in yet another embodiment of the present disclosure, the airflow control member 4200' may be easily rotated, the second outlet 4055' may be opened and closed by a simple configuration, and wide airflow and descending airflow may be selectively formed.

Figure 81:
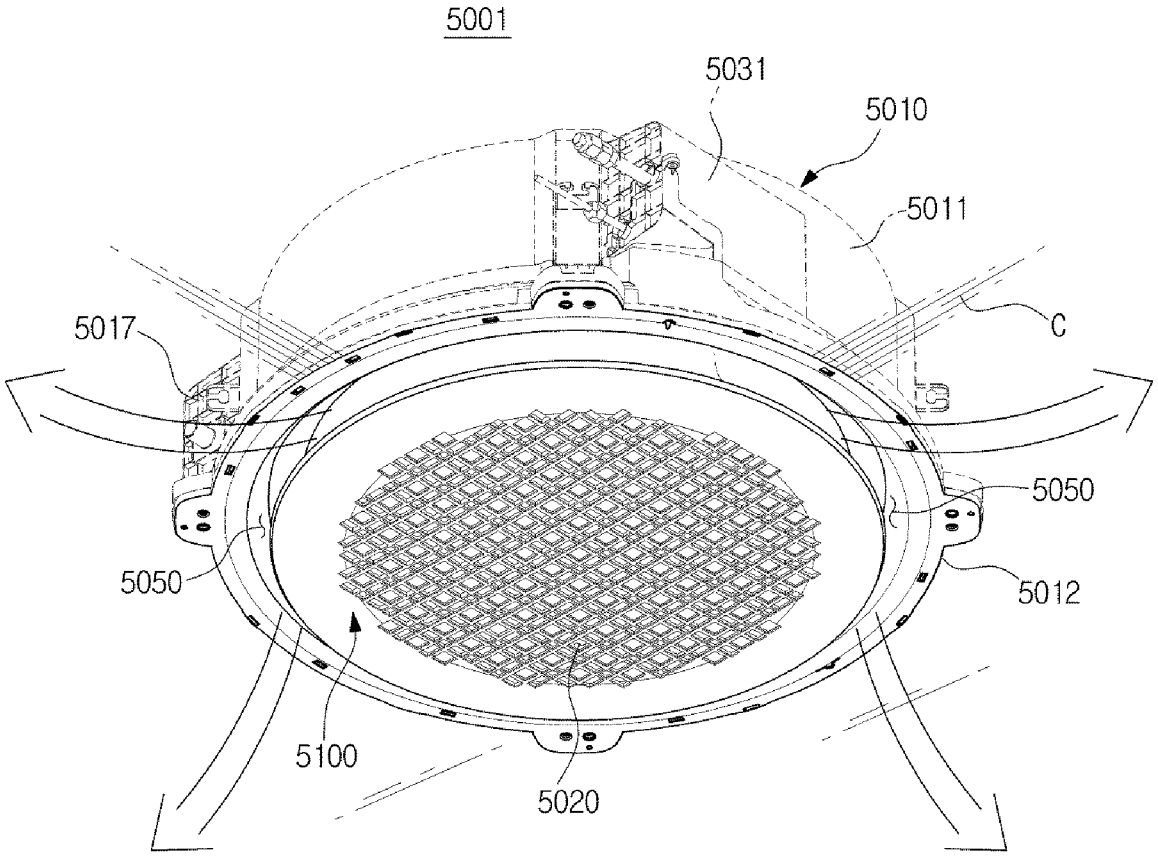
FIG. 81 is a perspective view of an air conditioner according to yet another embodiment of the present disclosure.
Figure 82:
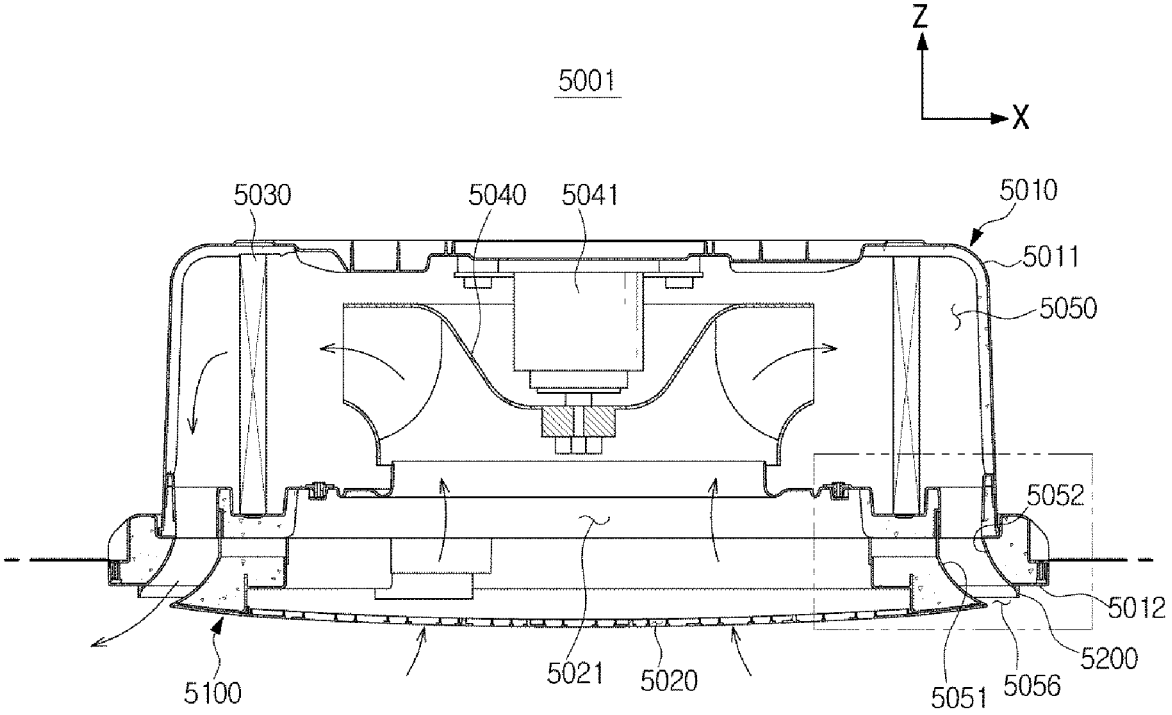
FIG. 82 is a lateral cross-sectional view of the air conditioner illustrated in FIG. 81.
Figure 83:
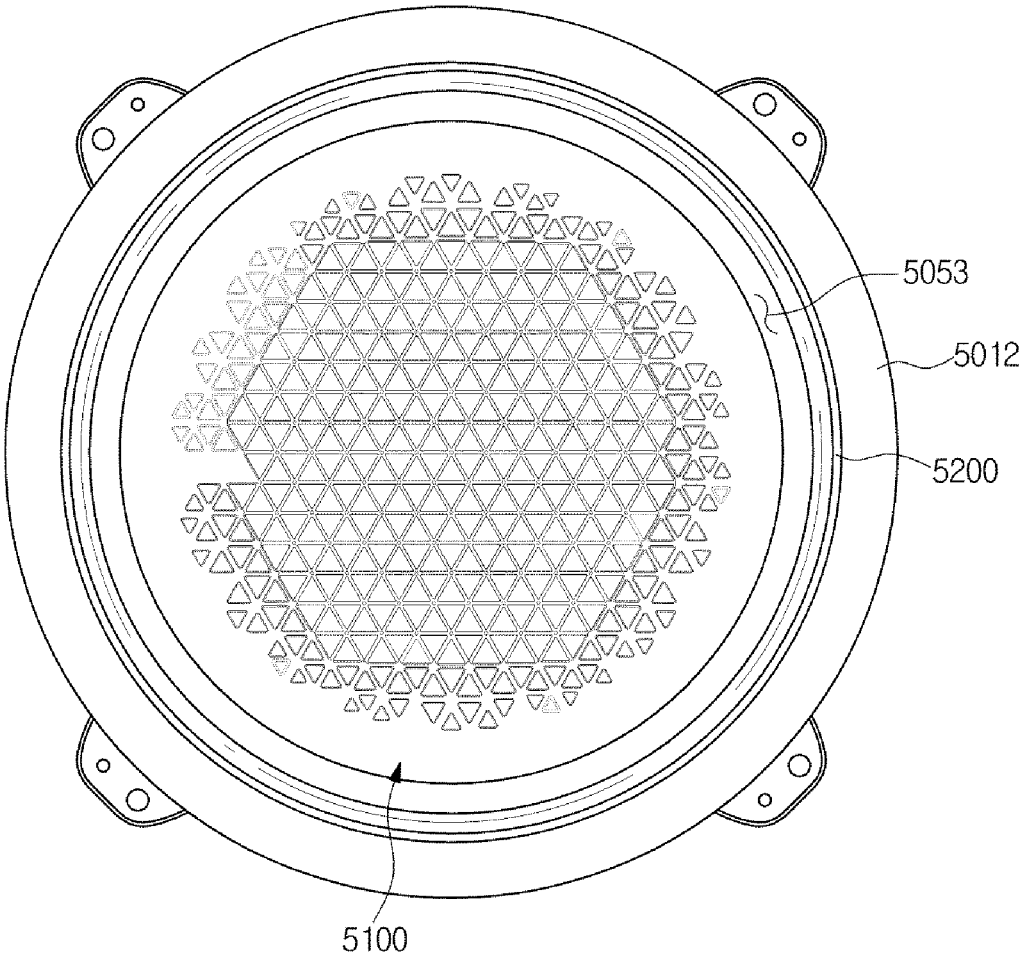
FIG. 83 is a rear view of the air conditioner according to yet another embodiment of the present disclosure.

FIG. 81 is a perspective view of an air conditioner 5001 according to yet another embodiment of the present disclosure. FIG. 82 is a lateral cross-sectional view of the air conditioner 5001 illustrated in FIG. 81, and FIG. 83 is a rear view of the air conditioner according to yet another embodiment of the present disclosure.

The air conditioner 5001 may be installed in a ceiling C. At least a portion of the air conditioner 5001 may be buried in the ceiling C.

The air conditioner 5001 may include a housing 5010 provided in a substantially cylindrical shape, a heat exchanger 5030 provided inside the housing 5010, and a blower fan 5040 configured to circulate air.

The housing 5010 may have a substantially circular shape when viewed in the vertical direction. However, the shape of the housing 5010 is not limited thereto, and the housing 5010 may also have an elliptical shape or a polygonal shape. The housing 5010 may be formed of an upper housing 5011 arranged inside the ceiling C, and a lower housing 5012 coupled below the upper housing 5011, arranged outside the ceiling C, and exposed to the outside. However, embodiments are not limited thereto, and a middle housing may be further arranged between the upper housing 5011 and the lower housing 5012.

An inlet 5020 through which air is suctioned may be arranged at a central portion of the lower housing 5012, and a suction flow passage 5021 configured to connect the inlet 5020 to the blower fan 5040 to make air suctioned through the inlet 5020 to be introduced into the blower fan 5040 may be provided above the inlet 5020.

However, as in yet another embodiment of the present disclosure, the inlet 5020 and the suction flow passage 5021 may be arranged at an airflow control guide unit 5100 which will be described below. The airflow control guide unit 5100 may form at least a portion of the housing 5010 and control discharged airflow being discharged toward an outside of the housing 5010 by lifting movement.

A discharge flow passage 5050 provided to enable air suctioned through the inlet 5020 to be heat-exchanged with the heat exchanger 5030 and discharged may be formed at an outside in a radial direction of the inlet 5020 and an outside in a radial direction of the heat exchanger 5030. The discharge flow passage 5050 may have a substantially ring shape when viewed in the vertical direction. However, embodiments are not limited thereto, and the discharge flow passage 5050 may also be provided to include a curved section.

The discharge flow passage 5050 may be provided in a ring shape by the heat exchanger 5030 provided in a ring shape and the housing 5010 provided in a cylindrical shape. One side of the discharge flow passage 5050 may be connected to the heat exchanger 5030, and the other side thereof may be connected to an outlet 5056 provided near the lower housing 5012.

By the above structure, the air conditioner 5001 may suction air from a lower side, cool and heat the air, and then discharge the air back to the lower side.

A grille (not illustrated) may be coupled to an upper side of the inlet 5020 to filter dust from air being suctioned through the inlet 5020.

The heat exchanger 5030 may be provided inside the housing 5010 and may be arranged on a flow passage of air between the inlet 5020 and the outlet 5056. The heat exchanger 5030 may be formed of a tube (not illustrated) having refrigerant flow therethrough and a header (not illustrated) connected to an external refrigerant tube to supply or recover refrigerant to or from the tube. A heat-exchange fin may be provided in the tube to expand a heat dissipation area.

The heat exchanger 5030 may have a substantially ring shape when viewed in the vertical direction. The shape of the heat exchanger 5030 may correspond to the shape of the housing 5010. The shape of the heat exchanger 5030 may correspond to the shape of the outlet 5056. The heat exchanger 5030 may be placed on a drain tray 5016, and condensate generated in the beat exchanger 5030 may be collected in the drain tray 5016.

The blower fan 5040 may be provided inside in a radial direction of the heat exchanger 5030. The blower fan 5040 may be a centrifugal fan configured to suction air in an axial direction and discharge air in a radial direction. A blower motor 5041 configured to drive the blower fan 5040 may be provided in the air conditioner 5001.

By the above configuration, the air conditioner 5001 may suction air from an indoor space, cool the air, and then discharge the air back to the indoor space, or suction air from an indoor space, heat the air, and then discharge the air back to the indoor space.

The air conditioner 5001 may further include a heat exchanger pipe 5031 connected to the heat exchanger 5030 from outside of the housing 5010 and having refrigerant flow therethrough, and a drain pipe 5017 configured to discharge condensate collected in the drain tray 5016 to the outside. The heat exchanger pipe 5031 and the drain pipe 5017 may be connected to the outside via one side of the upper housing 5011.

As described above, the air conditioner 5001 according to yet another embodiment of the present disclosure includes the discharge flow passage 5050 formed in a ring shape and the outlet 5056 formed in a ring shape and having at least a portion corresponding to the ring-shaped discharge flow passage 5050.

The discharge flow passage 5050 may include a first guide surface 5051 and a second guide surface 5052 provided at a lower portion and forming the ring-shaped discharge flow passage 5050. A ring-shaped space may be formed at an upper portion of the discharge flow passage 5050 by an inner circumferential surface of the upper housing 5011 and the heat exchanger 5030, and a ring-shaped space may be formed at the lower portion of the discharge flow passage 5050 disposed below the heat exchanger 5030 by the first guide surface 5051 formed by an outer circumferential surface of the airflow control guide unit 5100 and the second guide surface 5052 formed by the inner circumferential surface of the upper housing 5011.

However, embodiments are not limited to yet another embodiment of the present disclosure, and the first guide surface 5051 and the second guide surface 5052 may extend from the upper housing 5011 or the lower housing 5012, or may extend from a middle housing that may be provided between the upper housing 5011 an the lower housing 5012 although not illustrated. Also, the first guide surface 5051 and the second guide surface 5052 may be formed by a separate configuration.

Each of the first guide surface 5051 and the second guide surface 5052 may include a curved portion 5053 provided in a curved shape and extending in an outward direction of a radial direction of the discharge flow passage 5050. The curved portion 5053 may be provided at a side adjacent to the outlet 5056.

Air being discharged from the outlet 5056 through the discharge flow passage 5050 may be discharged along the curved portion 5053 in a direction in which the curved surface is bent. Consequently, air being discharged from the outlet 5056 may be discharged toward the outside of the housing 5010 along the outward direction of the radial direction of the discharge flow passage 5050, which is a direction in which the curved portion 5053 extends.

As illustrated in FIG. 83, an airflow control protrusion 5200 configured to change a direction of airflow being discharged from the outlet 5056 may be arranged in the outward direction of the radial direction of the outlet 5056. The airflow control protrusion 5200 may include a discharge guide surface 5210 protruding to extend in a downward direction of the outlet 5056 and configured to guide airflow in the downward direction in which the airflow control protrusion 5200 extends.

The airflow control protrusion 5200 may be provided on a moving path of discharged airflow and change a discharge direction by colliding with air being discharged.

Specifically, as described above, air being discharged heads toward the outward direction of the radial direction of the discharge flow passage 5050 or the outlet 5056 by the curved portion 5053 and forms wide airflow heading toward all directions from the housing 5010. The wide airflow may collide with the airflow control protrusion 5200, descend along the discharge guide surface 5210, and be changed to descending airflow.

Consequently, air being discharged from the air conditioner 5001 according to yet another embodiment of the present disclosure mostly form descending airflow due to the airflow control protrusion 5200.

According to circumstances, the air conditioner 5001 should selectively form wide airflow in which air spreads in all directions and descending airflow in which discharged airflow is centralized downward. Here, because the air conditioner 5001 according to the embodiment of the present disclosure mostly forms descending airflow, a problem occurs in controlling discharged airflow.

In the case of a conventional air conditioner, a housing and a heat exchanger are provided in a quadrilateral shape, and accordingly, an outlet is formed in a quadrilateral shape. Due to the outlet being provided in the quadrilateral shape, the outlet cannot be arranged to cover the whole outer portion in the radial direction along a perimeter of the heat exchanger. Accordingly, there are problems in that a section from which discharged airflow is discharged is limited and a blind spot is formed due to airflow not being smoothly delivered to a portion without an outlet.

However, the air conditioner 5001 according to yet another embodiment of the present disclosure may deliver airflow to all directions without a blind spot by having the discharge flow passage 5050 formed in a ring shape and the outlet 5056 having a ring shape corresponding to that of the discharge flow passage 5050.

Because the outlet of the air conditioner according to yet another embodiment of the present disclosure has a ring shape as described above unlike the conventional air conditioner, a blade configured to control discharged airflow is difficult to be arranged inside the outlet. This is because it is disadvantageous to arrange a blade shaft inside the outlet provided in a ring shape, and it is difficult to rotate a blade inside the ring-shaped outlet. Accordingly, the air conditioner 5001 including the ring-shaped discharge flow passage 5050 according to yet another embodiment of the present disclosure has to control discharged airflow that is discharged from the outlet 5056 by an element other than a blade.

For this, the air conditioner may drive the airflow control guide unit 5100, which will be described below, to control discharged airflow. Specifically, although an air conditioner including a blade controls descending airflow and wide airflow by changing an arrangement angle of the blade, the air conditioner 5001 according to yet another embodiment of the present disclosure may control descending airflow and wide airflow by driving the airflow control guide unit 5100.

Also, when discharged airflow is controlled without using a blade as in yet another embodiment of the present disclosure, the problems in that an amount of discharged air is decreased due to airflow being interfered by a blade and flow noise is increased due to turbulent flow generated around the blade may be solved.

Hereinafter, the airflow control guide unit 5100 will be described in detail.

Figure 84:
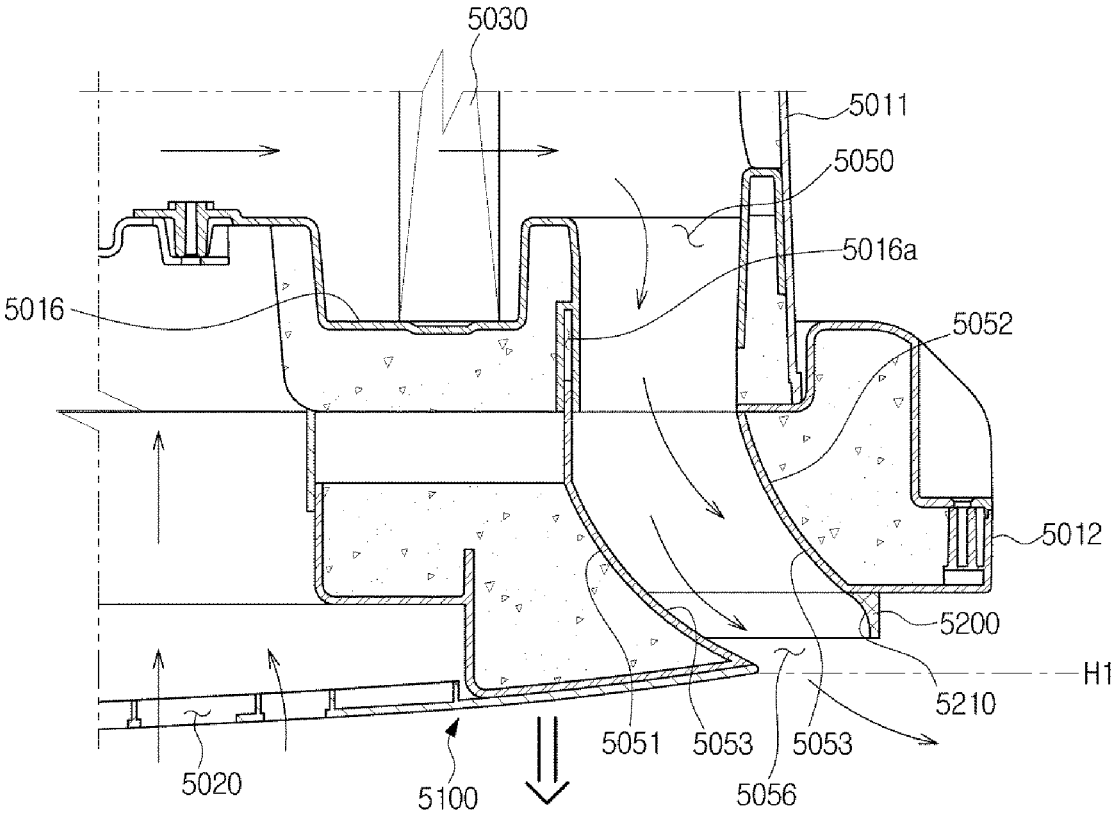
FIG. 84 is an enlarged view of the portion marked in FIG. 82.
Figure 85:
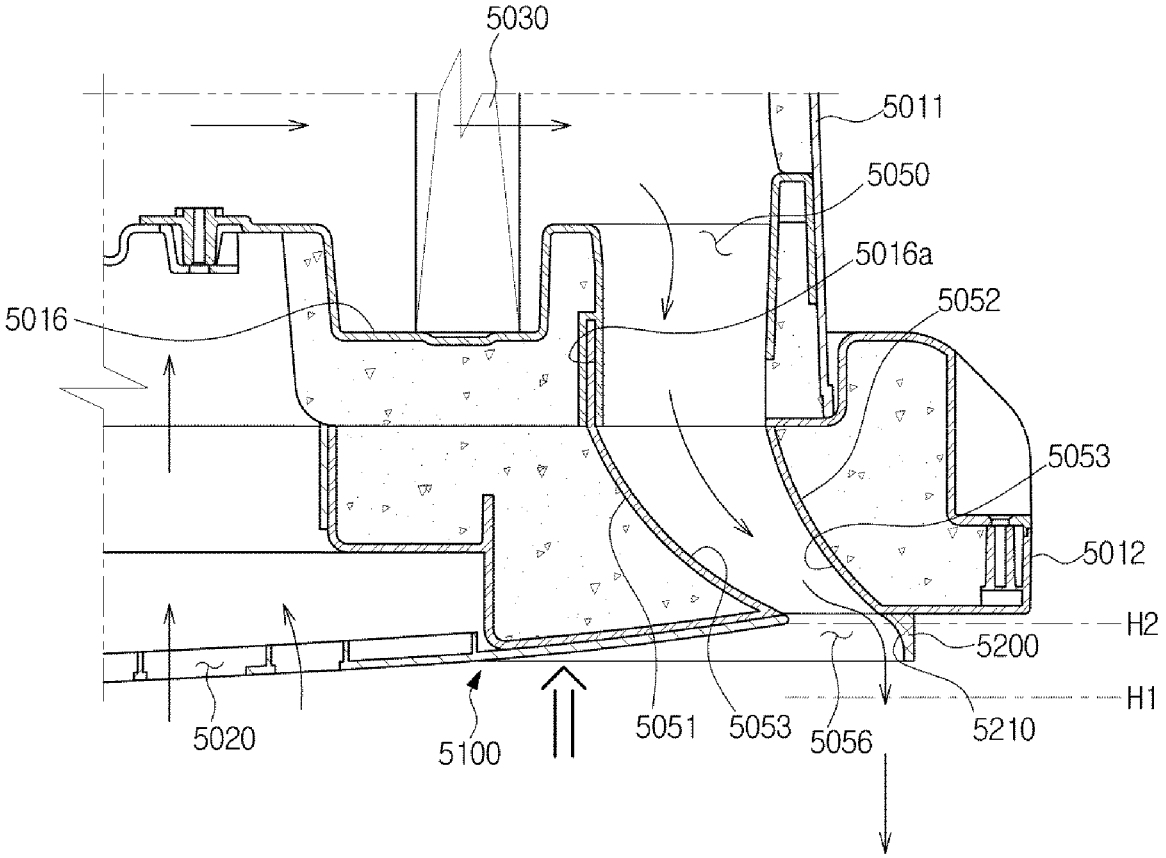
FIG. 85 is an enlarged view of a portion corresponding to the portion marked in FIG. 82 when the airflow control guide unit of the air conditioner is arranged at a first position according to yet another embodiment of the present disclosure.
Figure 86:
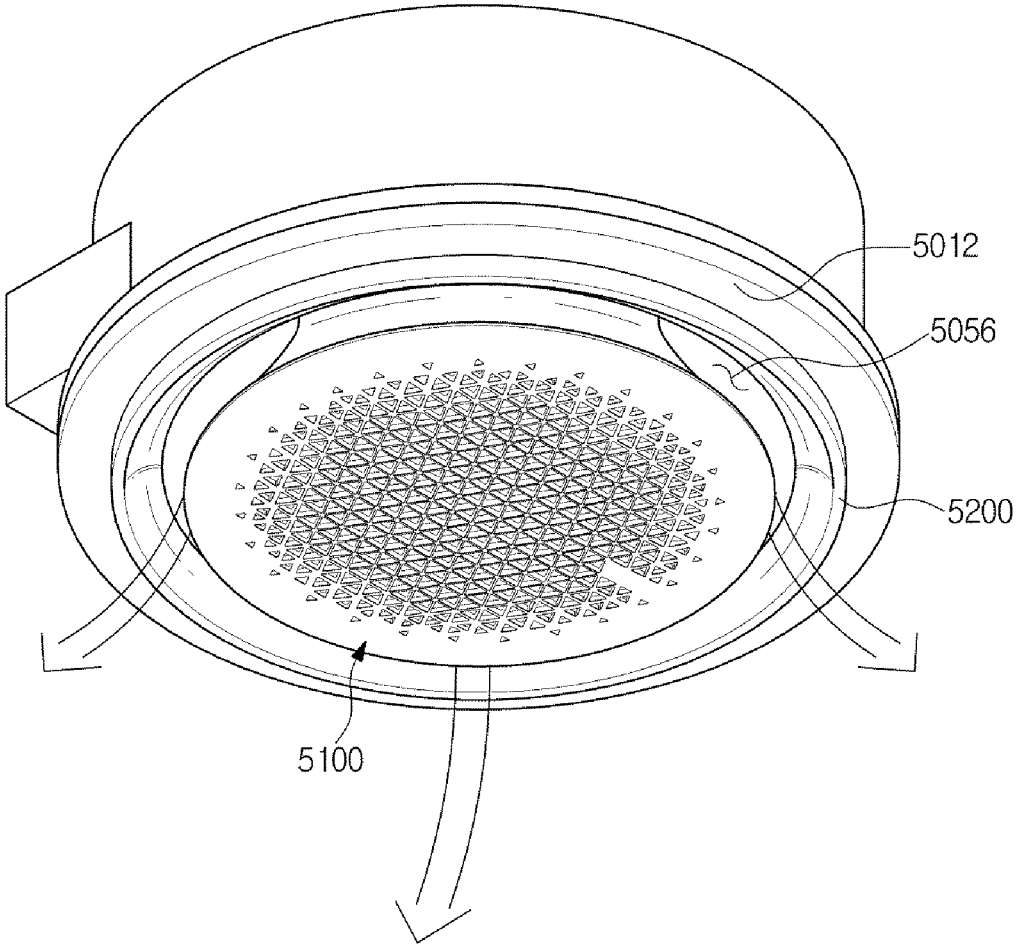
FIG. 86 is a perspective view when the airflow control guide unit of the air conditioner is arranged at a second position according to yet another embodiment of the present disclosure.
Figure 87:
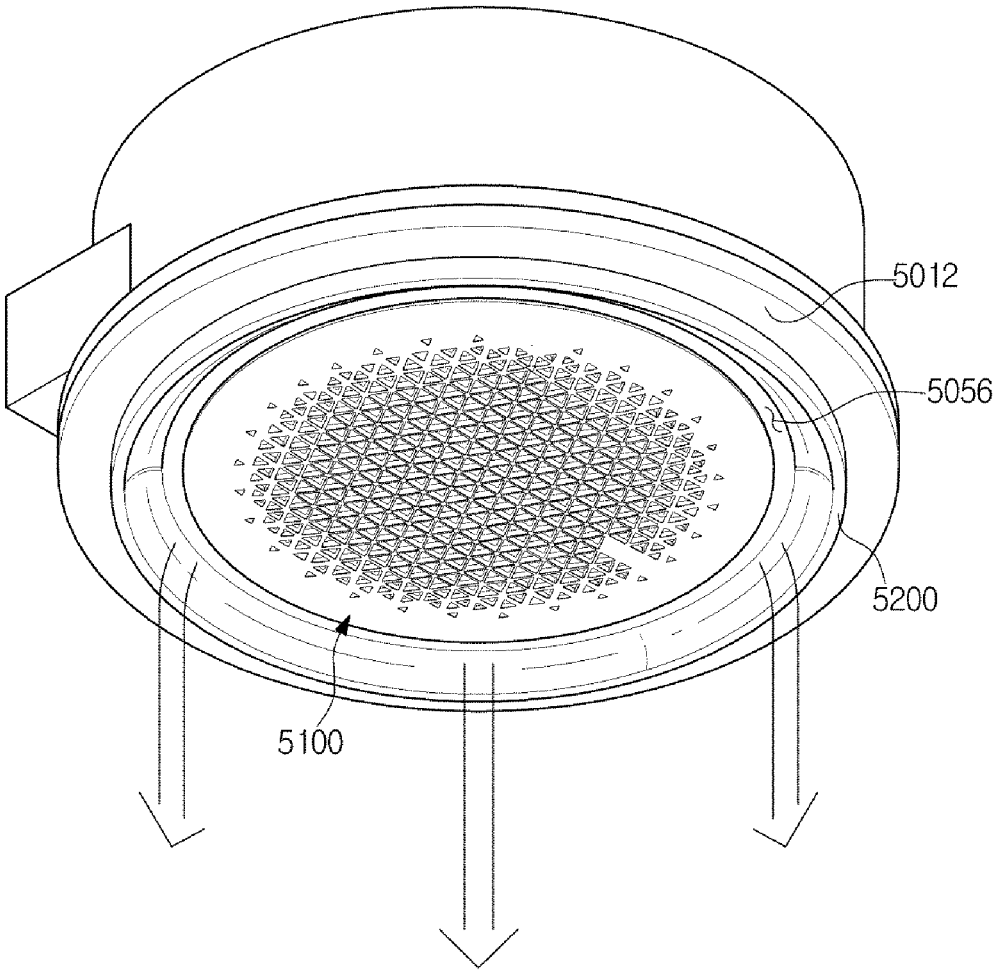
FIG. 87 is a perspective view when the airflow control guide unit of the air conditioner is arranged at the first position according to yet another embodiment of the present disclosure.

FIG. 84 is an enlarged view of the portion marked in FIG. 82, FIG. 85 is an enlarged view of a portion corresponding to the portion marked in FIG. 82 when the airflow control guide unit of the air conditioner is arranged at a first position according to yet another embodiment of the present disclosure, FIG. 86 is a perspective view when the airflow control guide unit of the air conditioner is arranged at a second position according to yet another embodiment of the present disclosure, and FIG. 87 is a perspective view when the airflow control guide unit of the air conditioner is arranged at the first position according to yet another embodiment of the present disclosure.

As illustrated in FIGS. 84 and 85, the airflow control guide unit 5100 may be arranged at a central side of the lower housing 5012. The airflow control guide unit 5100 may be provided in a substantially cylindrical shape.

The outer circumferential surface of the airflow control guide unit 5100 may form the first guide surface 5051 of the discharge flow passage 5050, and the inner circumferential surface of the guide unit 5100 may form the suction flow passage 5021 configured to connect the inlet 5020 to the blower fan 5040 to make air suctioned through the inlet 5020 to be introduced into the blower fan 5040.

The airflow control guide unit 5100 may be arranged below the drain tray 5016 and may be liftably provided below the drain tray 5016. The airflow control guide unit 5100 may be lowered and arranged at a first position H1 and may be lifted and arranged at a second position H2. That is, the airflow control guide unit 5100 may be provided to be liftable between the first position H1 and the second position H2.

The airflow control guide unit 5100 may include a lifting guide 5130 extending upward. When the airflow control guide unit 5100 is being lifted, the lifting guide 5130 may guide the airflow control guide unit 5100 so that the airflow control guide unit 5100 moves upward or downward.

Specifically, the drain tray 5016 may include a guide groove 5016*a* provided to correspond to the lifting guide 5130, and lifting of the airflow control guide unit 5100 may be by the lifting guide 5130 vertically sliding in the guide groove 5016*a*.

As illustrated in FIG. 84, when the airflow control guide unit 5100 is being lowered and arranged at the first position H1, the lifting guide 5130 may slide downward in the guide groove 5016*a*, and at least a portion of the lifting guide 5130 may be deviated from the guide groove 5016*a*. Accordingly, the airflow control guide unit 5100 may be lowered as much as a length by which the lifting guide 5130 is deviated from the guide groove 5016*a*.

Also, as illustrated in FIG. 83, when the airflow control guide unit 5100 is being lifted and arranged at the second position H2, the lifting guide 5130 may slide upward in the guide groove 5016*a*, and the lifting guide 5130 may be inserted into the guide groove 5016*a*. Accordingly, the airflow control guide unit 5100 may be lifted as much as a length by which the lifting guide 5130 is inserted into the guide groove 5016*a*.

When the airflow control guide unit 5100 is lifted and arranged at the second position H2, an upper surface of the airflow control guide unit 5100 may be arranged to be adjacent to a lower surface of the drain tray 5016.

The airflow control guide unit 5100 may include a driving device (not illustrated) configured to lift the airflow control guide unit 5100. The driving device (not illustrated) may include an element such as a rack pinion and a driving motor and move the airflow control guide unit 5100 in the vertical direction.

However, embodiments are not limited to yet another embodiment of the present disclosure, and the lifting guide 5130 may guide upward movement of the airflow control guide unit 5100 by being inserted into a guide groove provided in an element other than the drain tray 5016. That is, the lifting guide 5130 may be inserted into a guide groove in any element that may be provided inside the upper housing 5011, or a separate guide element may be arranged.

When the airflow control guide unit 5100 is lowered and arranged at the first position H1, an outer circumferential surface of the lifting guide 5130 may form one side of the first guide surface 5051 of the discharge flow passage 5050. That is, when the airflow control guide unit 5100 is lowered, the lifting guide 5130 is deviated from the guide groove 5106*a* and exposed to the outside. An exposed surface of the lifting guide 5130 is arranged to be in contact with one side of the first guide surface 5051 of the discharge flow passage 5050 and forms one side of the first guide surface 5051 of the discharge flow passage 5050.

That is, when the airflow control guide unit 5100 is arranged at the first position H1, the inner circumferential surface of the discharge flow passage 5050 extends more downward as much as a length by which the lifting guide 5130 is exposed, and, accordingly, discharged airflow may be discharged from a lower side compared to when the airflow control guide unit 5100 is arranged at the second position H2.

As illustrated in FIGS. 83 and 85, when the airflow control guide unit 5100 is arranged at the second position H2, air being discharged from the outlet 5056 may be guided downward by the airflow control protrusion 5200 provided on a discharge area and become descending airflow.

However, as illustrated in FIGS. 84 and 86, when the airflow control guide unit 5100 is lowered and arranged at the first position H1, a discharge area of air being discharged from the outlet 5056 may be provided below the discharge area of the second position H2, and most air being discharged may not collide with the airflow control protrusion 5200, head toward the outward direction of the radial direction of the outlet 5056, and become wide airflow.

That is, the airflow control guide unit 5100 may be arranged at the first position H1 by being lowered and control discharged airflow so that the discharged airflow becomes wide airflow, and may be arranged at the second position H2 by being lifted and control discharged airflow so that the discharged airflow becomes descending airflow.

In other words, with respect to the airflow control guide unit 5100, the first position H1 may be a section in which the airflow control guide unit 5100 controls wide airflow, and the second position H2 may be a section in which the airflow control guide unit 5100 controls descending airflow.

Hereinafter, an airflow control guide unit 5300 of an air conditioner 5001' according to yet another embodiment of the present disclosure will be described. Because elements other than elements, which will be described below, are the same as those of the air conditioner 5001 according to yet another embodiment of the present disclosure described above, overlapping descriptions will be omitted. Unlike the embodiment described above, the air conditioner 5001' according to yet another embodiment of the present disclosure does not include the airflow control protrusion 5200.

Figure 88:
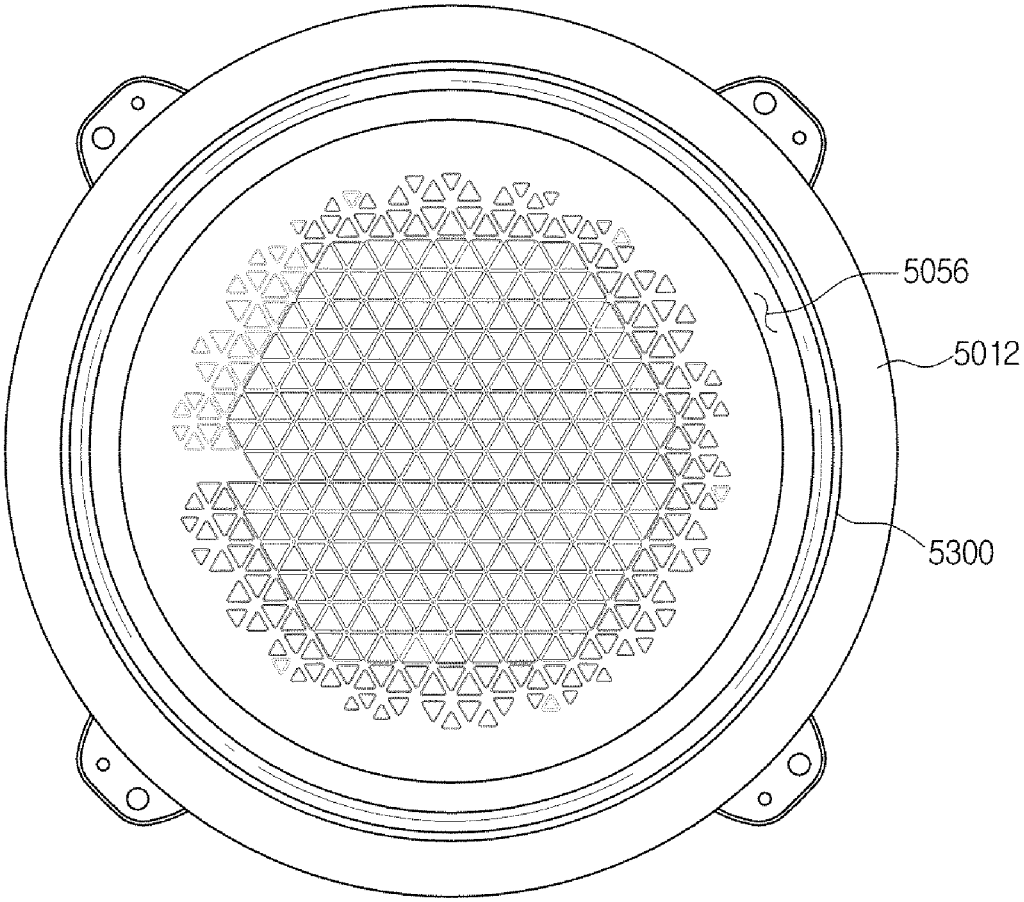
FIG. 88 is a rear view of an air conditioner according to yet another embodiment of the present disclosure.
Figure 89:
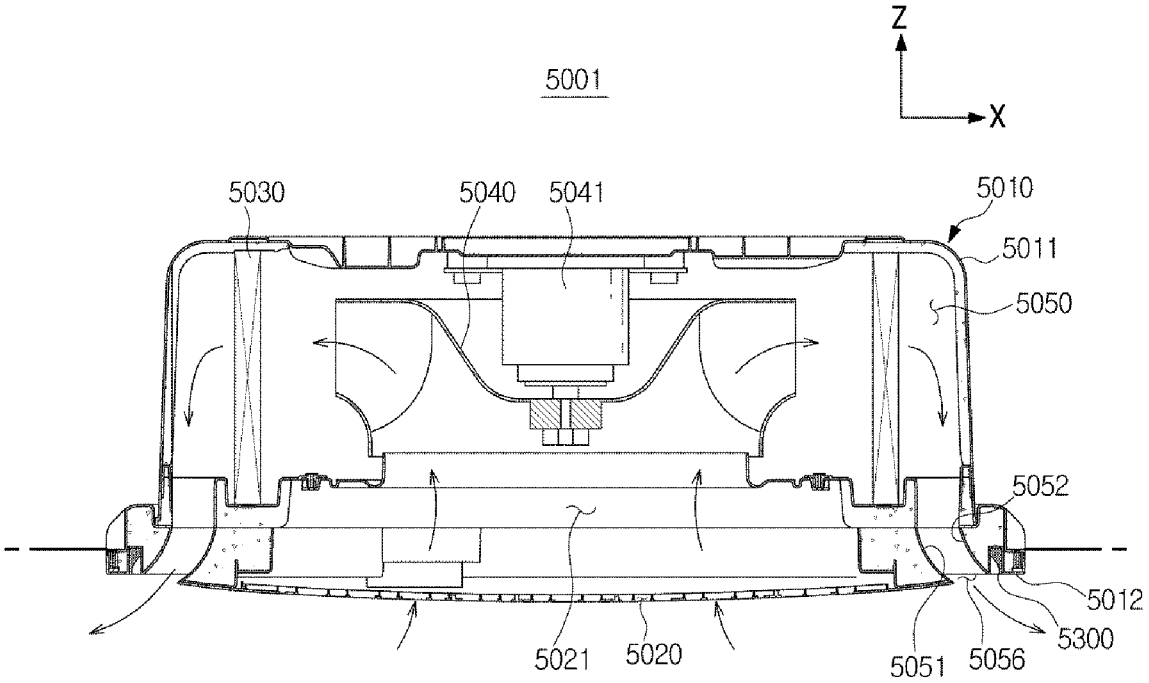
FIG. 89 is a lateral cross-sectional view of the air conditioner according to yet another embodiment of the present disclosure.
Figure 90:
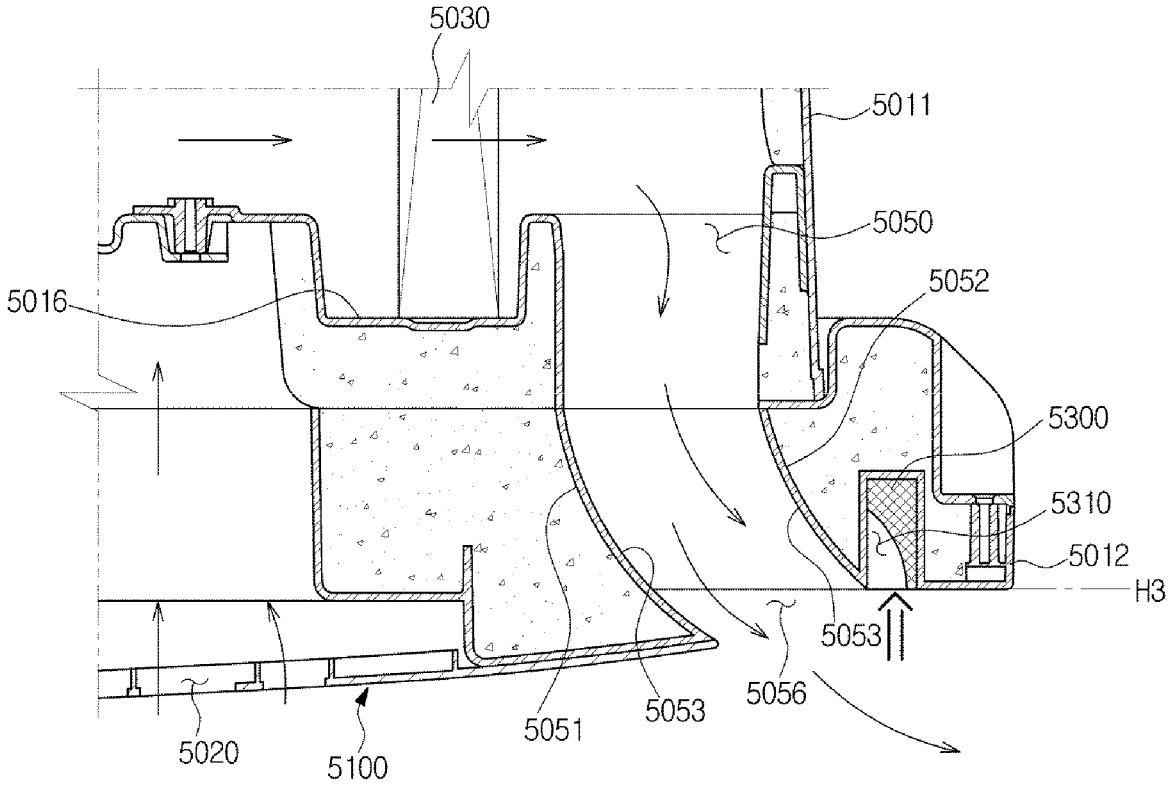
FIG. 90 is an enlarged view of a portion marked in FIG. 89.
Figure 91:
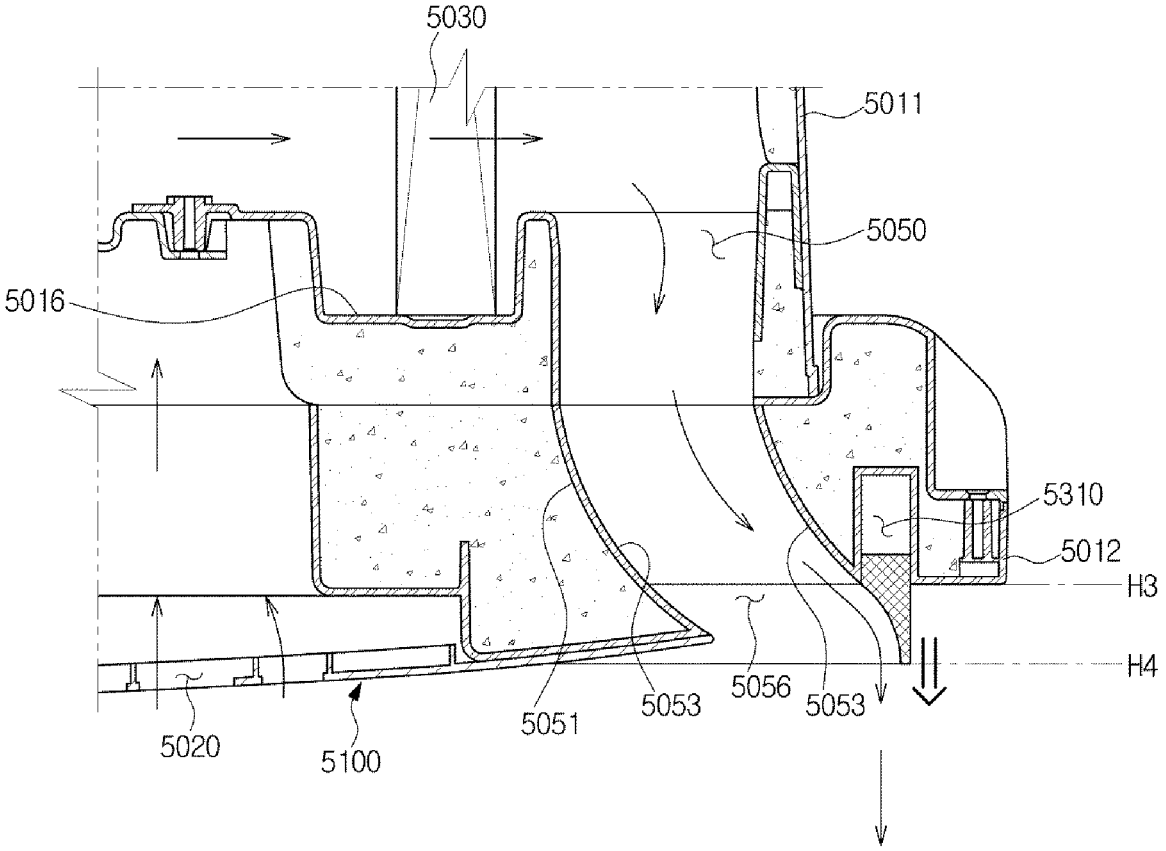
FIG. 91 is an enlarged view of a portion corresponding to the portion marked in FIG. 89 when an airflow control guide unit of the air conditioner is arranged at a first position according to yet another embodiment of the present disclosure.
Figure 92:
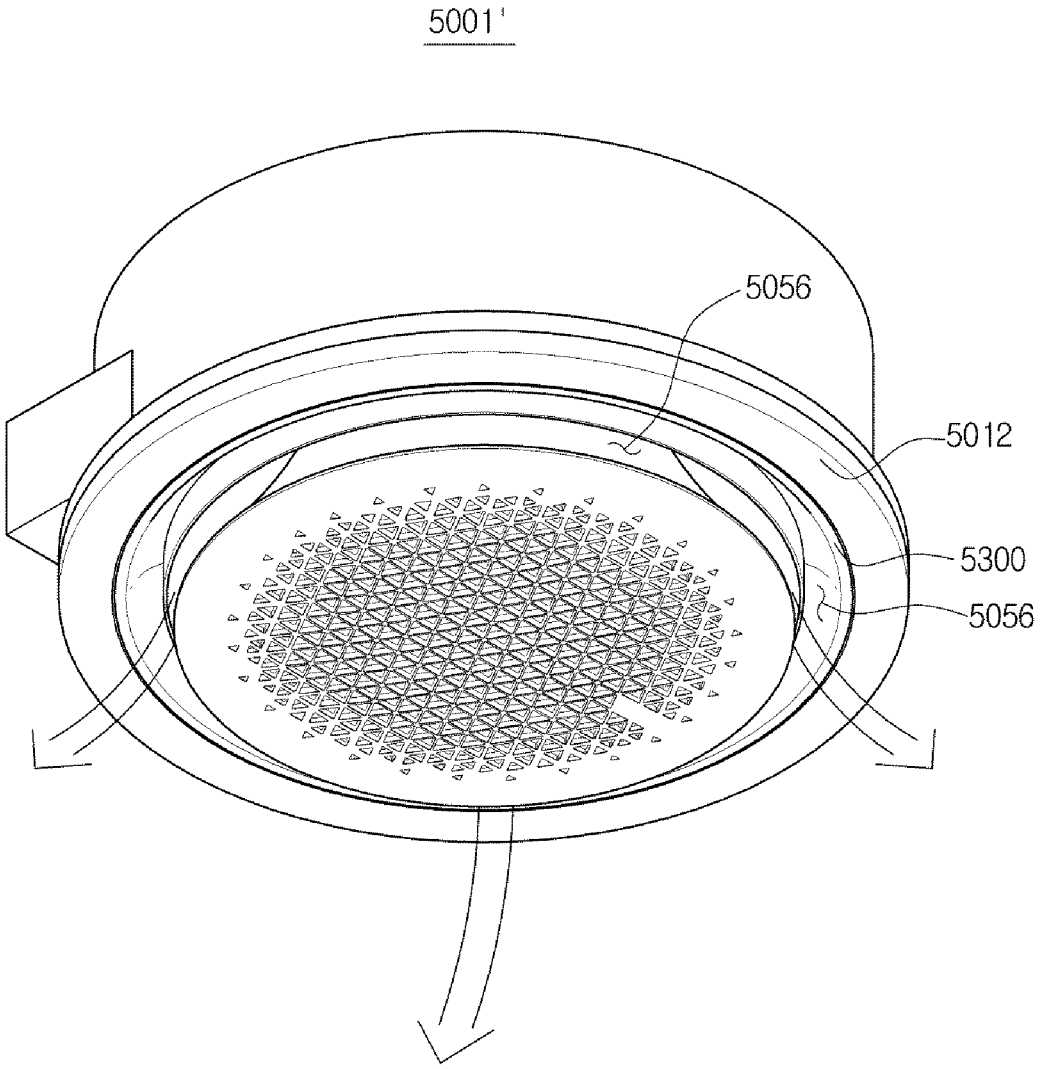
FIG. 92 is a perspective view when the airflow control guide unit is arranged at a second position according to yet another embodiment of the present disclosure.
Figure 93:
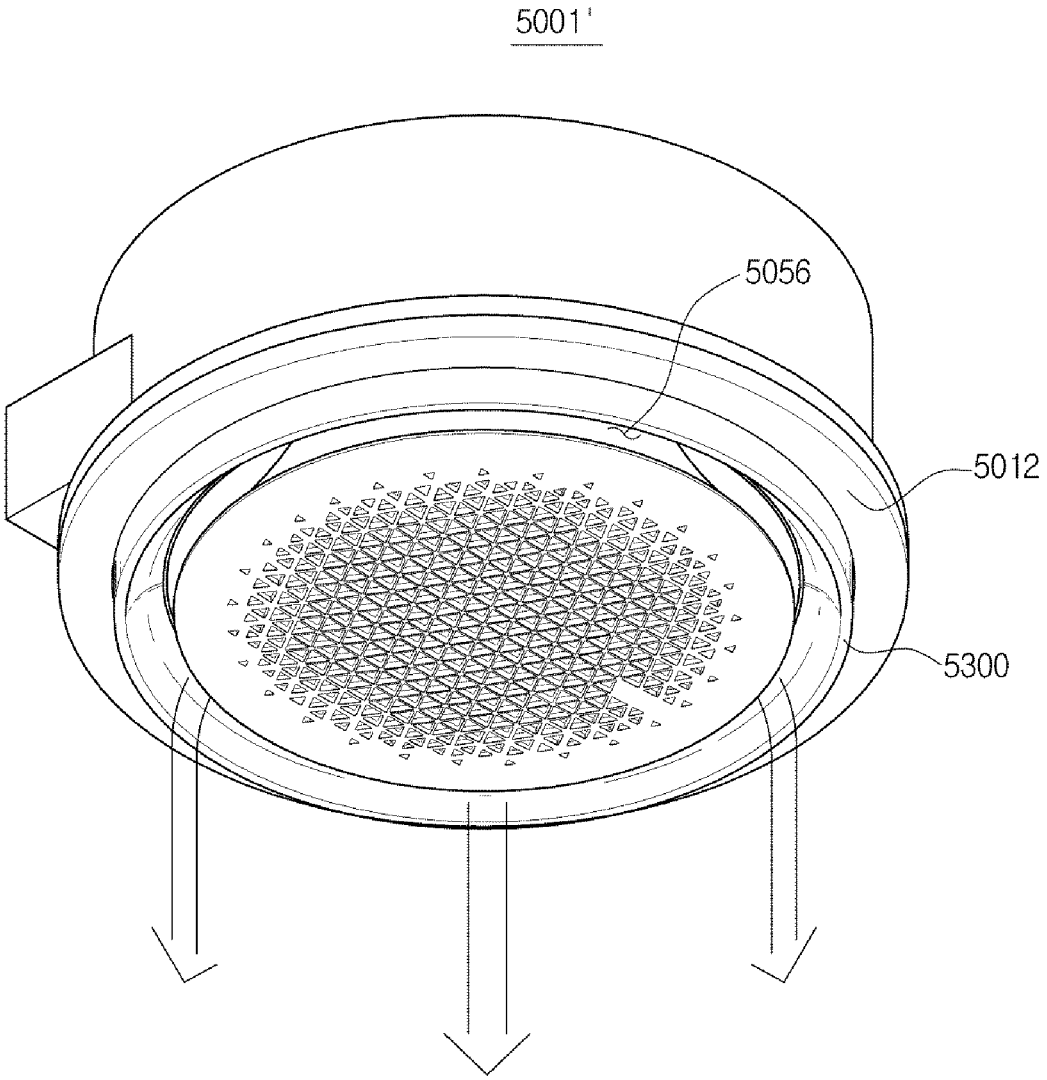
FIG. 93 is a perspective view when the airflow control guide unit is arranged at the first position according to yet another embodiment of the present disclosure.

FIG. 88 is a rear view of an air conditioner according to yet another embodiment of the present disclosure, FIG. 89 is a lateral cross-sectional view of the air conditioner according to yet another embodiment of the present disclosure, FIG. 90 is an enlarged view of a portion marked in FIG. 89, FIG. 91 is an enlarged view of a portion corresponding to the portion marked in FIG. 89 when an airflow control guide unit of the air conditioner is arranged at a first position according to yet another embodiment of the present disclosure, FIG. 92 is a perspective view when the airflow control guide unit is arranged at a second position according to yet another embodiment of the present disclosure, and FIG. 93 is a perspective view when the airflow control guide unit is arranged at the first position according to yet another embodiment of the present disclosure.

As illustrated in FIG. 88, the airflow control guide unit 5300 may be provided in a ring shape at an outside in the radial direction of the outlet 5056.

As described above, air being discharged through the outlet 5056 heads toward the outward direction of the radial direction of the discharge flow passage 5050 or the outlet 5056 along the curved portion 5053. This is to control airflow by arranging the airflow control guide unit 5300 in a discharge direction.

Although the airflow control guide unit 5300 is provided in a ring shape corresponding to that of the outlet 5056 as in yet another embodiment of the present disclosure, embodiments are not limited thereto, and the airflow control guide unit 5300 may be provided in various shapes. However, for efficient airflow control, the airflow control guide unit 5300 preferably has a shape corresponding to that of the outlet 5056 and is provided at the outside of the outlet 5056. Consequently, when the outlet 5056 is provided in a shape other than a ring shape, the airflow control guide unit 5300 may also be provided in the shape other than a ring shape.

As illustrated in FIGS. 90 and 91, the airflow control guide unit 5300 may slide between a first position H3 and a second position H4. The first position H1 may be defined as a position at which the airflow control guide unit 5300 is not arranged on a moving path of discharged airflow, and the second position H4 may be defined as a position at which the airflow control guide 5100 is arranged on the moving path of discharged airflow.

Description will be given on the basis of the illustrated airflow control guide unit 5300. The airflow control guide unit 5300 placed at the first position H3 is inserted into an insertion groove 5310 provided inside the housing 5010 and is inserted into the housing 5010. Specifically, the airflow control guide unit 5300 is inserted into the insertion groove 5310 provided in the housing 5010 by sliding and is arranged not to be exposed to the outside.

The airflow control guide unit 5300 placed at the second position H4 has slid from the first position H3 and is protruding toward the outside of the housing 5010. Specifically, the airflow control guide unit 5300 slides from the insertion groove 5310, is deviated from the insertion groove 5310, passes through the lower housing 5012, protrudes from a lower side of the housing 5010, and is placed on the moving path of discharged airflow.

The airflow control guide unit 5300 may include a driving device (not illustrated) configured to slide the airflow control guide unit 5300. The driving device (not illustrated) may include an element such as a rack pinion and a driving motor and slide the airflow control guide unit 5300 in the vertical direction.

However, embodiments are not limited thereto, and the airflow control guide 5300 may move between the first position H3 and the second position H4 using various methods other than sliding.

As described above, discharged airflow being discharged from the outlet 5056 is wide airflow heading toward the outward direction of the radial direction of the outlet 5056. The airflow control guide unit 5300 may be placed at the second position H4, control wide airflow being discharged, and change the wide airflow to descending airflow heading below the outlet 5056.

Also, when the airflow control guide unit 5300 is placed at the first position H3, the airflow control guide unit 5300 is not arranged on a direction in which discharged airflow is formed and does not limit wide airflow being discharged through the outlet 5056.

That is, the air conditioner 5001' may form wide airflow when the airflow control guide unit 5300 is arranged at the first position H3, and the air conditioner 5001' may form descending airflow when the airflow control guide unit 5300 is arranged at second position H4.

Hereinafter, an airflow control guide unit 5400 of the air conditioner 5001' according to yet another embodiment of the present disclosure will be described. Because elements other than elements, which will be described below, are the same as those of the air conditioner 5001 according to yet another embodiment of the present disclosure described above, overlapping descriptions will be omitted.

Figure 94:
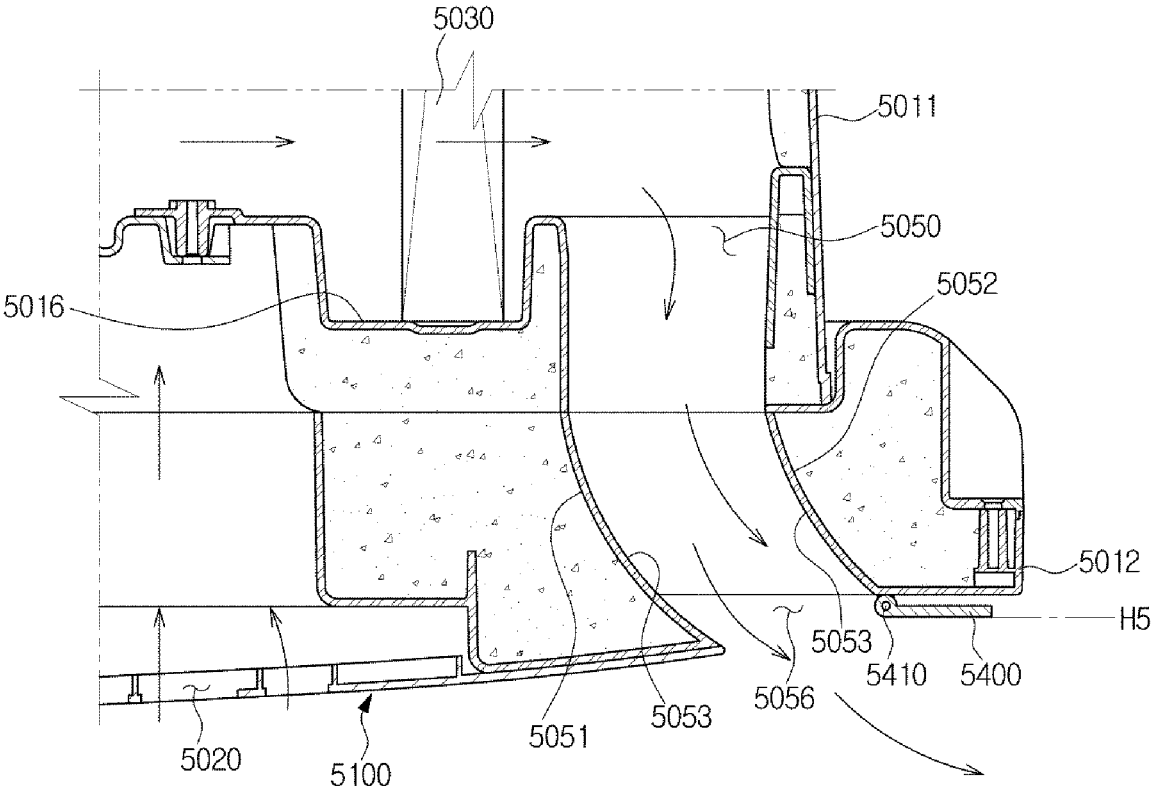
FIG. 94 is an enlarged lateral cross-sectional view of a portion when an airflow control guide unit of the air conditioner is arranged at a first position according to yet another embodiment of the present disclosure.
Figure 95:
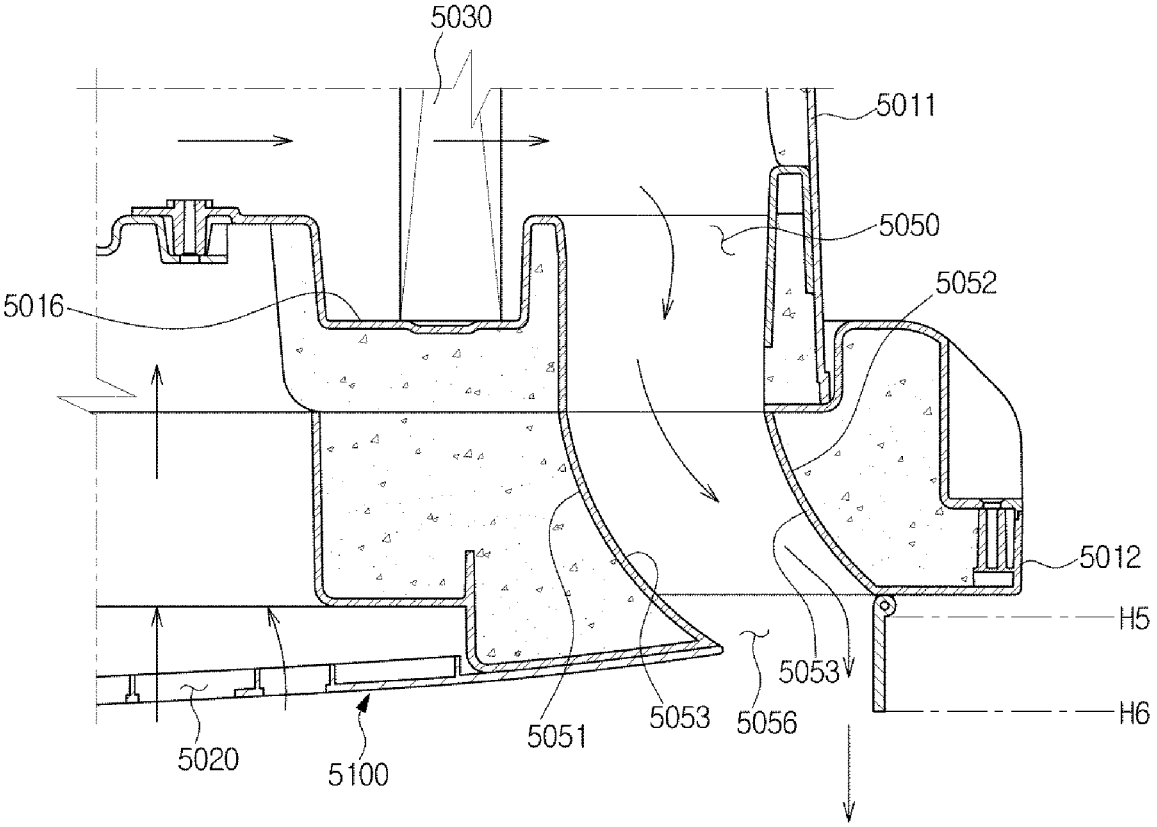
FIG. 95 is an enlarged lateral cross-sectional view of a portion when the airflow control guide unit of the air conditioner is arranged at a second position according to yet another embodiment of the present disclosure.

FIG. 94 is an enlarged lateral cross-sectional view of a portion when an airflow control guide unit of the air conditioner is arranged at a first position according to yet another embodiment of the present disclosure, and FIG. 95 is an enlarged lateral cross-sectional view of a portion when the airflow control guide unit of the air conditioner is arranged at a second position according to yet another embodiment of the present disclosure.

As illustrated in FIGS. 94 and 95, the airflow control guide unit 5400 may be provided at an outside in the radial direction of the outlet 5056.

As described above, air being discharged through the outlet 5056 heads toward the outward direction of the radial direction of the discharge flow passage 5050 or the outlet 5056 along the curved portion 5053. This is to control airflow by arranging the airflow control guide unit 5300 in a discharge direction.

The airflow control guide unit 5400 may include a rotating shaft 5410 provided at one end of the guide unit 5400. The guide unit 5400 may move between a first position H5 and a second position H6 by rotating about the rotating shaft 5410.

That is, when a position at which the airflow control guide unit 5400 faces the lower housing 5012 as illustrated in FIG. 94 is defined as the first position H5 and a position at which the airflow control guide unit 5400 has rotated about the rotating shaft 5410 from the first position H5 and is arranged in a direction perpendicular to the lower housing 5012 is defined as the second position H6, the airflow control guide unit 5400 may change wide airflow being discharged through the outlet 5056 to descending airflow when arranged at the second position H6.

Specifically, when the airflow control guide unit 5400 is arranged at the second position H6 by rotating, the airflow control guide unit 5400 may be arranged on a discharge section of wide airflow. Accordingly, air being discharged by forming wide airflow may collide with the airflow control guide unit 5400, be guided below the outlet 5056, and be changed to descending airflow.

That is, the air conditioner 5001' may form wide airflow when the airflow control guide unit 5400 is arranged at the first position H5, and the air conditioner 5001' may form descending airflow when the airflow control guide unit 5400 is arranged at the second position H6.

Figure 96:
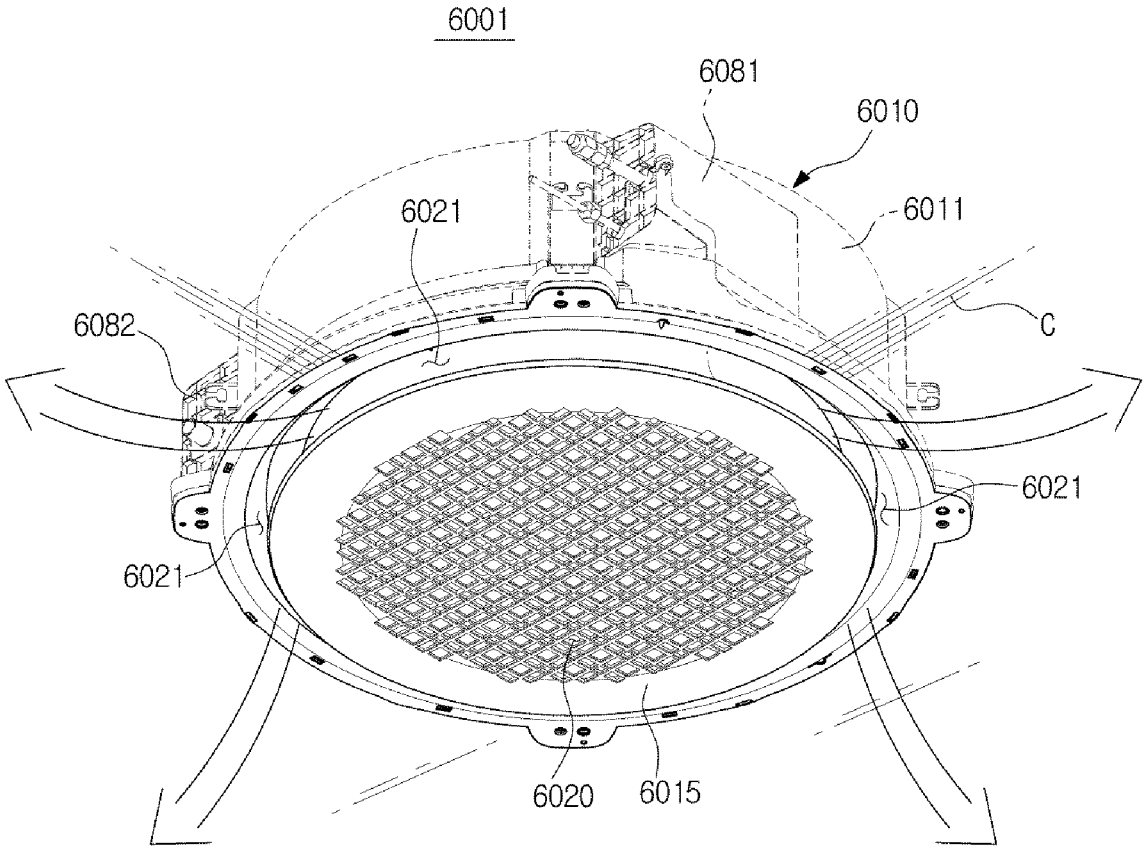
FIG. 96 is a perspective view of an air conditioner according to yet another embodiment of the present disclosure.
Figure 97:
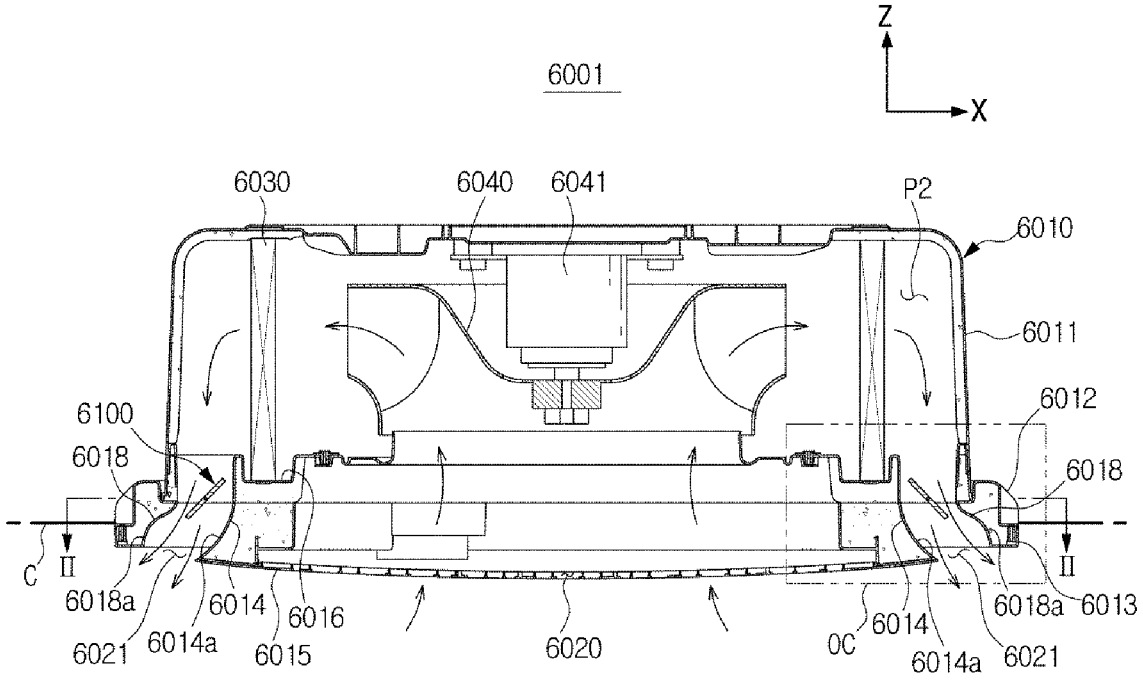
FIG. 97 is a lateral cross-sectional view of the air conditioner illustrated in FIG. 96.
Figure 98:
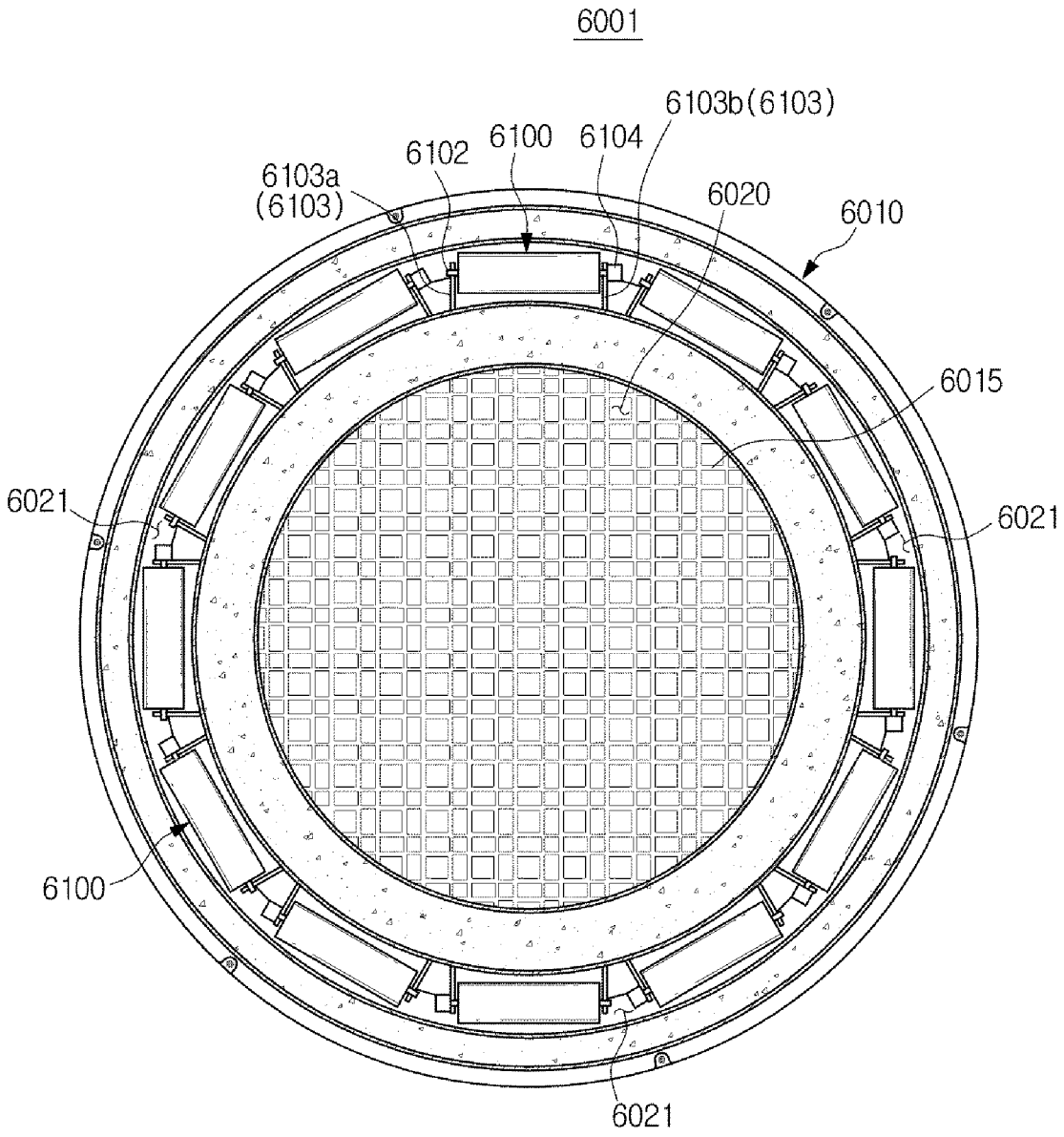
FIG. 98 is a cross-sectional view taken along line II-II marked in FIG. 97.

FIG. 96 is a perspective view of an air conditioner 6001 according to yet another embodiment of the present disclosure. FIG. 97 is a lateral cross-sectional view of the air conditioner 6001 illustrated in FIG. 96. FIG. 98 is a cross-sectional view taken along line II-II marked in FIG. 97.

The air conditioner 6001 according to yet another embodiment of the present disclosure will be described with reference to FIGS. 96 to 98.

The air conditioner 6001 may be installed in a ceiling C. At least a portion of the air conditioner 6001 may be buried in the ceiling C.

The air conditioner 6001 may include a housing 6010 having an inlet 6020 and an outlet 6021, a heat exchanger 6030 provided inside the housing 6010, and a blower fan 6040 configured to circulate air.

The housing 6010 may have a substantially circular shape when viewed in the vertical direction. However, the shape of the housing 6010 is not limited thereto, and the housing 6010 may also have an elliptical shape or a polygonal shape. The housing 6010 may be formed of an upper housing 6011 arranged inside the ceiling C, a middle housing 6012 coupled below the upper housing 6011, and a lower housing 6013 coupled below the middle housing 6012.

The inlet 6020 configured to suction air may be formed at a central portion of the lower housing 6013, and the outlet 6021 configured to discharge air may be formed at an outside in a radial direction of the inlet 6020. The outlet 6021 may have a substantially circular shape when viewed in the vertical direction. However, embodiments are not limited thereto, and the outlet 6021 may be provided to include a curved section.

By the above structure, the air conditioner 6001 may suction air from a lower side, cool and heat the air, and then discharge the air back to the lower side The lower housing 6013 may have a first guide surface 6014 and a second guide surface 6018 forming the outlet 6021. The first guide surface 6014 may be provided adjacent to the inlet 6020, and the second guide surface 2018 may be provided to be more spaced apart from the inlet 6020 than the first guide surface 6014. The first guide surface 6014 and/or the second guide surface 6018 may include Coanda curved portions 6014*a* and 6018*a* provided at one end portion along a direction in which air is being discharged and configured to guide air being discharged through the outlet 6021. The Coanda curved portions 6014*a* and 6018*a* may induce airflow being discharged through the outlet 6021 to flow in close contact with the Coanda curved portions 6014*a* and 6018*a*.

The first guide surface 6014 and the second guide surface 6018 will be described in detail together with an airflow control device 6100 which will be described below.

A grille 6015 may be coupled to a bottom surface of the lower housing 6013 to filter dust from air being suctioned into the inlet 6020.

The heat exchanger 6030 may be provided inside the housing 6010 and arranged on a flow passage of air between the inlet 6020 and the outlet 6021. The heat exchanger 6030 may be formed of a tube (not illustrated) having refrigerant flow therethrough and a header (not illustrated) connected to an external refrigerant tube to supply or recover refrigerant to or from the tube. A heat-exchange fin may be provided in the tube to expand a heat dissipation area.

The heat exchanger 6030 may have a substantially circular shape when viewed in the vertical direction. The shape of the heat exchanger 6030 may correspond to the shape of the housing 6010. The shape of the heat exchanger 6030 may correspond to the shape of the outlet 6021. The heat exchanger 6030 may be placed on a drain tray 6016, and condensate generated in the heat exchanger 6030 may be collected in the drain tray 6016.

The blower fan 6040 may be provided inside in a radial direction of the heat exchanger 6030. The blower fan 6040 may be a centrifugal fan configured to suction air in an axial direction and discharge air in a radial direction. A blower motor 6041 configured to drive the blower fan 6040 may be provided in the air conditioner 6001.

By the above configuration, the air conditioner 6001 may suction air from an indoor space, cool the air, and then discharge the air back to the indoor space, or suction air from an indoor space, heat the air, and then discharge the air back to the indoor space.

The air conditioner 6001 may further include a heat exchanger pipe 6081 connected to the heat exchanger 6030 and having refrigerant flow therethrough, and a drain pump 6082 configured to discharge condensate collected in the drain tray 6016 to the outside. The heat exchanger pipe 6081 may be seated on a heat exchanger pipe seating portion (not illustrated) provided at the drain tray 6016, and the drain pump 6082 may be seated on a drain pump seating portion (not illustrated) provided at the drain tray 6016.

Referring to FIGS. 97 and 98, the air conditioner 6001 may include the airflow control device 6100 configured to control discharged airflow of air being discharged from the outlet 6021.

The airflow control device 6100 may be arranged at a substantially upstream portion of the outlet 6021 not to be exposed when the air conditioner 6001 is viewed from the outside. The airflow control device 6100 may be arranged on the flow passage P2 through which air that has passed through the heat exchanger 6030 is discharged. The airflow control device 6100 may be arranged at a portion where the first guide surface 6014 and the second guide surface 6018 forming the outlet 6021 start. The airflow control device 6100 may be provided at a position at which air that has passed through the heat exchanger 6030 is introduced into the first guide surface 6014 or the second guide surface 6018.

A plurality of airflow control devices 6100 may be provided along a circumferential direction of the outlet 6021. Although twelve airflow control devices 6100 are illustrated in FIG. 98 as being provided, the number of airflow control devices 6100 is not limited thereto. Eleven or less or thirteen or more airflow control devices 6100 may be provided, or only one airflow control device 6100 may be provided.

The airflow control device 6100 may include an opening-and-closing member 6101 configured to guide air that has passed through the heat exchanger 6030 toward the first guide surface 6014 or the second guide surface 6018, a guide shaft 6102 having the opening-and-closing member 6101 fixed and coupled thereto, a shaft support member 6103 configured to rotatably support the guide shaft 6102, and a shaft driver 6104 configured to rotate the guide shaft 6102.

A plurality of opening-and-closing members 6101 may be provided by being spaced apart at predetermined intervals along the circumferential direction of the outlet 6021. Referring to FIG. 98, although the plurality of opening-and-closing members 6101 are illustrated as being arranged at equal intervals, embodiments are not limited thereto, and the plurality of opening-and-closing members 6101 may also be arranged at different intervals.

The opening-and-closing member 6101 may be fixed and coupled to the guide shaft 6102. The opening-and-closing member 6101 may rotate about the guide shaft 6102, extending in a direction similar to the circumferential direction of the outlet 6021, as a rotation axis. Accordingly, the opening-and-closing member 6101 may guide air that has passed through the heat exchanger 6030 toward the first guide surface 6014 or the second guide surface 6018. Also, the opening-and-closing member 6101 may be provided to have a shape and/or size that is almost similar to a shape and/or size of a cross-section of the outlet 6021 along the radial direction of the outlet 6021.

The guide shaft 6102 may extend along a rotation axis of the opening-and-closing member 6101. A plurality of guide shafts 6102 may be provided to be spaced apart at predetermined intervals along the circumferential direction of the outlet 6021. Like the plurality of opening-and-closing members 6101 described above, the plurality of guide shafts 6102 may be arranged at equal intervals or arranged at different intervals. Because the plurality of guide shafts 6102 are respectively fixed and coupled to the plurality of opening-and-closing members 6101, the plurality of guide shafts 6102 may be arranged to correspond to arrangement of the plurality of opening-and-closing members 6101.

The guide shaft 6102 may rotate while one end thereof is rotatably connected to the shaft support member 6103 and supported by the shaft support member 6103. Also, the guide shaft 6102 may have the other end connected to the shaft driver 6104. The shaft driver 6104 may include a driving source (not illustrated) configured to generate power for rotating the guide shaft 6102. Accordingly, the guide shaft 6102 may receive power from the shaft driver 6104 and rotate.

The shaft support member 6103 may include a first shaft support member 6103*a* directly connected to the guide shaft 6102 and configured to directly support the guide shaft 6102, and a second shall support member 6103*b* connected to the shaft driver 6104 and configured to indirectly support the guide shaft 6102.

The first shaft support member 6103*a* may have one end portion connected to the housing 6010 and the other end portion rotatably connected to the guide shaft 6102 and may rotatably support the guide shaft 6102.

The second shaft support member 6103*b* may have one end portion connected to the housing 6010 and the other end portion connected to the shaft driver 6104 and may support the shaft driver 6104. That is, the second shaft support member 6103*b* may indirectly support the guide shaft 6102.

Configuration for rotating the opening-and-closing member 6101 of the airflow control device 6100 has been described above with reference to FIGS. 97 and 98. However, a configuration for rotating opening-and-closing member 6101 is not limited thereto and may be any configuration capable of rotating the opening-and-closing member 6101 so that air that has passed through the heat exchanger 6030 is guided toward the first guide surface 6014 or the second guide surface 6018.

Figure 99:
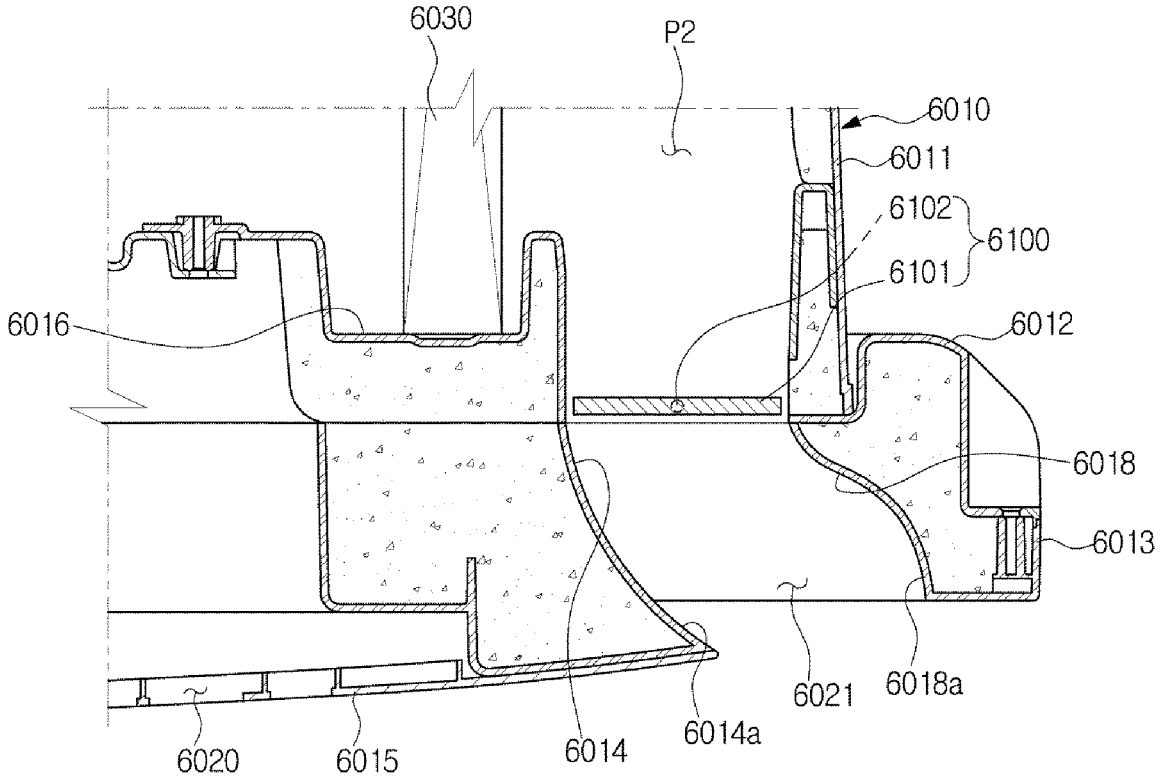
FIG. 99 is an enlarged view of a portion OC marked in FIG. 97.
Figure 100:
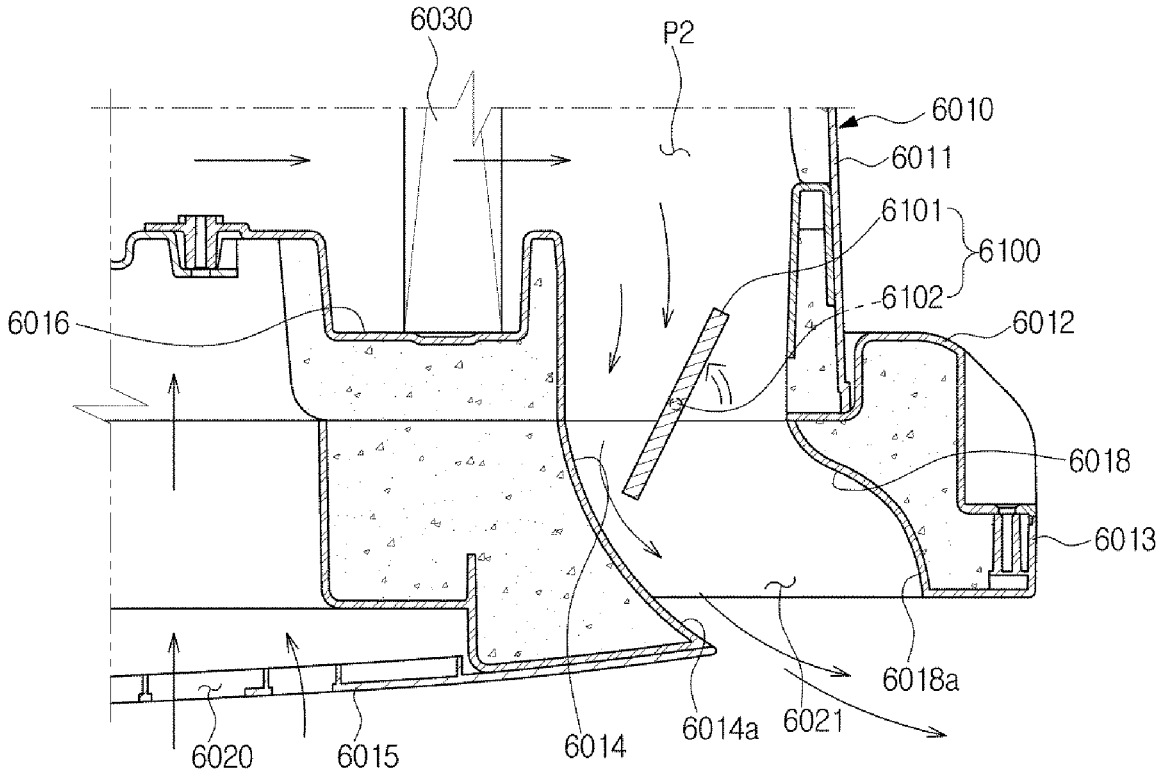
FIGS. 100 and 101 are views illustrating discharged airflow from the air conditioner illustrated in FIG. 96.
Figure 101:
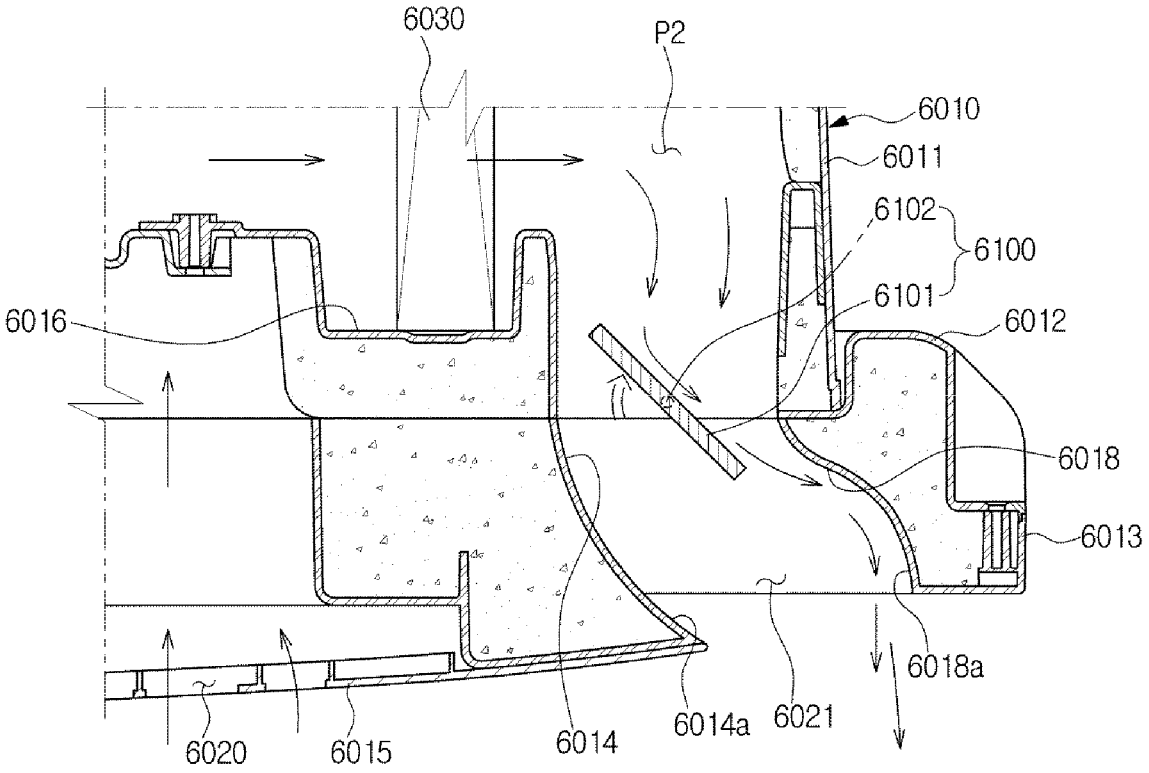

FIG. 99 is an enlarged view of a portion OC marked in FIG. 97. FIGS. 100 and 101 are views illustrating discharged airflow from the air conditioner 6001 illustrated in FIG. 96.

An operation in which discharged airflow from the air conditioner 6001 illustrated in FIG. 96 is controlled will be described with reference to FIGS. 99 to 101.

Referring to FIG. 99, when the air conditioner 6001 does not operate, the airflow control device 6100 is arranged in a substantially horizontal direction on the outlet 6021.

Referring to FIG. 100, when the user attempts to set a direction of discharged airflow that is discharged from the outlet 6021 of the air conditioner 6001 to be along the outside in the radial direction of the outlet 6021, the opening-and-closing member 6101 of the airflow control device 6100 is rotated counterclockwise by a predetermined angle about the guide shaft 6102 as a rotation axis by a command from the user. Here, the predetermined angle may be set so that the opening-and-closing member 6101 may guide air passing through the outlet 6021 toward the first guide surface 6014.

Air guided toward the first guide surface 6014 by the opening-and-closing member 6101 may be reflected by the first guide surface 6014 and widely spread toward the outside in the radial direction of the outlet 6021. That is, the air conditioner 6001 may discharge air toward a portion spaced apart from the air conditioner 6001, and, consequently, the air conditioner 6001 may gently cool or heat an entire indoor space. Here, a portion of air that is not reflected by the first guide surface 6014 and is discharged along the first guide surface 6014 may spread toward the outside in the radial direction of the outlet 6021 by the Coanda curved portion 6014*a* provided at one end portion of the first guide surface 6014.

On the other hand, referring to FIG. 101, when the user attempts to set a direction of discharged airflow that is discharged from the outlet 6021 of the air conditioner 6001 to be along the inside in the radial direction of the outlet 6021, the opening-and-closing member 6101 of the airflow control device 6100 is rotated clockwise by a predetermined angle about the guide shaft 6102 as a rotation axis by a command from the user. Here, the predetermined angle may be set so that the opening-and-closing member 6101 may guide air passing through the outlet 6021 toward the second guide surface 6018.

Air guided toward the second guide surface 6018 by the opening-and-closing member 6101 may be reflected by the second guide surface 6018 and be discharged in a substantially vertical direction. That is, a direction of discharged airflow may be set to be closer to the inside in the radial direction of the outlet 6021, compared to a case in which air is reflected by the first guide surface 2014 and discharged. Accordingly, the air conditioner 6001 may intensively cool or heat a portion adjacent to the air conditioner 6001. Here, a portion of air that is not reflected by the second guide surface 6018 and is discharged along the second guide surface 6018 may be discharged in a substantially vertical direction by the Coanda curved portion 6018*a* provided at one end portion of the second guide surface 6018 and form centralized airflow.

Here, air that is discharged through a section on the outlet 6021 at which the airflow control device 6100 is not arranged may be drawn toward air passing through the airflow control device 6100 and may be discharged in an airflow direction almost similar to an airflow direction of air passing through the airflow control device 6100.

In this way, according to the embodiment illustrated in FIGS. 97 to 101, a direction of discharged airflow may be controlled according to a user's request even when the outlet 6021 is provided in a circular shape.

Figure 102:
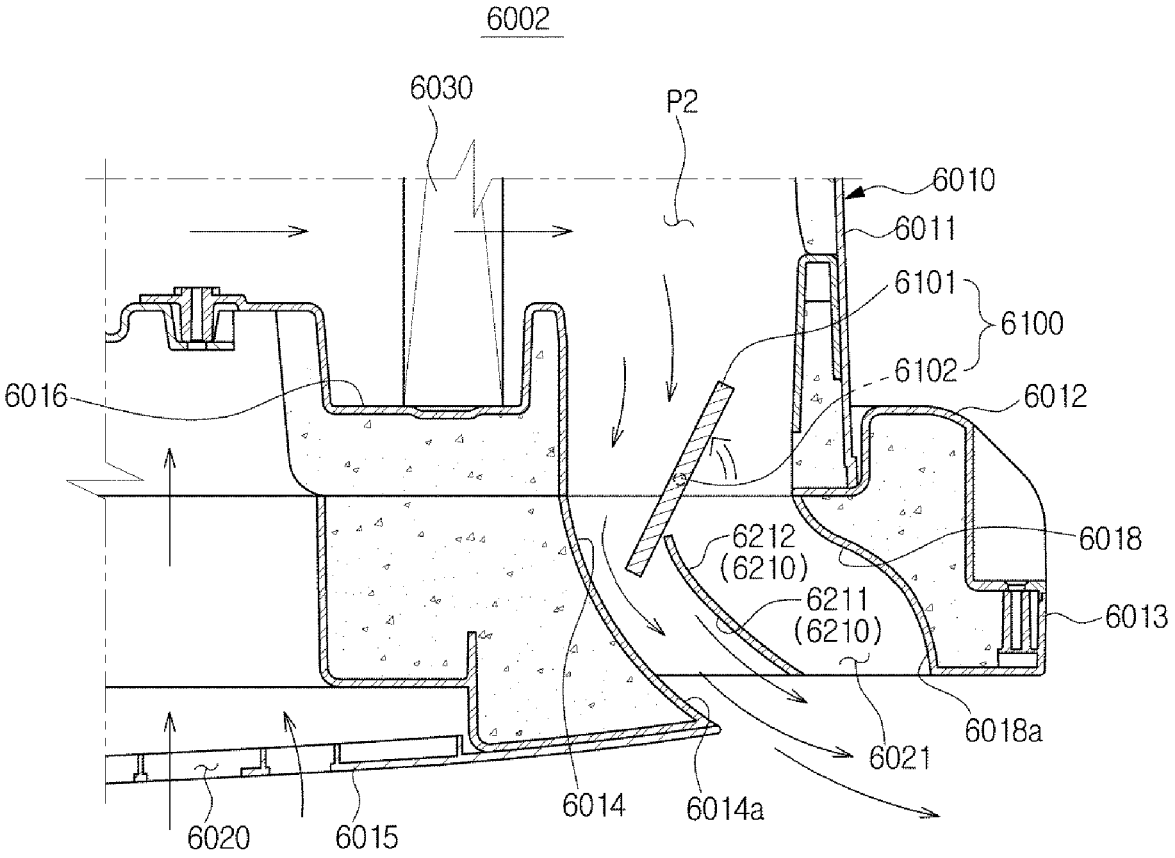
FIGS. 102 and 103 are views illustrating yet another embodiment of the air conditioner illustrated in FIG. 96.
Figure 103:
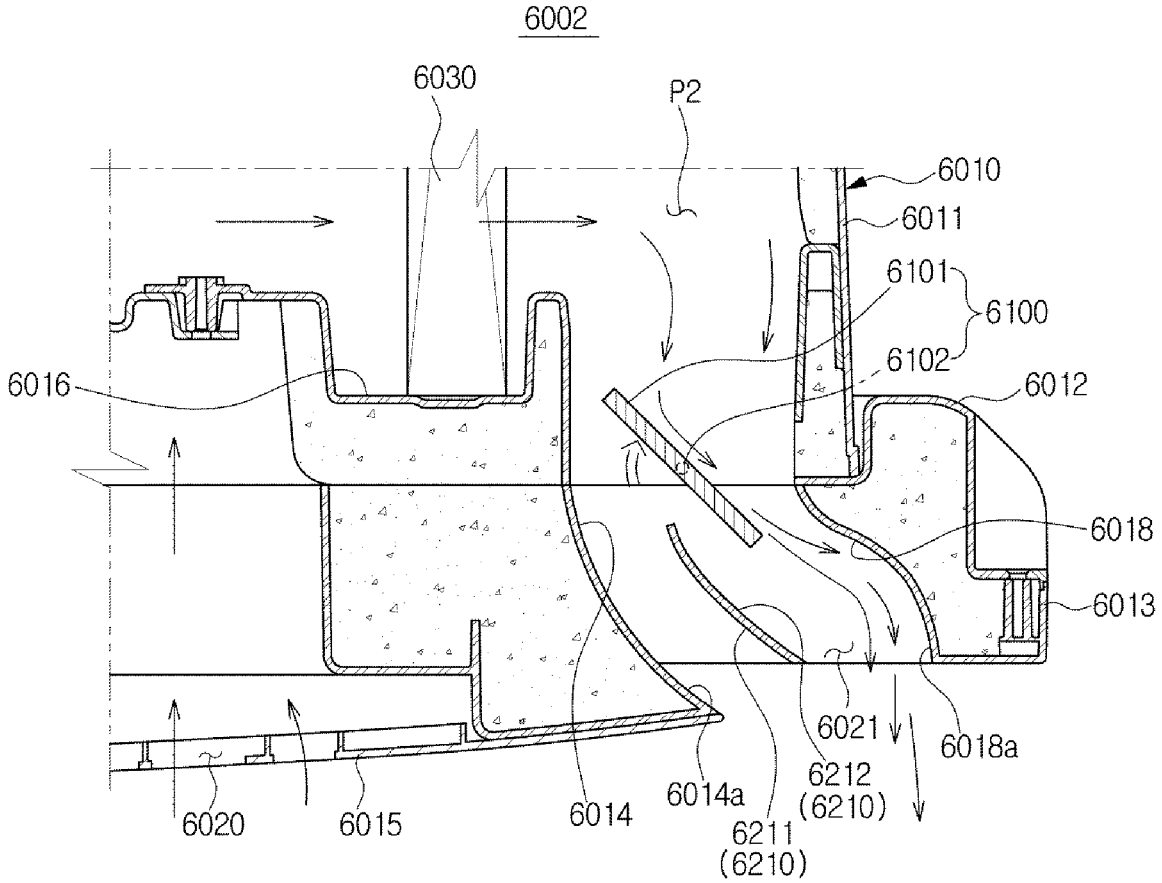

FIGS. 102 and 103 are views illustrating yet another embodiment of the air conditioner 6001 illustrated in FIG. 96.

An air conditioner 6002 according to yet another embodiment will be described with reference to FIGS. 102 and 103. However, like reference numerals may be assigned to elements which are the same as those in the embodiments described above, and description thereof may be omitted.

The air conditioner 6002 may further include a guide rib 6210 configured to guide air that has passed through the airflow control device 6100.

The air conditioner 6002 may include the airflow control device 6100 according to the embodiment illustrated in FIG. 99. The airflow control device 6100 may include the opening-and-closing member 6101 configured to guide air that has passed through the heat exchanger 6030 toward the first guide surface 6014 or the second guide surface 6018 and the guide shaft 6102 having the opening-and-closing member 6101 fixed and coupled thereto.

The guide rib 6210 may be provided on a flow passage of air through which air that has passed through the airflow control device 6100 is discharged. The guide rib 6210 may be provided to be progressively inclined toward the outside in the radial direction of the outlet 6021 toward the direction in which air is discharged. Guide ribs 6210 may consecutively extend along the circumferential direction of the outlet 6021. However, embodiments are not limited thereto, and the guide ribs 6210 may be provided to be spaced apart at predetermined intervals while extending along the circumferential direction of the outlet 6021. Here, the guide rib 6210 may be arranged to correspond to a section in which the airflow control device 6100 is arranged.

The guide rib 6210 may guide air that has passed through the airflow control device 6100.

Specifically, referring to FIG. 102, when the user attempts to set a direction of discharged airflow that is discharged from the outlet 6021 of the air conditioner 6002 to be along the outside in the radial direction of the outlet 6021, the opening-and-closing member 6101 of the airflow control device 6100 is rotated counterclockwise by a predetermined angle about the guide shaft 6102 as a rotation axis by a command from the user. Here, the predetermined angle may be set so that the opening-and-closing member 6101 may guide air passing through the outlet 6021 toward the first guide surface 6014.

Air guided toward the first guide surface 6014 by the opening-and-closing member 6101 may be reflected by the first guide surface 6014 and widely spread toward the outside in the radial direction of the outlet 6021. Here, the guide rib 6210 may guide a portion of air reflected by the first guide surface 6014. Specifically, a first surface 6211 of the guide rib 6210 facing the first guide surface 6014 may guide a portion of air reflected by the first guide surface 6014 so that the portion of air may be discharged toward the outside in the radial direction of the outlet 6021. Here, the portion of air reflected by the first guide surface 6014 may be guided toward the outside in the radial direction of the outlet 6021 along the first surface 6211 of the guide rib 6210 by the Coanda effect.

Also, referring to FIG. 103, when the user attempts to set a direction of discharged airflow that is discharged from the outlet 6021 of the air conditioner 6002 to be along the inside in the radial direction of the outlet 6021, the opening-and-closing member 6101 of the airflow control device 6100 is rotated clockwise by a predetermined angle about the guide shaft 6102 as a rotation axis by a command from the user. Here, the predetermined angle may be set so that the opening-and-closing member 6101 may guide air passing through the outlet 6021 toward the second guide surface 6018.

Air guided toward the second guide surface 6018 by the opening-and-closing member 6101 may be reflected by the second guide surface 6018 and be discharged in a substantially vertical direction. Here, the guide rib 6210 may guide a portion of air reflected by the second reflective surface 6018. Specifically, a second surface 6212 of the guide rib 6210 facing the second reflective surface 6018 may guide the portion of air reflected by the second reflective surface 6018 and move the portion of air again toward air being discharged in a substantially vertical direction. Accordingly, air reflected by the second surface 6212 of the guide rib 6210 may encounter air being discharged in a substantially vertical direction by the second reflective surface 6018 and be discharged in the substantially vertical direction together with air being discharged by the second reflective surface 6018.

In this way, according to the embodiment illustrated in FIGS. 102 and 103, because air that has passed through the airflow control device 6100 is secondly guided by the guide rib 6210, loss of an amount of discharged air may be reduced, and cooling and heating efficiencies may be increased.

Figure 104:
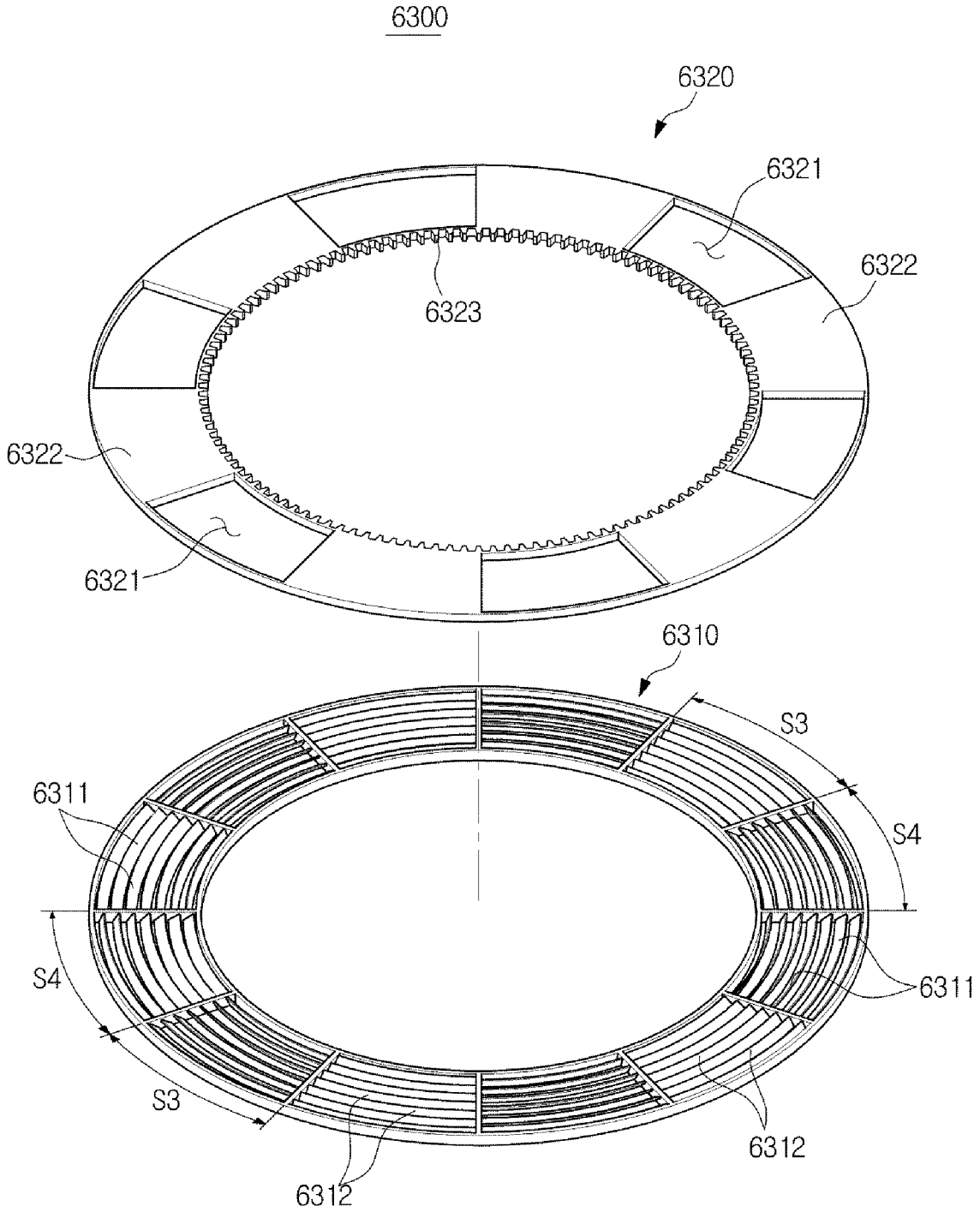
FIG. 104 is a view illustrating yet another embodiment of the airflow control device of the air conditioner illustrated in FIG. 99.
Figure 105:
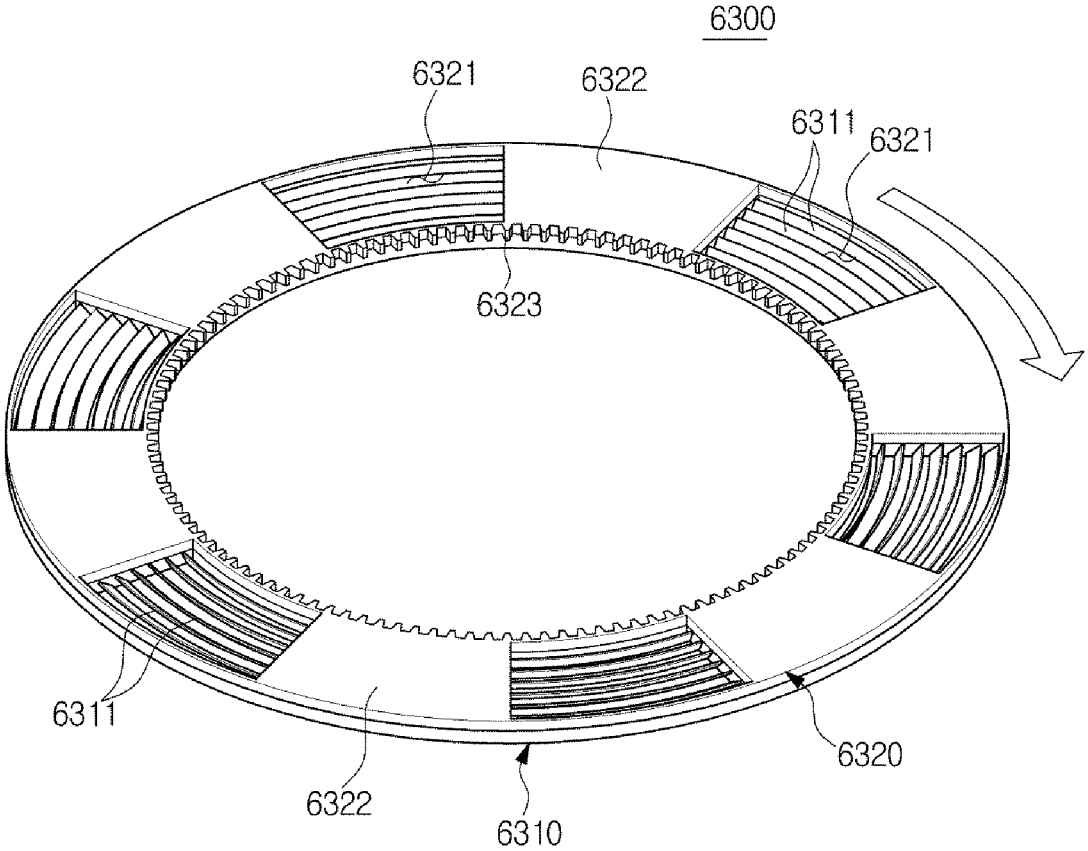
FIGS. 105 and 106 are views illustrating a case in which an airflow control device illustrated in FIG. 104 controls discharged airflow to be in a first direction.
Figure 106:
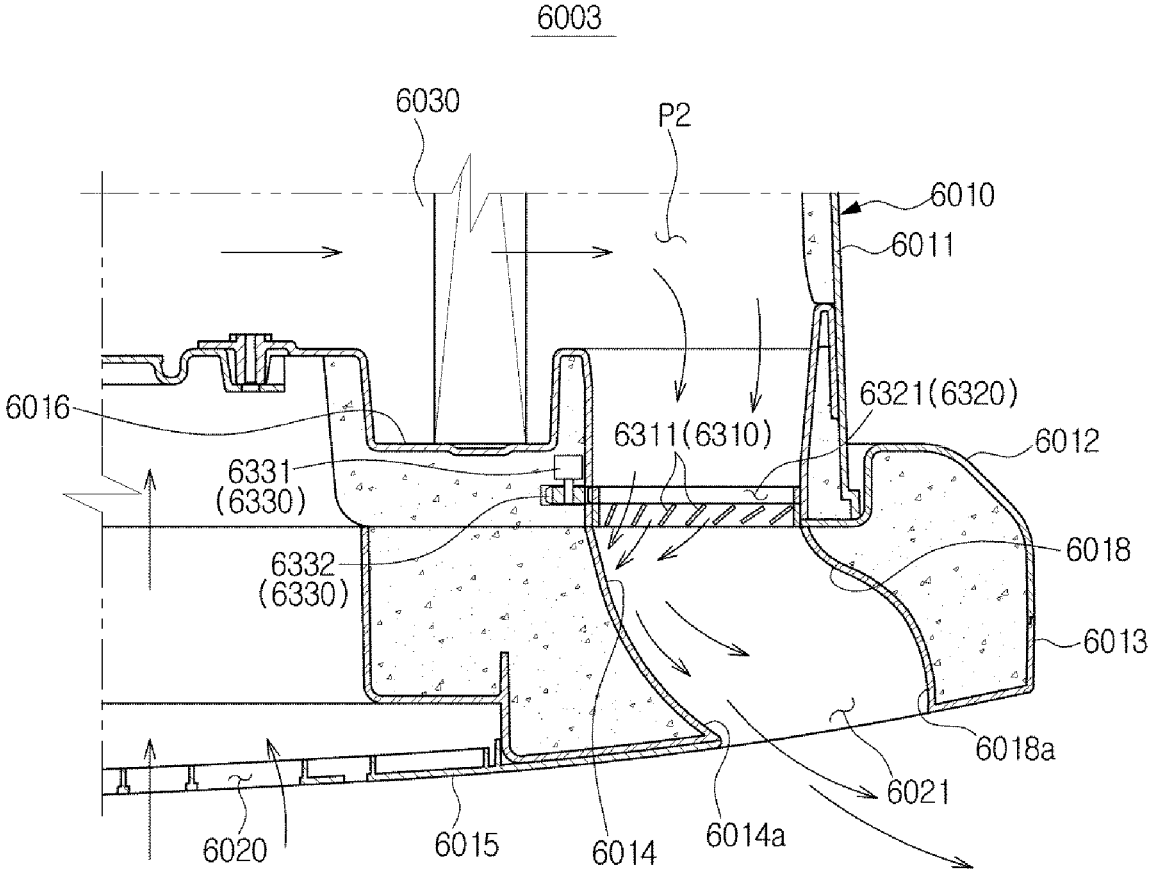
Figure 107:
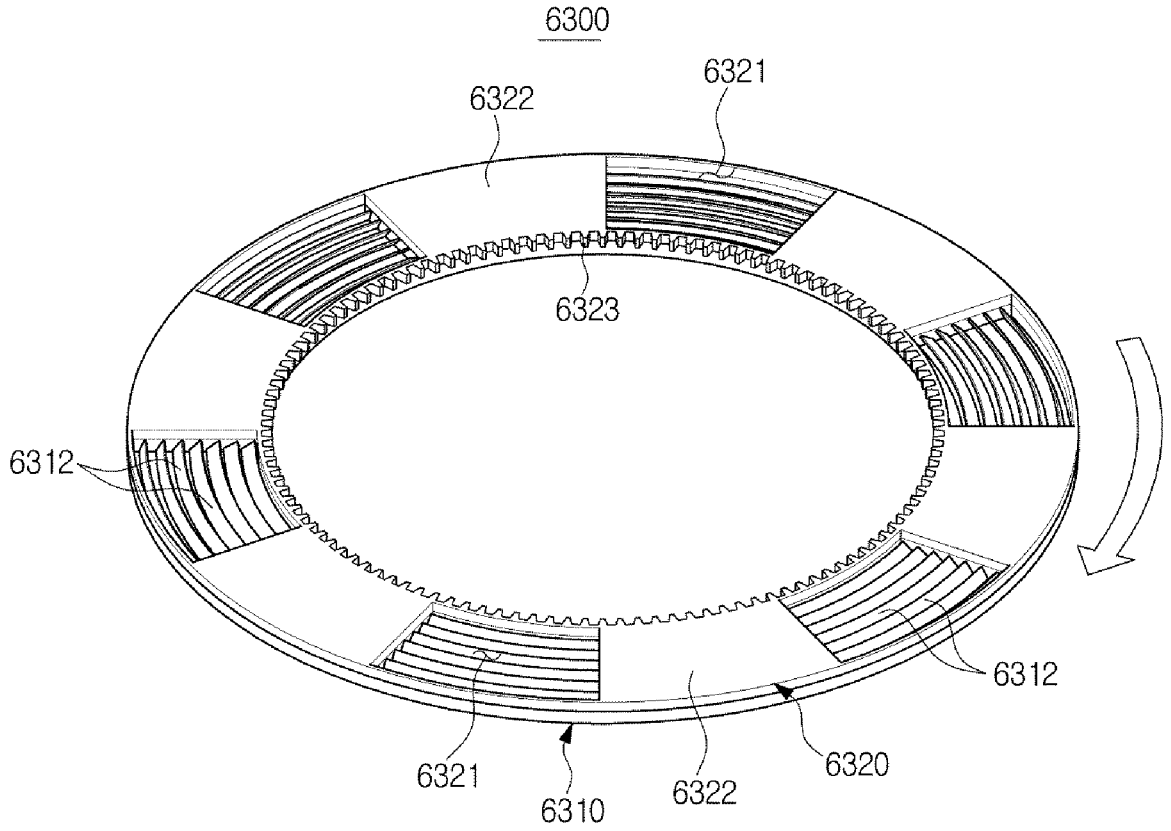
FIGS. 107 and 108 are views illustrating a case in which the airflow control device illustrated in FIG. 104 controls discharged airflow to be in a second direction.
Figure 108:
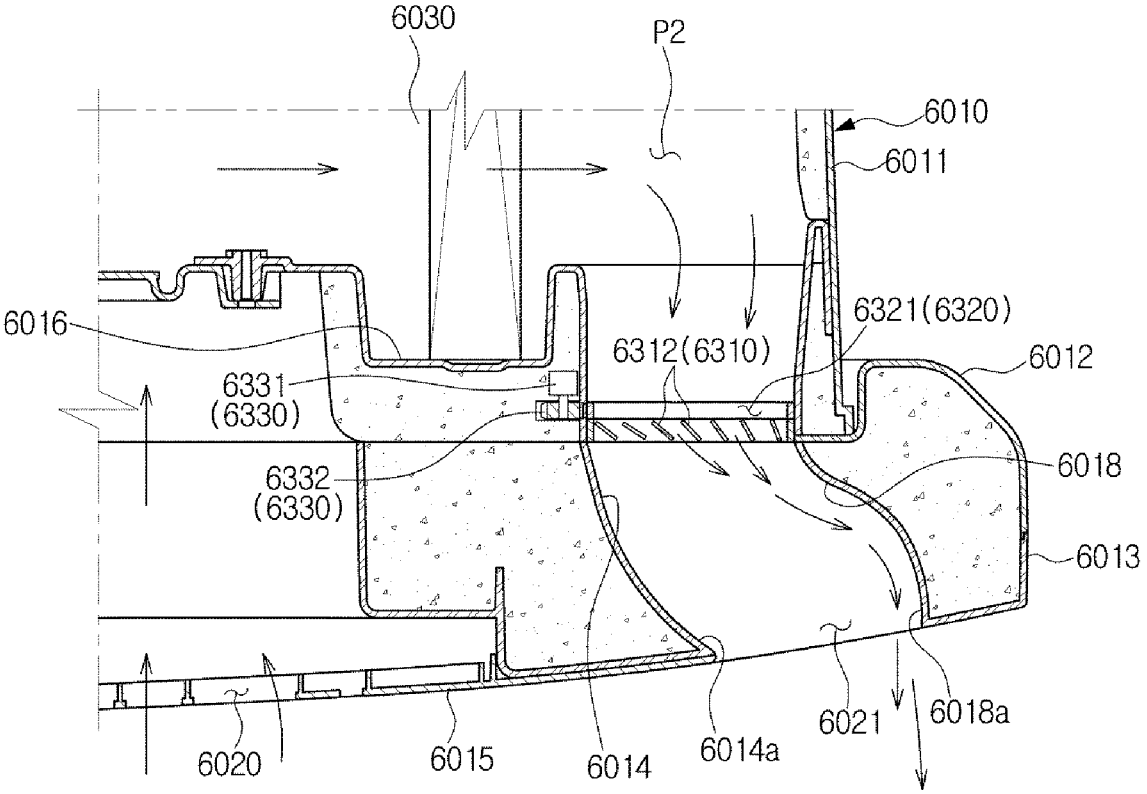

FIG. 104 is a view illustrating yet another embodiment of the airflow control device 6100 of the air conditioner 6001 illustrated in FIG. 99. FIGS. 105 and 106 are views illustrating a case in which an airflow control device 6300 illustrated in FIG. 104 controls discharged airflow to be in a first direction. FIGS. 107 and 108 are views illustrating a case in which the airflow control device 6300 illustrated in FIG. 104 controls discharged airflow to be in a second direction.

The airflow control device 6300 of an air conditioner 6003 according to yet another embodiment of the present disclosure will be described with reference to FIGS. 104 to 108. However, like reference numerals may be assigned to elements which are the same as those in the embodiments described above, and description thereof may be omitted.

The air conditioner 6003 may have the outlet 6021 formed in a substantially circular shape and include the airflow control device 6300 configured to guide air that has passed through the heat exchanger 6030 toward the first reflective surface 6014 or the second reflective surface 6018. The airflow control device 6300 may be provided at an upstream portion of the outlet 6021 along the circumferential direction of the outlet 6021. The airflow control device 6300 may be provided at a portion where the first reflective surface 6014 and the second reflective surface 6018 start. The airflow control device 6300 may be provided to have a shape and a size which are substantially the same as those of a cross-section along the radial direction of the outlet 6021.

The airflow control device 6300 may include a guide member 6310 configured to guide air that has passed through the heat exchanger 6030 toward the first reflective surface 6014 or the second reflective surface 6018, and an opening-and-closing member 6320 configured to selectively open or close a portion of the guide member 6310.

The guide member 6310 extends along the circumferential direction of the outlet 6021, and may include a first section S3 having a first guide member 6311 formed therein and a second section S4 having a second guide member 6312 formed therein. However, although six first sections S3 and six second sections S4 are illustrated in FIG. 104 as being formed, embodiments are not limited thereto, and five or less or seven or more first sections S3 and second sections S4 may be formed. Furthermore, only one first section S3 or second section S4 may be formed, and the number of first sections S3 may be different from the number of second sections S4. The first section S3 and the second section S4 may be alternately arranged along the circumferential direction of the guide member 6310. The first section S3 and the second section S4 may be alternately provided along the circumferential direction of the guide member 6310.

The first guide member 6311 configured to guide air that has passed through the heat exchanger 6030 toward the first reflective surface 6014 may be provided in the first section S3 of the guide member 6310. A plurality of first guide members 6311 may be provided as illustrated in FIG. 104, or, although not illustrated, a single first guide member 6311 may be provided.

The first guide member 6311 may extend along the circumferential direction of the outlet 6021. The first guide member 6311 may be provided to be progressively inclined toward the first reflective surface 6014 toward a direction in which air is discharged. Accordingly, the first guide member 6311 may guide air moving toward the outlet 6021 toward the first guide surface 6014.

Also, when the plurality of first guide members 6311 are provided, because the plurality of first guide members 6311 progressively recede from the first reflective surface 6014 toward the outside in the radial direction of the outlet 6021, the plurality of first guide members 6311 may be provided to have a slope that gradually becomes horizontal toward the outside in the radial direction of the outlet 6021. That is, the plurality of first guide members 6311 may be provided so that the slope thereof with respect to the radial direction of the guide member 6310 is decreased as the plurality of first guide members 6311 recede from the first reflective surface 6014. Accordingly, the first guide members 6311 may guide air toward the first reflective surface 6014 even when arranged to be far from the first reflective surface 6014 toward the outside in the radial direction of the outlet 2021.

The second guide member 6312 configured to guide air that has passed through the heat exchanger 6030 toward the second reflective surface 6018 may be provided in the second section S4 of the guide member 6310. A plurality of second guide members 6312 may be provided as illustrated in FIG. 104, or, although not illustrated, a single second guide member 6312 may be provided.

The second guide member 6312 may extend along the circumferential direction of the outlet 6021. The second guide member 6312 may be provided to be progressively inclined toward the second reflective surface 6018 toward the direction in which air is discharged. Accordingly, the second guide member 6312 may guide air moving toward the outlet 6021 toward the second reflective surface 6018.

Also, when the plurality of second guide members 6312 are provided, because the plurality of second guide members 6312 progressively recede from the second reflective surface 6018 toward the inside in the radial direction of the outlet 6021, the plurality of second guide members 6312 may be provided to have a slope that gradually becomes horizontal toward the outside in the radial direction of the outlet 6021. That is, the plurality of second guide members 6312 may be provided so that the slope thereof with respect to the radial direction of the guide member 6310 is decreased as the plurality of second guide members 6312 recede from the second reflective surface 6018. Accordingly, the second guide members 6312 may guide air toward the second reflective surface 6018 even when arranged to be far from the second reflective surface 6018 toward the inside in the radial direction of the outlet 6021.

The opening-and-closing member 6320 may be configured at an upper side of the guide member 6310 to rotate about the center in a radial direction of the opening-and-closing member 6320 as a rotation axis. The rotation axis of the opening-and-closing member 6320 may be provided to correspond to the center along the radial direction of the outlet 6021 and the center along the radial direction of the guide member 6310. Accordingly, the opening-and-closing member 6320 may selectively open or close the first section S3 and the second section S4 of the guide member 6310.

The opening-and-closing member 6320 may include an opener 6321 configured to open the first section S3 and the second section S4 and a blocker 6322 configured to close the first section S3 and the second section S4. The number of openers 6321 and blockers 6322 may correspond to the number of first sections S3 and second sections S4 of the guide member 6310. When a plurality of openers 6321 and blockers 6322 are provided, the openers 6321 and the blockers 6322 may be alternately arranged along the circumferential direction of the opening-and-closing member 6320.

The opener 6321 may be formed to be hollow to open the first section S3 and the second section S4. The opener 6321 may be provided to have a size and a shape that correspond to those of the first section S3 and/or the second section S4 of the guide member 6310. Accordingly, the opener 6321 may selectively open the first section S3 and the second section S4.

The blocker 6322 may be provided to have a size and a shape that correspond to those of the first section S3 and/or the second section S4 of the guide member 6310. Accordingly, the blocker 6321 may selectively close the first section S3 and the second section S4.

The opener 6321 and the blocker 6322 may be provided to correspond to shapes, sizes, or arrangements of the first section S3 and the second section S4.

The opening-and-closing member 6320 may further include an opening-and-closing driver 6330 provided to be rotatable about the center in the radial direction as a rotation axis.

The opening-and-closing driver 6330 may include an opening-and-closing driving source 6331 provided inside the housing 6010 and configured to generate power, and an opening-and-closing power transmitter 6332 configured to transmit power generated by the opening-and-closing driving source 6331 to the opening-and-closing member 6320.

The opening-and-closing driving source 6331 may be provided inside the housing 6010 at the inside in the radial direction of the opening-and-closing member 6320. However, embodiments are not limited thereto, and the opening-and-closing driving source 6331 may be provided inside the housing 6010 at the outside in the radial direction of the opening-and-closing member 6320 or may be provided outside the housing 6010. The opening-and-closing driving source 6331 may be a motor.

The opening-and-closing power transmitter 6332 may transmit power generated by the opening-and-closing driving source 6331 to the opening-and-closing member 6320 to enable the opening-and-closing member 6320 to rotate.

Specifically, the opening-and-closing power transmitter 6332 may be provided as a gear, and the opening-and-closing member 6320 may include a gear tooth 6323 formed at an inner circumferential surface thereof and configured to receive power by being engaged with a gear of the opening-and-closing power transmitter 6332. By the above configuration, the opening-and-closing member 6320 may receive power generated by the opening-and-closing driving source 6331 through the opening-and-closing power transmitter 6332 and rotate about the center in the radial direction of the opening-and-closing member 6320 as a rotation axis. However, a configuration of the opening-and-closing power transmitter 6332 is not limited thereto, and may be any configuration as long as a configuration is capable of rotating the opening-and-closing member 6320. Also, the guide member 6310, instead of the opening-and-closing member 6320, may be configured to receive power from the opening-and-closing power transmitter 6332 and rotate. In this case, a gear tooth may be formed at an inner circumferential surface of the guide member 6310, and the opening-and-closing power transmitter 6332 may be engaged with the inner circumferential surface of the guide member 6310.

An operation in which discharged airflow of the air conditioner 6003 including the airflow control device 6300 illustrated in FIG. 104 is controlled will be described with reference to FIGS. 105 to 108.

Referring to FIGS. 105 and 106, when the user attempts to set a direction of discharged airflow that is discharged from the outlet 6021 of the air conditioner 6003 to be along the outside in the radial direction of the outlet 6021 (a first direction), the opening-and-closing member 6320 of the airflow control device 6300 is rotated to a position for opening the first section S3 of the guide member 6310 by a command from the user. Accordingly, all first sections S3 of the guide member 6310 are opened, and all second sections S4 thereof are closed by the blocker 6322. Consequently, all of air that has passed through the heat exchanger 6030 passes through the airflow control device 6300 only through the first sections S3.

Here, air passing through the first section S3 may be guided toward the first reflective surface 6014 by the first guide member 6311. Air guided toward the first reflective surface 6014 is reflected by the first reflective surface 6014 and widely spreads toward the outside in the radial direction of the outlet 6021. That is, the air conditioner 6003 may discharge air toward a portion spaced apart from the air conditioner 6003 and gently cool or heat an entire indoor space. Here, a portion of air that is not reflected by the first reflective surface 6014 and is discharged along the first reflective surface 6014 may spread toward the outside in the radial direction of the outlet 6021 by the Coanda curved portion 6014*a* provided at one end portion of the first reflective surface 6014.

On the other hand, referring to FIGS. 107 and 108, when the user attempts to set a direction of discharged airflow that is discharged from the outlet 6021 of the air conditioner 6003 to be along the inside in the radial direction of the outlet 6021 (a second direction), the opening-and-closing member 6320 of the airflow control device 6300 is rotated to a position for opening the second section S4 of the guide member 6310 by a command from the user. Accordingly, all second sections S4 of the guide member 6310 are opened, and all first sections S3 thereof are closed by the blocker 6322. Consequently, all of air that has passed through the heat exchanger 6030 passes through the airflow control device 6300 only through the second sections S4.

Here, air passing through the second section S4 may be guided toward the second reflective surface 6018 by the second guide member 6312. Air guided toward the second reflective surface 6018 is reflected by the second reflective surface 6018 and descends in a substantially vertical direction. That is, a direction of discharged airflow is changed to be closer to the inside in the radial direction of the outlet 6021, compared to a case in which air is reflected by the first reflective surface 6014 and discharged. Accordingly, the air conditioner 6003 may intensively cool or heat a portion adjacent to the air conditioner 6003. Here, air that is not reflected by the second reflective surface 6018 and is discharged along the second reflective surface 6018 may be discharged in a substantially vertical direction by the Coanda curved portion 6018*a* provided at one end portion of the second reflective surface 6018 and form centralized airflow.

In this way, according to the embodiment illustrated in FIGS. 104 to 108, a direction of discharged airflow may be controlled according to a user's request even when the outlet 6021 is formed in a circular shape.

As described above, the air conditioners 6001, 6002, and 6003 according to the present disclosure may control a direction of discharged airflow discharged from the outlet 6021 having a circular shape with a relatively simple configuration, and, because the outlet 6021 having a circular shape is provided, air may be discharged in all directions along the circumferences of the air conditioners 6001, 6002, and 6003, and cooling and heating blind spots may be minimized.

Although the technical spirit of the present disclosure has been described above by particular embodiments, the scope of the present disclosure is not limited to the embodiments. Various embodiments that may be modified or changed by one of ordinary skill in the art within a scope not departing from the gist of the technical spirit of the present disclosure stated in the claims below are to be understood as belonging to the scope of the present disclosure.

The invention claimed is:

1. An air conditioner comprising:

a housing having an inlet and an outlet, and first and second guide surfaces opposite each other and which together form an outlet passage along which air suctioned through the inlet travels to be provided to the outlet to be discharged through the outlet; and a heat exchanger configured to heat-exchange the air suctioned through the inlet before being provided to the outlet; and a guide member having a first end and a second end, and having a convex shape spanning from the first end to the second end, the guide member configured to slide along one of the first and second guide surfaces to move between a first position at which the guide member convexly extends from the one of the first and second guide surfaces with the second end being closer than the first end to the outlet, and is thereby positioned to interfere with the air travelling through the outlet passage and a second position at which the second end is further from the outlet than when the guide member is in the first position, wherein the guide member has a first surface having the convex shape spanning from the first end to the second end, and a second surface, opposite the first surface, having a shape corresponding to a shape of the one of the first and second guide surfaces, and, when the guide member is in the first position, the second surface abuts the one of the first and second guide surfaces, and the first surface convexly extends from the one of the first and second guide surfaces, the guide member thereby being configured so that, when the guide member is in the first position, a direction of airflow of the air discharged through the outlet is different than when the guide member is in the second position.

2. The air conditioner of claim 1, further comprising:

a driving source configured to generate power for moving the guide member between the first position and the second position.

3. The air conditioner of claim 1, wherein at least one of the first guide surface and the second guide surface includes a Coanda curved portion at the outlet.

4. The air conditioner of claim 1, wherein:

the inlet and the outlet are provided at a bottom surface of the housing; and the housing is installable on a ceiling.

5. The air conditioner of claim 1, wherein the housing is installable on a wall.

6. The air conditioner of claim 1, wherein when the guide member is at the second position, the second surface abuts the one of the first and second guide surfaces, and the first surface convexly extends from the one of the first and second guide surfaces.

7. The air conditioner of claim 1, wherein when the guide member is at the second position, the guide member abuts the one of the first and second guide surfaces.

* * * * *